US012161910B2

(12) United States Patent
Aref

(10) Patent No.: US 12,161,910 B2
(45) Date of Patent: Dec. 10, 2024

(54) ABDOMINAL EXERCISE DEVICE

(71) Applicant: Mohammed Hassan Aref, West Hills, CA (US)

(72) Inventor: Mohammed Hassan Aref, West Hills, CA (US)

( * ) Notice: Subject to any disclaimer, the term of this patent is extended or adjusted under 35 U.S.C. 154(b) by 154 days.

(21) Appl. No.: 17/910,796

(22) PCT Filed: Mar. 11, 2021

(86) PCT No.: PCT/US2021/021839
§ 371 (c)(1),
(2) Date: Sep. 9, 2022

(87) PCT Pub. No.: WO2021/183730
PCT Pub. Date: Sep. 16, 2021

(65) Prior Publication Data

US 2023/0148095 A1 May 11, 2023

Related U.S. Application Data

(60) Provisional application No. 62/988,380, filed on Mar. 11, 2020.

(51) Int. Cl.
*A63B 23/02* (2006.01)
*A63B 21/00* (2006.01)
*A63B 21/055* (2006.01)

(52) U.S. Cl.
CPC ..... *A63B 23/0216* (2013.01); *A63B 21/0557* (2013.01); *A63B 21/4015* (2015.10); *A63B 21/4025* (2015.10)

(58) Field of Classification Search
CPC ..... A63B 23/02–0244; A63B 21/151–153
See application file for complete search history.

(56) References Cited

U.S. PATENT DOCUMENTS 4,251,070 A 2/1981 Leseberg
4,251,071 A 2/1981 Norton
(Continued)

FOREIGN PATENT DOCUMENTS

AU 2005216127 B2 2/2005
CN 211574632 1/2020
(Continued)

OTHER PUBLICATIONS

International Search Report and Written Opinion of PCT/US2021/021839, May 20, 2021 (mailing date), Aref, Mohammed Hassan.
(Continued)

*Primary Examiner* — Nyca T Nguyen
(74) *Attorney, Agent, or Firm* — Makoui Law, PC; Ali Makoui

(57) ABSTRACT

An abdominal exercise device includes a frame comprising top, middle, and bottom frame sections. The middle frame section has a curved shape for creating a teeter-totter movement during exercise. The device includes a headrest connected to the bottom frame section, a plurality of connectors for connecting elastic bands to the frame, and an elastic band connected to at least two connectors. The two ends of the elastic band are connected to two straps. The device creates the teeter-totter movement to exercise the abdominal muscles in response to a person lying down in supine position with the back of the head on the headrest and the feet in the two straps, the person applying a downward pressure with the feet to the straps to move the headrest from a resting position, and the person removing the downward pressure to allow the headrest to go back to the resting position.

7 Claims, 68 Drawing Sheets

(56) References Cited

U.S. PATENT DOCUMENTS 4,335,875 A 6/1982 Elkin
4,685,671 A 8/1987 Hagerman et al.
4,789,154 A 12/1988 Mattox
4,909,505 A 3/1990 Tee
5,263,916 A 11/1993 Bobich
5,413,548 A 5/1995 Hoffman
5,492,520 A * 2/1996 Brown ..... A63B 23/0211 482/142
5,514,059 A 5/1996 Romney
5,518,486 A 5/1996 Sheeler
5,545,113 A 8/1996 Bobich
5,545,114 A * 8/1996 Gvoich ..... A63B 21/0552 482/142
5,569,138 A * 10/1996 Wang ..... A63B 23/03533 482/130
5,577,987 A * 11/1996 Brown ..... A63B 23/0211 482/142
5,599,261 A 2/1997 Easley et al.
5,601,517 A 2/1997 Haber et al.
5,630,778 A 5/1997 Barreca
5,665,041 A 9/1997 Hsieh
5,697,874 A 12/1997 Abelbeck
5,711,747 A 1/1998 Steinback et al.
5,725,463 A 3/1998 Colonello et al.
5,728,035 A 3/1998 Sands
5,746,688 A 5/1998 Prager
5,749,815 A 5/1998 Lipps
5,772,562 A 6/1998 Stevens
5,772,563 A 6/1998 Lin
5,776,042 A 7/1998 Szabo
5,779,607 A 7/1998 Harris
5,813,954 A 9/1998 Wilkinson
5,833,582 A 11/1998 Chen
5,868,651 A 2/1999 Washington
5,871,425 A 2/1999 Gvoich
5,913,757 A 6/1999 Winters
5,931,768 A 8/1999 Amesquita
5,957,820 A 9/1999 Zarillo et al.
5,964,685 A 10/1999 Boland
5,993,361 A 11/1999 Paoli et al.
5,997,450 A 12/1999 Wilkinson
6,053,851 A 4/2000 Tu
6,080,090 A 6/2000 Taylor et al.
6,090,023 A 7/2000 Liu
6,099,438 A 8/2000 Dawson
6,110,078 A 8/2000 Dyer
6,110,081 A * 8/2000 Barrett ..... A63B 21/0552 482/121
6,213,923 B1 4/2001 Cameron et al.
6,244,998 B1 6/2001 Hinds
6,254,517 B1 7/2001 Kennedy
6,280,367 B1 8/2001 Arsenault
6,319,180 B1 11/2001 Kallassy
6,413,192 B2 7/2002 Abelbeck
6,425,845 B1 7/2002 Varner
6,494,819 B1 12/2002 Boland
6,692,414 B1 2/2004 Gelbart et al.
6,743,159 B1 6/2004 Taylor et al.
6,755,771 B2 6/2004 Wallerstein
6,827,676 B2 12/2004 Kuo
6,843,759 B2 1/2005 Wallerstein
6,923,749 B1 8/2005 Smith
6,971,977 B1 12/2005 Chen
7,087,003 B1 8/2006 Katterjohn
7,128,700 B2 * 10/2006 Wallach ..... A63B 21/4035 482/121
7,169,097 B1 1/2007 Stearns
7,172,539 B1 2/2007 Bythewood et al.
7,172,541 B2 2/2007 Boland et al.
7,232,404 B2 6/2007 Nelson
7,232,405 B2 6/2007 Ko
7,294,096 B1 11/2007 Stearns
7,311,645 B1 12/2007 Lynch
7,318,792 B1 1/2008 Chen et al.
7,329,213 B1 2/2008 Farley
7,341,547 B2 3/2008 Liao
7,344,486 B2 3/2008 Casey et al.
7,407,467 B2 8/2008 Diamond, Jr.
7,416,520 B1 8/2008 Danowski
7,481,752 B2 1/2009 Garner
7,485,079 B2 2/2009 Brown et al.
7,585,263 B2 9/2009 Brown et al.
7,614,986 B2 11/2009 Mattox
7,658,701 B2 2/2010 Webb et al.
7,798,943 B1 9/2010 Tsai
7,806,811 B1 10/2010 Danowski
7,828,704 B1 11/2010 Hsieh et al.
7,867,149 B1 1/2011 Webber et al.
7,998,039 B1 8/2011 Wallach
8,172,732 B1 5/2012 Webber et al.
8,398,530 B1 3/2013 Rubens
8,747,287 B2 6/2014 Li
8,864,637 B2 10/2014 Leirer
8,888,661 B2 11/2014 Ellis
8,900,105 B2 12/2014 Zhu
9,278,244 B2 3/2016 Chuang et al.
9,278,252 B1 3/2016 Will
9,387,357 B2 * 7/2016 Mueller ..... A63B 21/15
9,573,018 B2 2/2017 MacColl et al.
9,630,041 B2 4/2017 Ellis
9,789,351 B2 10/2017 Lalaoua
9,789,352 B2 10/2017 Lalaoua
9,895,574 B2 2/2018 Gejdos
9,907,989 B2 3/2018 Louviere
D818,548 S 5/2018 Ho et al.
10,130,838 B2 11/2018 Murrell
10,286,250 B2 5/2019 Cordero
11,571,604 B2 2/2023 Aref
2002/0091048 A1 7/2002 Chen
2002/0132711 A1 9/2002 Wallerstein
2002/0173411 A1 11/2002 Wallerstein
2003/0100415 A1 * 5/2003 Augustine ..... A63B 23/0211 482/140
2004/0014570 A1 1/2004 Centopani
2004/0023763 A1 2/2004 Sleiman
2004/0209750 A1 10/2004 Parmater
2004/0242389 A1 12/2004 Kerry
2004/0259703 A1 12/2004 Goh
2005/0143233 A1 6/2005 Shifferaw
2005/0159276 A1 * 7/2005 Falcone ..... A63B 21/0552 482/129
2005/0187080 A1 8/2005 Bowser
2005/0187082 A1 8/2005 Bowser
2005/0261114 A1 11/2005 Heitzman et al.
2006/0019807 A1 1/2006 Husted et al.
2006/0025289 A1 2/2006 Wallach
2006/0194679 A1 8/2006 Hatcher
2006/0258520 A1 11/2006 Bowser
2006/0270535 A1 11/2006 Casey
2007/0027008 A1 2/2007 Levinson et al.
2007/0037677 A1 2/2007 Splane
2007/0037679 A1 2/2007 Geeting
2007/0042880 A1 2/2007 Ratner
2007/0066459 A1 3/2007 Lemmex
2007/0087919 A1 4/2007 Rong
2007/0099780 A1 5/2007 Bowser
2007/0111869 A1 * 5/2007 Wallach ..... A63B 21/4043 482/121
2007/0129225 A1 6/2007 Hammer
2007/0135281 A1 6/2007 Liao
2007/0243981 A1 10/2007 Verheem
2007/0287615 A1 12/2007 Gilchrist
2007/0298943 A1 12/2007 Mehta
2008/0108487 A1 * 5/2008 Bizzell ..... A63B 21/0552 482/142
2008/0176727 A1 7/2008 Heitzman
2008/0214369 A1 9/2008 Mancini
2008/0242519 A1 10/2008 Parmater
2009/0042701 A1 2/2009 Tsai
2009/0227435 A1 9/2009 Pandozy
2009/0233773 A1 9/2009 Cardey
2009/0286660 A1 11/2009 Nicklas
2009/0325770 A1 12/2009 Baschnagel

(56) References Cited

U.S. PATENT DOCUMENTS

| | | | | |
|---|---|---|---|---|
| 2010/0022367 | A1 | 1/2010 | McBride et al. | |
| 2010/0029449 | A1 | 2/2010 | Kim | |
| 2010/0041526 | A1 | 2/2010 | Bowser et al. | |
| 2010/0050473 | A1 | 3/2010 | Rosso | |
| 2010/0160126 | A1 | 6/2010 | Nardone | |
| 2010/0204025 | A1 | 8/2010 | Vanterpool | |
| 2010/0222189 | A1 | 9/2010 | Washington | |
| 2010/0273617 | A1 | 10/2010 | Mills et al. | |
| 2011/0059828 | A1 | 3/2011 | Blissett | |
| 2011/0105285 | A1 | 5/2011 | Shaffer | |
| 2011/0183827 | A1 | 7/2011 | Radi | |
| 2011/0195826 | A1 | 8/2011 | Nayebdadash | |
| 2012/0065038 | A1 | 3/2012 | Nayebdadash | |
| 2012/0115695 | A1 | 5/2012 | Watterson et al. | |
| 2012/0165167 | A1 | 6/2012 | Hauptmann | |
| 2012/0264577 | A1 | 10/2012 | Dennis et al. | |
| 2012/0316041 | A1 | 12/2012 | Meister et al. | |
| 2013/0053226 | A1 | 2/2013 | Jiang | |
| 2014/0113780 | A1 | 4/2014 | Emmert | |
| 2014/0148852 | A1 | 5/2014 | Welch | |
| 2014/0364287 | A1 | 12/2014 | Chuang et al. | |
| 2015/0065321 | A1 | 3/2015 | Goodson | |
| 2015/0196798 | A1 | 7/2015 | Baschnagel | |
| 2015/0297948 | A1 | 10/2015 | Meister et al. | |
| 2015/0360071 | A1 | 12/2015 | Lee | |
| 2016/0101309 | A1 | 4/2016 | Schreiber et al. | |
| 2016/0143387 | A1 | 5/2016 | Alfonso | |
| 2017/0014677 | A1 | 1/2017 | Lalaoua | |
| 2017/0014678 | A1 | 1/2017 | Lalaoua | |
| 2017/0296867 | A1 | 10/2017 | Doane | |
| 2018/0117396 | A1* | 5/2018 | Engelfried, Jr. ... | A63B 23/0405 |
| 2018/0126217 | A1 | 5/2018 | Asanovich et al. | |
| 2018/0133535 | A1 | 5/2018 | Derry | |
| 2019/0111302 | A1* | 4/2019 | Ballestero ..... | A63B 23/0211 |
| 2019/0262650 | A1 | 8/2019 | Bolillo | |
| 2019/0329086 | A1 | 10/2019 | Rindfleisch | |
| 2020/0030660 | A1* | 1/2020 | Herring ..... | A63B 21/4039 |
| 2020/0121980 | A1 | 4/2020 | Griggs | |
| 2020/0353314 | A1 | 11/2020 | Messinger | |
| 2021/0052958 | A1 | 2/2021 | Fulford et al. | |
| 2021/0245002 | A1 | 8/2021 | Narasimhaiah | |
| 2022/0060208 | A1 | 2/2022 | Wang | |

FOREIGN PATENT DOCUMENTS

| | | |
|---|---|---|
| EP | 0717649 B1 | 5/1998 |
| EP | 0999879 B1 | 11/2003 |
| WO | WO 2021/183730 | 9/2021 |

OTHER PUBLICATIONS

Portions of prosecution history of U.S. Appl. No. 16/816,239, filed Jan. 2020, Aref, Mohammed Hassan.

* cited by examiner

ABDOMINAL EXERCISE DEVICE

CLAIM OF BENEFIT TO PRIOR APPLICATIONS

This application is a national stage application of PCT Application PCT/US21/21839, filed on Mar. 11, 2021, now published as WO 2021/183730. PCT Application PCT/US21/21839_claims the benefit of U.S. Provisional Patent Application Ser. No. 62/988,380, filed on Mar. 11, 2020. The contents of PCT Application PCT/US21/21839, published as WO 2021/183730 and U.S. Provisional Patent Application No. 62/988,380 are hereby incorporated by reference.

BACKGROUND

Abdominal exercise devices, commonly known as ab rollers, have been used to exercise the abdominal muscle group. These devices include a mechanism to raise the upper torso of a person to contract the abdominal muscles. The person, while in a supine position and the knees bended in an upward position, may grab the handlebars on the device and pull down the handlebars while lifting the upper torso from the supine position.

BRIEF DESCRIPTION OF THE DRAWINGS

The various embodiments of the present full body exercise device now will be discussed in detail with an emphasis on highlighting the advantageous features. These embodiments depict the novel and non-obvious full body exercise device shown in the accompanying drawings, which are for illustrative purposes only. These drawings include the following figures, in which like numerals indicate like parts.

DETAILED DESCRIPTION

Figure 1A:
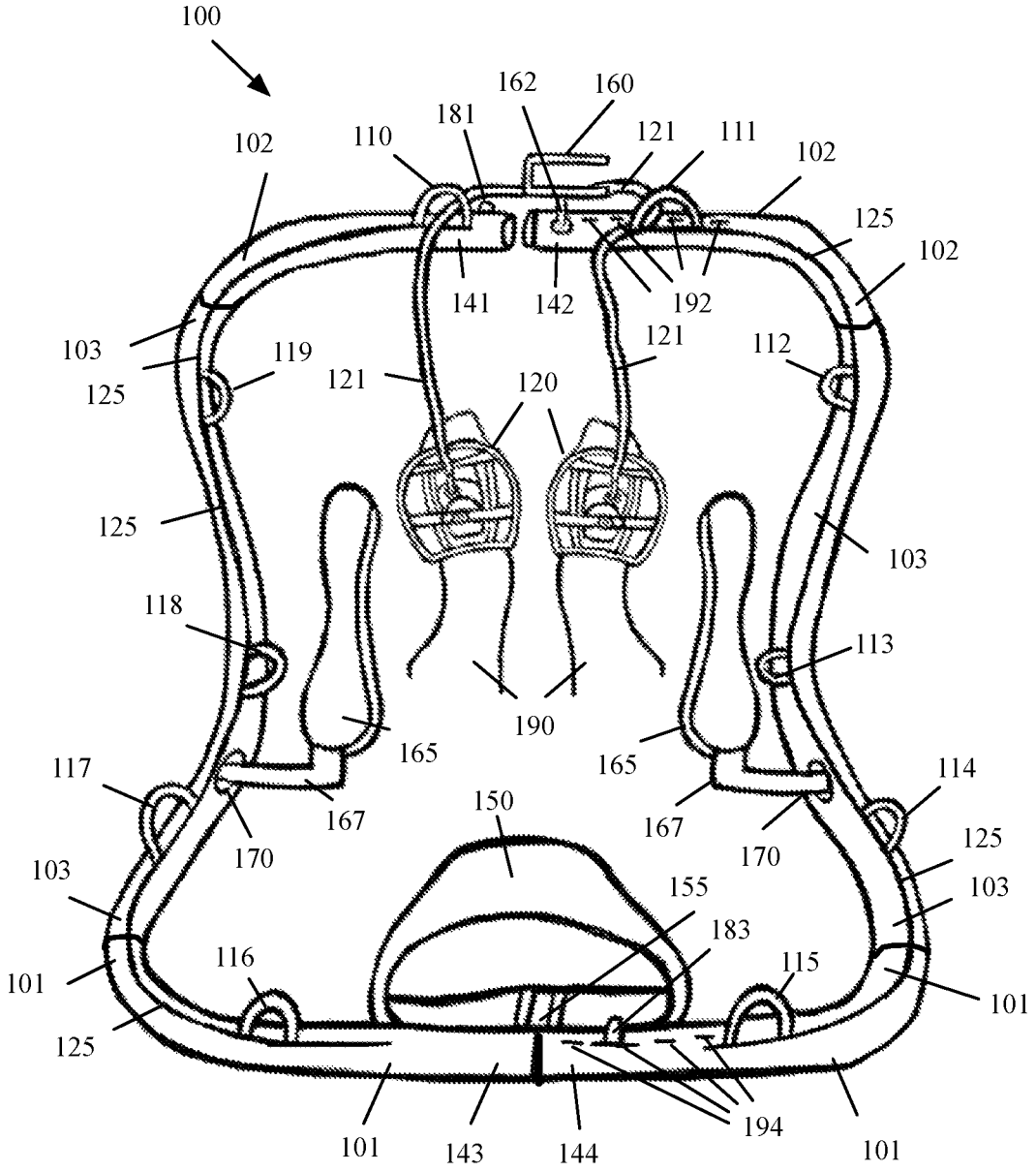
FIGS. 1A-1C are a front elevation view, a side perspective view, and a bottom view of a full body exercise device with connectors for connecting one or more elastic bands to provide a rocking effect, according to various aspects of the present disclosure.

Ab roller devices are exercise devices used to perform abdominal crunches. These devices have a curved frame to create a rocking movement and a headrest for supporting the head and neck during exercise. The previously provided ab roller devices are used as follows. The device is placed on a level surface. A person lies on the back, places the head on the headrest, bends the knees in an upward position, and grabs the top of the curved frame. The person then rolls into a crunch by pulling down the top of the frame towards the chest area. The curved shape of the device's frame lifts the headrest from the ground, resulting in the upper body to be raised into the crunch position.

One aspect of the present embodiments includes the realization that the previously provided ab roller devices require the use of the hands to create the rocking movement for bringing the body into the crunch position. Using of the hands to create the rocking movement creates several drawbacks. For example, muscle fatigue in the hands and arms area may prevent the use of the ab roller device over an extended period of time. In addition, the hands are not free to perform other exercises that may help the simultaneous strengthening of the muscles in the chest, shoulders, arms, and back areas.

Furthermore, the previously provided ab roller devices require the knees to be bended and the feet to be placed flat on the floor. The ab roller devices typically do not provide for the simultaneous exercise of the muscles in the lower body areas. Therefore, the time the person spends using the ab roller device is primarily used to just exercise the muscles in the abdominal areas.

In addition, the headrests of the previously provided ab roller devices do not have mobility and do not contour the person's head and neck while working out. The stiff headrests may create stress on the head and neck area as the headrests are lifted from the ground to place the person in the crunch position.

The ab roller devices may be placed upside down on a surface to perform push-ups and dips. The previously provided ab roller devices, however, do not provide assistance in performing pushups and dips. The previously provided ab roller devices do not allow a person to adjust the width of the device. If the person is tall or the person has a big shape, the person may have difficulty using the device (or may not be able to use the device) because of the device's narrow width relative to the person's body width.

The present embodiments, as described in detail below, solve the above-mentioned shortcomings by providing an ab roller exercise device that may be used as a full body exercise device. The full body exercise device may have a curved shape frame, allowing the exercise device to move in a rocking motion during exercise without the use of hands. The full body exercise device may include a headrest and one or more connectors. Each connector may be used for connecting one or more elastic bands. The connectors may be hooks, clamps, latches, straps, etc. The connectors may also be holes or openings made in the frame of the exercise device for connecting elastic bands.

The elastic band(s) may be used to provide additional rocking motion (referred to as teeter-totter motion or seesaw motion) for the exercise device during exercise. For example, the elastic band(s) may be attached to one or more straps/braces. A person may lie down in supine position with back of the head resting on a headrest. The person may place the feet in the straps/braces. If the person pushes down on the foot straps, the elastic band(s) may provide a rocking motion to the exercise device. The rocking motion pushes the headrest away from the resting position (moving upward) in order to exercise the abdominal muscles.

The use of the elastic band to create the rocking motion on the device to contract the abdominal muscles eliminates the need for the hands to grab and pull down the top frame section of the exercise device to create the rocking motion needed to contract the abdominal muscles. The hands may rest on the chest area, may rest on the armrests, or may grab elastic bands to exercise other muscle areas.

Some embodiments may include a railing mechanism to move the connectors along the frame sections. The locations of the connectors in these embodiments, may not be fixed and the connectors may be moved along the railing to different locations in order to perform different exercises. The full body exercise device, in some embodiments, may include one or more retractable band winder(s). Each retractable band winder may be used to wind a corresponding elastic band or a corresponding cable wire. Some embodiments may include one retractable band winder to retract more than one elastic bands and/or cable wires.

The headrest, in some embodiments, may be an ergonomic contouring headrest that may move with the motion of the device. The headrest may include a shapeable material such as padded memory foam, which may contour and hug the head of a person, as well as the lower and higher part of the neck area during workout.

The headrest may include an adjustable spring lock that may allow the headrest to move up and down with the pressure of the neck and head during exercise. The adjustable spring lock may allow the headrest to move up and down and lock the headrest to its location on the top portion of the adjustable spring lock by the turning the knob (or push button) located underneath the headrest.

The width of the full body exercise device, in some embodiments, may be adjustable to fit the size of a person that is using the exercise device. The exercise device, in these embodiments, may include push in buttons and several openings (or slots) on the top frame section and the bottom frame section of the exercise device. Each push in button may be placed in different openings or slots to adjust the width of the exercise device.

The full body exercise device, in some embodiments, provides assistance for performing pushups and dips. In these embodiments, the full body exercise device includes connectors on the middle frame section that may be used to connect elastic bands. When the full body exercise device is turned upside down for doing pushups or dips, the connectors on the middle frame may be used to connect an elastic band with memory foam pillow to assist a person in performing pushups or dips.

The remaining detailed description describes the present embodiments with reference to the drawings. In the drawings, reference numbers label elements of the present embodiments. These reference numbers are reproduced below in connection with the discussion of the corresponding drawing features.

I. Full Body Exercise Devices

Figure 1B:
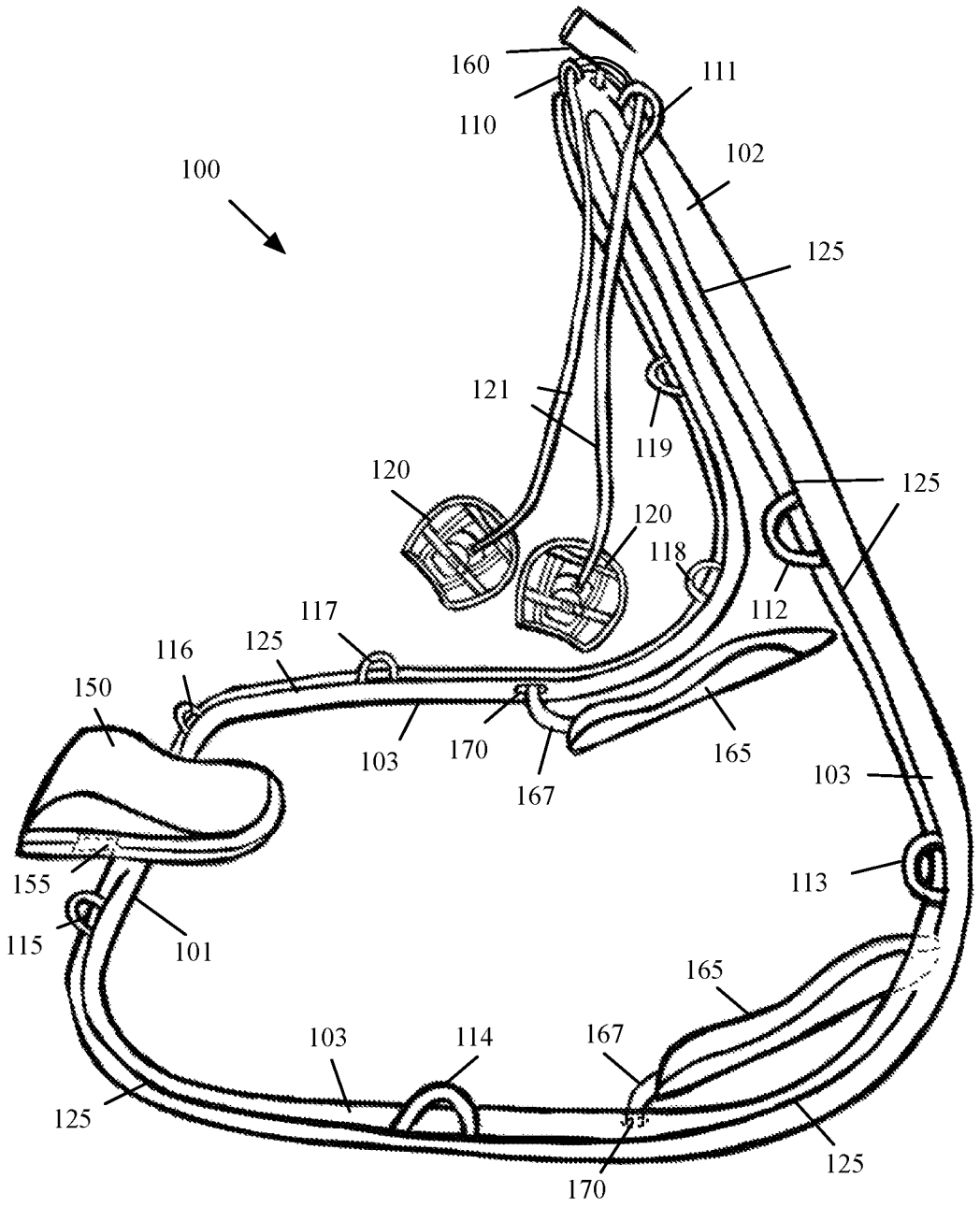
Figure 1C:
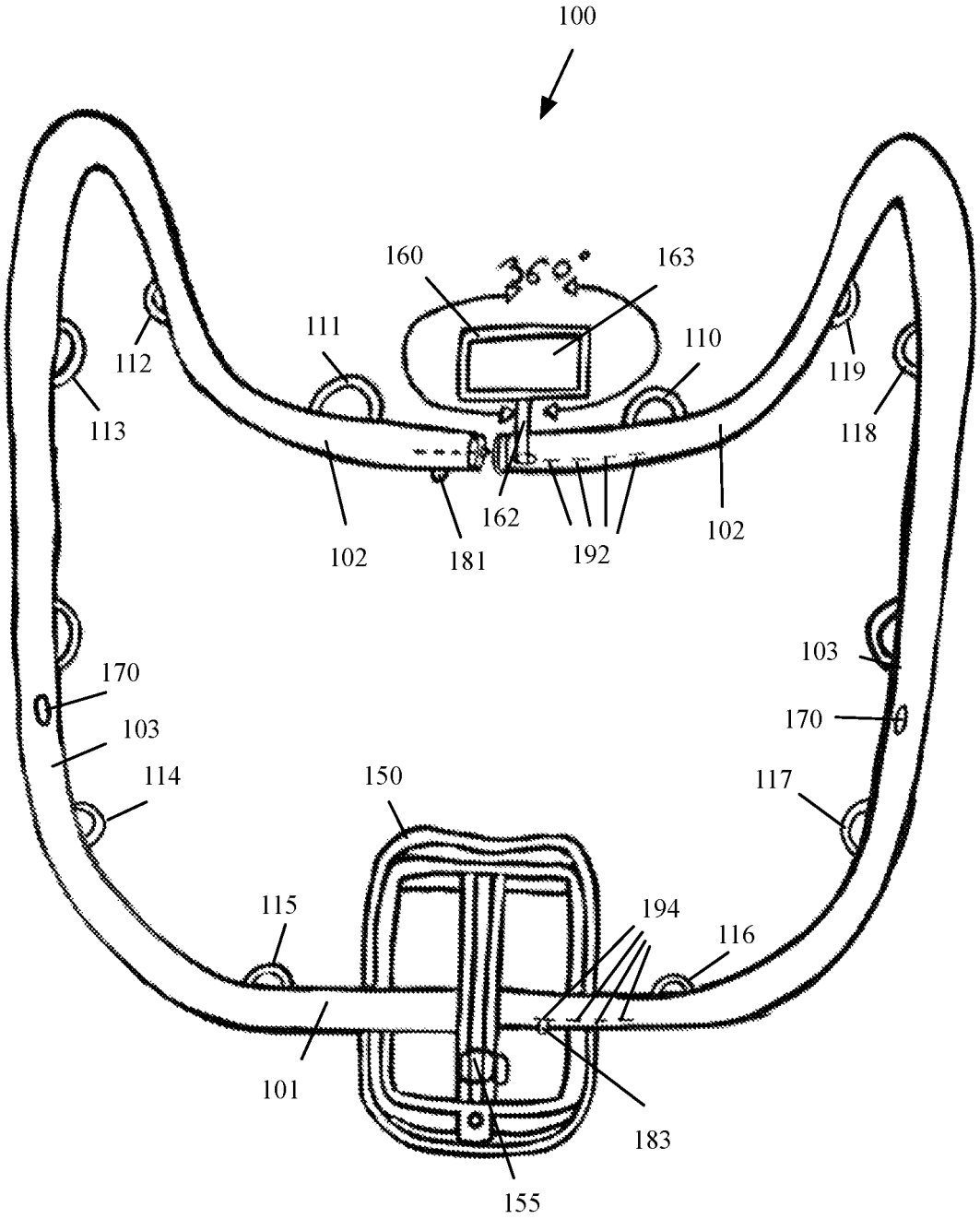

Some of the present embodiments provide a full body exercise device. FIGS. 1A-1C are a front elevation view, a side perspective view, and a bottom view of a full body exercise device with connectors for connecting one or more elastic bands to provide a rocking effect, according to various aspects of the present disclosure. With reference to FIGS. 1A-1C, the exercise device 100 may include a frame that has several sections 101-103. For clarity, the sections are referred to as the bottom frame section 101, the top frame section 102, and the middle frame section 103, which refer to the relative location of each section when the exercise device 100 is used by a person in supine position.

The frame sections 101-103 may be made of appropriate material such as, for example, and without limitations, aluminum, titanium, or other rigid material. The frame sections 101-103 may be shaped as tubes.

The frame sections 101-103, in some of the present embodiments, may be made of a single tube. In other embodiments, such as the embodiment depicted in FIGS. 1A-1C, the frame may include separate sections 101-103 that may include separate tubes to allow the length and/or the width of the exercise device to be adjusted. The adjacent tubes may have different diameters such that a first tube of a first section may be hollow and may have a larger diameter than an adjacent second tube of a second section (e.g., the inside diameter of the first tube may be slightly larger than the outside diameter of the second tube) such that a portion of the smaller diameter tube may fit into a portion of the larger diameter tube and the tubes may be connected to each other by pins, push buttons, screws, etc.

Each of the sections 101-103 may include separate segments. For example, in the embodiment of FIGS. 1A-1C, each of the top section 102, the middle section 103, and the bottom section 101 includes two separate segments in order to allow the width of the exercise device to be adjusted. Each segment may be shaped as a tube. The adjacent tubes of each section 101-103 may have different diameters such that a first tube may be hollow and may have a larger diameter than an adjacent second tube such that a portion of the smaller diameter tube may fit into a portion of the larger diameter tube and the tubes may be connected to each other by pins, push buttons, screws, etc. For example, the inside diameter of the first tube may be slightly larger than the outside diameter of the second tube.

In some of the present embodiments, the length and the width of the exercise device 100 may be changed to fit the size of a person that is using the device to exercise. The adjustments may be done by changing the relative positions of the frame sections 101-103 using a set of push in buttons, pins, hooks, etc.

In the embodiment depicted in FIGS. 1A-1C, a set of push in buttons are used to adjust the length and the width of the exercise device 100. For example, the push in button 181 on the top frame section 102 and/or the push in button 183 on the bottom frame section 101 may be used to adjust the width of the exercise device 100.

There may be several openings (or slots) 192 on the top frame section 102 that the push in button 181 may be placed in. There may be several openings (or slots) 194 on the bottom frame section 101 that the push in button 183 may be placed in. By pushing in the buttons 181 and/or 183, the user may be able to adjust the width of exercise device 100 using one of the several openings (or slots).

Although, in the pictured orientation, the push in buttons 181 and 183 are positioned on the left side of the exercise device 100 (the push in button 183 is on the left side of the exercise device but is shown to be locked into one of the slots 194 on the right side of the device) and the slots 192 and 194 are on the right side, in other embodiments, the position of the push in buttons 181 and/or 183 and the corresponding slots may be the opposite of what is shown in FIG. 1A. In the example of FIG. 1A, the top frame section 102 and the bottom frame section 101 may each include two separate segments 141-142 and 143-144, respectively. For example, the push in button 181 may be on the segment 141 of the top frame section 102 that has the smaller diameter and the slots 192 may be on the segment 142 of the top frame section 102 with the larger diameter. Similarly, the push in button 183 may be on the segment 143 of the bottom frame section 101 that has the smaller diameter and the slots 194 may be on the segment 144 of the bottom frame section 101 with the larger diameter.

Adjusting the width of the bottom frame section 101, in some embodiments, may require removing the headrest 150 and placing the headrest 150 back in its place after the width adjustment. In some embodiments, the lower frame section 101 may include two or more segments on each side of the headrest 150, in order to adjust the of the width of the lower bottom section 101 without the need for removing the headrest 150. For example, there may be a push in button on a first segment of the lower frame section 101 on the left side of the headrest 150 (in the pictured orientation) and there may be several slots on a second segment of the lower frame section 101 on the left side of the headrest 150. The second segment may be hollow and may have a larger diameter than the first segment such that a portion of the first segment may fit into a portion of the second segment.

Similarly, there may be a push in button on a third segment of the lower frame section 101 on the right side of the headrest 150 and there may be several slots on a fourth segment of the lower frame section 101 on the left side of the headrest 150. The fourth segment may be hollow and may have a larger diameter than the third segment such that a portion of the third segment may fit into a portion of the fourth segment.

With further reference to FIGS. 1A-1C, the bottom frame section 101 may be connected to a headrest 150. The headrest 150 may provide head and neck support during exercise. The headrest 150 may have an ergonomic design with padded memory foam that contours and hugs the head of a person, as well as the lower and higher part of the neck area. The exercise device 100 may include an adjustable spring lock 155 for adjusting the headrest 150.

The adjustable spring lock 155 may be located on a side of or underneath the headrest 150. The adjustable spring lock 155 may include an adjustable mechanism to allow a person who is using the exercise device 100 to adjust the positioning of the headrest to the person's height. Unless otherwise stated, the terms person or user refer to a person that is using the exercise device 100 to perform exercise. The adjustable spring lock 155 may include a tilt mechanism to allow the headrest 150 to have mobility, contouring to the person's head and neck, while working out. The adjustable spring lock 155 may allow the person to adjust the position of the headrest 150 back and forth to conform to the height of the user. The person may then lock the headrest 150 in the selected position. Further details of the headrest 150 of some embodiments are described below with reference to FIG. 37.

The exercise device 100 may include the ergonomic armrests 165. The term armrest is interchangeably used herein to refer to an armrest, a hand rest, and/or an elbow rest, which may be used to rest a person's hand, arm, and/or elbow. The armrests 165, in some embodiments, may be permanently attached to the exercise device 100. The armrests 165, in some embodiments, may be attachable and detachable. The armrests 165 may be attached to the device, for example, and without limitations, by a push in button mechanism. FIG. 1C shows the exercise device 100 with the armrests removed (e.g., to facilitate placing the exercise device 100 upside down). Some embodiments may not include armrests.

The ergonomic armrests 165 may allow a person to place the person's hands down for comfortability and to rest the arms. The armrests 165, at the same time, may allow the person to continue with the workout by applying downward pressure on the armrests 165 in creating a rocking motion. The middle frame section 103 may include the slots (or holes) 170 to allow the attachments 167 of the armrests 165 to latch in.

The armrests 165, in some embodiments, may include a curvature on the top surface of the armrests 165. The curvature may be used to create a rocking effect when a person is lying down and placing the hands on the armrests 165 and applying pressure downwards. The pressure may raise the backend of the headrest 150. By releasing the pressure on the armrests 165, the headrest 150 may go back to its original position. Therefore, a teeter-totter effect may be created by applying forward pressure to and releasing the forward pressure off the armrests 165.

As shown in FIGS. 1A-1C, the middle frame section 103 has a curved shape, allowing the exercise device 100 to move in a rocking motion when used. With further reference to FIGS. 1A-1C, the exercise device 100 may include one or more elastic bands 121. As described below, some of these elastic bands may be used to create a rocking motion without using the hands.

In the example of FIGS. 1A-1C, one elastic band is shown for simplicity. The elastic band(s) 121 may be secured to the top frame section 102 by one or more connectors 110-111, such as, for example, and without limitations, by one or more hooks, clamps, latches, straps, etc. Further examples of the connectors used in different embodiments are described below.

The elastic bands may be in the shape of cylindrical tubes and/or may have a non-tubular shape. The elastic bands may be made of elastic latex, rubber, polymers with viscoelasticity (e.g., elastomer), spring, or other form of resistance material. The elastic bands may be provided in different resistance level desired for a particular exercise to be performed. The terms elastic band and resistant band are interchangeably used herein. Although FIGS. 1A-1C show that there are a total of ten connectors 110-119, the exercise device 100, in different embodiments, may be designed with more or fewer connectors.

Each elastic band that is connected to one or more of the connectors 110-119 may be used to exercise one or more different groups of muscles. For example, the elastic band 121 is connected to the connectors 110-111, which are attached to the top frame section 102. One end of each elastic band 121 may be connected to a foot strap (or foot brace) 120 to receive a foot 190 of a person. The terms strap and brace are interchangeably used herein when referred to a device that may be worn on a foot or a hand.

Although in the depicted embodiment the elastic band 121 is one band that goes through the two connectors 110 and 111, other embodiments may use two separate, substantially equal size elastic bands, one of which may be connected to the connector 110 and one of the foot straps 120 and the other elastic band may be connected to the connector 111 and the other foot strap 120. Furthermore, in some embodiments, the single piece elastic band 121 may be connected to only one connector or to two or more connectors (e.g., there may be additional connectors on the top frame section 102 to provide better support for connecting the elastic band 121).

The elastic band 121 may be used to exercise foot, leg, or thigh muscles. The elastic band 121 may be used to exercise arm muscles when pulling on the elastic band with hands. The elastic band 121 may also provide additional rocking motion (referred to as teeter-totter motion or seesaw motion) for the exercise device 100 during exercise. For example, when a person is in supine position (with back of the head resting on the headrest 150 and the hands resting on the armrests 165 or holding on the top frame section 102 for balance), if the person pushes down on the foot straps 120, the elastic band 121 provides a rocking motion to the exercise device 100. The rocking motion pushes the headrest 150 away from the resting position (moving upward) in order to exercise the abdominal muscles. The person may optionally grab the top frame section 102 by the hands and push down on the top frame section 102 in order to provide additional rocking motion to the exercise device 100.

Other connectors 112-119 may be located on different sections of the exercise device 100 and may be, for example, and without limitations, one or more hooks, clamps, latches, straps, etc. In the example of FIGS. 1A-1C, the connectors 112-114 and 117-119 may be located on the middle frame section 103 and may be used to connect different elastic bands (not shown in FIGS. 1A-1C) to the exercise device 100. By pulling and/or pushing on such an elastic band forward and/or outwardly with the hands, feet, knees, ankles, and/or thighs, the elastic band may contract different muscles, which may allow a person to work out the muscles in the chest, shoulders, arms, abs, legs, hips, glutes, and/or back areas simultaneously.

The connectors 114 and 117 are located on the two sides of the lower part of the middle frame section 103. The placement of the connectors 114 and 117 may allow a person to attach additional resistant bands to perform different exercises in targeting different parts of the muscles, such as the chest, arms, and shoulders etc.

The connectors 115 and 116 are located on the two sides of the bottom frame section 101. The placement of the connectors 115 and 116 may allow a person to attach additional resistant bands to perform different exercises in targeting different muscles, such as the muscles in the chest, arms, and shoulder areas.

With continued reference to FIGS. 1A-1C, the exercise device 100 may include a phone holder 160 located on the top frame section 102. The phone holder 160, in some embodiments, may be C-shaped and/or may rotate 360 degrees around a base 162. Some of the present embodiments may not include a phone holder.

With reference to FIG. 1C, the exercise device 100 is turned upside down. The adjustable spring lock 155 located beneath the headrest 150 allows the user to adjust the headrest 150 by moving the headrest 150 back and forth and locking the position of the headrest 150 to fit the height of the person. The phone holder 160 in FIG. 1C is shown with a phone 163 inserted inside. The phone holder 160 allows the user to turn the phone 163 in a 360 degree rotation as well as forward and backwards once placed on the phone holder 160. The phone holder 160 may be screwed, or a push in button mechanism may be used to connect the phone holder 160 to one side of the top frame section 102.

The connectors 110-119 may include, without limitations, one or more of the following types of elements that provide the holding/hooking/locking/latching mechanism. The connectors may include clamps, for example, and without limitations, adjustable cable/wire clamps, power cord clamps, buckle line cord clips, cable clips, adhesive wire management clamps with adjustable tie mount, and/or nylon r-type white/black cable clamp organizer cord. The connectors may include zipper loop cords and/or spring loaded cord lock toggles. The connectors may include latches such as latch hook.

The connectors may include metal hardware rings, for example, and without limitations, steel rings with a pad, metal-D rings with clip, black anodized D-rings, D rings and O rings for straps, and/or metal opening O rings. The connectors may include cable ties, for example, and without limitations, cable wire storage, D lines, cable tidies, universal cable holders, adhesive tape wire cable holders, adhesive cable straps, clip buckle cord plastic ties, and/or self-adhesive wire tie cable mount clamp clip. The connectors may include nickel and/or anodized and stainless steel footman loops.

The connectors may include pin hardware, for example, and without limitations, metal spring pins and/or retaining clip spring cotter pins. The connectors may include hooking mechanism, for example, and without limitations, heavy duty black vinyl coated S-hooks, wire hooks, loop snaps, carabiner clips, steel D-ring snap hook carabiners, mini carabiners, metal snap hooks, mini metal spring links, shock (or bungee) cord hooks, swivel snap hooks, stayput shock cord hooks, shock cord hook clips, lock zip cords, spring cords, reusable adjustable wire fixing clamp, and/or cables that have tie mount.

The hooks may be designed with a hedge mechanism that may allow the hooks to bend forward and backwards. Some hooks may include a pulling and tightening belt strap mechanism to secure the elastic bands while other hooks/straps might be designed with a D ring mechanism that has an opening in the ring that allows the elastic band to lock in and/or to be wrapped or tied around.

The connectors may include plastic cord locks, which may include the following styles of plastic cord locks: ball style, barrel style, block style, bowling pin style, capped barrel style, double hole style, ellipse style, big bertha barrel style, round barrel style, uncapped square barrel style, mini style, cord keepers, and/or self-adhesive nylon mounting flat pole. The connectors may include adjustable elastic multi band straps/loop strap fasteners/holder/strap.

In some embodiments, a locking mechanism with snap fit feature may be provided to snap and lock the elastic band in place. The connectors 110-119, in some embodiments, may be attachable and detachable. The connectors 110-119, in some embodiments, may be permanently attached to the exercise device 100.

Figure 1D:
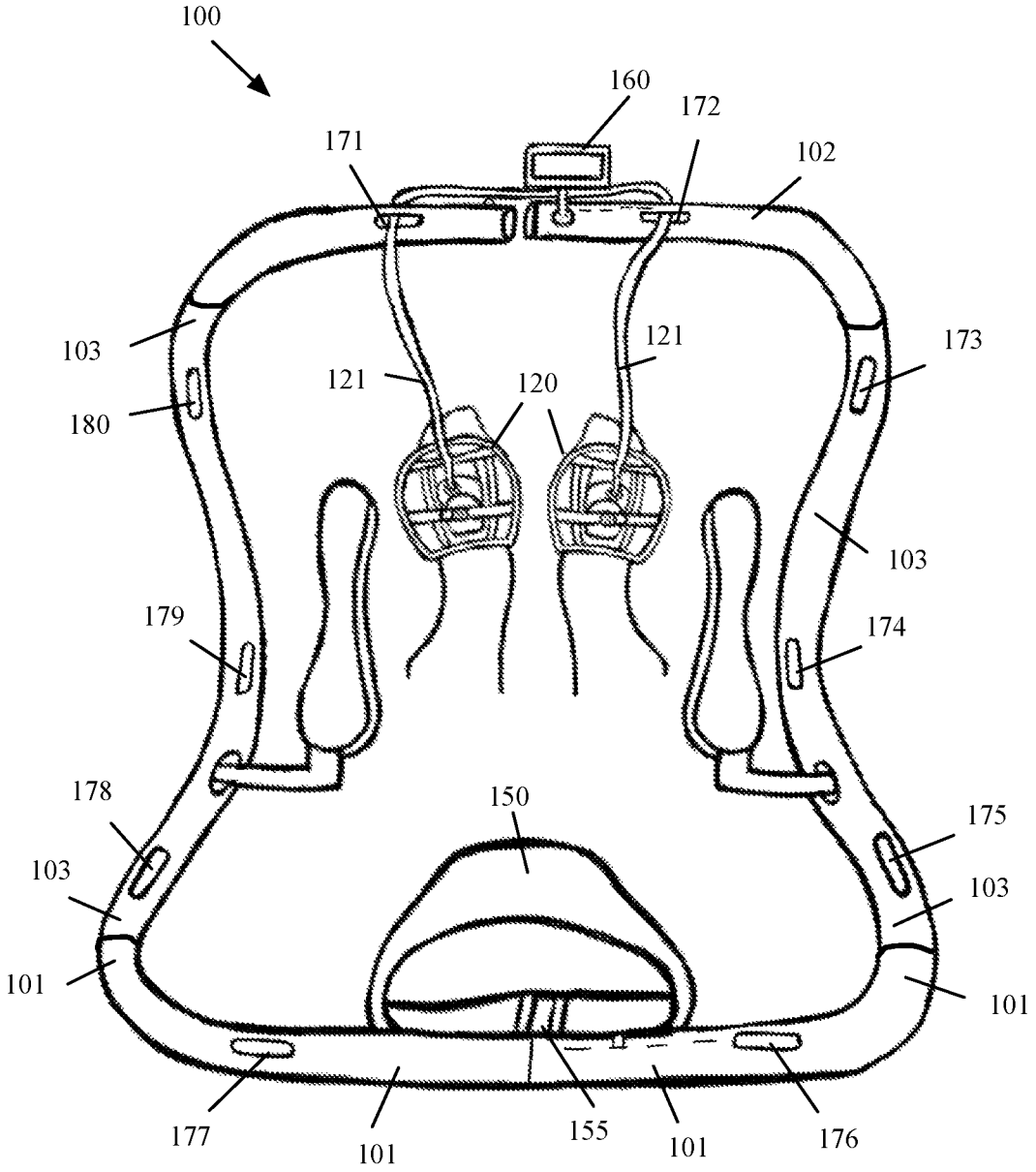
FIG. 1D is a front elevation view of the full body exercise device of FIG. 1A where the connectors for connecting the elastic bands are holes made in the frame of the full body exercise device, according to various aspects of the present disclosure.

In addition to the above-mentioned examples for the connectors 110-119, the connectors in some embodiments may be holes made in the frame of the exercise device 100. FIG. 1D is a front elevation view of the full body exercise device of FIGS. 1A-1C, where the connectors for connecting the elastic bands are holes made in the frame of the full body exercise device, according to various aspects of the present disclosure. With reference to FIG. 1D, the full body exercise device 100 may have similar components as the full body exercise device 100 of FIG. 1A. However, in addition to, or in lieu of the connectors 110-119, the exercise device 100 of FIG. 1D includes one or more connectors 171-180.

The connectors 171-180 include holes (or openings) that are made in the frame sections 101-103 of the exercise device 100 to connect elastic bands such as the elastic band 121 to the exercise device. Although FIG. 1D shows that there are a total of ten connectors 171-180, the exercise device 100, in different embodiments, may include more or fewer connectors than shown in the figure. The connectors' 171-180 holes are made such that a band may go through a hole from one side of the exercise device 100 (e.g., the front, the back, the top, the bottom of the device in the pictured orientation) and come out of another side of the device.

The connectors' 171-180 holes may be used to connect an elastic band to the device 100. The elastic band may be tied around one hole. The elastic band may be connected to the device 100 by passing the band through several hole. For example, as shown in FIG. 1D, the elastic band 121 may be secured by passing through the two connectors' 171-172 holes.

In some of the present embodiments, the edges around the connectors' holes may be covered by a soft material such as, for example, and without limitations, rubber, plastic, silicone, vinyl, etc., to protect a person's skin against the rough edges of the holes and/or to prevent the rough edges of the holes to damage the elastic bands that go through the holes. In some embodiments, the diameters of the holes are made such that one or more elastic bands may pass through a hole.

As described above with reference to FIGS. 1A-1C, the frame of the full body exercise, in some embodiments, may include several separate sections 101-103 to allow the length and/or the width of the exercise device to be adjusted. The separate sections may be physically separated for ease of transportation and storage. At least a portion of the frame of the exercise device, in some embodiments, may be collapsible to further facilitate transportation and storage.

Figure 1E:
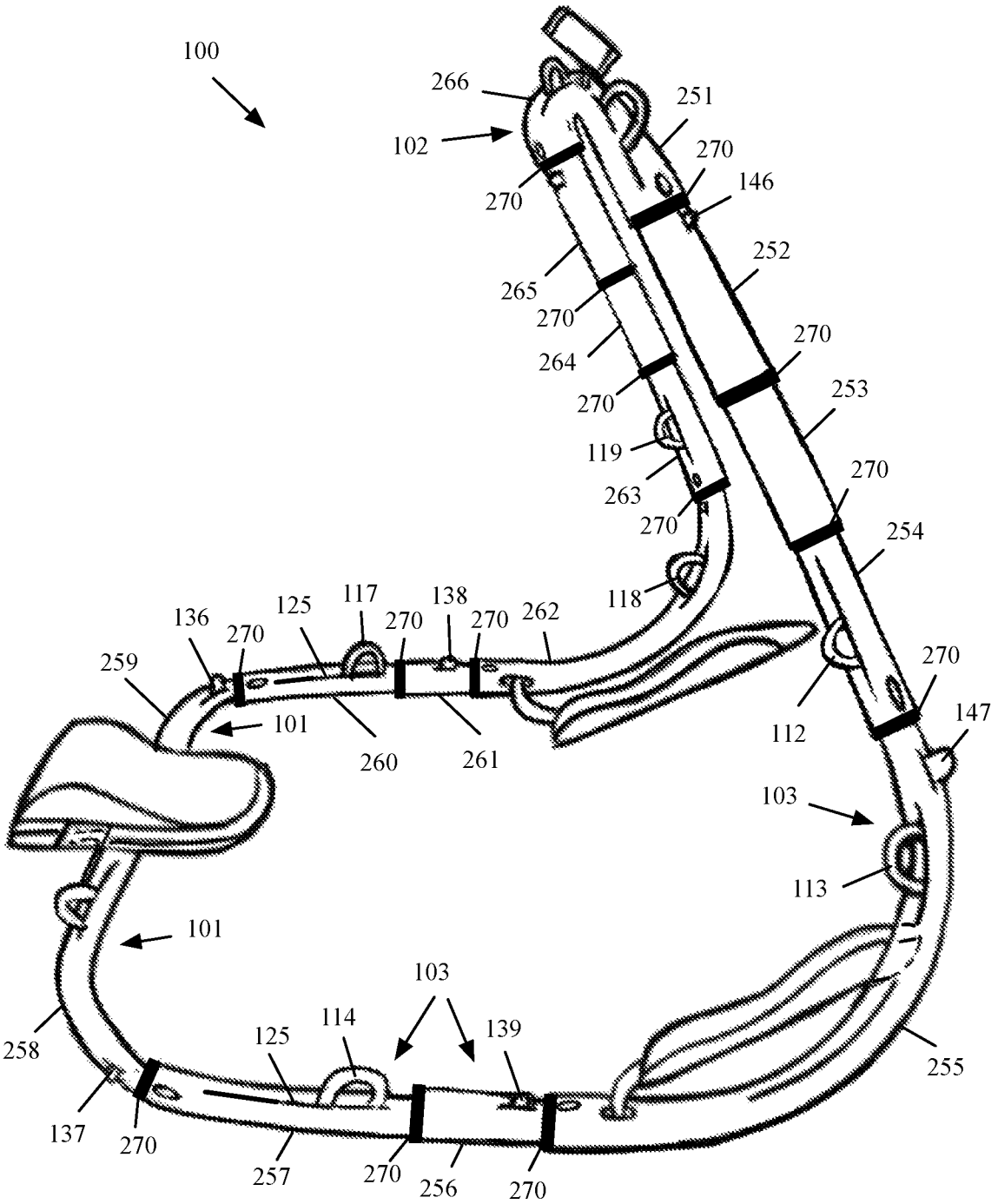
FIG. 1E is a side perspective view a full body exercise device with connectors for connecting one or more elastic bands to provide a rocking effect and a collapsible frame to facilitate carrying and storage, according to various aspects of the present disclosure.

FIG. 1E is a side perspective view a full body exercise device with connectors for connecting one or more elastic bands to provide a rocking effect and a collapsible frame, according to various aspects of the present disclosure. With reference to FIG. 1E, the exercise device 100 may include several push in buttons such as the push in buttons 136-139 and 146-147 that may be used to separate different sections of the exercise device's frame from each or to separate different segments of a section from each other. The push in buttons 136-139 and 146-147 may be used to adjust the width and/or the length of the exercise device 100. Adjusting the width and/or the length of the exercise device is further described below with reference to FIG. 5.

With continued reference to FIG. 1E, the exercise device's frame may include one or more collapsible telescopic segments 251-266. Different embodiments may include different number of telescopic segments. Each of the bottom frame section 101, the top frame section 102, and the middle frame section 103 may include one or more telescopic segments. Adjacent telescopic segments may belong to the same frame section 101-103 or to a different frame section.

The telescopic segments may have an appropriate shape to facilitate the collapsing of the adjacent segments into each other. For example, and without limitations, the telescopic segments may have a substantially tubular shape. The adjacent tubes may have different diameters such that a first tube of a first segment may be hollow and may have a larger diameter than an adjacent second tube of a second segment (e.g., the inside diameter of the first tube may be slightly larger than the outside diameter of the second tube) such that a portion of the smaller diameter tube may fit into a portion of the larger diameter tube.

The frame of the exercise device 100 may include locking mechanisms 270 between the adjacent telescopic segments. The locking mechanisms may be used for quick tightening and release of the adjacent telescopic segments against each other. The locking mechanisms may be internal or external. The internal locking mechanisms may be configured to use friction to stay locked. For example, and without limitations, the locking mechanism, in some embodiments, may include an expansion joint inside a frame segment.

The expansion joint may be made of an expandable substance, such as plastic, and may expand when the frame segment is twisted in a first direction in order to tighten the frame segment to an adjacent frame segment. The expansion joint may contract when the frame segment is twisted in a second, opposite direction, in order to release the frame segment from the adjacent frame segment.

The external locking mechanisms may include a lever or clamp that may be used to quickly lock and unlock adjacent telescopic segments. Both internal and external locking mechanisms may be used to collapse the frame and/or to adjust and finetune the width and/or the length of the excursive device's frame to fit the size of a particular person.

With further reference to FIG. 1E, some of the adjacent frame segments, such as the frame segments 252-254 may be substantially straight. These segments may be configured to telescopically collapse into the segment that has the largest diameter (e.g., segment 252).

Some of the adjacent segments, such as segments 254 and 255, segments 255 and 256, segments 259 and 260, etc., may have different curvatures. For example, segment 254 may be substantially straight and segment 255 may have a straight portion adjacent to the segment 254, a curved portion, and another straight portion adjacent to the segment 256. The frame of the exercise device may be configured such that a push in button, such as the push in button 147, may be pressed down and the straight portion of the segment 255 may be pushed inside the segment 254 by unlocking the locking mechanism 270 located between the two segments. The connection loops, such as the connection loop 114, may be moved along the groves 125 to a desirable position in order to facilitate the telescopic movement of the segment 257 inside an adjacent segment, such as the segment 256.

In some embodiments, the curved segments of the frame, such as the segment 255 may be further divided into smaller curved telescopic segments (not shown). The curved telescopic segments may be shaped as pipe bends. The adjacent curved segments may have different diameters such that a first curved segment may be hollow and may have a larger diameter than an adjacent second curved segment such that a portion of the smaller diameter curved segment may fit into a portion of the larger diameter curved segment.

The full body exercise device 100 of FIG. 1E provide several technical advantages over the ab roller devices that are made of a contiguous frame. The individual segments may be separated and/or fitted into an adjacent segment. The full body exercise device 100 of FIG. 1E may be collapsed into a smaller volume for ease of storage and/or to facilitate carrying (e.g., inside a backpack or a gym bag). The width and/or the length of the full body exercise device 100 of FIG. 1E may also be adjusted and finetuned by using the telescopic segments, such as the telescopic segments 251-266 and the locking mechanisms 270.

Different types of connectors. telescopic segments, and/or locking mechanisms described above with reference to FIGS. 1A-1E may be used for any other exercise device of the present embodiments. For example, and without limitations, the connectors shown in FIGS. 2-6, 8-36, and 38 may be one or more of the connector types described above with reference to FIGS. 1A-1E.

Figure 2:
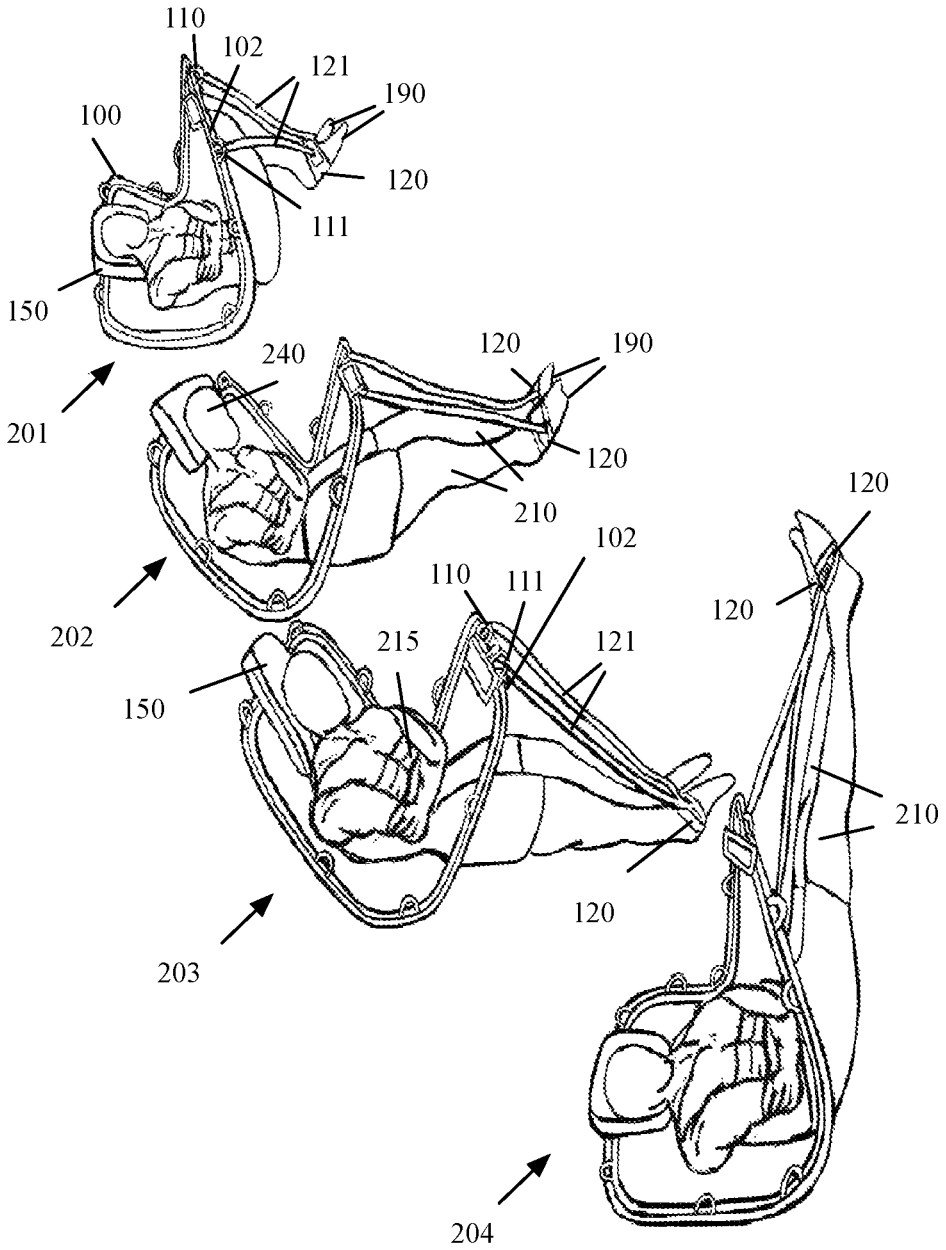
FIG. 2 is a functional diagram illustrating an example use of one or more elastic bands to provide rocking effect for a full body exercise device, without the use of hands, according to various aspects of the present disclosure.

FIG. 2 is a functional diagram illustrating an example use of one or more elastic bands to provide rocking effect for a full body exercise device, without the use of hands, according to various aspects of the present disclosure. FIG. 2, as shown, includes four operational stages 201-204. In stage 201, a person using the exercise device 100 has placed the person's head and neck on the headrest 150 in a supine position. The person has crunched in the knees and has placed the feet 190 in the foot straps 120. The foot straps 120 are connected to the elastic band(s) 121, which is(are) connected to the top frame section 102 by the connectors 110-111. As described above with reference to FIGS. 1A-1C, the elastic band(s) 121 may be one piece or two separate pieces and there may be one or more connectors on the top frame section 102 to connect the elastic band(s) 121.

As shown in stage 202, once the person has put the feet 190 in the foot straps 120, the person may substantially straighten the person's legs 210 by applying a downward pressure to the foot straps 120. The feet 190 attached to the foot straps 120 create a pull down force on the top frame section 102, which in turn results in having the back area of the device, where the headrest 150 is located, to automatically lift off from its resting position on ground. The curved design of the exercise device 100 and the placement of the elastic band(s) 121 create a force on the exercise device 100 that creates a forward motion (in relation to the person's head 240) when the legs 210 are in straight, substantially horizontal, position.

As shown in stage 203, the straighter the legs 210 and the closer the legs 210 are towards the ground, the higher the back portion of the exercise device 100 lifts off the ground, creating more pressure on the abdominal muscles 215 of the person while the person's body goes forward and comes back down. This movement contracts the abdominal muscles 215, while at the same time provides leg muscle workout out and provides a body stretch.

As shown in stage 204, the person with the head on the headrest 150 (which may include memory foam) and the feet 190 secured in elastic band's foot straps 120 has the legs 210 in vertical position, facing up. The person in this stage has removed the downward pressure to the foot straps 120. Having the legs 210 in the vertical position, the exercise device 100 automatically rocks back into its original position, having the headrest 150 touching the ground. The automatic teeter-totter motion effect described with reference to stages 201-204 is created because of the location of connectors (hooks/laches/straps) 110-111 that allow the elastic band(s) 121 to attach to the top frame section 102 and the curvature of design of the exercise device 100.

The person may repeat stages 201-204 to exercise the abdominal muscles. The person's hand may rest on the person's body as illustrated. The person may also place the hands on the of top frame section 102 without pressing down. The person's hand may also be pressed on the top frame section 102 to further assist in the teeter-totter motion, or the person's hand may rest on armrests (not shown) when the exercise device has the armrests 165 (as shown in FIG. 1A).

In the previous ab roller devices, a person had to rely on the person's hands pushing down on the top frame section 102 in order to move the exercise device 100 in the forward and backward directions. By attaching the elastic band(s) 121 to the top frame section 102, and creating a teeter-totter (or rocking) motion without relying on the hands, some of the present embodiments provide the technical advantage of relieving the person's hand from creating the teeter-totter motion. For example, the person may simply put the hands on the top frame section 102 for stability and may use the legs 210 to provide the teeter-totter motion. Alternatively, the person may rest the hands and arms on the optional armrests 165 (FIGS. 1A-1C) with or without grabbing the top frame section 102 and still provide the rocking motion to the exercise device 100 using the legs 210, the foot straps 120, and the elastic band(s) 121. Alternatively, the person may attach additional elastic bands to the exercise device 100 and use the hands, as described in several examples below, to perform additional exercises simultaneous to performing abdominal crunches.

FIGS. 1A-1C show several connectors 110-119 for connecting elastic bands. Some embodiments may include a railing mechanism 125 to move the connectors 110-119 along the frame sections 101-103. Accordingly, the locations of the connectors 110-119 may not be fixed and the connectors may be moved along the railing 125 to different locations in order to perform different exercises. In addition, the number of the connectors may be more or fewer then the number of connectors shown in FIGS. 1A-1C. For example, a fewer connectors may be used and the same connector may be moved along the railing 125 to any desired location (e.g., the locations shown for the connectors 111-114 or the locations shown for the connectors 116-119).

Figure 3:
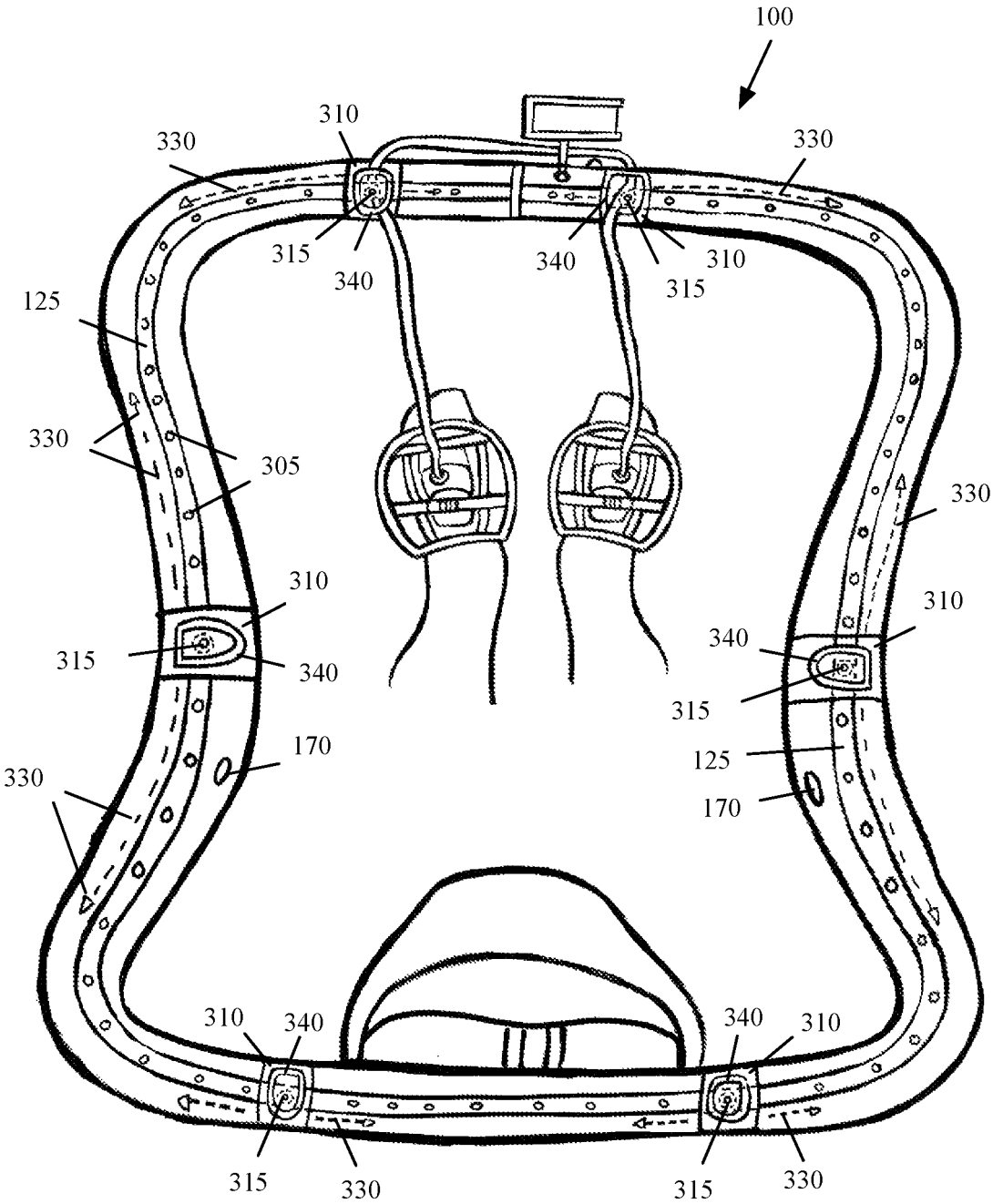
FIG. 3 is a front elevation view of a full body exercise device with a set of railings with brackets to move the connectors along the frame sections, according to various aspects of the present disclosure.

FIG. 3 is a front elevation view of a full body exercise device with a set of railings and brackets to move the connectors along the frame sections, according to various aspects of the present disclosure. With reference to FIG. 3, the exercise device 100 may include the railings 125. The railings 125 may include the openings (or slots) 305. The railings 125, in some embodiments, may run substantially across the frame sections 101-103. In other embodiments, the railings 125 may run across some portions of the frame sections 101-103.

With further reference to FIG. 3, the exercise device 100 may include one or more brackets 310 that may slide on the railings 125. Each bracket may include a locking element such as the pin/push in buttons 315. The pins/push in buttons 315 may be used to hook the bracket 310 into one of the opening/slots 305 on the railings 125. By pressing the push in button twice, the push in button 315 may unhook the bracket 310, allowing the person to slide the bracket 310 up or down on railings 125. The arrows 330 symbolize that the bracket 310 is able to move up or down on the frame of the device 100.

The connectors 340 may be similar to the connectors described with reference to FIGS. 1A-1C. Each connector 340 may be connected to (e.g., may be attached to the top of) a bracket 340. All of the above-mentioned connector types may be slidable across the railing 125, which may allow the user to choose where the user prefers to connect the elastic bands. In addition, some embodiments may include one or more connectors similar to the connectors 171-180 of FIG. 1D.

In some of the present embodiments, the brackets 310 may be turned to lock into the openings/slots 305. For example, by turning a bracket 310 to the right, the pin/push in button 315 of the bracket 310 may lock into a slot 305. By turning the bracket 310 to the left, the pin/button 315 may be unlocked from the slot 305. The connectors 340 may be hooks and the hooks attachment on the bracket 310 may be designed with a swivel mechanism that may allow the hooks to move side to side.

Figure 4:
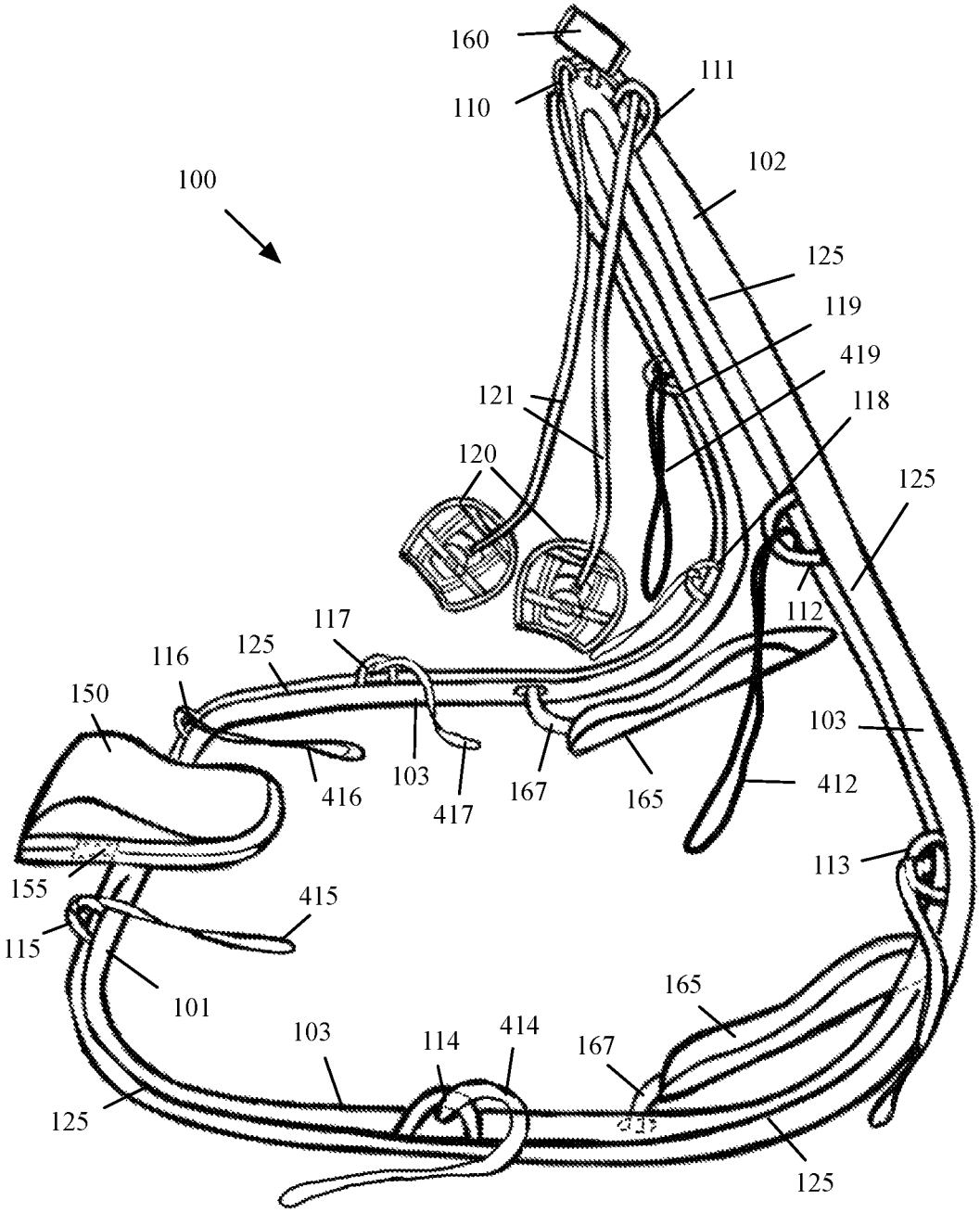
FIG. 4 is the full body exercise device of FIGS. 1A-1C with additional elastic bands connected to different connectors, according to various aspects of the present disclosure.

FIG. 4 is the full body exercise device of FIGS. 1A-1C with additional elastic bands connected to different connectors, according to various aspects of the present disclosure. As described above, some embodiments may include a railing mechanism 125 to move the connectors 110-119 along the frame sections 101-103. Accordingly, the locations of the connectors 110-119 may not be fixed and the connectors may be moved along the railing 125 to different locations in order to perform different exercises. In addition, the number of the connectors may be more or less then the number of connectors shown in FIG. 4. For example, the same connector may be moved along the railing 125 to any desired location (e.g., the locations shown for the connectors 111-114 or the locations shown for the connectors 116-119).

Each elastic band placement may allow the user to perform different exercises. The user may connect more than one elastic band to a connector for any of the exercises mentioned in the present embodiments to provide more resistance for doing the exercise. For example, connecting an elastic band 415 to the connector 115 and an elastic band 416 to the connector 116 may allow the user to work out the triceps, chest, and shoulders muscles. The person may lie on the back with the head on the headrest 150, while having the knees slightly bent. The person may then reach back with the hands, behind the head, and grab the elastic bands 415 and 416 that are connected to the connectors 115 and 116, respectively. The person may then extend the arms outwards, directly above the shoulder, bending the elbows and back down until the person reaches behind the head, and then backs up, above the shoulder muscles.

Another exercise with the resistant bands 415 and 416 is called "lying pull overs." In this exercise, the person may lie flat on the back with the head on the headrest 150 and reach back with arms, grabbing one or both resistant bands 415 and 416 with the hands, and pressing the arms up and over the head. This exercise works out the triceps, chest and shoulder muscles. The person may connect one band to both connectors 115 and 116. The person may also connect more than one elastic band to a single connector. The person may also connect the elastic band 415 from the connector 115 to the connector 114 and the elastic band 416 from the connector 116 to the connector 117, creating diagonal straight lines with each band 415 and 416. The person may grab each band with the hands, and may crunch in the elbows, pulling down on the bands 415 and 416 towards the rib cage. This exercise works out the latissimus dorsi (lats) and abdominal (ab) muscles.

Another exercise the person is able to do with elastic bands connected to the connectors 114 and 117 is an exercise to help improve and strengthen the rotator cuff muscle, which is located in the shoulder. This exercise is called shoulder lateral rotation. The person may lie on the back, with the head on the headrest 150. The person may cross the left arm over to the right side of the connector 114 where the band 414 is located, and/or cross the right arm over to the left side of the connector 117 where the band 417 is located.

Having one arm crossing over the chest area, the person may grab the corresponding elastic band 414 or 417 and pull the band over to the side of the arm that is used to pull the band, while keeping the elbows close into the body. The person may then rotate the shoulders, such that the arm moves outwards. The person may then repeat this motion.

Another exercise that a person may be able to perform with elastic bands 414 and 417 connected to the connectors 114 and 117, respectively is a lying chest fly. The person may have the legs bent and/or straight out, and the person may grab one elastic band 414 or 417 with each hand (the band that is closer to the hand). The person may then extend the arms out with the elbow slightly bent. This exercise strengthens the muscles in the chest area.

Since the connectors 414 and 417 are located on the lower portion of the middle frame section 103 (i.e., closer to the headrest 150), using elastic bands connected to the connectors 414 and 417 allows the person to perform chest and shoulder workout. The resistance of bands connected to the connectors 414 and 417 contracts the muscles in the chest and shoulder areas.

Elastic bands may also be diagonally connected from the connector 117 to the connector 112 or from the connector 114 to the connector 119. By doing so, while lying down, the person may have the head on the headrest 150 and may place the knees and/or the feet on the band. The person may then press down on the bands towards the ground, slowly allowing the band to come back. The resistance of the band may push back the knee or foot towards the person, constricting the abs and hip muscles. At the same time, the person may stretch out the muscles in the legs.

In another exercise (as further described below with reference to FIG. 18), an elastic band may be connected from the connector 114 to the connector 112. Another elastic band may be connected from the connector 117 to the connector 119. The person may be able to perform a stretch by the lying on the back and raising the legs and having both knees bent in (in a frog like position). The person may then place the side of the knees on each of the bands that is connected to each side. The person may then place the inner knees on each side of the elastic band, putting pressure on the elastic band. The person may then release the contraction of the elastic band by releasing the pressure off the band. This back and forth movement, may create a teeter-totter effect, working out the abdominal area, while providing a stretch that may help the person loosen and strengthen the muscles in the hip, glutes, and inner groin areas.

The connectors 112 and 119 that are located on the top portion of the middle frame section 103 may allow (as further described below with reference to FIG. 16) the person to place the foot inside a strap and/or an elastic loop at the end of the bands 412 and 419 and/or directly place the foot/hands inside the bands to work out the legs or biceps. The person may be able to simultaneously work out the muscles in the legs, chest, and arms areas by connecting two or more elastic bands at a time. For example, the person may be able to grab on the elastic bands 415 and 416 and perform lying pull overs to work out the arm, shoulder, and chest muscles. At the same time, the person may place the foot into an elastic band that is connected to the connectors 112 and 119 and perform knee crunches to work out the ab and glute muscles. Several more exercises that may be performed by additional elastic bands are described below.

Figure 5:
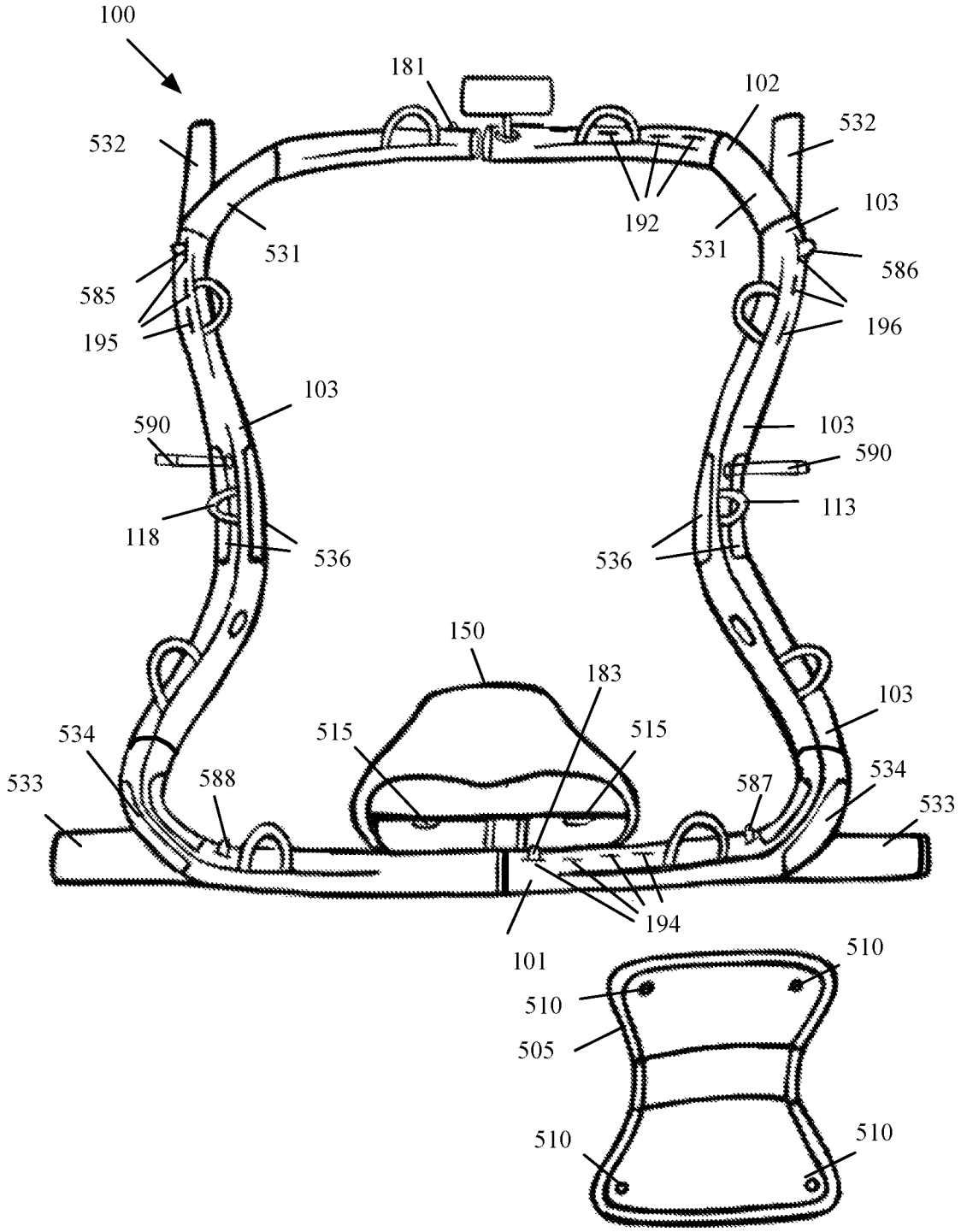
FIG. 5 is a front elevation view of a full body exercise device that includes mechanisms to adjust the width and length of the exercise device, according to various aspects of the present disclosure.

The prior art ab roller devices do not allow a person to adjust the width of the device. If the person is tall or the person has a big shape, the person may have difficulty using the device (or may not be able to use the device) because of the device's narrow width relative to the person's body width. Some of the present embodiments solve this problem by providing a mechanism to adjust the width of the exercise device. FIG. 5 is a front elevation view of a full body exercise device 100 that includes mechanisms to adjust the width and the length of the exercise device, according to various aspects of the present disclosure.

With reference to FIG. 5, the connectors 113 and 118, which are located on the inner curved portion of the middle frame section 103, may be used to connect an elastic band with a memory foam pillow 505. A resistant band, with or without the memory foam pillow 505, may be connected from the connector 118 to the connector 113, and may be used to assist for pushups and dips when the device is turned over. The memory foam pillow resistant band may assist the person to perform dips and pushups when the device is turned over for additional workout. As described further below, the memory foam pillow resistant band may also be used without the exercise device 100.

The push in buttons 587 and 588 may be used to detach the bottom frame section 101 from the middle frame section 103. The push in buttons 585 and 586 and the slots 195 and 196 may be used to adjust the length of the exercise device 100. The push in buttons 585 and 586 may also be used to detach the middle frame section 103 from the top frame section 102.

The push in button 181 on the top frame section 102 and/or the push in button 183 on the bottom frame section 101 may be used to adjust the width of the exercise device 100. There may be several openings (or slots) 192 on the top frame section 102 that the push in button 181 may be placed in. There may be several openings (or slots) 194 on the bottom frame section 101 that the push in button 183 may be placed in. By pushing in the push in buttons 181 and/or 183, the user may be able to adjust the width of exercise device 100 using one of the several openings (or slots).

The exercise device 100 may include the handlebars 590, located on the middle frame section 103. One problem that a user may face when using an ab roller device is the pressure that the person applies with the legs on the elastic bands that are attached to the top and/or middle frame sections may lift up the ab roller device off the ground.

The handlebars 590 solve this lifting problem. For example, when the person applies pressure on the elastic bands with the legs, the person may hold on to the handlebars 590. By holding down on to the handlebars 590, the exercise device 100 may not lift off the ground. The handlebars 590 may be use for different work outs. For example, when a person is performing a chest workout, the person may lie flat on the ground with the back of the head on the headrest 150. The person may then place each hand on one each of the handlebars 590. The person may bend the elbows slightly, lift up the exercise device off the ground, and slowly bring the exercise device 100 back down. By repeating this up and down motion with the exercise device 100, the person may work out the muscles in the arms and chest areas.

Another technical advantage of the handlebars 590 is that when the exercise device is flipped upside down to perform pushup and/or dips, the person has the option of placing the hands on the handlebars 590. One of the benefits of placing the hands on the handlebars versus the device's frame is that the person is able to turn the wrist up and down, as the person is performing push-ups. By turning the wrist up and down, the person is able to contract the muscles in the forearms, which results in strengthening the forearms. The handlebars 590, in some embodiments, may be attachable and detachable and may be made of material such as, for example, and without limitations, steel or other types of metal, plastic, etc.

As described below with reference to FIG. 37, the headrest 150, in some embodiments, may be an ergonomic contouring headrest that may move with the motion of the device. In addition to, or in lieu of the headrest being an ergonomic contouring headrest, the memory foam pillow 505 of FIG. 5 may be attached to the existing headrest 150. FIG. 5 shows the bottom plan view of the memory foam pillow 505. As shown, the memory foam pillow 505 may include the snap on buttons 510 that may snap into the snap buttons 515, which may be located on top or underneath the headrest 150 or on the bottom frame section 101. As described below, the memory foam pillow 505 may be detached from the headrest 150 and may be used with a resistant band without the exercise device 100.

The exercise device 100 may include foam paddings 531 for hand grip support. The foam paddings 531 may cover a portion of the top frame section 102. Alternatively, the foam paddings 531 may cover a portion of the middle frame section 103. The exercise device 100 may include foam paddings 536 for ground support when the device is in rocking motion. The foam paddings 536 may be used for hand grip support when the device is turned upside down. The foam paddings 536 may cover a portion of the middle frame section 102. The exercise device 100 may include foam paddings 534 for hand support when the exercise device 100 is turned upside down.

The exercise device 100 may include foam padding peg frames 533 located on the bottom frame section 101 (close to the middle frame section 103) for gripping the surface where the exercise device is located (e.g., the ground, floor, etc.) to provide stability when the exercise device 100 is in rocking motion. Once the exercise device 100 is turned upside down for pushups and dip, the foam paddings 533 may be used for grip support on the surface where the exercise device is located. The foam padding peg frames 533 may be attachable and detachable and may be made of material such as, for example, and without limitations, steel or other types of metal, plastic, rubber, etc.

The end of foam padding peg frames 533 may have a spring clamp, a hook-and-loop fastener strap, or a similar mechanism that may allow a person to attach the foam padding peg frames 533 to the bottom frame section 101. The hook-and-loop fasteners include two components which may be attached to the opposing surfaces to be fastened. The first component includes tiny hooks and the second component includes small loops. When the two components are pressed together, the hooks may catch in the loops and the two pieces fasten or bind temporarily. An example of the hook-and-loop fasteners is the hook-and-loop fasteners provided by Velcro company. Instead of a spring clamp mechanism, the end of the foam padding peg frames 533 may include a push in button mechanism to allow a person to latch the pegs onto the bottom frame. In the embodiments that the foam padding peg frames 533 include push in button mechanism, the bottom frame section 101 may have holes (or openings) to which the button may latch in.

The exercise device 100 may include the attachable and detachable foam padding peg frames 532 located on both sides of the top frame section 102. The foam padding peg frames 532 may be used for hanging towels or clothing items and/or may be used to provide stability when the exercise device is used in an upside down position (e.g., as described below with reference to FIGS. 6 and 8).

The end of the foam padding peg frames 532 may have a spring clamp, a hook-and-loop fastener strap, or a similar mechanism that may allow attaching the foam padding peg frames 532 to the top frame section 102. The foam padding peg frames 532 may be made of material such as, for example, and without limitations, steel or other types of metal, plastic, rubber, etc.

Instead of a spring clamp mechanism, the end of the foam padding peg frames 532 may include a push in button mechanism to allow latching the pegs onto the top frame 102. If the foam padding peg frames 532 include push in button mechanism, then the top frame section 102 may have holes (or openings) to which the button may latch in.

The exercise device 100, in some embodiments, may be foldable. The middle frame section 103 may include a push in button mechanism and/or a pull down lever mechanism that may allow a person to fold the exercise device from the middle, making it convenient to store away the device.

Figure 6:
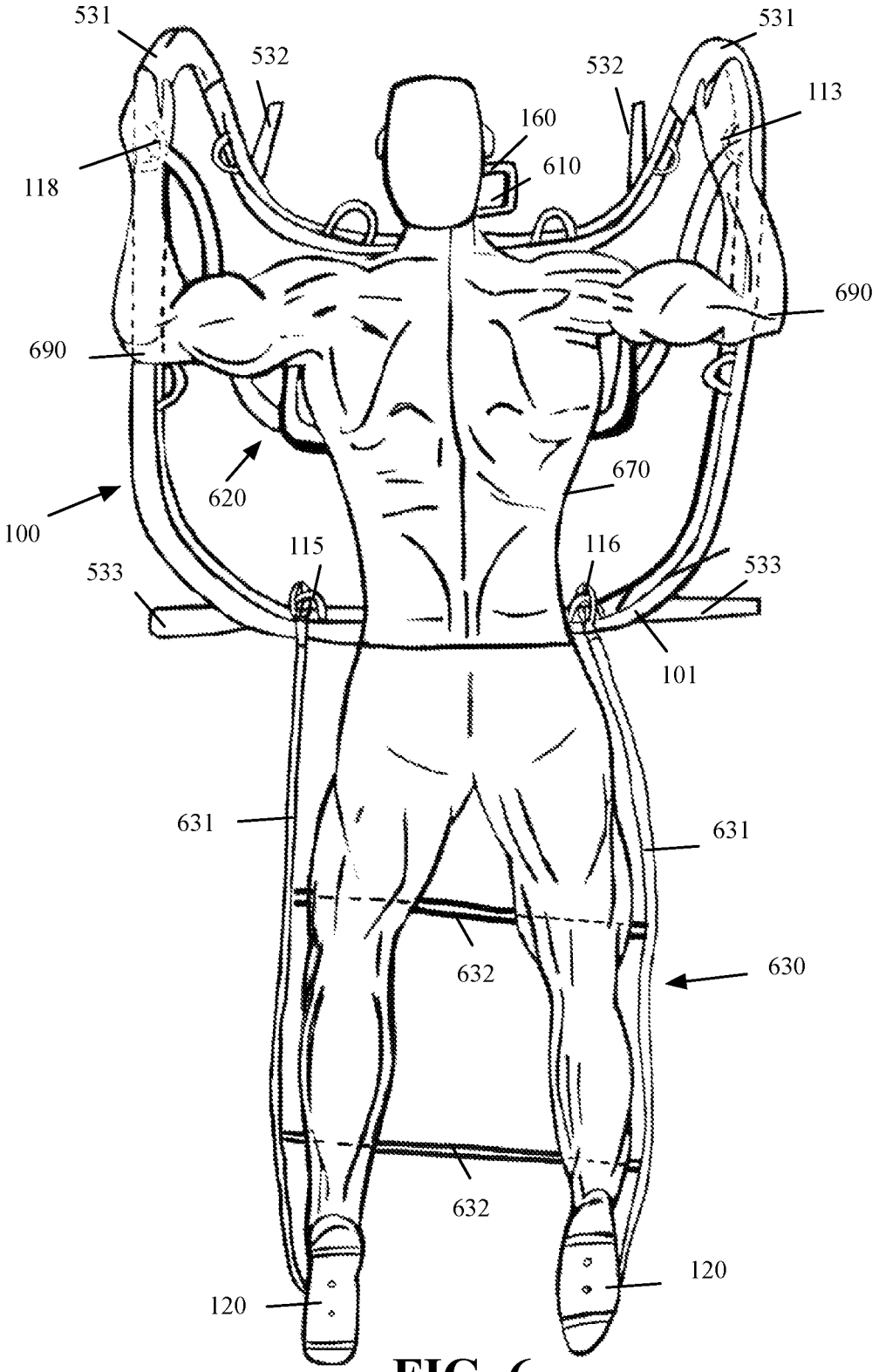
FIG. 6 is a functional diagram showing an example use of the full body exercise device in an upside down position, according to various aspects of the present disclosure.

FIG. 6 is a functional diagram showing an example use of the full body exercise device 100 in an upside down position, according to various aspects of the present disclosure. With reference to FIG. 6, the person 670 may be able to watch a workout program with a phone 610 placed on the phone holder 160 (e.g., while performing an exercise such as pushups). For example, the person may download a workout application on the phone 610. The workout application may be programmed to use a motion sensor in the phone 610 (e.g., an accelerometer, a gyroscope, etc.) to sync with, and recognize, the movements of the exercise device and the person's body while the device is being used. The person may select which exercise to perform and watch a digital coach guiding the person through the selected exercise. The workout application may be configured to guide the person step by step through different exercise programs such as, for example, and without limitations, strength conditioning, covering the upper and lower body, different yoga stretches, and/or Pilate movements. The workout application, in some embodiments, may track statistics such as, for example, and without limitations, the person's heartrate, the calories burnt, the duration of exercise performed, etc.

Figure 7A:
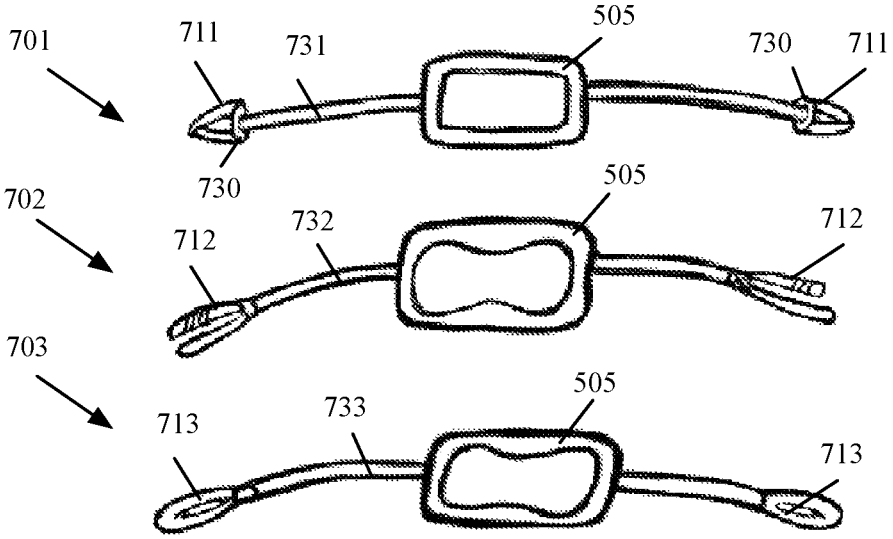
FIG. 7A shows the top perspective views of several memory foam pillow elastic bands that may be used for pushups and dips, according to various aspects of the present disclosure.
Figure 7B:
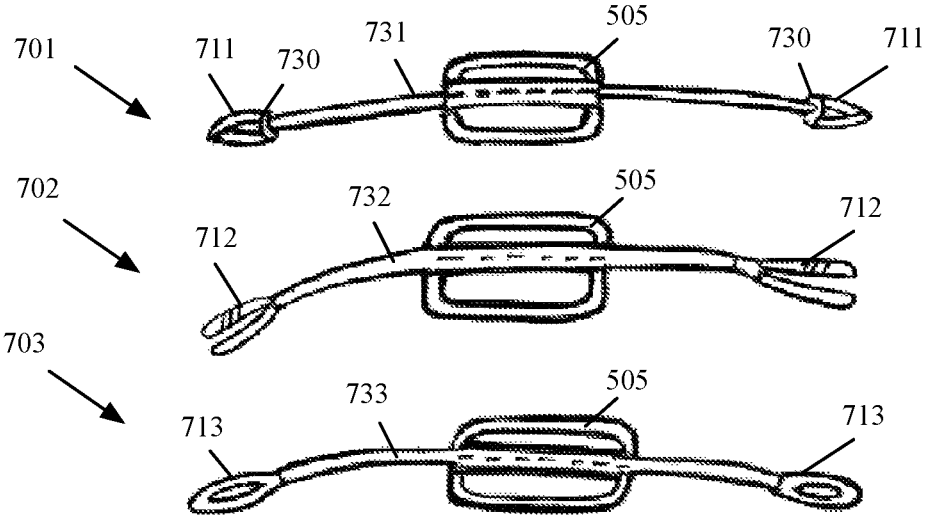
FIG. 7B shows the bottom perspective views of the memory foam pillow elastic bands of FIG. 7A, according to various aspects of the present disclosure.

In order to perform pushups on the exercise device 100, the person may place the hands on the foam padding 531 for grip support. The person may connect a memory foam pillow elastic band 620 to the connectors 113 and 118. FIG. 7A shows the top perspective views of several memory foam pillow elastic bands 701-703 that may be used for pushups and dips, according to various aspects of the present disclosure. FIG. 7B shows the bottom perspective views of the memory foam pillow elastic bands 701-703 of FIG. 7A, according to various aspects of the present disclosure.

With reference to FIGS. 7A-7B, the memory foam pillow 505 may be similar to the memory foam pillow 505 of FIG. 5. The elastic bands 731-733 may be tubular or non-tubular elastic bands. At the two ends of each memory foam pillow elastic band 701-703, there may be different types of endings 711-713. The endings 711-713 act as a latching mechanism, which may be attached to the connectors (such as the connectors 110-119 of FIGS. 1A-1C and 4-5 or the connectors 171-180 of FIG. 1D) on the exercise device 100. For example, the endings 711 may include elastic and/or non-elastic webbing loops with a grommet/eyelet 730.

The endings 712 may include two webbing buckle straps at each end (e.g., and without limitations, the endings may be made of elastic or non-elastic hook-and-loop fasteners strap). The endings 713 may include elastic or non-elastic webbing loops without a grommet/eyelet. For example, the endings 713 may be made with elastic loops designed with the elastic band itself, by making a loop at the ends and securing the loop by wrapping a tape around the loop that was created.

The webbing loop may be connected to the elastic band by grommet/eyelet. The webbing loop may also be connected to the elastic band by wrapping the webbing loop with strong tape, rubber, and/or sewing onto the elastic band. The loops may also be made from metal, plastic snap hooks, and/or D rings/buggee shock cords, which are attached by wrapping a strong tape and rubber, and/or sewing into the end of the elastic or non-elastic webbing loop. The ends of the elastic bands that is made with elastic loops may be made from the elastic band itself. If the loops were made by the elastic band itself, the loops would be made, by making a loop at the ends and securing the loop by wrapping the tape around the loop that was created.

The memory foam pillow elastic band 701-703 may be connected to any two connectors (such as, for example, and without limitations, poles/railing/bars). The memory foam pillow and the elastic band, in some embodiments, may be covered with wicking fabric. FIG. 7B shows how the memory foam pillow 505 may be attached to the tubular and/or non-tubular elastic bands 731-733. The memory foam pillow 505 may be attachable and detachable as described further below.

With reference to FIG. 6, the memory foam pillow elastic band 620 may be any of the memory foam pillow elastic bands 701-703 of FIGS. 7A-7B. The person 670 may have the memory foam pillow push elastic band 620 positioned, hanging in front of the chest. The person may be able to perform pushups, by bending in the elbows 690 and going forward with the chest towards the ground and applying pressure towards the memory foam pillow elastic band 620. The person may continue to have the elbows 690 bent, lowing the body closer to the ground.

The resistance of the memory foam pillow elastic band 620 connected to both side of the exercise device 100 may assist the person 670 in being pushed back up. Repeating this up and down motion using the memory foam pillow elastic band 620 may make performing the pushups much easier that doing the pushups without the band 620. The memory foam pillow resistance band 620 may give support towards the person's chest area while applying pressure.

Figure 7C:
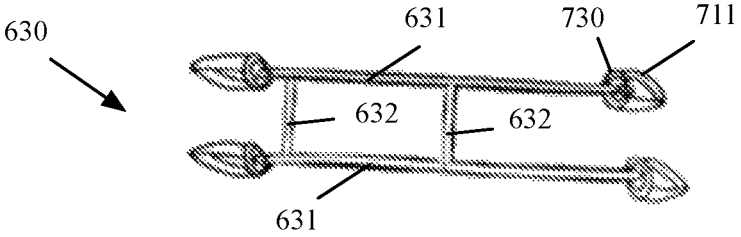
FIG. 7C shows the top perspective view of a custom resistant band, according to various aspects of the present disclosure.

With reference to FIG. 6, a custom resistance band 630 that includes two pairs of resistant bands 631-632 may be used. One pair of resistant bands 631 may be connected to the connectors 115 and 116 on the lower frame section 101. The resistant band 631 are further connected to person's foot braces 120. FIG. 7C shows the top perspective view of a custom resistant band 630, according to various aspects of the present disclosure. As shown, the resistant band 630 may include a pair of elastic tubular and/or non-tubular elastic bands 631 that are attached to each of another pair of elastic bands 632 that may also be tubular and/or non-tubular. Although the four endings of the resistant band 630 are shown with webbing loops 711 and grommet/eyelet 730, the endings may include webbing buckle straps at each end (similar to the ending 712 of FIGS. 7A-7B) or may include elastic and/or non-elastic webbing loops without a grommet/eyelet (similar to the ending 713 of FIGS. 7A-7B).

With further reference to FIG. 6, the person 670 may use the custom resistant band 630 to perform back leg lifts, by bending the knee, lifting each leg one at a time, and extending the leg outward and back in, towards the waist line. Repeating the back and forth motion of legs may strengthen the glutes and legs of the person 670. The pair of elastic tubular and/or non tubular elastic bands 632 adds resistance to the resistant band 631, for example, when performing an exercise called leg side kick. The person 670 may be in the same position as in FIG. 6, and may move each leg side to side, one leg at a time. When repeating the sidekicks with the legs, the pair of elastic bands 632 may contract the muscles in the person's 670 glute and leg areas.

With reference to FIG. 6, the custom resistant band 630 may be similar to the custom resistant band 630 of FIG. 7C with any of the endings 711-713 of FIGS. 7A-7B. The purpose and benefit of the pair of bands 632 of FIG. 7 being attach to the pair of bands 631 is to allow the person to feel the contraction of the band by moving the legs side to side. By moving the legs side to side, one at a time, the person may contract the muscles in the glutes and at the same time stretching out the hips. This is achieved by having the custom resistant band 630 to be horizontally and vertically designed as shown in FIG. 7C.

By attaching the elastic bands 631 to the front of the feet, the person may be able to perform a glute and leg exercise. While performing push-ups, in between each transition of coming back up, the person may lift one foot off the ground, pushing out the legs, while having the knees slightly bent. The person's heels may be going backwards, up towards the ceiling. Repeating this movement may strengthen the muscles in the glute and leg areas.

Figure 8:
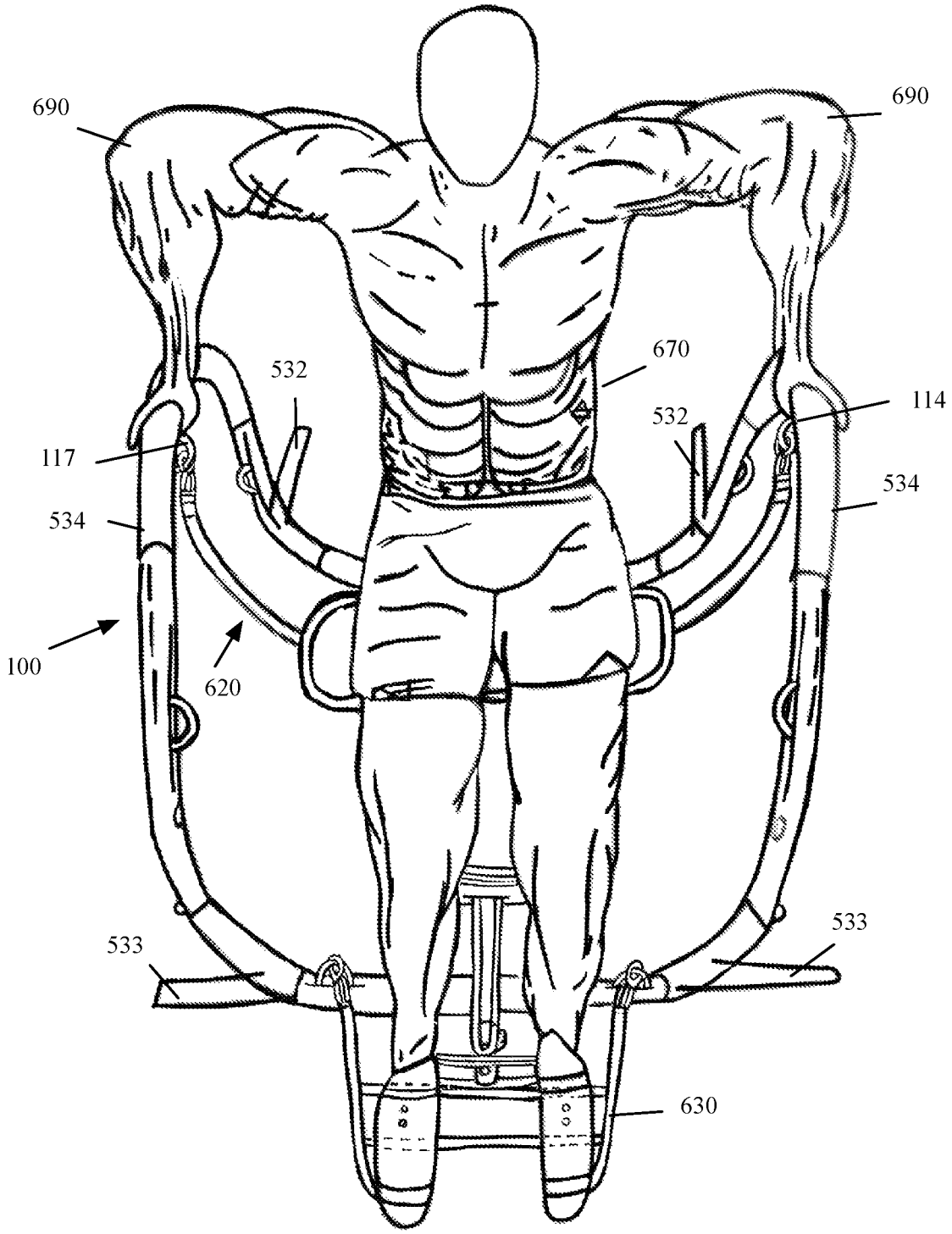
FIG. 8 is a functional diagram showing an example use of the full body exercise device in an upside down position with the user in the opposite position of FIG. 6, according to various aspects of the present disclosure.

FIG. 8 is a functional diagram showing an example use of the full body exercise device 100 in an upside down position with the user in the opposite position of FIG. 6, according to various aspects of the present disclosure. With reference to FIG. 8, the person 670 may turn to the opposite position of FIG. 6, facing frontwards with the glute area facing the ground, while having the hands on the two curve padding 534 of the exercise device 100.

In order for the person 670 to perform dips, the person may bend in the elbows 690, applying downward pressure. With the glutes on the memory foam pillow of the memory foam pillow elastic band 620 and while having the elbows 690 bent and applying downward pressure, the person may be able to receive assistance from the memory foam pillow elastic band 620. The contraction of the memory foam pillow elastic band 620 may help in assisting the person to bounce back up. By repeating this motion, the person may perform dips without straining the arms, thereby allowing the person to work out the triceps, shoulders, chest and abdominal areas. FIGS. 6 and 8 also illustrate how the detachable foam padding pegs 532-533 may provide support for stability by preventing the exercise device 100 from tipping over due to the curved design of the device 100.

Figure 9:
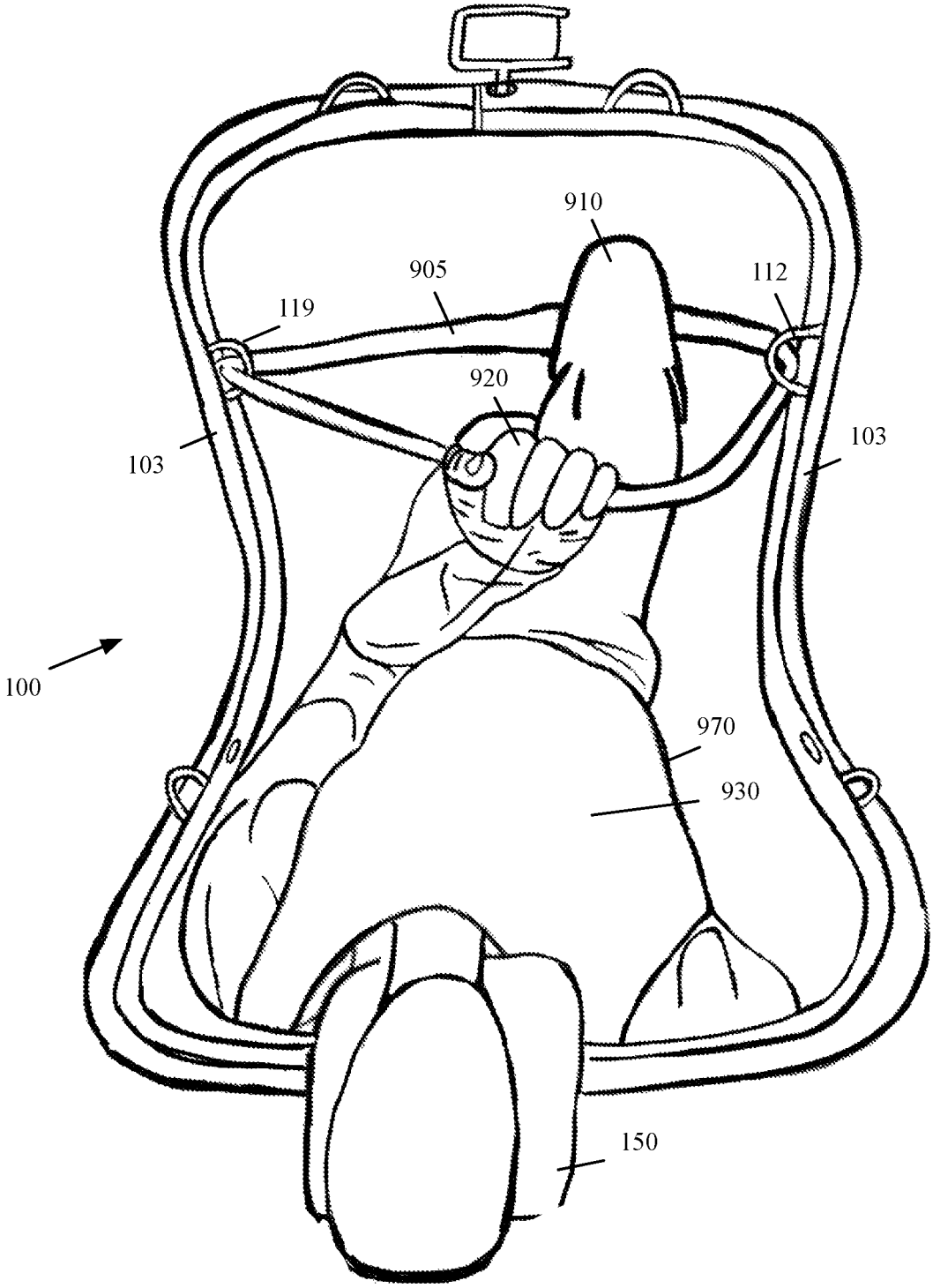
FIG. 9 is a functional diagram showing an example use of the full body exercise device to perform a bicep and abdominal exercise, according to various aspects of the present disclosure.

FIG. 9 is a functional diagram showing an example use of the full body exercise device 100 to perform a bicep and abdominal exercise, according to various aspects of the present disclosure. With reference to FIG. 9, the connectors 119 and 112 on the middle frame section 103 are used to connect an elastic band and/or an elastic loop band 905 to the exercise device 100. As shown, a person 970 may place a knee 910 through the elastic loop band 905, putting forward pressure on the band 905, and applying continuous forward bouncing pressure with the knee 910. This movement may create a rocking motion to the device 100 and may work out the abs and glutes muscles. Simultaneously, the person 970 may be pulling the band 905 by a hand 920 towards the chest 930 and then back away from the chest 930, releasing tension off of the elastic band 905. By repeating this motion back and forth with the hands and knees (e.g., by switching to the other hand and the other knee), the person may create a rocking motion to the device 100 and be able to strengthen the biceps, abs, and glutes muscles at the same time.

In FIG. 9, the person 970 is directly placing the elastic loop band 905 onto the connectors 119 and 112. The elastic loop band 905 and the elastic loop bands that are attached to the exercise devices of different embodiments may be any type of elastic resistant band such as therapy bands, which may have a flat surface rather than a tubular structure; compact resistance bands/tubular bands, which are the elastic bands with the two plastic handles at the end; or fit loop bands/mini bands, which are similar to the therapy bands. The fit loop band has flat surface, rather than a tubular structure and is a continuous loop. The elastic loop bands that are attached to the exercise devices of different embodiments may also be ring resistance bands, which include a small, single ring with two handles attached to either side. These handles are soft, rather than hard, plastic. The elastic loop bands may also be lateral resistance bands, which include hook-and-loop fasteners cuffs, instead of plastic handles, on each end of the bands. The cuffs are typically wrapped around the ankle. The elastic loop bands may also be pull up bands, which include one continuous loop. All bands may be made in different color and sizes, each color symbolizing the weight (or resistance) level of the band.

Figure 10:
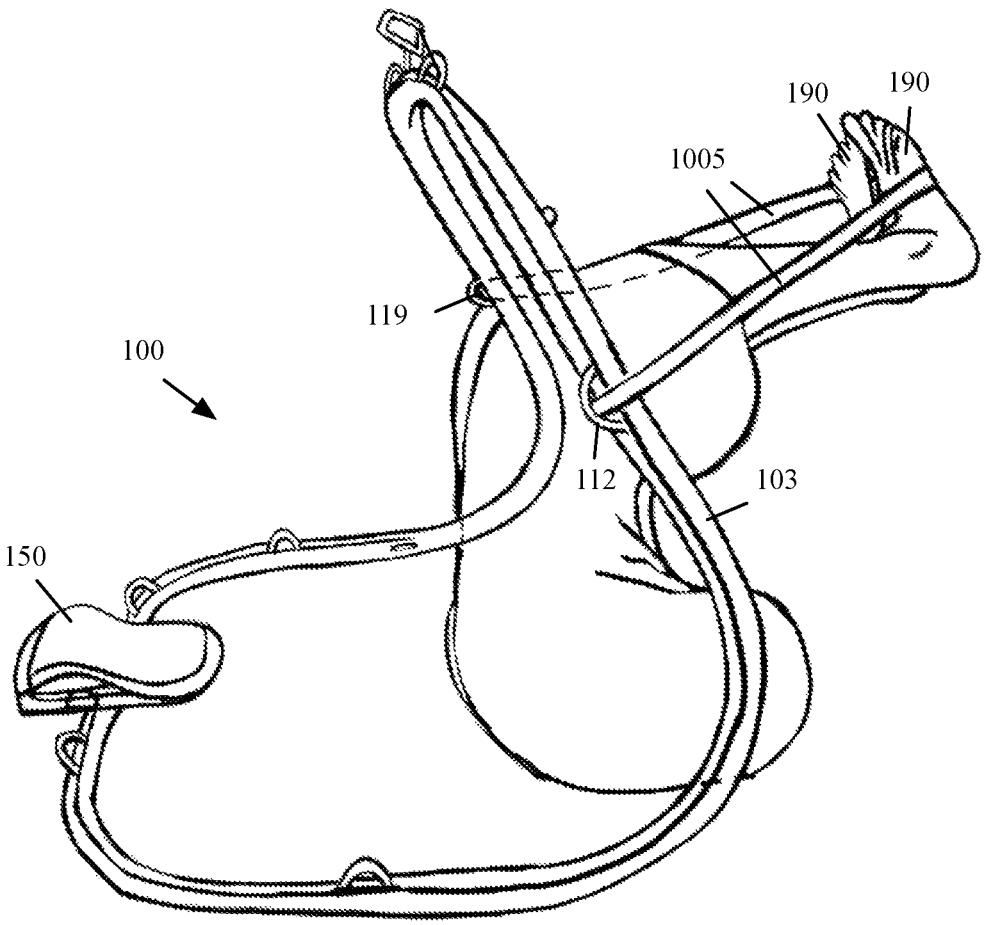
FIG. 10 is a functional diagram showing an example use of the full body exercise device to perform a leg push out exercise, according to various aspects of the present disclosure.

FIG. 10 is a functional diagram showing an example use of the full body exercise device 100 to perform a leg push out exercise, according to various aspects of the present disclosure. With reference to FIG. 10, the user (only a portion of the user's body is shown) may connect an elastic band 1005 to the connectors 119 and 112, which are located on the middle frame section 103.

The user may apply forward pressure on the elastic band 1005 with both feet 190. In this exercise, the user may work out the thighs, gluts, hips, and calf muscles. At the same time, the user may be working out the abs by doing knee crunches. This exercise also creates the rocking (or teeter-totter) effect on the exercise device 100. Similar to the exercise described above with reference to FIG. 2, when the person applies downward pressure on the elastic band 1005, the headrest 150 may lift off its resting position on the ground. When the person removes the downward pressure on the elastic band, the headrest 150 may go back to its resting position. The difference types of elastic band(s) that were described above with reference to FIG. 9 may be used in this exercise. The elastic band and/or elastic loop band may be designed with wicking fabric. The elastic bands may be tubular or non-tubular elastic bands.

Figure 11:
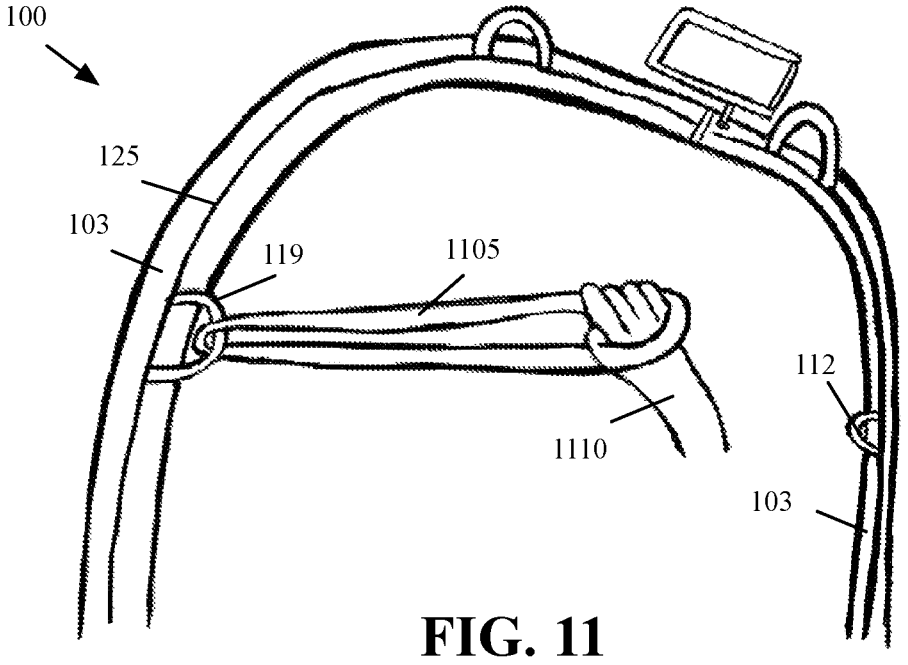
FIG. 11 a functional diagram showing an example use of the full body exercise device to perform a one arm exercise using an elastic band, according to various aspects of the present disclosure.

FIG. 11 a functional diagram showing an example use of the full body exercise device 100 to perform a one arm exercise using an elastic band, according to various aspects of the present disclosure. With reference to FIG. 11, the person may lay flat on the back with the head on the headrest 150 (FIG. 5). The person may attach a tubular and/or non-tubular elastic band and/or an elastic loop band 1105 to the connector 119 located on the middle frame section 103. As described above, the location of the connector 119 may be adjusted using the railings 125.

The person may then grab the end of the elastic loop band 1105 by a hand 1110 and perform a one arm exercise. This exercise may allow the person to work out the muscles in the arms, shoulders, and chest areas. If the person wants to work out the right arm (as shown in FIG. 11), person may extend the right arm to the left side of exercise device where the band is located, extend the band outwards, and allow the band to slowly contract back. By repeating this motion back and forth, the contraction of the band 1105 may strengthen the muscles in the arm, shoulders, and chest areas.

If the person wants to work out the left arm, the person may place the elastic loop band 1105 on the connector 112 on the right side (in the pictured orientation) of the middle frame section 103. The person may also workout both arms at the same time by connecting one elastic band or elastic loop band to the connector 112 and another elastic band or elastic loop band to the connector 119 and crossing the bands across the chest area. Pulling the bands with both bands creates an X figure motion.

Figure 12:
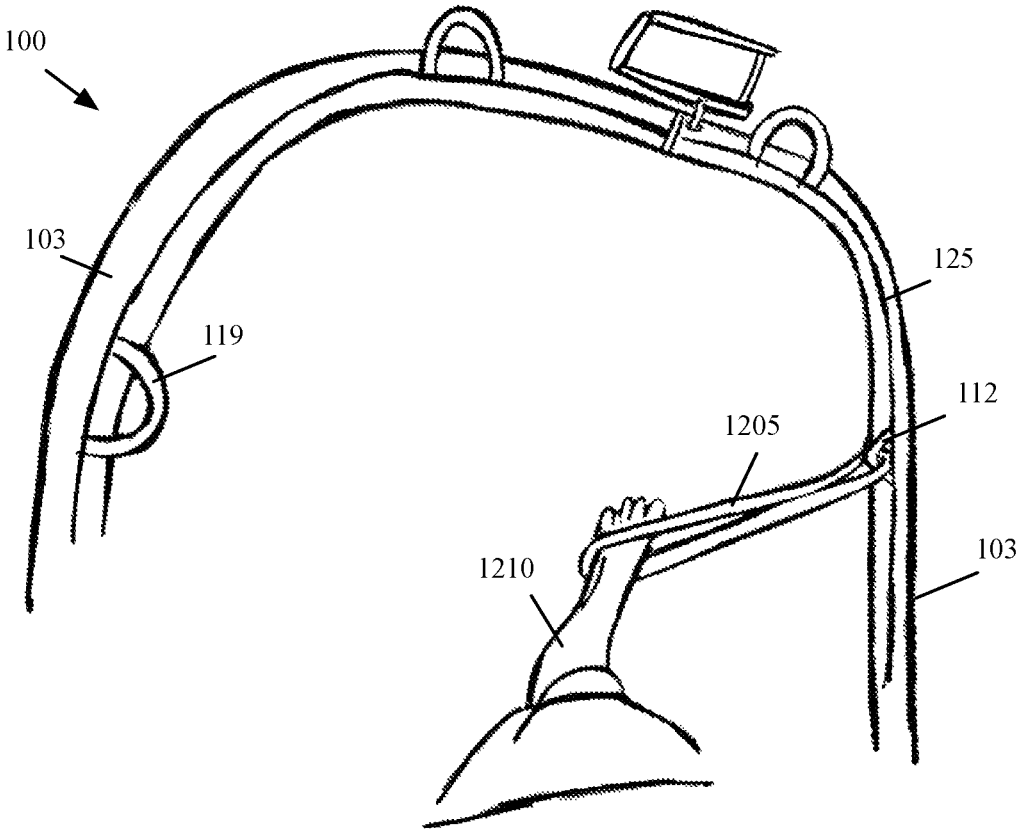
FIG. 12 a functional diagram showing an example use of the full body exercise device to perform a one leg side stretch exercise using an elastic band, according to various aspects of the present disclosure.

FIG. 12 a functional diagram showing an example use of the full body exercise device 100 to perform a one leg side stretch exercise using an elastic band, according to various aspects of the present disclosure. With reference to FIG. 12, a tubular and/or non-tubular elastic band and/or an elastic band 1205 may be connected to the one side of the full body exercise device 100 by the connectors 112 or 119, which are located on the middle frame section 103. As described above, the location of the connector 112 and/or 119 may be adjusted using the railings 125.

The one leg side stretch exercise may allow a person to work out the hips, inner and out thighs, gluts, and the abs muscles at the same time. The person may have the head on headrest 150 (FIG. 5) with the back flat on the ground. The person may then place the left foot 1210 in the loop of the elastic loop band 1205 that is attached to the connector 112. The person may then move the legs side to side in motion, going out sideways and coming back in, which may contract the leg muscles and may create a rocking motion with the full body exercise device 100.

The contraction of the elastic loop band 1205 may build strength in the leg muscles. If the person is working out the right leg, the person may place the elastic loop band 1205 around the connector 119 on the left side of the middle frame section. If the person wants to work out the left leg, the person may place the elastic band 1205 on the connector 112 on the right side (in the pictured orientation) of the middle frame section 103, as shown in FIG. 12.

Figure 14:
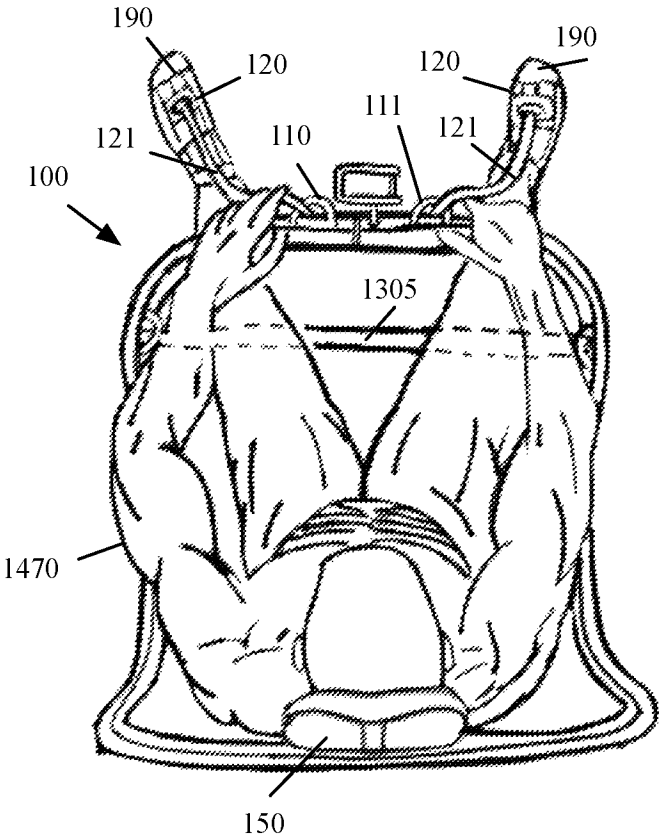
FIGS. 13-14 are functional diagrams showing an example use of the full body exercise device to perform a sit up exercise using two elastic bands, according to various aspects of the present disclosure.
Figure 13:
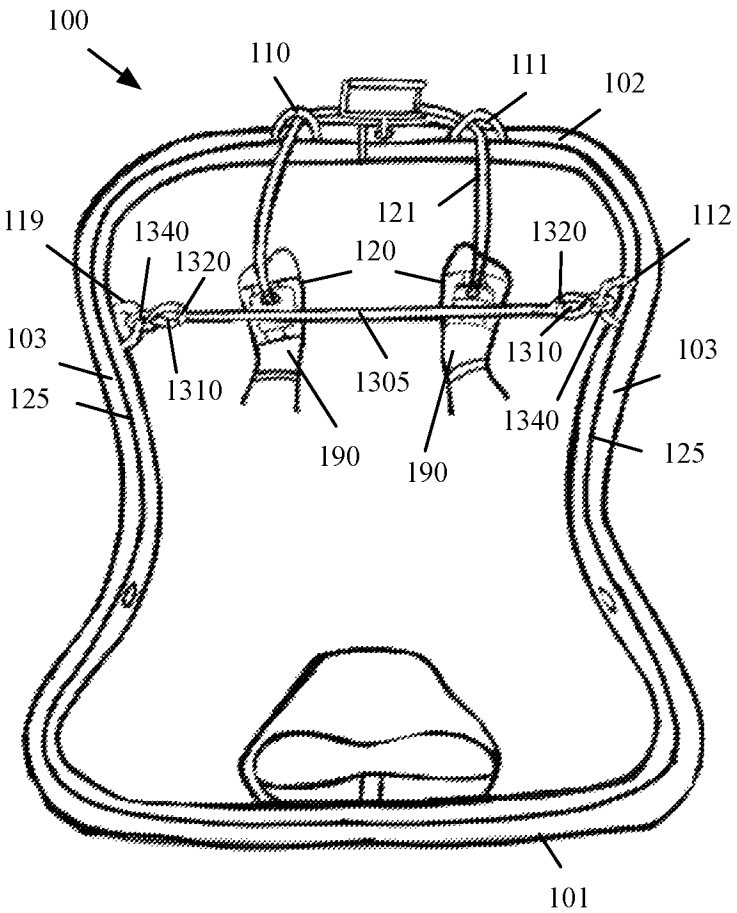

FIGS. 13-14 are functional diagrams showing an example use of the full body exercise device 100 to perform a sit up exercise using two elastic bands, according to various aspects of the present disclosure. With reference to FIGS. 13-14, the person 1470 working out on the full body exercise device 100 may connect an elastic band 1305 to the connectors 119 and 112, which are located on the middle frame section 103. As described above, the location of the connectors, in some embodiments, may be adjustable by moving the connectors across the railing 125 to adjust the location of the connector to match the type of exercise and/or the size of a person's body.

The elastic band 1305 may be a straight elastic band (as depicted in FIGS. 13-14) or may be an elastic loop band (such as the loop band 905 of FIG. 9). In the example of FIGS. 13-14, the elastic band 1305 may include the elastic and/or non-elastic webbing loop straps 1310 at the ends. The elastic band 1305 may be similar to the elastic band 731 of FIGS. 7A-7B.

With reference to FIGS. 13-14, the elastic band 1305 may include two elastic and/or non elastic webbing loop straps 1310, one on each side of the elastic band 1305. The two elastic and/or non elastic webbing loops 1310 may be connected to the elastic band 1305 by the grommets/eyelets 1320. The ends of the elastic band that are the two elastic and/or non elastic webbing loops 1310, in some embodiments, may include the connectors 1340 such as, for example, and without limitations, snap hooks, buggee shock cords, and/or elastic loops. The "snap hook/buggee shock cord" may also be made from metal and/or plastic. The ends 1310 of the elastic band 1305 may also include D rings that are sewn into the webbing loop. If the ends are made with D rings, then the person may have to attach a snap hook to the D rings, in order for the ends of the elastic band to attach to the connectors of the exercise device 100.

Instead of the grommets/eyelets 1320, the elastic and/or non elastic webbing loops 1310 may be connected to the elastic band 1305 by wrapping the webbing loops 1310 with tape, rubber with tape, and/or rubber sewed onto the elastic band. The loops, in some embodiments, may be designed from the elastic band itself. For example, a loop may be made at each end of the elastic band and secured by wrapping a tape around the loop and/or by using a lock cord mechanism. The webbing loops 1310 may also have wicking fabric (not shown) to protect the person's skin and bones against hard edges of the webbing, to provide protection from the snap hooks metal, to protect the person's skin from the hard edges of the grommet, and/or to prevent the rubber from pulling against the person's skin while working out.

As shown in FIGS. 13-14, another elastic band 121 may be connected to the connectors 110 and 111 on the top frame section 102. Each end of the elastic band 121 may be connected to a foot brace 120. Alternatively, two elastic bands of substantially the same size may be used instead of the one elastic band 121. One end of the first elastic band may be connected to the connector 110 and one end of the second elastic band may be connected to the connector 111. The other end of each elastic band may be connected to a foot brace 120.

With further reference to FIGS. 13-14, the person 1470 may lay flat down with the back on the floor and the head on headrest 150. As shown in FIG. 14, the person may place both legs over the elastic band 1305. In the embodiments that the elastic band is a loop band, the person may slide both legs through the loop of the elastic band 1305. The person may then place the feet into the foot braces 120.

By adding the elastic band 1305 to the exercise device, the person may be able to work out the muscles in the hips, thighs, glutes, and adnominal areas at the same time. While the device is rocking back and forth by the pressure applied by the feet 190 to the elastic band(s) 121, the person may apply downward pressure on the elastic band 1305, which may contract the abdominal and leg muscles simultaneously. During this workout, the person may open and close the legs, contracting the muscles in the hips. thighs, and glute areas. At the same time, the exercise device may be rocking back and forth and contracting the abdominal muscles. This full body workout is possible because of the elastic band 1305 that is placed under the thigh area (or around the thigh area in the embodiments that the elastic band is an elastic loop band), as well as the elastic band 121 that is attached to the feet 120. This exercise is sometime referred to as a straddle V sit up.

Figure 16:
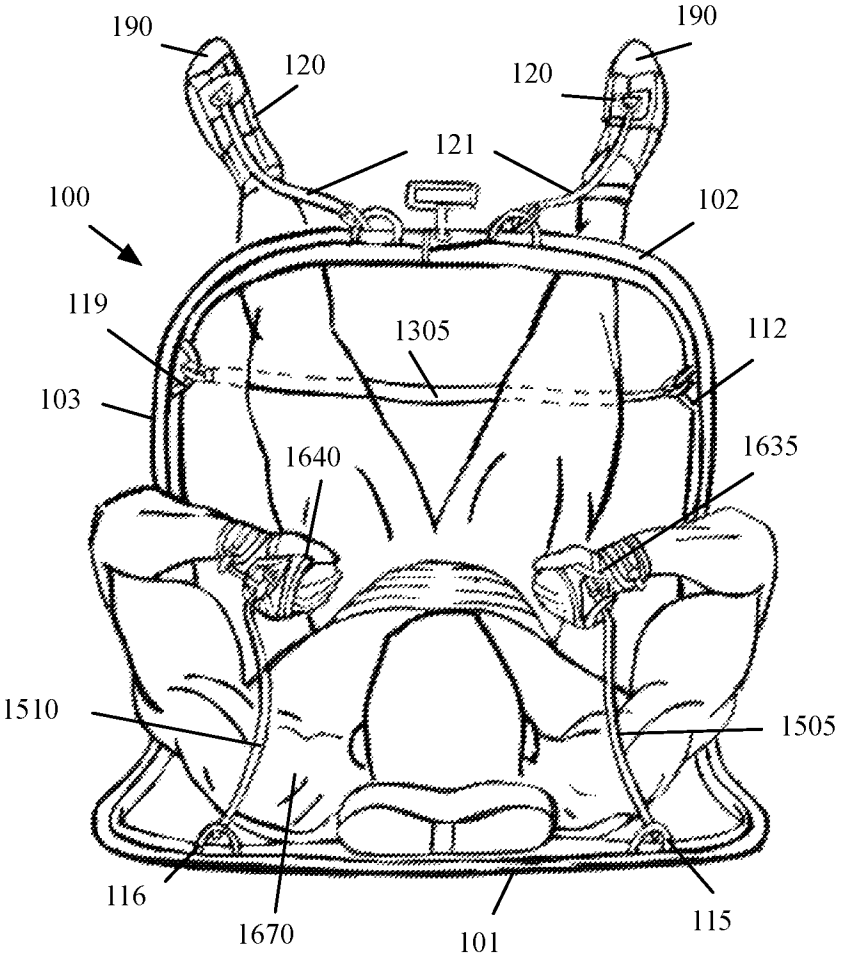
FIGS. 15-16 are functional diagrams showing an example use of the full body exercise device to perform a lying pull over and sit up exercise using more than two elastic bands, according to various aspects of the present disclosure.
Figure 15:
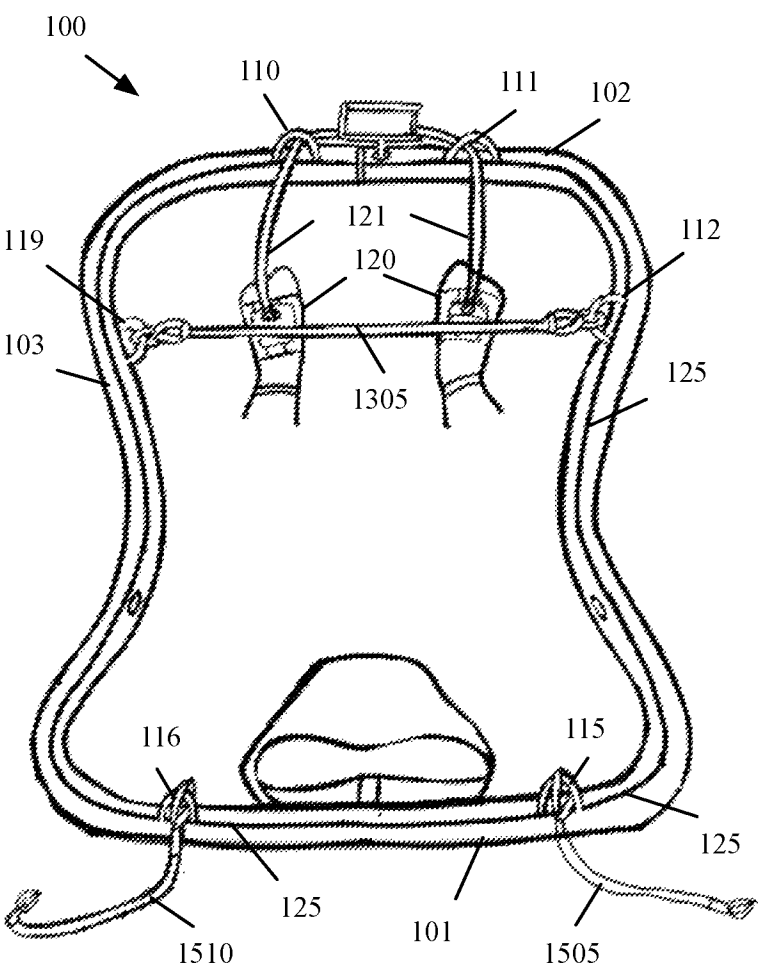

FIGS. 15-16 are functional diagrams showing an example use of the full body exercise device 100 to perform a lying pull over and sit up exercise using more than two elastic bands, according to various aspects of the present disclosure. The elastic bands 1305 and 121 may be similar to the elastic bands 1305 and 121 described above with reference to FIGS. 13-14. With reference to FIGS. 15-16, in addition to the elastic bands 1305 and 121, the elastic band 1505 may be connected to connector 115 and the elastic band 1510 may be connected to the connector 116. The other end of the elastic bands 1505-1510 may be connected to a hand straps/braces 1635-1640, respectively. As described above, the location of the connectors, in some embodiments, may be adjustable by moving the connectors across the railing 125 to adjust the location of the connector to match the type of exercise and/or the size of a person's body.

The person 1670 may be able to create a rocking motion with the full body exercise device 100 by placing the foot 190 in the foot braces 120. As the person 1670 is rocking forward with the full body exercise device 100, the person may pull upwards on the elastic bands 1505 and 1510, performing an exercise similar to a lying pull over exercise. This exercise may allow the person to work out the muscles in the arms, shoulders, and chest areas, while working out the abs and legs simultaneously.

Figure 18:
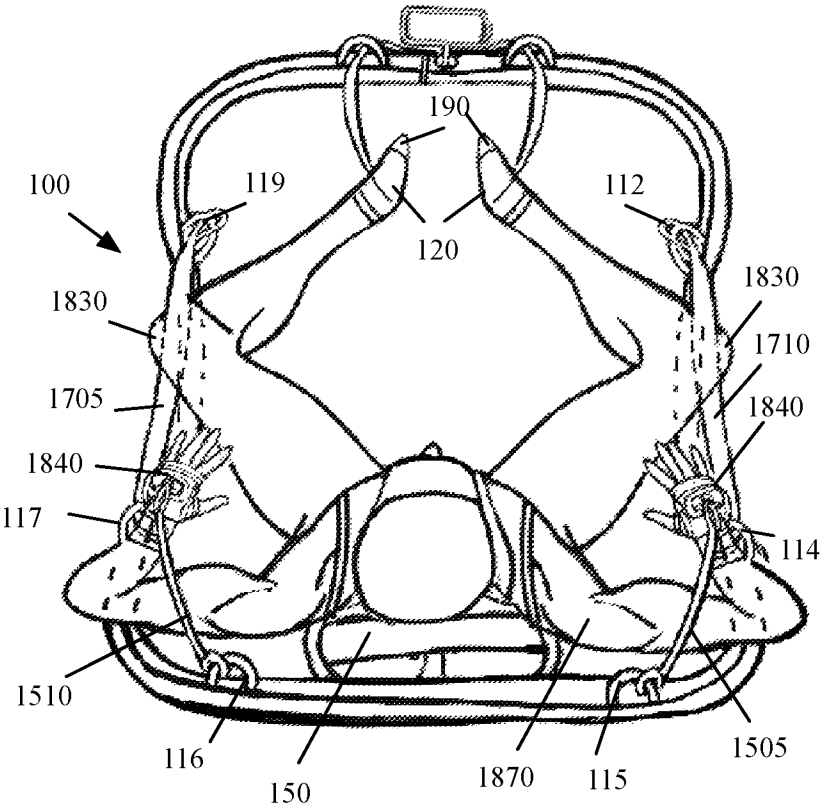
FIGS. 17-18 are functional diagrams showing an example use of the full body exercise device to perform a supine butterfly hip stretch and sit up exercise using more than two elastic bands, according to various aspects of the present disclosure.
Figure 17:
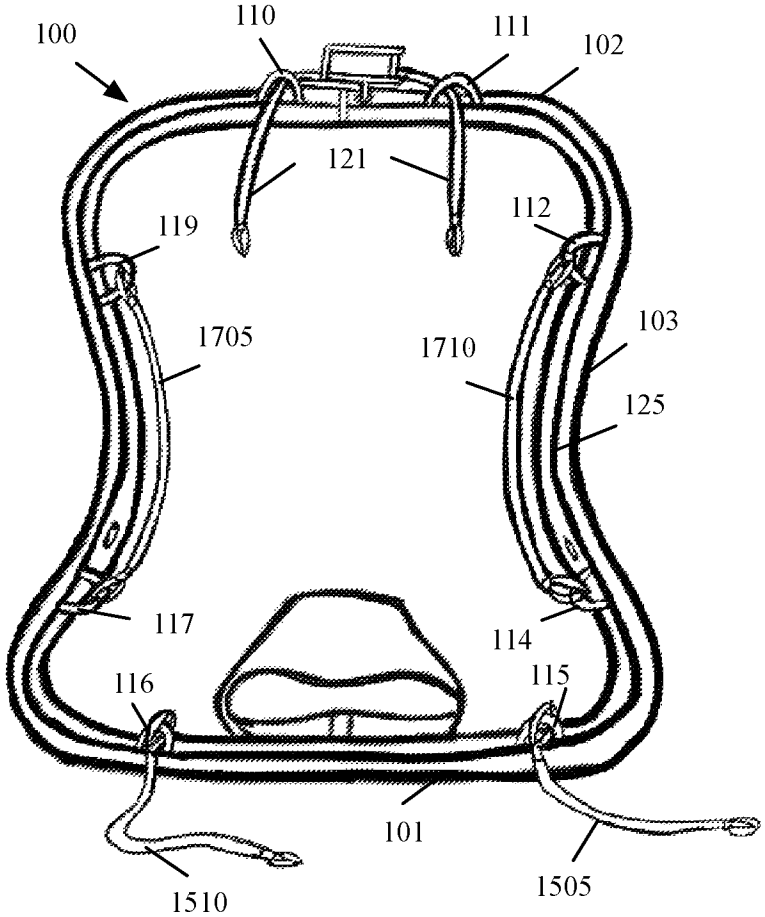

FIGS. 17-18 are functional diagrams showing an example use of the full body exercise device 100 to perform a supine butterfly hip stretch and sit up exercise using more than two elastic bands, according to various aspects of the present disclosure. With reference to FIGS. 17-18, the elastic bands 1505, 1510, and 121 may be similar to the elastic bands 1505, 1510, and 121 described above with reference to FIGS. 15-16. As shown in FIGS. 17-18, in addition to the elastic bands 1505, 1510, and 121, an elastic band 1705 may connected between the connectors 119 and 117 and an elastic band 1710 may be connected between the connectors 112 and 114. As described above, the location of the connectors, in some embodiments, may be adjustable by moving the connectors across the railing 125 to adjust the location of the connector to match the type of exercise and/or the size of a person's body.

The elastic bands 1705 and 1710 may be tubular and/or non-tubular loop covered with wicking fabric. The person 1870 may lay flat on the back with the head on the headrest 150. The person may first place the feet 190 into the foot braces 120. The person 1870 may then connect the gloves 1840 to the elastic bands 1505-1510. The person may then bend the knees 1830, bringing the heels of the feet as close as possible together. The person may then place each knee 1830 inside one of the elastic bands 1705-1710, if the elastic bands 1705-1710 are elastic loop bands. If the elastic bands 1705-2110 are not elastic loop bands, the person may place the knees on top of the elastic bands.

The person may then let the knees 1830 slowly fold outwards, keeping the sole of the feet 190 as close as possible together. This position of the legs, while lying on the back, is a yoga exercise where a person may stretch out the inner legs and loosen up the hip joints. Furthermore, by having the elastic band(s) 121 connected to the feet 190, and the elastic bands 1505-1510 connected to the hands, the person may be able to perform a lying down pullover and a butterfly crunch at the same time. Therefore, not only is the person able to stretch out the legs and hips, but the person is able to work out the abs and arms muscles at the same time.

Figure 19:
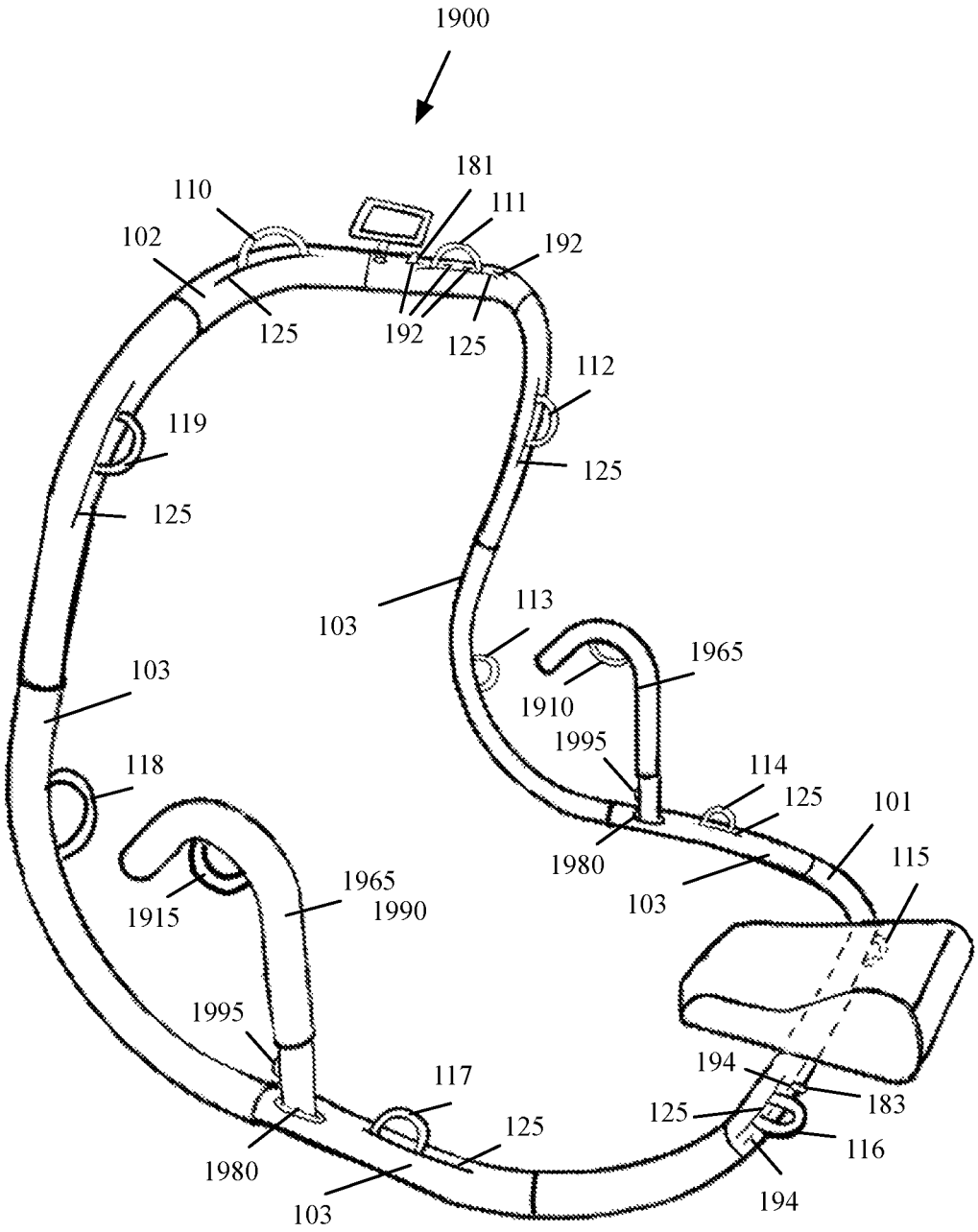
FIGS. 19-21 are perspective views of three examples of full body exercise devices with connectors for connecting one or more elastic bands to provide a rocking effect, according to various aspects of the present disclosure.
Figure 20:
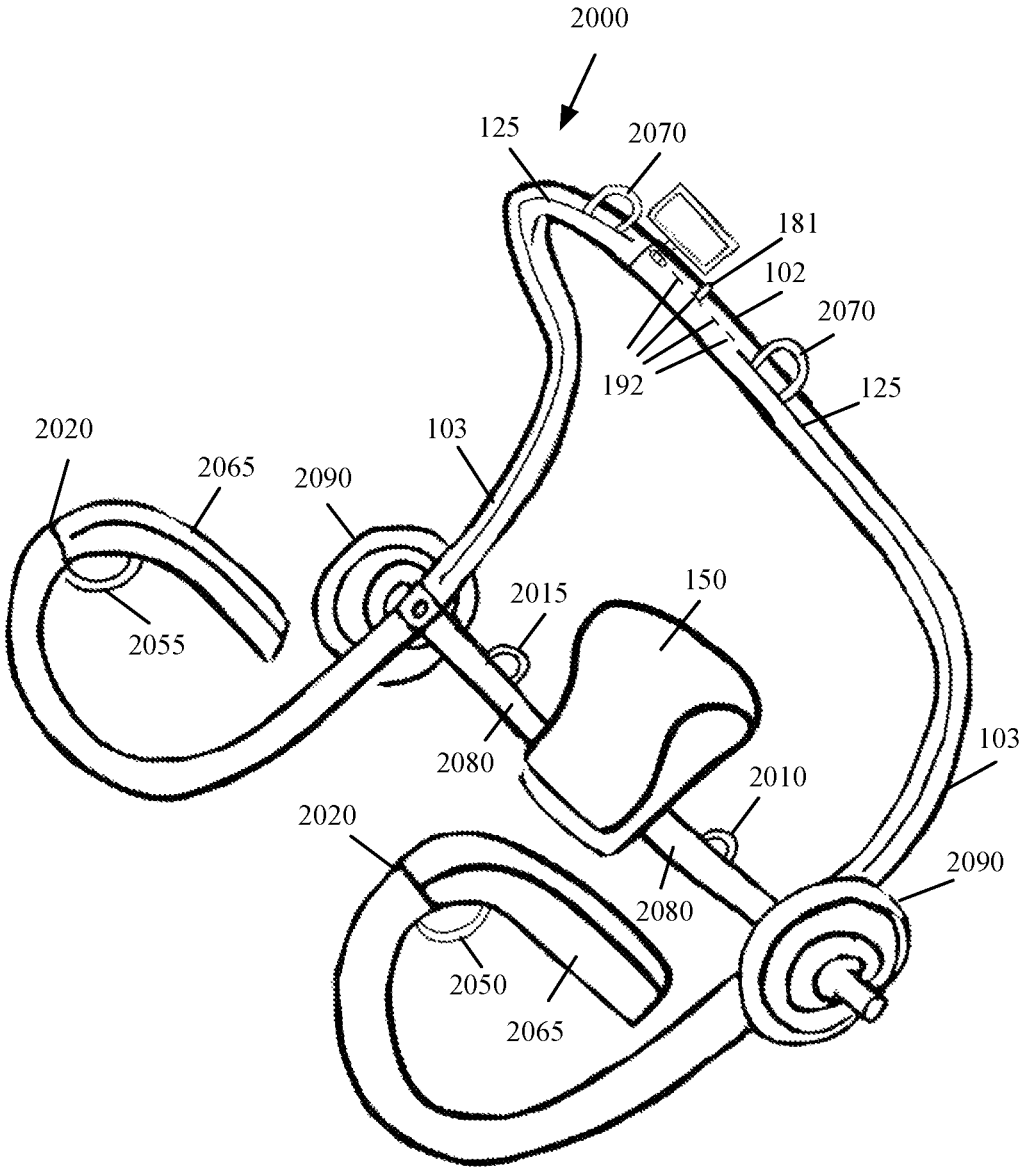
Figure 21:
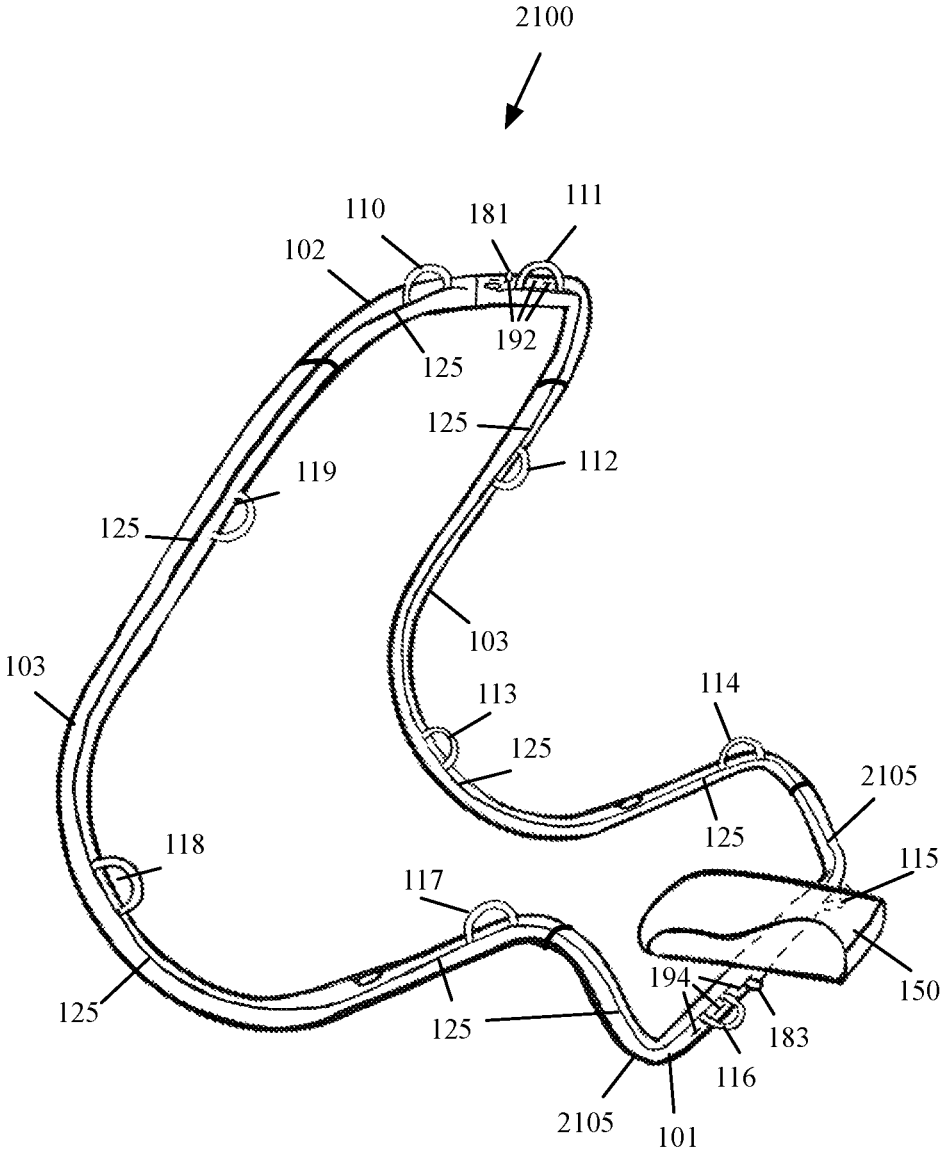

Several examples of the full body exercise device 100 have been described herein with the particular frame design of FIGS. 1A-1E. Other embodiments may use a different frame design and/or a different arm rest design for the exercise device. FIGS. 19-21 are perspective views of three examples of full body exercise devices with connectors for connecting one or more elastic bands to provide a rocking effect, according to various aspects of the present disclosure.

With reference to FIG. 19, the exercise device 1900 has a different armrest design than the armrests 165 of FIGS. 1A-1B. Other components of the exercise device 1900 may be similar to the components of FIGS. 1A-1B, 1D, and/or FIG. 1E. The armrests 165 of FIGS. 1A-1B may be used as a hand rest or an elbow rest and may be used to rest a person's hand, arm, or elbow. The armrests 165 may be connected to the middle frame section 103 of the exercise device 100 by the attachments 167 (e.g., as shown in FIG. 1A).

In FIG. 19, the armrest 1965 may be connected to the middle frame 103 by a push in button 1995. The exercise device 1900 may include a slot opening 1980 on each side of the middle frame 103 where the push in button 1995 may latch into. The connectors 1910-1915 that are located under the armrests 1965 provide the technical advantage of allowing a person to attach an elastic band from the connector 1910 to the connector 1915. The person may place the leg(s) over of this elastic band and may connect the feet to another elastic band connected to the connector(s) 110-111 (e.g., as shown by the elastic band(s) 121 in FIG. 1A).

In contrast to the armrests 165 of FIGS. 1A-1B, the armrests 1965 of FIG. 19 curve downward (in the pictured orientation where the exercise device is placed on the ground to receive a person in supine position). As shown, the exercise device 1900 may include the connectors 1910-1915 inside the curvature of the armrests 1965 to allow the attachment of elastic bands.

The exercise device 1900 may include the connectors 110-119, which may be similar to the connectors 110-119 described above with reference to the exercise device 100 and may be used to connect elastic bands to create teeter-totter effect and/or to exercise different muscles groups. The exercise device 1900, in some embodiments, may include connectors that are similar to the connectors 171-180 of FIG. 1D. The exercise device 1900, in some embodiments, may include the railings 125 (which may be similar to the railings 125 of the exercise device 100, described above) and may allow the location of the connectors 110-119 to be adjusted along the railings 125.

The armrests 1965, in some embodiments, may be permanently attached to the exercise device 1900. The armrests 1965, in other embodiments may be attachable and detachable. The armrests 1965 may be attached to the exercise device, for example, and without limitations, by the push in button mechanism 1995. The height of the armrests 1965 may be adjustable, for example, and without limitations, by using the push in button mechanism 1995. An armrest such as the armrest 1965 may be incorporated in any of the present embodiments, in lieu of the armrest 165. The width of the exercise device 1900 may be adjustable by using the push in buttons 181 and 183 and the slots 192 and 194 (e.g., as described above with reference to FIG. 5) to fit a person's body width.

With reference to FIG. 20, the top frame section 102 of the exercise device 2000 is located above the headrest 150. This is in contrast with, for example, the exercise device 100 of FIG. 1A, where the top frame section 102 is located in front of a person who uses the exercise device 100 in supine position.

With further reference to FIG. 20, the headrest 150 may be attached to a horizontal bar 2080 that is attached to both sides of the middle frame section 103. The horizontal bar 2080 is the bottom frame section of the exercise device 2000. Some embodiments may include the connectors 2010-2015 on the horizontal bar 2080 for connecting elastic bands. A person may connect elastic bands (not illustrated) to the connectors 2010-2015 to create rocking motion with the full body workout device 2000. The person may place the foot inside the foot brace (not illustrated) that is connected to the end of the elastic band, which may be similar to foot brace 120 of FIG. 15.

The ends of the horizontal bar 2080 may extend out through the middle frame section 103, which may be used to place weights 2090 on each side. Clamps (not shown) may be placed at each end of the horizontal bar 2080 to secure the weights 2090 in place.

The armrests 2065 of FIG. 20 may be attached at the curving point 2020 of the middle frame section 103. The armrests 2065 may not be detachable in some embodiments. Some embodiments may include the connectors 2050-2055 under the armrests 2065 for connecting elastic bands. An elastic band may be connected to the connectors 2070 that are located on the top frame section 102, as well as on the connector(s) 2050-2055, and 2015-2010, to create a teeter-totter effect. Once the elastic band is attached to these connectors, the person may place the feet into the foot braces that may be attached to the elastic band and create a teeter-tooter effect by moving the legs up and down and/or moving the legs in towards the chest area and back out.

The exercise device 2000 may include the connectors 110-119, which may be similar to the connectors 110-119 described above with reference to the exercise device 100 and may be used to connect elastic bands to create teeter-totter effect and/or to exercise different muscles groups. The exercise device 2000 may include connectors that are similar to the connectors 171-180 of FIG. 1D. The exercise device 2000, in some embodiments, may include the railings 125 (which may be similar to the railings 125 of the exercise device 100, described above) and may allow the location of the connectors 110-119 to be adjusted along the railings 125 to match the type of exercise and/or the size of a person's body. The width of the exercise device 2000 may be adjustable by using the push in button 181 and the slots 192 (e.g., as described above with reference to FIG. 5) to fit a person's body width.

With reference to FIG. 21, the frame of the exercise device 2100 may include the curvature 2105 next to the headrest 150. The exercise device 2100 may include armrests (not shown) such as the armrest 165 of FIG. 1A or the armrests 1965 of FIG. 19 (which may include connectors such as the connectors 1910-1915 of FIG. 19). The exercise device 2100 may include attachable foam paddings pegs (not shown) similar to the attachable foam paddings pegs 533 of FIG. 5.

Similar to what was described above with reference to the exercise device 100, the connectors 110-119 of FIG. 21 may be used to connect elastic bands to the exercise device 2100 to create a teeter-totter effect. Once the device 2100 is turned upside down, an elastic band with or without a memory foam pillow may be attached to the connectors 118 and 113 to assist the person in doing push up or dips, similar to what was described above with reference to FIGS. 6 and 8.

The exercise device 2100, in some embodiments, may include the railings 125 (which may be similar to the railings 125 of the exercise device 100, described above) and may allow the location of the connectors 110-119 to be adjusted along the railings 125 to match the type of exercise and/or the size of a person's body. The exercise device 2100, in some embodiments, may include connectors that are similar to the connectors 171-180 of FIG. 1D. Other components of the exercise device 2100 may be similar to the components of FIGS. 1A-1B and/or FIG. 1D. The width of the exercise device 2100 may be adjustable by using the push in buttons 181 and 183 and the slots 192 and 194 (e.g., as described above with reference to FIG. 5) to fit a person's body width.

Figure 22:
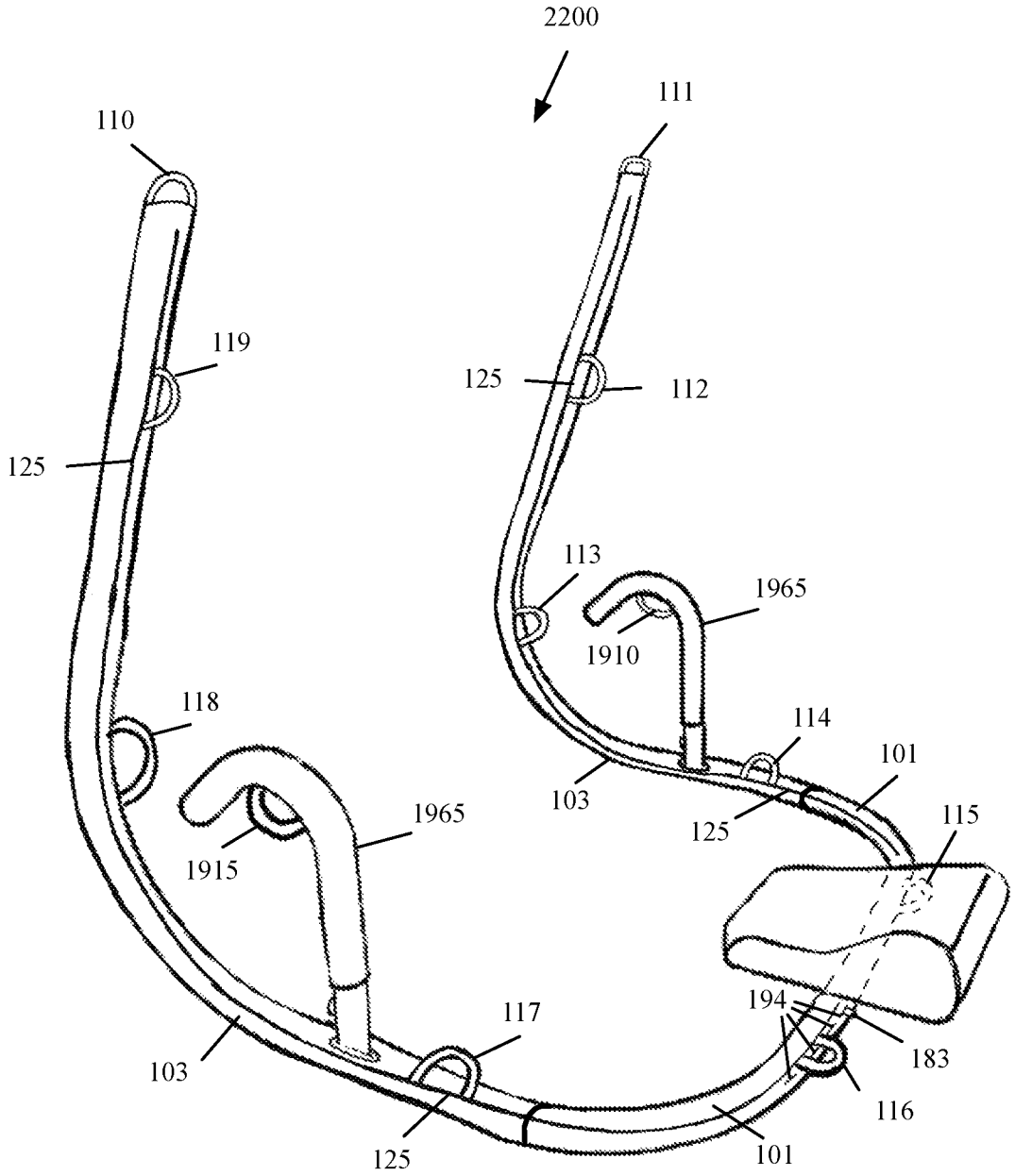
FIGS. 22-24 are perspective views of three examples of full body exercise devices that do not include a top frame section, according to various aspects of the present disclosure.
Figure 23:
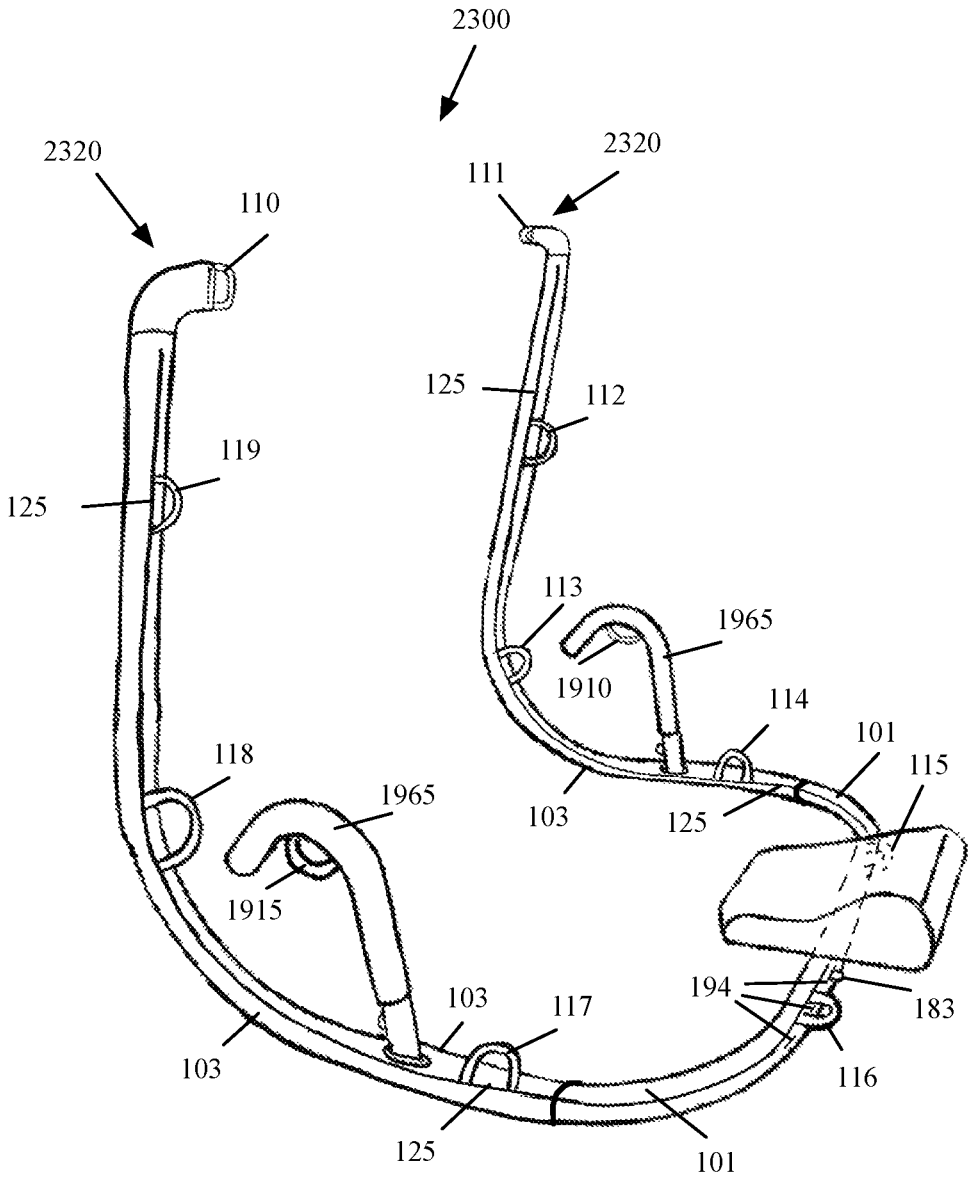
Figure 24:
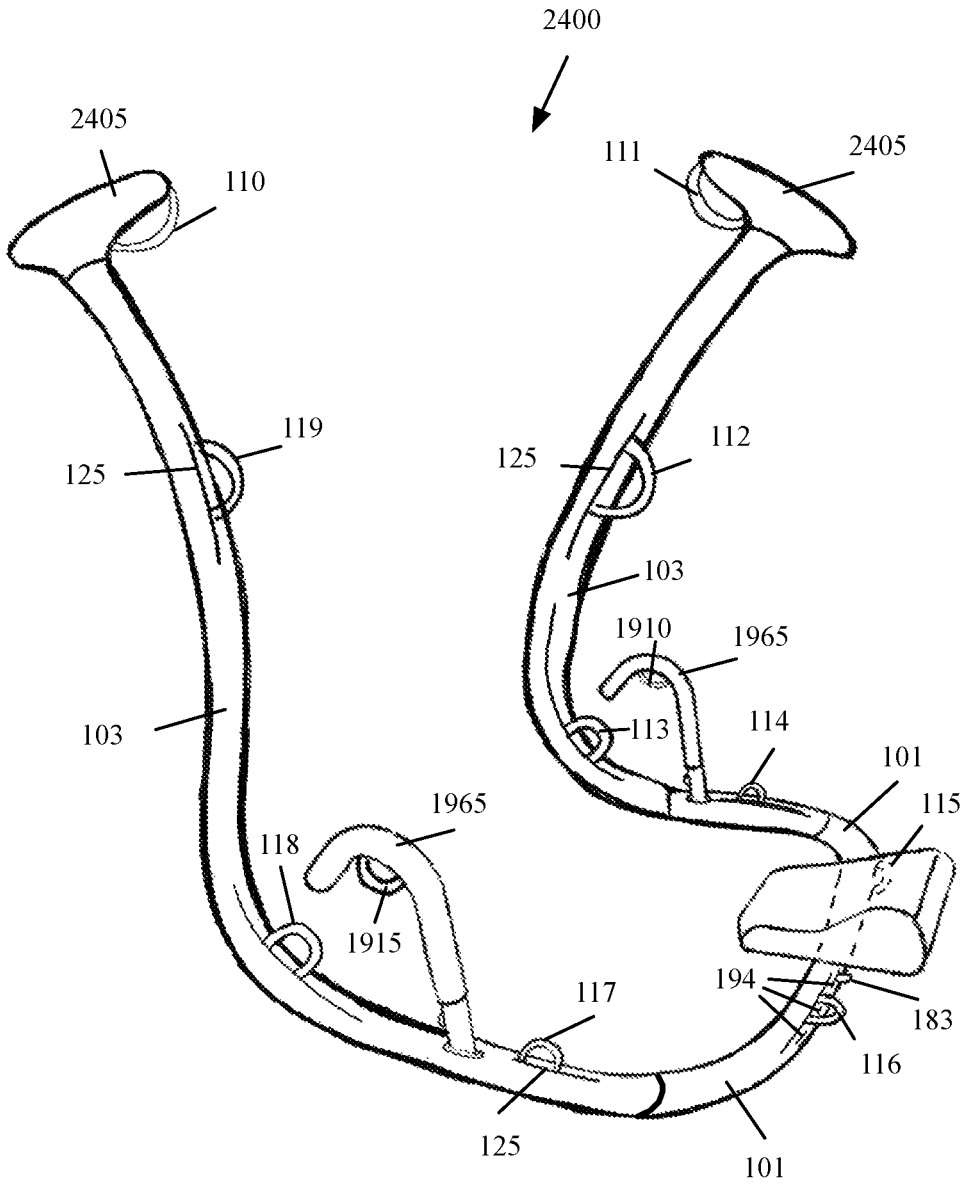

In some of the present embodiments, the full body exercise device may not include a top frame section. FIGS. 22-24 are perspective views of three examples of full body exercise devices that do not include a top frame section, according to various aspects of the present disclosure. The exercise devices that do not include a top frame section, may allow a person to have more open space while using the exercise device. For example, while stretching, the open space may allow the legs to stretch out and move straight forward towards the chest without bending the knees. The top frame, at times would obstruct the fluidity of motion during some of the stretches/work out position.

With reference to FIG. 22, the middle frame section 103 of the full body exercise device 2200 extents straight up (in the pictured orientation where the exercise device is placed on the ground to receive a person in supine position), having the connectors 110 and 111 connected to the top end of the middle frame section 103, which may allow attaching an elastic band to the connectors 110 and 111 to create a teeter-totter effect.

With reference to FIG. 23, the full body exercise device 2300 may be similar to the exercise device 2200 of FIG. 22, with the exception that the top ends 2320 of the middle frame section 103 curve in. With the curve design of the top ends 2320, a person may be able to turn the full body exercise device 2300 up-side down to perform push-ups and dips. The curvature design provide the technical advantage of allowing the exercise device to have stability when the device is up-side down. Similar to what was described above, the connector(s) 110-119 may allow attaching elastic band(s) to create the teeter totter effect. The connector(s) 1910-1915 may allow connecting elastic band(s) to assist the person to perform push up and dips, similar to what was described above with reference to FIGS. 6 and 8.

With reference to FIG. 24, the full body exercise device 2400 includes a curved middle frame section 103 that also curves diagonally outward. In some embodiments, the top ends of the middle frame section 103 may include rubber, silicone, and/or vinyl handles 2405. The handles 2405 may provide the exercise device 2400 stability once the exercise device 2400 is turned upside down.

The ergonomic handle bar design 2405 provides the technical advantage of giving stability to the device once the device is turned up-side down. The connectors 110-111 may allow connecting an elastic band with foot braces to the device. Once the elastic band is connected to the device, the person may place the feet into the foot brace and move the legs up and down to create a teeter-totter effect (e.g., as described above with reference to the exercise device 100). All exercise devices shown in FIGS. 19-24 may include the retractable band mechanism (as described below with reference to FIG. 35).

With reference to FIGS. 22-24, the armrests 1965 may be similar to the armrests 1965 of FIG. 19. The connectors 1910-1915 may be similar to the connectors 1910-1915 of FIG. 19. Alternatively, the exercise devices 2200, 2300, and/or 2400 may include armrests similar to the armrest 165 of FIG. 1A.

With further reference to FIGS. 22-24, the full body exercise devices 2200, 2300, and 2400 may include connectors, which may be similar to the connectors 110-119 described above with reference to the exercise device 100 and may be used to connect elastic bands to create teeter-totter effect and/or to exercise different muscles groups. The full body exercise devices 2200, 2300, and 2400, in some embodiments, may include connectors that are similar to the connectors 171-180 of FIG. 1D.

The full body exercise devices 2200, 2300, and 2400, in some embodiments, may include the railings 125 (which may be similar to the railings 125 of the exercise device 100, described above) and may allow the location of the connectors 110-119 to be adjusted along the railings 125 to match the type of exercise and/or the size of a person's body. The full body exercise devices 2200, 2300, and 2400 may include attachable foam paddings pegs (not shown) similar to the attachable foam paddings pegs 533 of FIG. 5. The width of the full body exercise devices 2200, 2300, and 2400 may be adjustable by using the push in button 183 and the slots 194 (e.g., as described above with reference to FIG. 5) to fit a person's body width. The height of the middle frame sections 103 of the full body exercise devices 2200, 2300, and 2400 may or may not be adjustable. For example, the full body exercise devices 2200, 2300, and/or 2400 may include a push in button mechanism located on the middle frame section 103, for example, and without limitations, similar to the push in buttons 585-588, described above with reference to FIG. 5.

Figure 25:
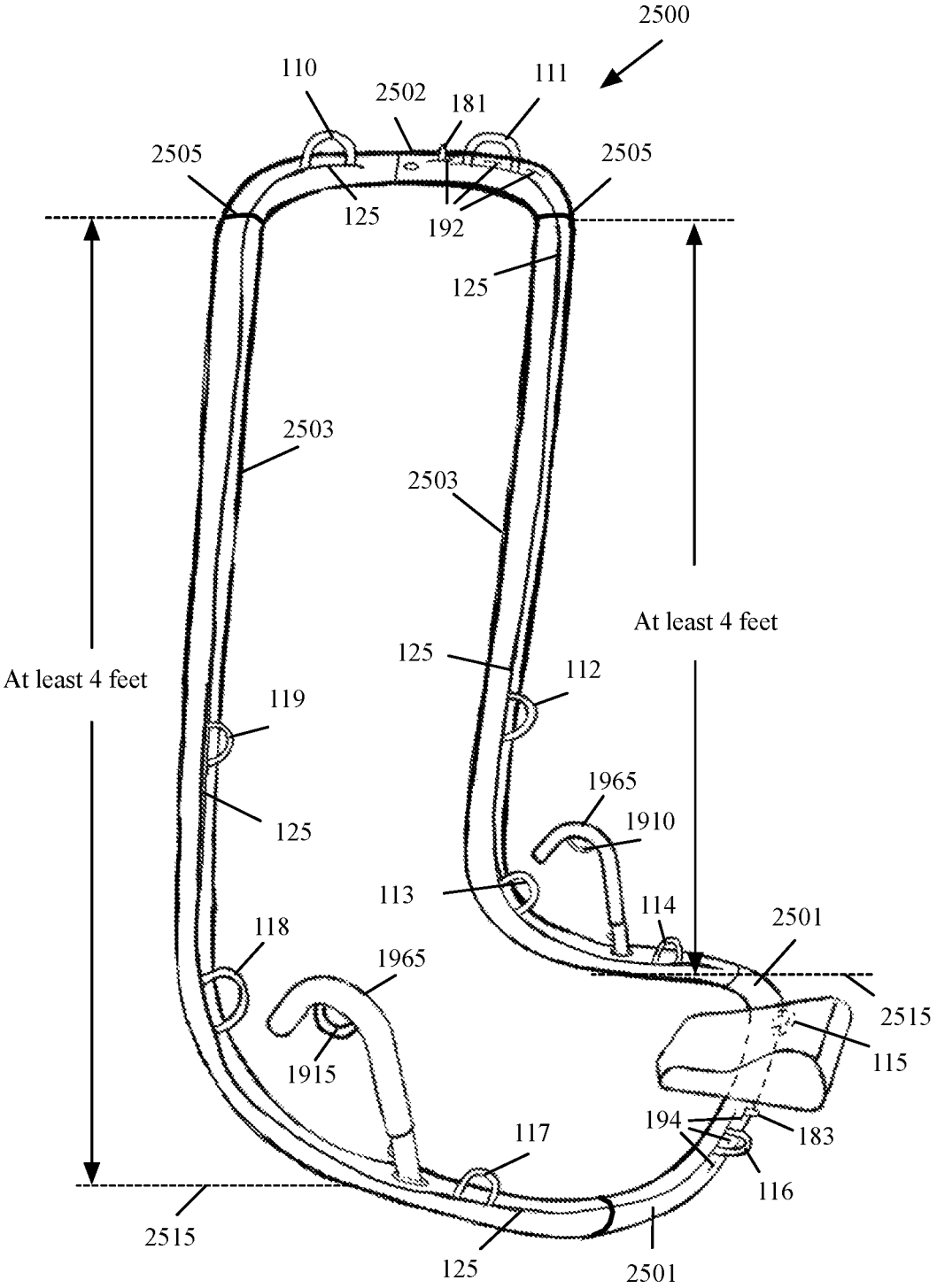
FIGS. 25-26 are perspective views of two examples of full body exercise devices with long frames, according to various aspects of the present disclosure.
Figure 26:
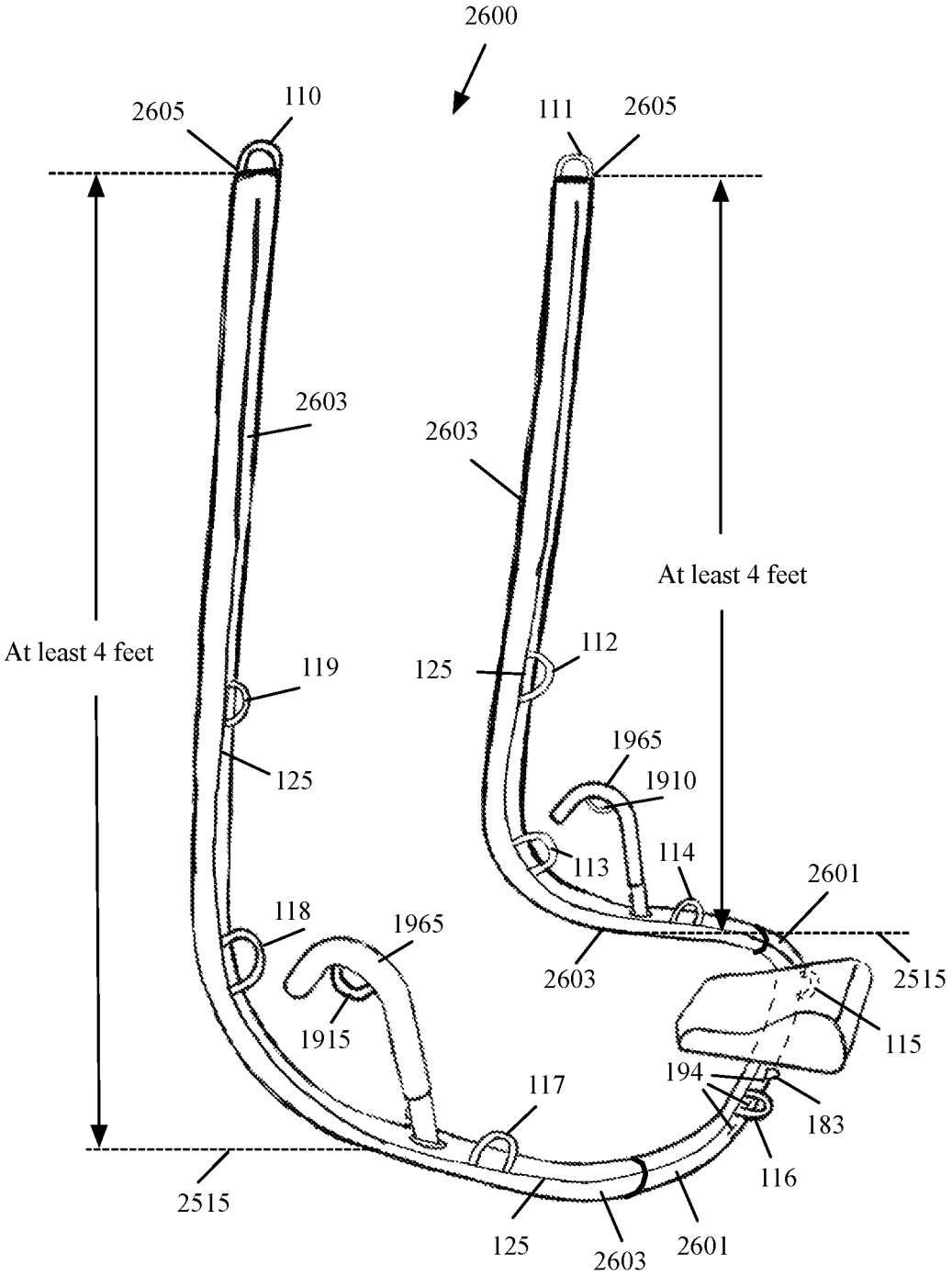

In some of the present embodiments, the full body exercise device may include a long frame size. FIGS. 25-26 are perspective views of two examples of full body exercise devices with long frames, according to various aspects of the present disclosure. With reference to FIGS. 25-26, when the exercise devices 2500 and 2600 are placed on a flat surface on the ground to receive a person in supine position, the tops 2505 and 2605 of the middle frame sections 2503 and 2603 are at least 4 feet above the ground level 2515. In some embodiments, the tops 2505 and 2605 of the middle frame sections 2503 and 2603 are between 4 feet to 6 feet above the ground level 2515.

The exercise device 2500 has a top frame section 2502, a middle frame section 2503, and a bottom frame section 2501. The exercise device 2600 has a middle frame section 2603, and a bottom frame section 2601. The exercise device 2600 does not have a top frame section. The long frames of the exercise devices 2500 and 2600 provide the technical advantage of allowing the legs of a user to be extended out more during a stretch/workout. Furthermore, the exercise devices 2500 and 2600 are suitable for users that are taller than an average person, for example, and without limitations, basketball players, football players, etc. The width of the exercise devices 2500 and 2600 may be adjustable by using the push in button 183 and the slots 194 (e.g., as described above with reference to FIG. 5) to fit a person's body width.

With further reference to FIGS. 25-26, the height of the middle frame sections 2503 and 2603 may or may not be adjustable. For example, the exercise device 2500 and/or the exercise device 2600 may include a push in button mechanism located on the middle frame section, for example, and without limitations, similar to the push in buttons 585-588, described above with reference to FIG. 5.

With reference to FIGS. 25-26, the armrests 1965 may be similar to the armrests 1965 of FIG. 19. The connectors 1910-1915 may be similar to the connectors 1910-1915 of FIG. 19. Alternatively, the exercise devices 2200, 2300, and/or 2400 may include armrests similar to the armrest 165 of FIG. 1A.

With further reference to FIGS. 25-26, the exercise devices 2500 and 2600 may include the connectors 110-119, which may be similar to the connectors 110-119 described above with reference to the exercise device 100 and may be used to connect elastic bands to create teeter-totter effect and/or to exercise different muscles groups. The exercise devices 2500 and 2600, in some embodiments, may include connectors that are similar to the connectors 171-180 of FIG. 1D.

The exercise devices 2500 and 2600, in some embodiments, may include the railings 125 (which may be similar to the railings 125 of the exercise device 100, described above) and may allow the location of the connectors 110-119 to be adjusted along the railings 125 to match the type of exercise and/or the size of a person's body. The exercise devices 2500 and 2600 may include attachable foam paddings pegs similar to the attachable foam paddings pegs 533 of FIG. 5.

Figure 27:
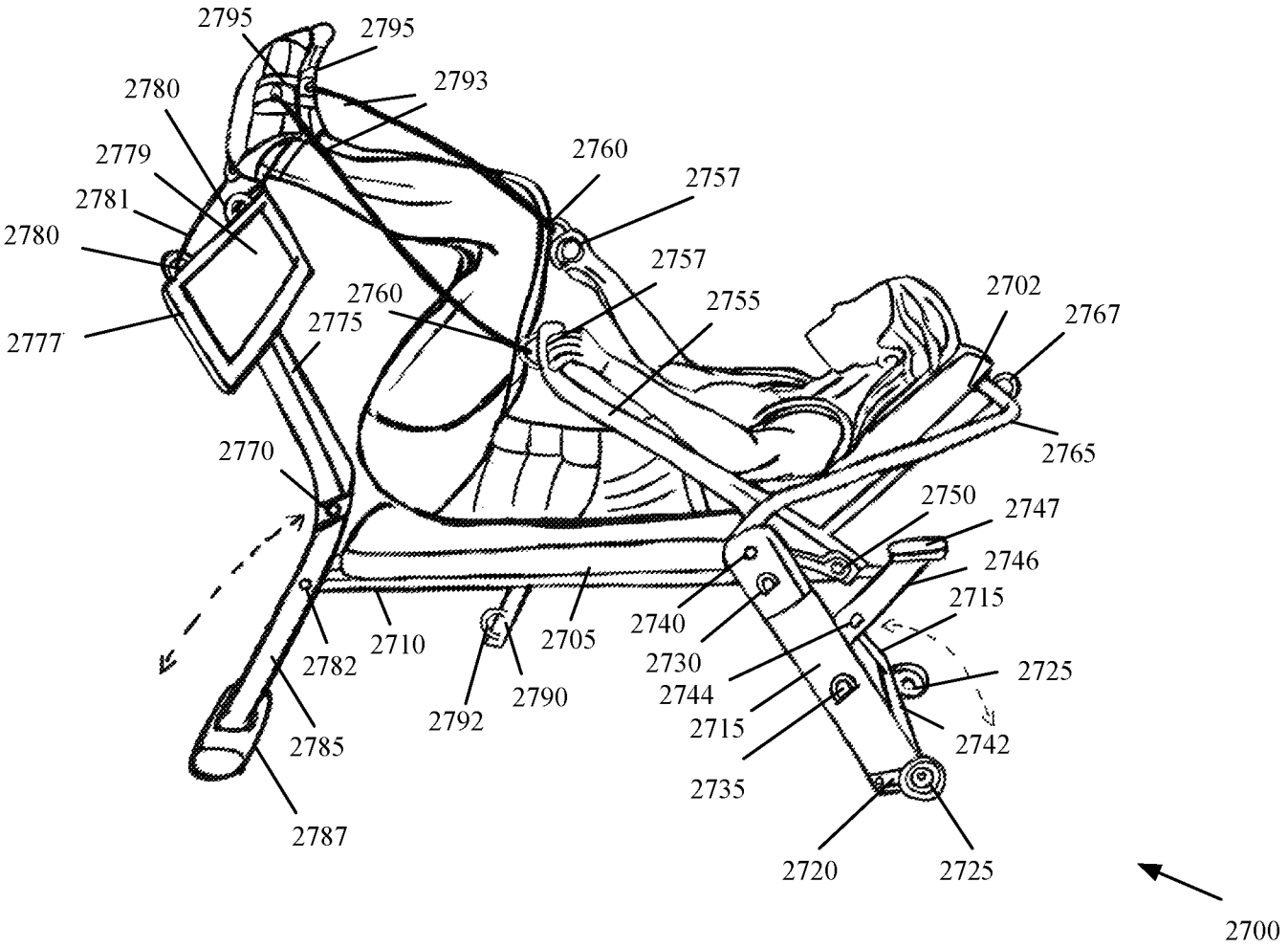
FIG. 27 is a functional diagram showing an example embodiment of a full body exercise device with a foldable bench, according to various aspects of the present disclosure.

FIG. 27 is a functional diagram showing an example embodiment of a full body exercise device with a foldable bench, according to various aspects of the present disclosure. With reference to FIG. 27, the exercise device 2700 may include a foldable bench, which may include a headrest section 2702 and a back section 2705. The foldable bench 2702-2705, in some embodiments, may include a cushion foam. The cushion foam may be, for example, and without limitations, covered in synthetic leather. The foam may also be memory foam, which may contour to the shape of the neck, covering the open spaces between the seat and curvature of the neck.

The headrest 2702 section of the foldable bench may cover the head, neck, and the upper back areas. The back portion 2705 of the foldable bench may cover the lower back and glute areas. The foldable bench 2702-2705 may be attached to a horizontal frame bar 2710. The full body exercise device 2700 may include a pair of diagonal leg frames 2715 and a pair of horizontal bars 2720. Since FIG. 27 shows a perspective view, one of the horizontal bars 2720 and one of several other pairs of components described below may be hidden by other components of the exercise device. The horizontal frame bar 2710, the pair of diagonal leg frames 2715, and the horizontal bars 2720 may be made, for example, and without limitations, from steel and/or other types of metal.

Each horizontal bar 2720 may be connected to a wheel 2725 on the bottom of the corresponding diagonal leg frame 2715. The wheels 2725 may facilitate moving the exercise device 2700 with ease. The exercise device 2700 may include connectors (such as the connectors 2730-2735) on each diagonal leg frame 2715 to attach elastic bands. The exercise device 2700 may include push in buttons 2740 and/or a pull out lever mechanism to allow adjusting the diagonal leg frames 2715. The exercise device 2700 may include a push in button mechanism 2782 and/or a pull out lever mechanism for adjusting the lower legs 2785 of the exercise device 2700. Adjusting the lower legs 2785 may allow folding in the lower leg 2785 to flatten the device. Adjusting the diagonal leg frames 2715 and the lower legs 2785 enables flattening of the device for storage. For example, the device may be folded and stored under a bed and/or in a closet.

The exercise device 2700 may include the horizontal bar frame 2742 (which may be made, for example, and without limitations, from steel and/or other types of metal) that connects the two sides of the device together. The exercise device 2700 may include the push in button mechanism 2744 and/or pull out lever mechanism for adjusting the diagonal frame bar 2746, which may be used to set the headrest 2702 on. By adjusting the diagonal frame 2746 to go down, the person may be able to go further back with the headrest 2702, allowing the person to receive greater stretch by extending the body core. The plastic and/or rubber padding 2747, located on top of the diagonal frame 2746 covers the steel/metal, allowing the person to lay the headrest 2702 on the padding 2747.

The exercise device 2700 may include the horizontal frame 2750 (which may be made, for example, and without limitations, from steel and/or other types of metal) that connects to the handlebars 2755. The handlebars 2755 may be covered with breathable, sweatproof rubber, silicone, and/or vinyl handles, which may allow a person to have a good grip on the handlebars 2755. The handlebar 2755 may curve in. The curved portion 2757 of the handlebars 2755 is where the users may place their hands.

The exercise device 2700 may include the connectors 2760 on top of the curve portion 2757 of the handlebars 2755 for attaching elastic bands. The exercise device 2700 may include the top horizontal frame bar 2765 that is attached to the headrest 2702. As shown, the exercise device 2700 may include two connectors 2767 on top of the top horizontal frame bar 2765 for attaching elastic bands (only one connector 2767 is shown in the pictured orientation).

The exercise device 2700 may include a push in button mechanism 2770 and/or pull out lever mechanism that allow the diagonal frame 2775, connected to the footrest 2777, to be adjusted up and down. Once the person has the leg attached to the elastic band 2781 that is connected to the connectors 2780 on top of the footrest 2777, the push in mechanism 2770 and/or pull out lever mechanism may allow the person to extend the legs down and up more, resulting in receiving more of a stretch to the abdominal area. The footrest 2777 may include an opening 2779, which may allow the users to slide their foot in. The footrest 2777 may, for example, and without limitations, have a rectangular shape and may be covered with sweatproof rubber, silicone, and/or vinyl, to give the users a good grip if they choose to place their foot in.

As shown, the exercise device 2700 may include the connectors 2780 on top of the footrest 2777 for attaching the elastic bands 2781. The lower leg 2785 may be connected to a horizontal base 2787. The horizontal base 2787 may be covered with sweatproof rubber, silicone, and/or vinyl to give a strong grip against the floor. The exercise device 2700 may include an attachable horizontal frame 2790 (which may be made, for example, and without limitations, from steel and/or other types of metal) underneath the bench 2705. The horizontal frame 2790 may include the connector 2792 on each side for connecting elastic bands. The horizontal frame 2790 may be adjusted to move underneath the bench by a swivel mechanism located underneath the bench (not illustrated).

With further reference to FIG. 27, an example of using the exercise device 2700 for performing ab crunches is shown where the elastic bands 2793 are attached to the connectors 2760 and the foot braces 2795. The connector(s) 2760-2767 may be used to attach elastic bands to create teeter-totter effect. Once the person attaches the elastic band 2793 to the connector(s) 2760 or 2767 and attaches the foot to the foot braces 2795 that are connected to the elastic band 2793, the person may be able to create the teeter-totter effective by moving the legs up and down. If the footrest 2777 is not folded down towards the ground, the person may direct the legs downward, parallel to outside edges of the bench 2705 and the footrest 2777. If the footrest 2777 is folded down, the person may be able to keep both legs together, and move the legs up and down without interference of the footrest.

As shown in FIG. 27, the person has attached the elastic bands 2793 to the foot braces 2795 and connected to the elastic band 2793 to the curve portion 2757 of the handlebar 2755. The person may then connect elastic bands 2781 connected to the connectors 2780 and the connectors that are attached to the heel of the foot brace 2795. By doing so, when performing exercise on the exercise device 2700, the person has created a resistance in going down with the elastic bands 2793, as well as creating resistance coming back up with the elastic band 2781. As the legs go up, the elastic band 2781 attached to heel of the foot brace 2795 and to the connectors 2780 may contract the muscles in the legs, glutes, and abdominal areas.

The exercise device 2700, in some embodiments, may include a monitor screen (not shown) that may allow the person to know how many crunches the person takes per minute, how much calories were burned, how long the person has been on the device, etc. The person may be able to track and scan each category on the monitor. The exercise device 2700, in some embodiments, may include, behind the headrest 2702, an extended iron/steel/metal frame pole (not shown), that may allow the person to place weight(s) behind the headrest 2702 to enhance the level of the exercise difficultly. Adding the weights may allow building more strength in the muscles of the abdominal area. In some embodiments, the footrest 2777 may be designed with two horizontal iron/steel/metal frame bars (not shown). The two horizontal frame bars may be located such that one horizontal frame is above the other, allowing the person to place the foot on the higher and/or the lower horizontal frame.

Figure 28:
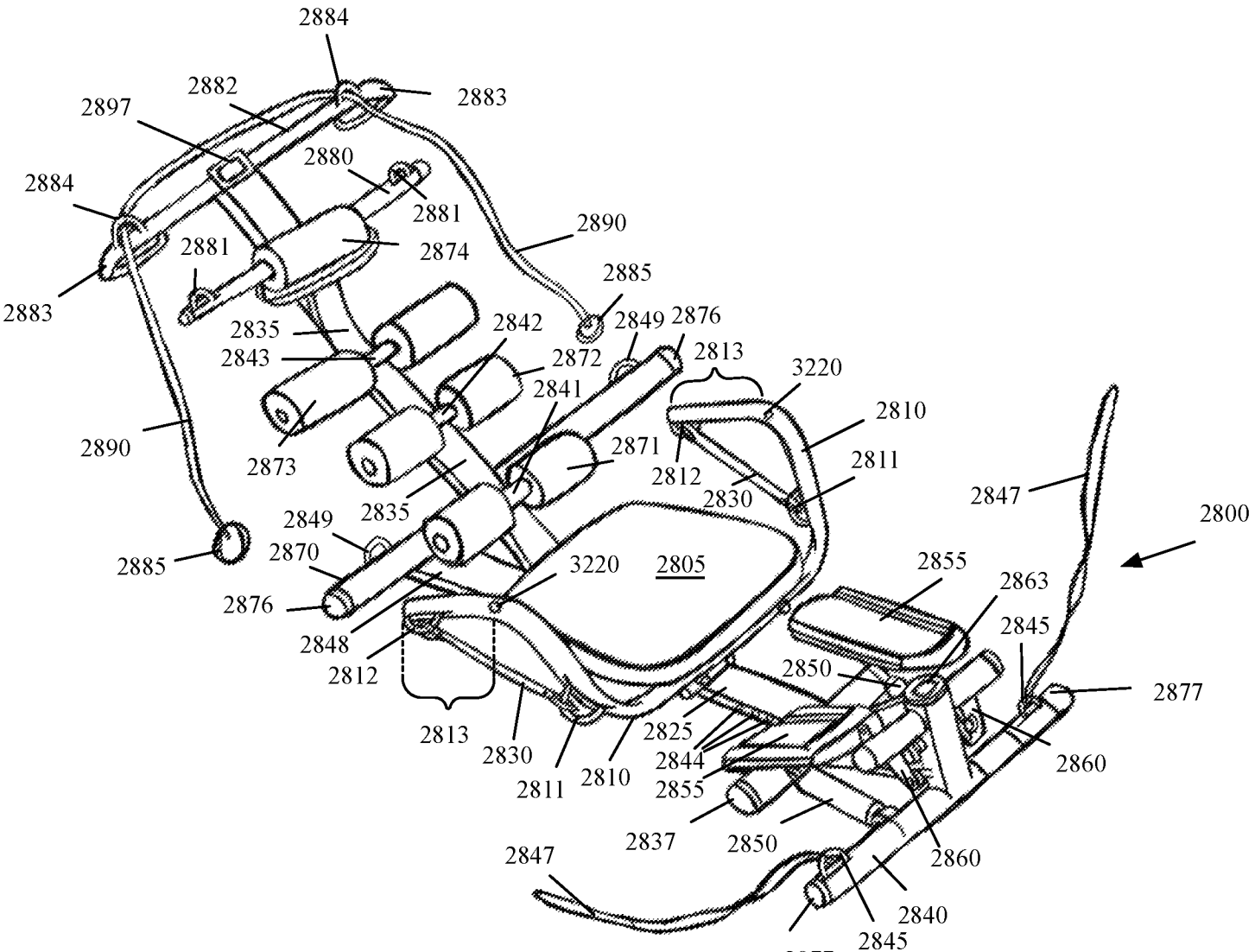
FIG. 28 is a top perspective showing an example embodiment of a full body exercise device with a leg workout device attached and elastic bands that provide a teeter-totter action, according to various aspects of the present disclosure.

FIG. 28 is a top perspective showing an example embodiment of a full body exercise device with a leg workout device attached and elastic bands that provide a teeter-totter action, according to various aspects of the present disclosure. With reference to FIG. 28, the exercise device 2800 may include the foam cushion seat 2805 that may be covered with synthetic leather, and/or breathable, sweatproof wicking fabric. The exercise device 2800 may include the handlebar frame 2810 that is partially located underneath the seat 2805. The exercise device 2800 may include the connectors 2811 and 2812 on each side of the device for connecting elastic bands 2830.

The handlebars 2810 may include a spring swivel mechanism 2820. The spring swivel mechanism 2820 may allow a portion 2813 of the handlebars 2810 to fold in and out. The folding in and out of the portion 2813 of the handlebar frame 2810 may allow a person to work out the arm muscles. By attaching the elastic bands 2830 to the handlebar frame 2810 (e.g., to the connectors 2811 and 2812), and pushing down on the foldable portion 2813 of the handlebar frame 2810, the resistance of the elastic bands 2830 that is connected to the handlebar frame 2810 creates a spring-like effect. The contraction caused by the elasticity of the elastic bands 2830 forces the handlebar frame 2810 to bounce back up in its original position.

In an exemplary exercise called dips, a person may sit on the seat 2805, position the hands on the handlebar frame 2810, slightly bend the elbow, and apply downward pressure on the handlebar frame 2810, which forces the handlebar frame 2810 to fold in. The person may then slowly release the pressure, allowing the handlebar frame 2810 to go back in its original position. By repeating this up and down motion with the arms, the elastic band 2830 may contract the muscles in the arms, shoulders, and trapezoid areas. The person may attach more than one elastic band between the pair of connectors 2811 and 2812 on each side of the exercise device 2800 to create more resistance and enhance the strength level.

The exercise device 2800 may include a bottom vertical frame bar 2825, which may be adjusted in length (e.g., by the push in buttons 2844). Adjusting the length of the bottom vertical frame bar 2825 may allow the device to fit the height of a person. The vertical frame bar 2825 may be attached underneath the seat 2805 by a screw and/or push in button mechanism (not shown). The middle horizontal frame 2837 may be connected to the bottom vertical frame bar 2825. At each end of the middle horizontal frame 2837, there may be a rubber cover to cover the iron/steel/metal frame and act as a holding grip against the floor.

The exercise device 2800 may include the front horizontal leg frame 2840. At each end of the front horizontal leg frame 2840 there may be a rubber/plastic cover 2877 to cover the iron/steel/metal frame and act as a holding grip against the floor. On top of each end of the front horizontal leg frame 2840 there may be a connector 2845 to connect elastic bands 2847.

With further reference to FIG. 28, the hydraulic pump cylinders 2850 may be connected to the front horizontal frame 2840 and underneath the foot pedals 2855. Since FIG. 28 shows a perspective view, one of the hydraulic pump cylinders 2850 and one of several other pairs of components described below may be hidden by other components of the exercise device.

The foot pedals 2855 may have two side edges that keep the foot in the pedals, and not allowing the foot to slip out. The foot pedals 2855 may have foam cushioning and/or memory foam cushioning, covered in breathable, sweatproof wicking fabric. The foam allows a person to have support to the bottom of the feet, if they use the device without shoes. As the person sits down on the exercise device 2800, rocking back and forth, working out the abs, simultaneously the person is able to work out the legs and arms.

The diagonal iron/steel/metal frames 2860 that are connected to the foot pedals 2855 allow the pedals 2855 to move up and down. The hydraulic pump cylinders 2850 may create resistance as the person pushes down with each foot on the pedals. As the person steps on one pedal 2855 and applies downward pressure, the pedal 2855 goes down, as the person releases pressure, the pedal 2855 slowly comes back up. The person may then apply the same downward pressure to the other pedal 2855. Stepping down, one foot after another on each pedal 2855, the person may contract the muscles in the legs, glutes, and abdominal areas.

The exercise device 2800 may include a monitor screen 2863 that may allow the person to know how many steps were taken per minute, how much calories were burned, and how long the device has been used. The person may be able track and scan each category on the monitor.

The exercise device 2800 may include the back end horizontal leg frame bar 2870 that is attached to the back vertical frame 2848, which may include a set of connectors 2849. The back vertical frame 2848 may be attached under the seat 2805. At each end of the back end horizontal leg frame bar 2870 there may be a rubber/plastic cover 2876 that allows the leg frame 2870 to grip against the floor. The ergonomic foam cushion rolls 2871 may support the lower back. The ergonomic foam cushion rolls 2872 may support the mid-back area. The ergonomic foam cushion rolls 2873 may support the upper back area. The ergonomic foam cushion rolls 2874 may support the neck and head areas. The foam cushion rolls 2871-2874 may be connected through a corresponding horizontal pipe frame 2841-2843 and 2880 to the top vertical frame bar 2835.

The top vertical frame bar 2835 is shown in FIG. 28 in a diagonal position because the frame is able to move backwards due to a spring mechanism (not shown). The spring mechanism may create resistance and may be located on the middle or lower part of the vertical frame bar 2835. The spring mechanism may be located behind or on the side of the vertical frame bar 2835) and attached to the lower horizontal frame 2870.

The spring mechanism may have several different resistance levels such as light weight, medium weight, and heavy weight. As the person applies pressure by leaning back on the vertical frame bar 2835, the vertical frame bar 2835 may tilt back. The spring mechanism may allow the vertical frame bar 2835 to bounce back up as the person leans forward, by reducing the pressure off of the vertical frame bar 2835. The vertical frame bar 2835, in some embodiments, may be made of, for example, and without limitations, plastic and/or rubber to allow the vertical frame bar 2835 to bend when pressure is applied.

The horizontal frame bar 2882 may be connected to the top of the vertical frame bar 2835 by a push in button and/or a screw (not shown). Each end of the horizontal frame bar 2882 may curve into a handlebar 2883. The handlebars 2883 may be covered with breathable sweatproof wicking fabric, rubber, silicone, and/or vinyl to provide a firm grip around the handles. A person may grab the handlebars 2883 while performing the ab crunches.

The horizontal frame bar 2880 that connects to the foam cushion 2874 may include the connectors 2881 for attaching elastic bands. The connectors 2884 may be located on each side of the top horizontal frame bar 2882 for connecting elastic bands. The elastic bands connected to the connectors 2881 and/or 2884 may be used to create a teeter-totter effect. As any other ab roller exercise devices of the present embodiments, the connectors of the exercise device 2800 may be any of the connectors described above with reference to FIGS. 1A-1E, including holes made in the frame of the exercise device 2800.

As the person sits down on the seat 2805 and leans back on the foam cushions 2871-2874 that support the back, neck, and head area, the person may have the foot connected to (e.g., placed in the loops and/or straps/braces 2885) the elastic band(s) 2890 that may be attached to the connectors 2884. The elastic band(s) 2890 may be stretched down in order to place the foot into the loop and/or strap/brace 2885. While the person leans back, the spring mechanism may allow the vertical frame bar 2835 to go down. The further the vertical frame bar 2835 goes down towards the floor, the greater the stretch may be to abdominal area. The person may have the knee bended in towards the chest and/or facing vertically up in the air as the person is going down. If the person has the legs bent in, the person may push out the legs, straightening out the legs, forcing the person back up.

Since the person has the feet connected to the elastic band(s) 2890 that is/are attached to the horizontal frame bar 2882 (which is in turn attached to the vertical frame bar 2835 that the person is leaning on), if the person has the legs in a vertical position, the person may slowly bring down the legs, without bending the knees, forcing the person to come back up. Repeating these motions creates the teeter-tooter effect. A similar teeter-tooter effect may be created if the elastic band(s) 2890 is/are connected to the connectors 2881. Similar to the other devices described herein, the teeter-totter effect of the device with the elastic band(s), without the use hands, allows the person to create contraction in the abdominal area, resulting in strengthening of the abdominal area.

Since the person has the feet connected to the elastic band(s) 2890, if the person places the legs back up in vertical position, straight up, the person may force the device to go back down. By straightening out the legs and bending the knees back towards the chest, the person creates a teeter-totter effect with the exercise device 2800.

Some embodiments may include an adjustment lever (not shown) that allows the person to set the vertical frame 2835 to several different levels, vertically (in straight up position), diagonal which is illustrated, flat down (a horizontal position), or slanted position (facing downward towards the ground). The exercise device 2800 may include a monitor screen 2897 that may allow the person to know how many crunches they performed per minute, how many calories were burned, how long the person was using the device, etc. The person may also be able to track and scan each category on the monitor screen 2897.

In some embodiments, there may be a swivel mechanism under the seat 2805. The person may be able to turn side to side on the seat 2805 because of swivel mechanism, allowing the person to work out oblique muscles. The person may hold the handlebar frame 2810, crunch in the knees, and as the person turns to left, the person may straighten out the knees, not allowing the feet to touch the ground as the person turns left to right.

In some embodiments, the swivel mechanism may have a pin (not shown), which may be removed to allow the seat to move side to side. To lock in the seat in straight position, the person may align the seat in a straight position and push in the pin, locking in the seat to prevent the seat to move side to side. The top vertical frame bar 2835 may have opening/slots (not shown) on each side of the top vertical frame bar 2835 to allow the person to place the ends of the horizontal frame bar 2880 into the openings and be able to screw the horizontal frame bar 2880 into the both sides of the vertical frame.

The person may also move the neck cushion 2874 up and down on the vertical frame bar 2835 to fit the person's correct height. There may be two adjustment knobs (not shown) on the back side of the vertical frame 2835 that connects to the middle section of the horizontal frame 2880. The two adjustment knobs (not shown) may allow the person to loosen and tighten the pressure against the vertical frame bar 2835 by turning the knob, allowing the person to adjust the horizontal frame 2880 to fit the person's height in order to lay the head on the foam cushion 2874. The foam cushions 2871-2874 may be covered with breathable sweat-proof wicking fabric, and/or synthetic leather. The top vertical frame bar 2835, in some embodiments, may move up or down in a range of 100 to 180 degrees rotation.

FIGS. 29-32 are top perspectives showing example full body exercise devices with elastic bands that provide a teeter-totter action without the use of hands, according to various aspects of the present disclosure. In the exercise device 2900 of FIG. 29, the foot pedals 2955 are in a substantially vertical position, facing a person that may be seated on the seat 2805.

Figure 29:
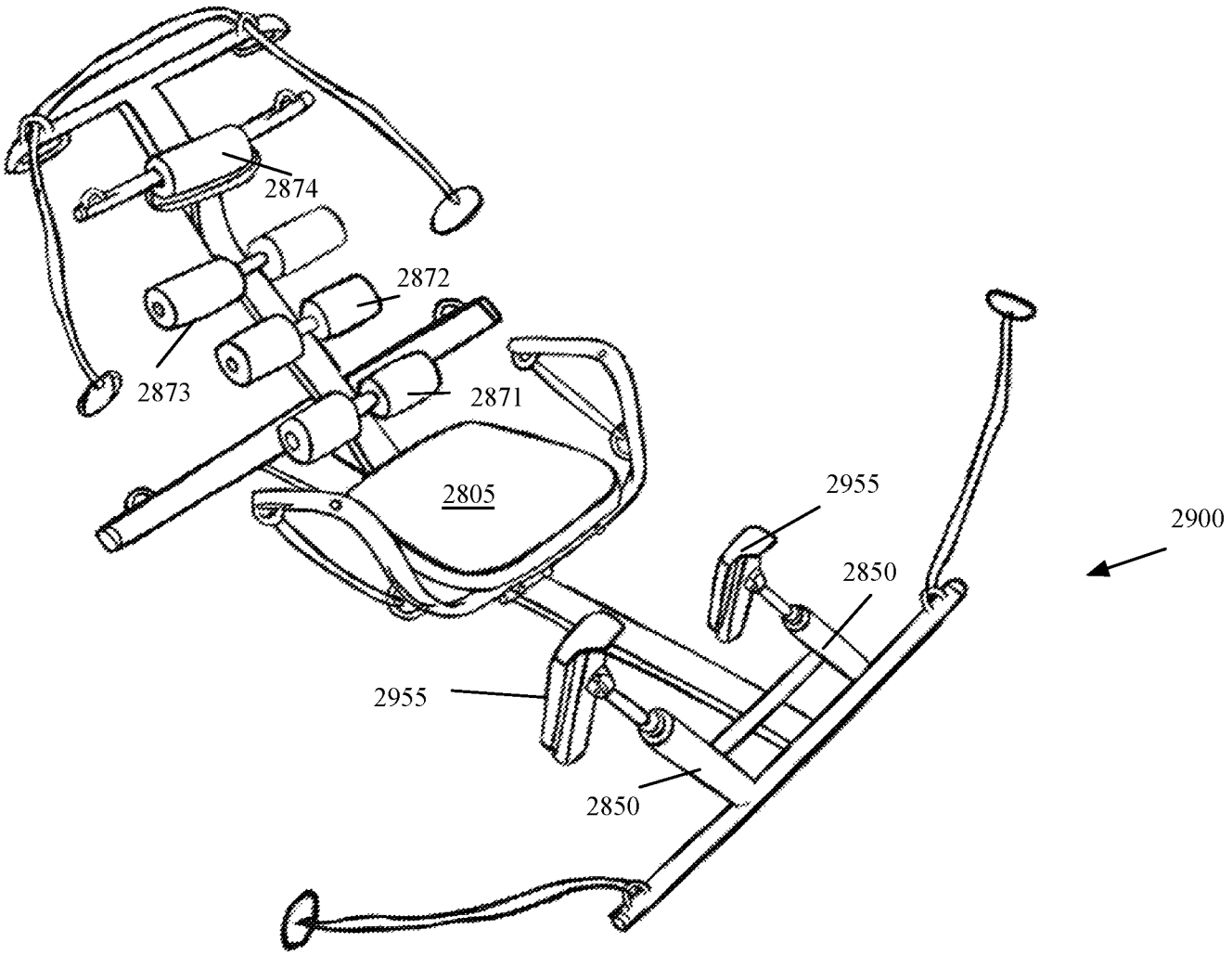
FIGS. 29-32 are top perspectives showing example full body exercise devices with elastic bands that provide a teeter-totter action without the use of hands, according to various aspects of the present disclosure.
Figure 30:
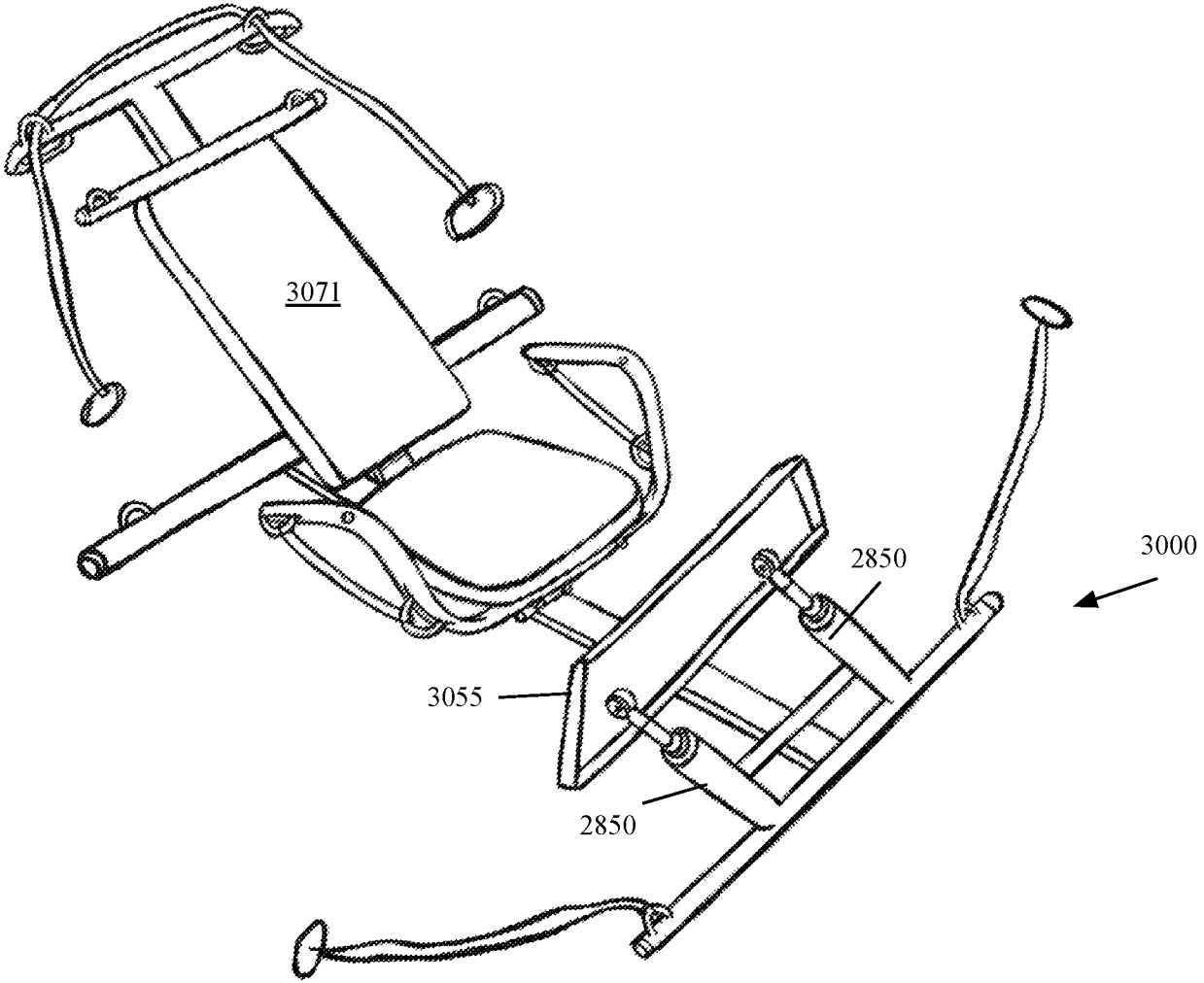

With reference to FIG. 30, the exercise device 3000 may include a flat foam cushion board 3071 instead of the foam rolls 2871-2874 of FIGS. 28-29. The foam cushion board 3071 may be covered with breathable sweatproof wicking fabric, and/or synthetic leather. The flat foam cushion board 3071 may be incorporated on the exercise devices 2800 of FIG. 28, 2900 of FIG. 29, and 3200 of FIG. 32. Conversely, the foam rolls 2871-2874 of FIGS. 28-29 may be incorporated in the exercise devices 3000 of FIG. 30 and 3100 of FIG. 31.

With further reference to FIG. 30, the lower part of the exercise device 3000 may include a flat iron/steel/metal foot plate 3055, which may be attached to the hydraulic cylinder pumps 2850. The iron/steel/metal foot plate 3055 may be covered with two rubber sheet tapes, that may give the person grip support for the feet as the person places the feet onto the plate 3055. The foot plate 3055 may, in some embodiments, include a layer of memory foam covered in wicking fabric. The memory foam cover may allow the person to place the feet on the foot plate 3055 without shoes, preventing the sole of the feet from pain and discomfort while working out.

The person may press down on the foot plate 3055 with both feet at the same time. The person may also choose to work out one leg at time, by pressing down on the foot plate 3055 with one leg. The foot plate 3055 may be used in the exercise device 2800 instead of the foot pedals 2855 or in the exercise device 2900 instead of the foot pedals 2955. The exercise device 3000 may allow the person to perform abdominal crunches, as described above with reference to the exercise device 2800 of FIG. 28, and simultaneously workout the leg muscles.

Figure 31:
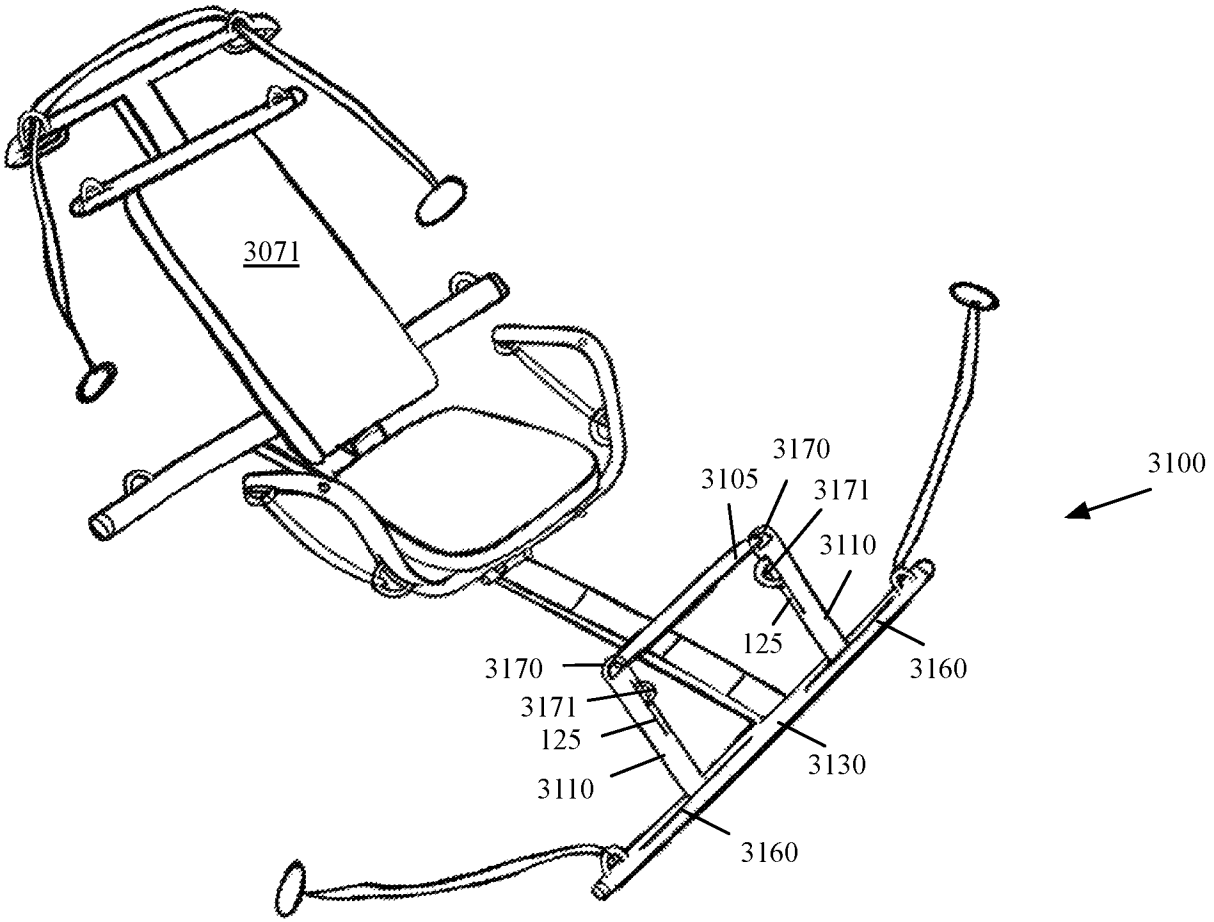

With reference to FIG. 31, the back support is illustrated with the flat board cushion support 3071, similar to the flat board cushion support 3071 of FIG. 30. In FIG. 31, instead of having the person pressing down on legs pedals and/or a foot plate that are attached to a hydraulic cylinder pump system, the person may apply pressure on one or more elastic bands 3105.

The two vertical iron/steel/metal frame sections 3110 may be connected to the front horizontal frame section 3130. The vertical frame sections 3110 may be adjusted on the horizontal frame section 3130, allowing the person to move the vertical frame sections 3110 (e.g., along the rails/slots 3160) to be closer together and/or further apart from each other. By positioning the vertical frame sections 3110 further apart from each other, the person may have a wider foot stance. While the person applies pressure with the feet on the elastic band(s) 3105, a wide foot stance may focus on contracting the outer muscles of the leg and glutes. By positioning the vertical frames 3110 closer to each other, the person may have a close foot stance while working out. When the person applies pressure with the feet on the elastic band(s) 3105, a close foot stance may focus the inner legs and glutes.

There may be one or more connectors 3170-3171 on each vertical frame section 3110 for connecting one or more elastic bands 3105 onto each side of the vertical frames 3110. The full body exercise device 3100 may include the railings 125 that may allow the position of some of the connectors (e.g., the connectors 3171) to be adjusted up and down the vertical frames 3110.

A person may perform a leg squat by sitting down on the exercise device 3100, and bending in the knees while pressing down with one or both foot on the elastic band(s) 3105. Pressing down on the elastic band(s) 3105 and releasing the pressure off the elastic band(s) 3105 and then reapplying pressure on the elastic band(s) 3105, may contract the elasticity of the band(s) resulting in contracting the legs muscles, the glutes, and abdominal muscle of the person.

Using the elastic band(s) 3105 instead of the hydraulic cylinder pumps 2850 of FIGS. 28-30 provides several technical advantages. Using the elastic band(s) eliminates the need to maintain the hydraulic pumps 2850 and/or to fix the hydraulic pumps 2850 in case the hydraulic pumps break down. Since the elastic band(s) 3105 create(s) resistance and contraction to the muscles in the thighs, calves, glutes and abdominal area by applying downward pressure and releasing pressure off the elastic band(s), the person may achieve the same results using the elastic band(s) as if the person was using the hydraulic cylinder pumps, but without the concern of the cylinder pumps malfunctioning.

In addition, the person may be able to utilize the elastic band(s) 3105 in performing abdominal exercises. For example, instead of stepping onto the elastic band(s) 3105, the person may hook the top of the foot against the elastic band(s) 3105, and as the person has the knees bent in, the person may crunch in the knees towards the chest while the elastic band(s) 3105 is/are hooked against the foot. The person may then keep the knees bent in, towards the chest area and may apply upward pressure against the elastic band(s) 3105. The person may then slowly release the tension off of the elastic band(s) 3105 by moving the legs down. By repeating this motion back and forth, the person may perform abdominal crunches.

Another advantage of using the elastic band(s) 3105 instead of the hydraulic cylinder pumps 2850 is that the person may attach different number of elastic bands and/or elastic loop bands with different resistance level to fit the level of workout. Furthermore, since the vertical frames 3110 may be adjusted to get closer or farther from each other, the person may be able fit different lengths of elastic band(s) and/or elastic loop band(s).

Another advantage of the elastic band(s) 3105 is that the person may be able to perform different leg exercises. For example, the person may bend the knees and apply downward pressure to the elastic band(s) 3105 and release the pressure off of the band(s) 3105 to perform an exercise similar to squats. The wider the stance on the elastic band(s) 3105, the more the person may be able to contract the muscles in the thigh area, quads and hamstrings, hips, glutes, lower back, and the abdominal area. A wider stance may focus more on the hip flexors. A closer stance with feet together, may focus more to strengthen the knee muscles and stability.

Figure 32:
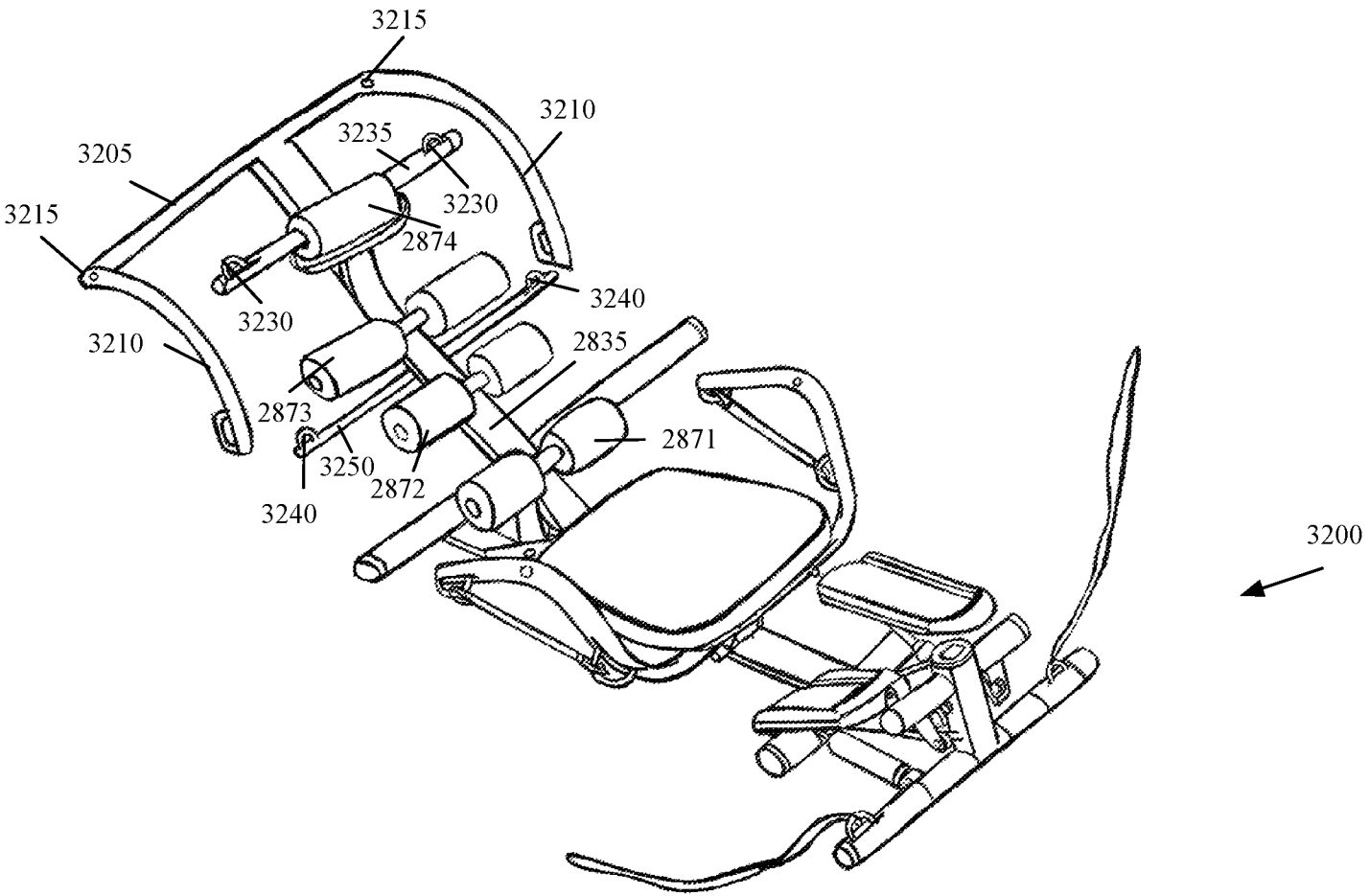

With reference to FIG. 32, the exercise device 3200 may include the top horizontal frame bar 3205. As shown, the top horizontal frame bar 3205 may include two curving iron/steel/metal handlebars 3210. At the end of each handlebar 3210, the handle bar's piping curves into the frame. The curve may be covered with breathable, sweatproof wicking fabric, silicone, and/or vinyl, allowing the person to have better grip on the handles. The person may be able to grab onto both side of the handles when performing ab crunches, creating more pressure and contraction onto the abdominal area.

The top frame bar 3205 may include the swivel-like mechanism and/or push in button mechanism 3215 that may allow the handlebars 3210 to move backwards. Moving the handlebars 3210 backwards may give the person more room, in the case, the person wants to perform an exercise such as chest fly. The chest fly exercise may be performed by attaching an elastic band (not shown) to the connectors 3230 located on the horizontal bar 3235. The chest fly exercise may also be performed by attaching an elastic band to the connectors 3240 on the horizontal frame bar 3250 that is located behind the middle back frame 2835. The elastic bands connected to the connectors 3230 and/or the connectors 3240 may be used to create teeter-totter effect. The teeter-totter effect may be created as described above with reference to the connectors 2884 and 2881 of FIG. 28. The top frame bar 3205 may also include connectors (not shown) to connect elastic bands to create the teeter-totter effect.

The horizontal frame bar 3250 may be designed with one or two individual horizontal iron/steel/metal frame pieces. The horizontal frame bar 3250, in some embodiments, may be foldable. The horizontal frame bar 3250 may be tucked in underneath the vertical frame bar 2835 when the person is not using it. A person may unfold the horizontal frame bar 3250, attach elastic band(s) to the connectors 3240, and then grab the elastic bands by hand. As the person has the elastic band(s) in the hand, the person may slightly bend the elbows in, then move the arms forward in front of the chest, and then move back down. Repeating this back and forth motion may contract the muscles in the chest area. Furthermore, the top horizontal frame bar 3205, in some embodiments, may be detachable, allowing the top horizontal frame bar 3205 to be removed from the exercise device 3200. The top horizontal frame bar 3205 design of FIG. 32 may be incorporated into the exercise devices of FIGS. 28-31.

With reference to FIGS. 29-32, the exercise device 2900, 3000, 3100, and 3200 may include a monitor screen (not shown) similar to the monitor screen 2897 of FIG. 28 that may allow the person to know how many crunches they performed per minute, how many calories were burned, how long the person was using the device, etc. The person may also be able to track and scan each category on the monitor screen.

Figure 33:
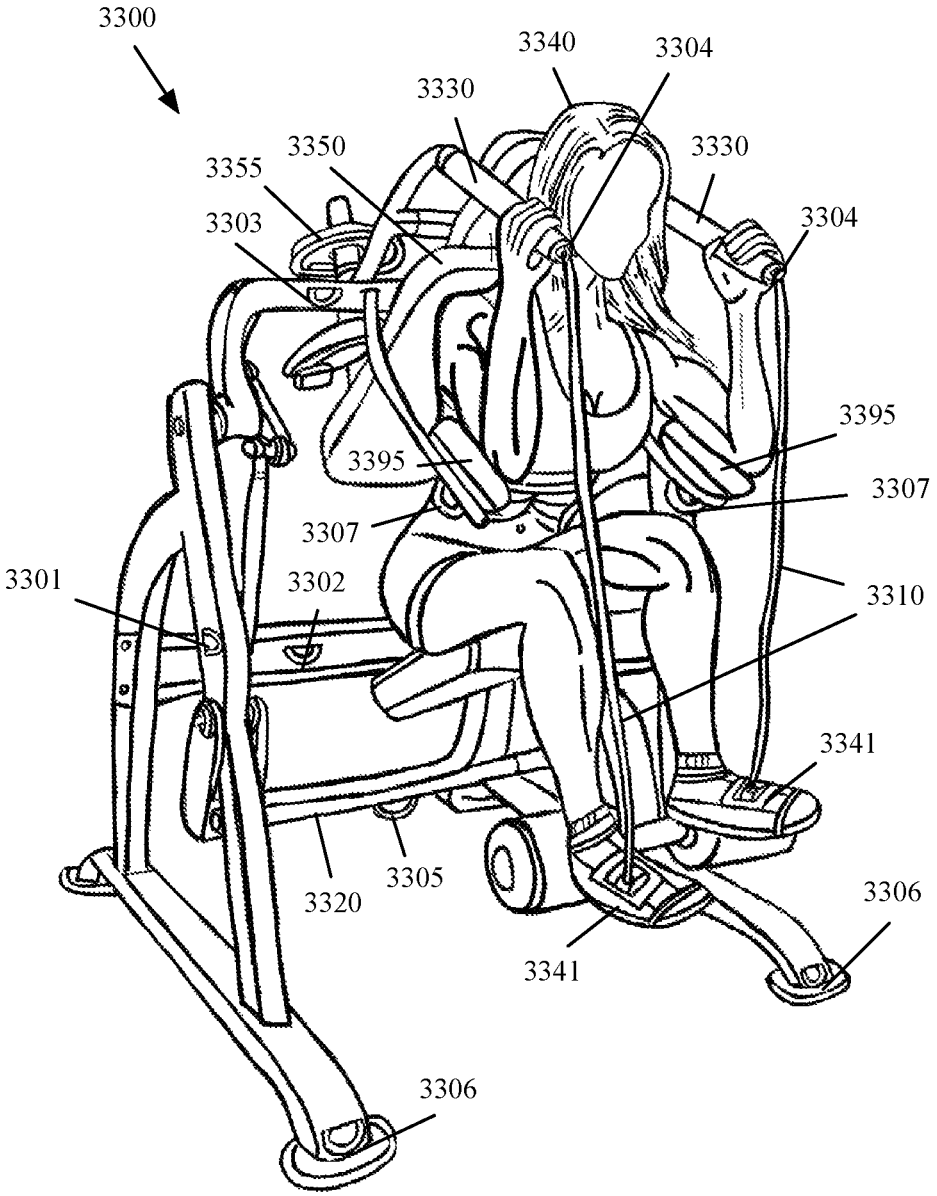
FIG. 33 is a functional diagram showing an example embodiment of a hammerhead abdominal crunch device with connectors and elastic bands to create a teeter-totter effect during abdominal exercises, according to various aspects of the present disclosure.

FIG. 33 is a functional diagram showing an example embodiment of a hammerhead abdominal crunch device with connectors and elastic bands to create a teeter-totter effect during abdominal exercises, according to various aspects of the present disclosure. With reference to FIG. 33, the exercise device 3300 may include several connectors 3301-3307 for connecting elastic bands. Each of the connectors 3301-3307 may be on one side of the exercise device 3300 and may have a counterpart connector on the other side of the exercise device. Since the figure shows a perspective view, some of the connectors are obstructed by other objects in the figure.

As described below, the elastic bands 3310 connected to the connectors 3304 and the foot braces 3341 may create a teeter-totter effect without the use of hands. Creating the teeter-totter effect by using the feet instead of hands provides the technical advantage of freeing the hands to grab elastic bands (not shown) connected to the connectors 3301-3303 and 3305-3307 and exercise different muscle areas simultaneous to exercising the abdominal area muscles.

With reference to FIG. 33, the elastic bands 3310 may be connected to the connectors 3304 that are located at the of the handle bars 3330. As shown, the person 3340 has attached the end of the elastic bands 3310 to the feet (e.g., connected to the foot braces 3341). The person may have the knees close the chest, then move the legs towards the ground. Applying pressure towards the ground while having the elastic bands 3310 attached to the handlebars 3330 and to the foot braces 3341, results the back 3350 of the exercise device 3300 to move forward.

With the elastic bands 3310 connected to the connectors 3304 and to the foot braces 3341, when the person moves the knees back up and/or reduces forward motion with the legs and/or hands, the back 3350 of the exercise device 3300 may move backward. Repeating the down and up motion of the knees/legs towards the ground and back to the chest creates a teeter-totter effect without the need to use the hands to pull (or push) on the handlebars 3330. For additional help, the person may optionally grab the handle bars 3330, as illustrated, in helping the person in performing the hammerhead abdominal crunch. By using the bands 3310, the person may work out the muscles in the abs, legs, and glutes areas all at the same time. The person may also add weights 3355 to a metal/iron/steel pole located in the back of the exercise device 3300.

Figure 34:
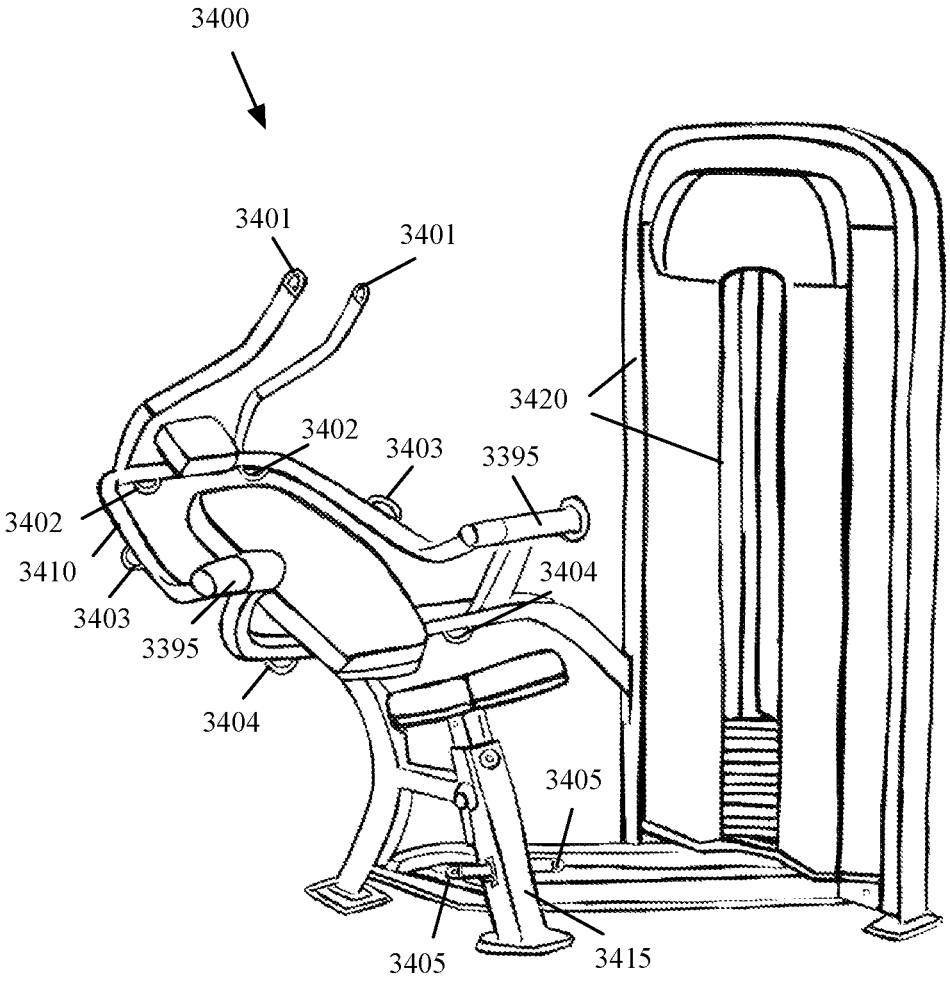
FIG. 34 is a perspective view showing the exercise device of FIG. 33 with a weight mechanism attached to the device, according to various aspects of the present disclosure.

FIG. 34 is a perspective view showing the exercise device of FIG. 33 with a weight mechanism attached to the device, according to various aspects of the present disclosure. With reference to FIG. 34, the exercise device 3400 may include a weight mechanism 3420 to provide additional weights for the device. As shown, the exercise device 3400 may include several connectors 3401-3405 for connecting elastic bands to create teeter-totter effect and/or to exercise multiple muscle groups at the same time.

For example, a person performing exercise may add elastic bands to the connectors 3405 that are located on the leg 3415 of the exercise device 3400 to simultaneously work out the arm muscles, as the person works out the ab muscles. The person may connect elastic band(s) to the connectors 3405 and grab the elastic bands. The person may then curl the arms up towards the chest and then slowly back down.

The person may also work out the chest muscles, by attaching elastic band(s) to the connectors 3403 that are located on the vertical frame 3410 of the exercise device 3400. The person may grab the elastic band, having the elbows slightly bent. The person may then pull the elastic band towards the front of the chest. The person may then slowly release tension off of the bands by moving the elastic bands away from the chest. By moving the elastic band, back and forth with the hands, the person may contract the muscles in the chest area while simultaneously the working out the abs. Adding the connectors to the hammerhead abdominal crunch exercise device provides the technical advantage of enabling a person to exercise chest, leg, and arm muscles simultaneously with exercising the abdominal muscles. Similar to other exercise devices of the present embodiments, the connectors allow attaching elastic bands to create the teeter-totter effect for doing abdominal crunches without the use of the hands. The hands may be used to perform other exercises simultaneous with the abdominal crunches or the hands may rest during the use of the exercise device 3400, by operating the exercise device 3400 with the feet. The exercise devices 3300 and 3400 may include armrest padding 3395 for resting the elbows during an exercise.

Figure 35:
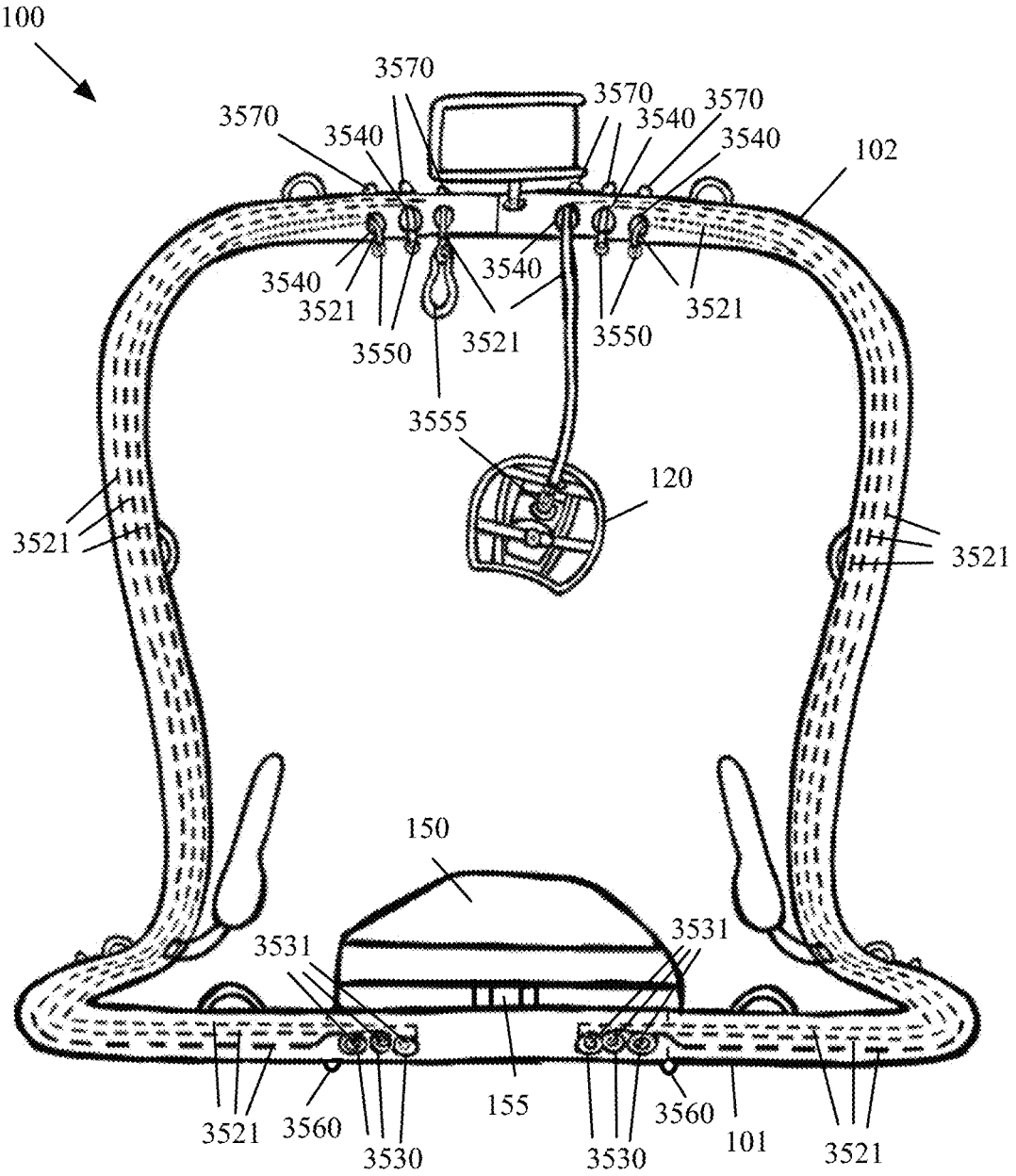
FIG. 35 is a front elevation view of a full body exercise device with one or more retractable band winders, according to various aspects of the present disclosure.
Figure 36:
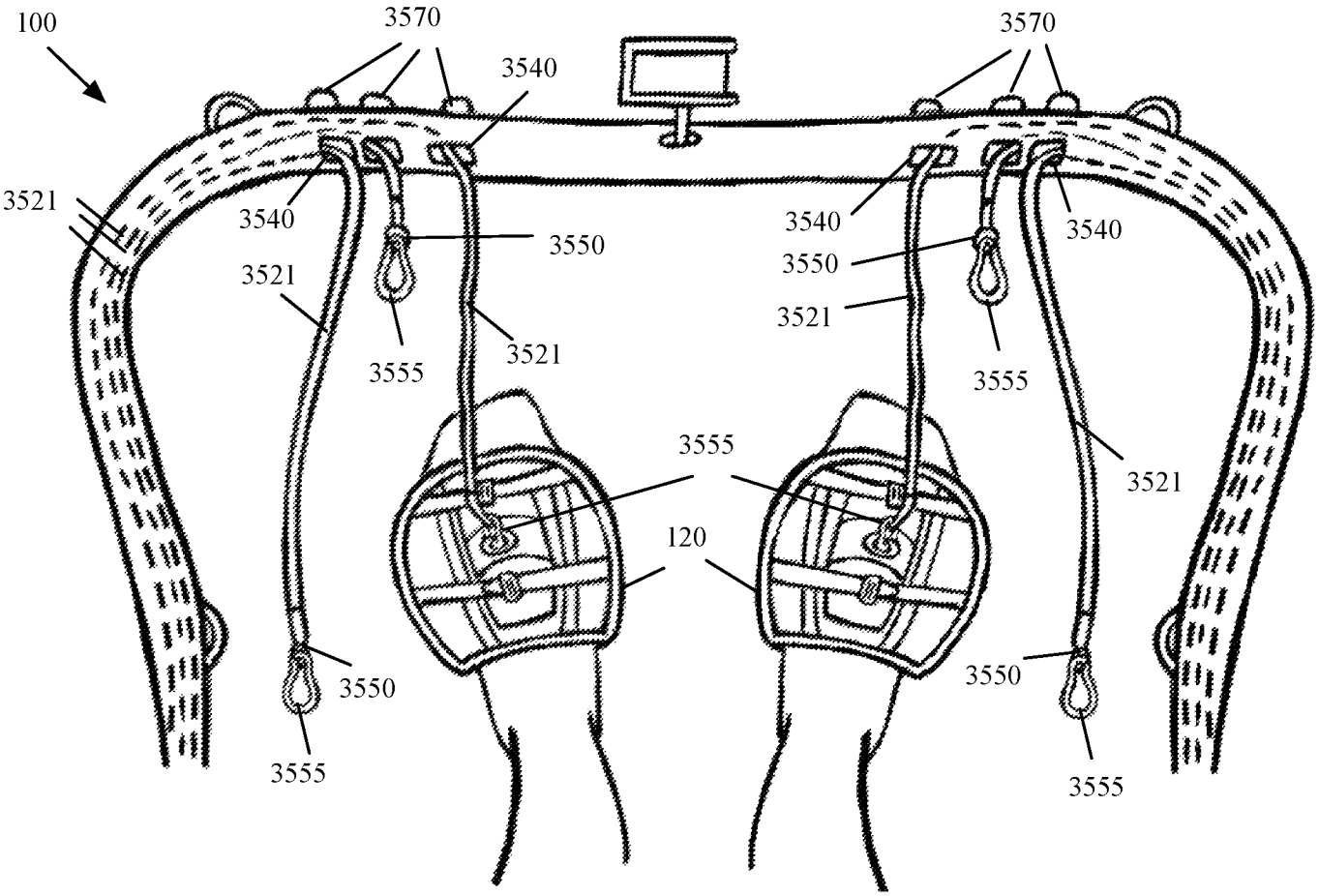
FIG. 36 is a front elevation view of a portion of the full body exercise device of FIG. 35, according to various aspects of the present disclosure.

In some of the present embodiments, the exercise device may include one or more band winders to wind and unwind the elastic band(s). FIG. 35 is a front elevation view of a full body exercise device with one or more retractable band winders, according to various aspects of the present disclosure. FIG. 36 is a front elevation view of a portion of the full body exercise device of FIG. 35, according to various aspects of the present disclosure.

With reference to FIGS. 35-36, the full body exercise device 100 may include similar components as the full body exercise device 100 of FIGS. 1A-6 and 8-18. In addition, the full body exercise device 100 of FIGS. 35-36 may include one or more pairs of retractable bands 3521. The exercise device 100 may also include the band retractor(s) (or band winder(s)) 3530 that may be built-in within the bottom frame section 101. For example, and without limitations, the band retractor(s) 3530, in some embodiments, may be located beneath or behind the headrest 150. The headrest 150 and the band retractor(s) 3530, in some embodiments, may be attached to the bottom frame section 101. Each band retractor 3530 may be a spring loaded band retractor that retracts an elastic band 3521 and/or a cable wire. Each band retractor 3530 may be used to retract (or wind) a corresponding elastic band 3521 and/or cable wire. Alternatively, some embodiments may include one retractable band retractor 3530 to retract more than one elastic bands 3521 and/or cable wires. The elastic band(s) 3521, in some of the present embodiments, may be tubular to facilitate winding and unwinding of the elastic bands.

In some embodiments, the bands 3521 may be non-elastic bands. For example, in some embodiments, cable wire(s) may be used to connect the strap/brace 120. In these embodiments, the non-elastic bands 3521 may be made, for example, and without limitations, from metal (e.g., steel). In these embodiments, the teeter-totter effect may be created by a spring mechanism 3531 in the retractor(s) 3530 (e.g., the retractor(s) 3530 may be spring loaded). When a person pulls on the non-elastic band 3521 with the feet, the spring mechanism 3531 pulls back on the non-elastic band, creating the teeter-totter effect when the person has the feet in the strap/brace 120 of the exercise device 100. Furthermore, the spring loaded band retractors may be used to create resistance when the person pulls the non-elastic bands. The non-elastic bands may, therefore, be used to exercise similar muscle areas as described herein with reference to the elastic bands.

Some embodiments may include a combination of elastic and non-elastic bands. For example, one or more pairs of bands (with one band of each pair on one side of the exercise device and the other band of the pair on the opposite side of the exercise device) may be elastic and one or more pairs of bands may be non-elastic.

In some embodiments, the exercise device 100 of FIGS. 35-36 may include one or more connectors such as the connectors 110-119 of FIGS. 1A-1C and/or one or more connectors such as the connectors 171-180 of FIG. 1D for connecting additional elastic bands to the exercise device 100 (e.g., in addition to the elastic and/or non-elastic bands 3521). In other embodiments, an exercise device that includes band retractors (e.g., the band retractors 3530 of the exercise device 100 of FIGS. 35-36), may not include the connectors 110-119 and 171-180. In these embodiments, the teeter-totter effect may be created by using the elastic and/or non-elastic bands 3530 (e.g., as described above with reference to FIGS. 1A-18).

The bottom, top, and middle frame sections 101-103 may be hallow and the elastic and/or non-elastic band(s) 3521 may go from the corresponding retractor(s) 3530, through the hollow interior of the frame sections 101-103, and may come out of the slots (or openings) 3540 on the top frame section 102. The embodiment depicted in FIGS. 35-36 shows a total of six slots 3540. Three slots on the right side of the top frame section 102 (in the pictured orientation) and three slots on the left side of the top frame section 102 for the elastic bands to come out. In other embodiments, the exercise device 100 may include more than six slots or less than six slots to accommodate a corresponding number of elastic bands 3521.

The elastic and/or non-elastic band(s) in each pair of slots 3540 on the left and right sides of the top frame section 102 may have a different level of weight resistance. For example, the exercise device 100 in FIGS. 35-36 may include elastic bands with three weights: light weight, medium weight, and heavy weight. Different types of resistant bands are described further below.

The ends 3550 of the elastic bands that come out of the slots 3540 may include loops such as webbing loops, snap hooks, shock (bungee) cord hooks, and/or hook/loop fasteners. The webbing loops may be designed to be elastic and/or non-elastic and may be covered with rubber, silicone, and/or vinyl. Each webbing loop may be used to connect a snap hook 3555 or other hooking elements to connect the elastic band 3521 to a foot strap/brace (e.g., the strap/brace 120). In some embodiments of the ends 3550 of the elastic band 3521, a plastic and/or rubber taping may be placed around the webbing loops, snap hooks, shock (bungee) cord hooks, and/or hook/loop fasteners to attach the loop(s) to the elastic band 3521.

In some of the present embodiments, the exercise device 100 with the snap hook 3555 may be connected to the elastic band 3521, and/or the snap hook 3555 may connect to the webbing loop 3550. The attachment of a snap hook 3555 to the end of the elastic band 3521 may eliminate the process of finding a snap hook and attaching the snap hook to the ends 3550 of the elastic band 3521.

The exercise device 100 may include the push in button(s) 3570 to allow a person to press the button(s) 3570 to retract the band that the person has used. In response to pressing a button 3570, the corresponding elastic band 3521 goes into its original position, back to the opening of the slot 3540 located on the top of the frame section 102. Some embodiments of the exercise device 100 of FIG. 35 may include only one push in button 3570 to retract multiple elastic bands 3521.

Some embodiments may not include the push in button(s) 3570. Some of these embodiments may include a spring loaded band retractor that winds a band around a spool (similar to a vacuum cleaner's cord retractor). In some of these embodiments, the elastic band(s) 3521 may be retracted by pulling twice on the bands.

For simplicity, FIG. 35 only shows one foot brace 120. As shown in FIG. 36, another foot brace 120 may be connected to another elastic band 3521 (for example another elastic band with the same level of resistance) on the left side of the top frame section 102 (in the pictured orientation). The exercise device 100 may be used in a similar way as the exercise device 100 described above with reference to FIGS. 1A-6 and 8-18.

The exercise device 100, in some embodiments, may include the push in button(s) 3560 and/or screws located on the left and right side of the bottom frame section 101, next to the headrest 150 to provide access to the band retractor(s) 3530 in case a person needs to fix the alignment of the bands inside the housing box (not shown) where the retractable mechanism 3530 is located. The exercise device 100, in some embodiments, may include a mechanism other than the button and/or screws 3560 for connecting and accessing the retractable band system.

During the workout, a person may select which level of resistant band the person would like to use. Once the person selects the weight level of the band, the person may then attach a snap hook 3555 and/or any loop/hooking like mechanism (e.g., a snap hook or a shock (bungee) cord hook) to the webbing loop 3550. The snap hook 3555 allows the person to connect a foot strap/brace 120 to the elastic band 3521. The person may select a foot strap/brace of the person's choice and change the foot strap/brace 120 to suit the person's preference. The person may then place the feet inside the foot straps/braces 120 and begin performing a teeter-totter without using the hands to perform an abdominal and leg workout, as described above with reference to FIG. 2.

Although the push in buttons 3570 in FIGS. 35-36 are located on the top of the top frame section 102, the push in button mechanism 3570 may be placed anywhere on the frame of the exercise device 100. The push in mechanism, in some embodiments, may include a lock that may allow the user to lock in and secure the length of the band, thereby allowing the user to choose how long the user wants to extend the elastic band 3521 out of the corresponding slot 3540. Adjusting the length of the band and locking the length of the band provide the advantage of allowing the user to target and concentrate in working out different parts of abdominal and leg muscles.

In some embodiments, the function of retracting and locking in the elastic band(s) 3521 may be replaced by another retracting mechanism that allows the user to have a similar type of control for adjusting the length of the band and at the same time, be able to retract the band into its original position. For example, the retractable band system 3530 of some embodiments may allow the user to tug on the band once to extend the length, and tug on the band twice to retract the band in its original position.

It should be noted that any of the full body exercise devices of the present embodiments may include the retractable band system of FIGS. 35-36. For example, the full body exercise devices illustrated in FIGS. 1A-6, 8-34 may include one or more band retractors 3530, one or more slots (or openings) 3540, one or more push in buttons 3560, one or more push in button(s) 3570, etc., for winding and unwinding of elastic and non-elastic bands. In some of these embodiments (e.g., the embodiments that do not include a top frame section), the slots (or openings) 3540 may be on the middle frame section 103 of the exercise device.

Figure 37:
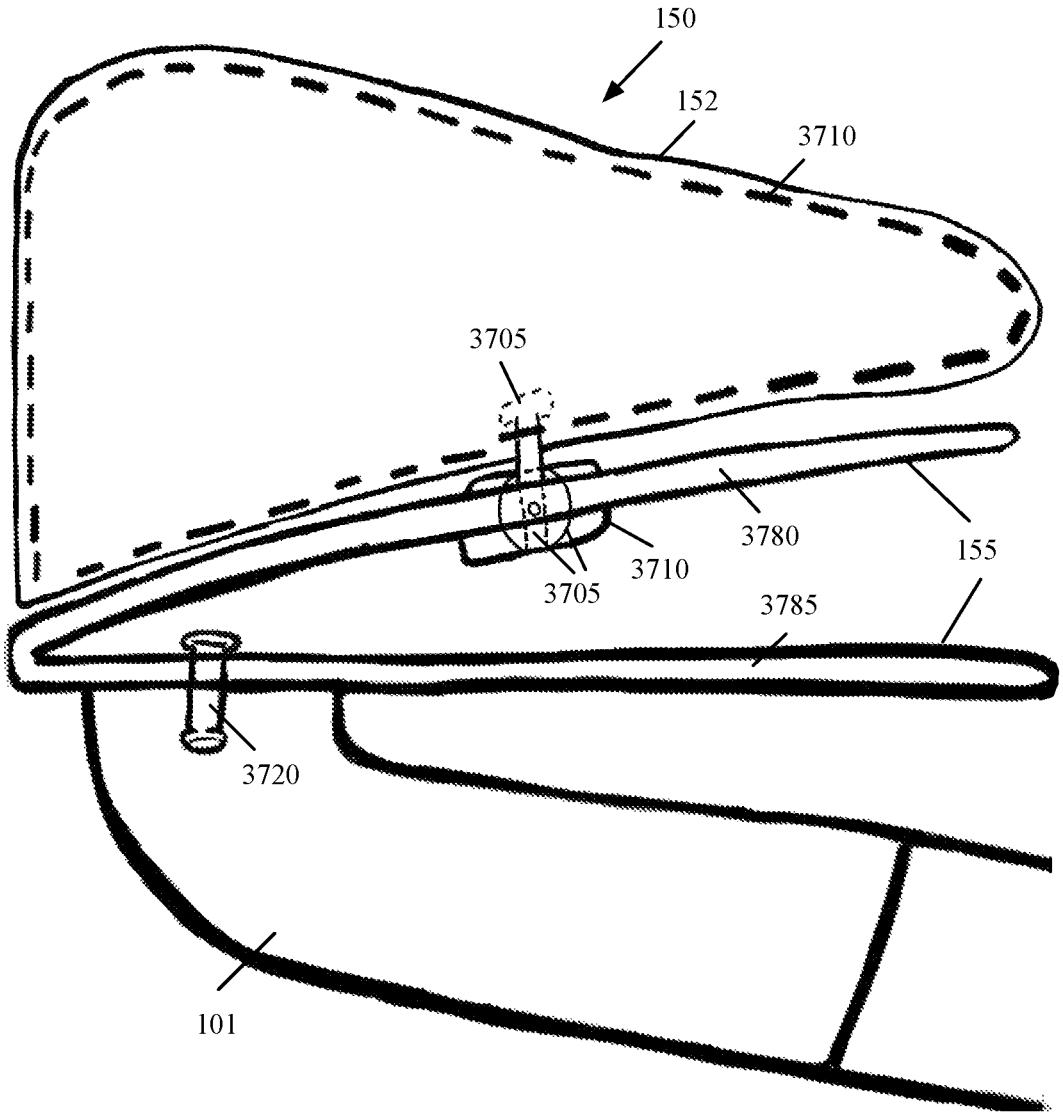
FIG. 37 is a side elevation view of the headrest of a full body exercise device, according to various aspects of the present disclosure.

FIG. 37 is a side elevation view of the headrest 150 of a full body exercise device, according to various aspects of the present disclosure. With reference to FIG. 37, the headrest 150, in some embodiments, may include a head cushion 152. The headrest 150, in some embodiments, may include a shapeable material such as padded memory foam 3710. In addition to, or in lieu of, memory foam, the headrest 150, in some embodiments, may include a shapeable material such as gel. The headrest 150, in some embodiments, may be an ergonomic contouring headrest that may move with the motion of the device. During an exercise, the padded memory foam 3710 may contour and hug the head of a person, as well as the lower and higher part of the neck area. In some embodiments, the head cushion 152 may be covered by material such as, for example, and without limitations, leather, fabric, wicking fabric etc.

The headrest 150 may include an adjustable spring lock 155 that may allow the headrest 150 to move up and down with the pressure of the neck and head during exercise. In some embodiments, the head cushion 152 may include a frame (not shown) to connect the head cushion 152 to the adjustable spring lock 155. The headrest, in some embodiments, may be attachable to and detachable from the adjustable spring lock 155. The bottom section 3785 of the adjustable spring lock 155 may be connected to the lower frame section 101 of the exercise device by the bolt screws 3720 (only one bolt screw is shown in the side view of FIG. 37).

The adjustable spring lock 155 may allow the headrest 150 to move up and down and lock the headrest to its location on the top section 3780 of the adjustable spring lock 155 by the turning the knob 3705 (or push button) located underneath the headrest 150. The adjustable spring lock 155 may also be located on the back, the side, and/or in the front underneath the headrest area. Instead of a knob 3705 (or a push button), the adjustable spring lock 155, in some embodiments, may include a single lever or button that may be pushed in or pulled out, in order to lock or unlock the location of the headrest 150 on the top section 3780 of the adjustable spring lock 155.

With further reference to FIG. 37, the headrest 150 may include a slider 3710 that may fit over the top section 3780 of the adjustable spring lock 155, which may allow adjusting the position of the headrest 150. Tightening of the knob 3705 may securely hold the headrest 150 in place from not sliding on the top section 3780 of the adjustable spring lock 155. The slider 3710 may be adjusted at any desired location on the top section 3780 of the adjustable spring lock 155 where the headrest 150 is placed, allowing the person to adjust the headrest 150 to the length of the person's desire.

Instead of the slider 3710 and the knob 3705, the adjustable spring lock 155, in some embodiments, may include a group of slots/holes (not shown) and the headrest 150 may include a push button mechanism (not shown) that latches onto the slots/holes (not shown). The push button and the slots/holes may allow the adjustable spring lock 155 to be retractable, allowing the user to adjust the headrest forward or backward, select a slot of their choice, and secure the placement of the headrest 150.

The adjustable spring lock 155 provides the technical advantage of allowing the headrest 150 to move up and down as the exercise device moves forward and back down to the ground, thereby preventing the edges of the headrest to scrap the back of the user's neck. The adjustable spring lock 155 may provide the following benefits. The adjustable spring lock 155 may support the neck by providing better usage of the headrest 150 for different sizes of users, where the user may adjust the headrest 150 to fit to the person's liking. The slider 3710 provides the technical advantage of allowing the position of the headrest 150 to be adjusted on the adjustable spring lock 155 of the exercise device 100.

Figure 38:
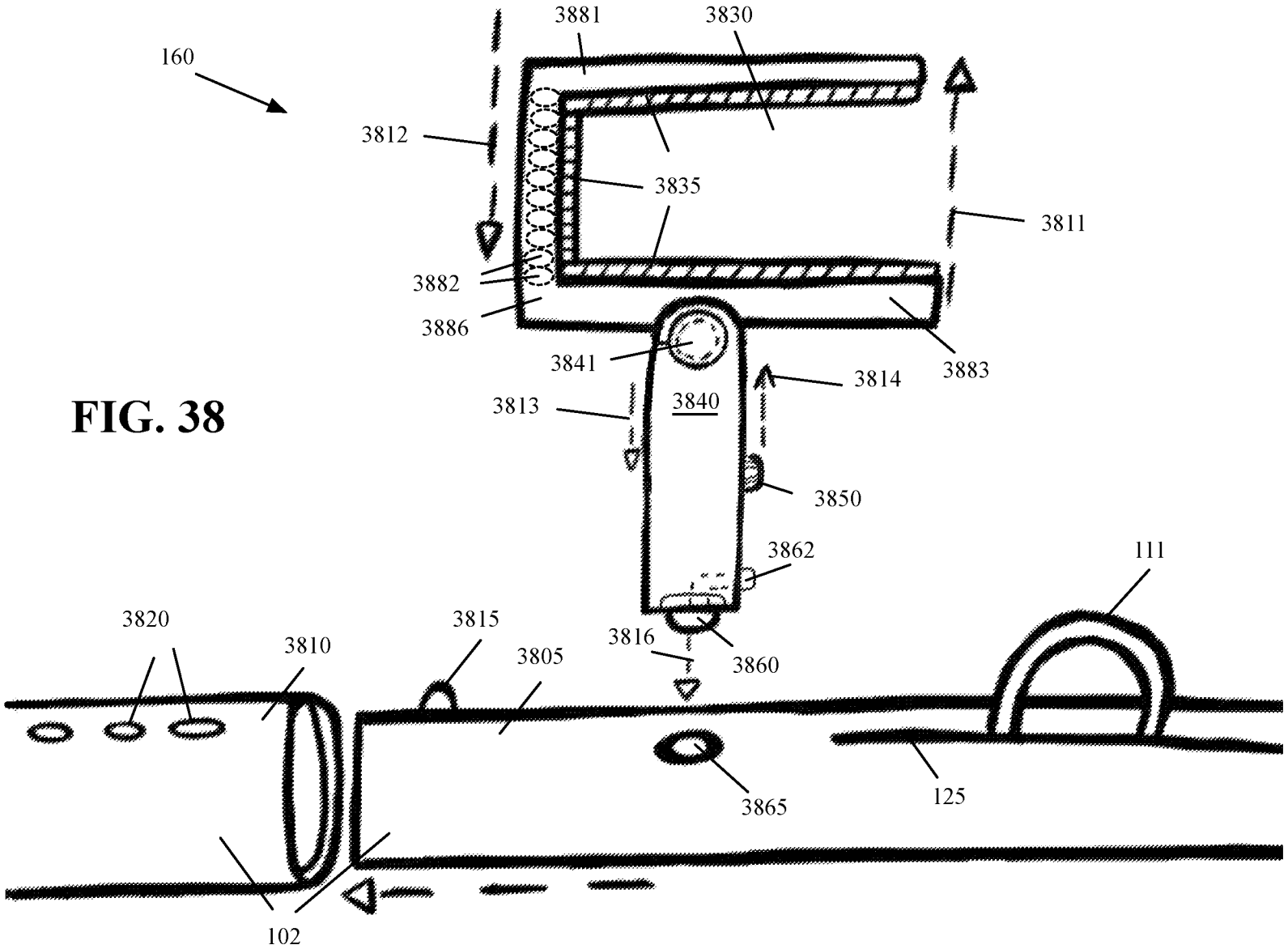
FIG. 38 is a front elevation view of a 360-degree rotating phone holder with a push in button mechanism that laches into the top frame section of the full body exercise device, according to various aspects of the present disclosure.

FIG. 38 is a front elevation view of a 360-degree rotating phone holder with a push in button mechanism that laches into the top frame section of the full body exercise device, according to various aspects of the present disclosure. With reference to FIG. 38, the phone holder 160 may have a C shape and may be placed on the right side or the left side of the top frame section 102 (in the pictured orientation) of the exercise device 100. In the example of FIG. 38, the phone holder 160 is placed on the right side 3805 of the top frame section 102. The right side 3805 of the top frame section 102 may connect to the left side 3810 by sliding the right side of 3805 into the left side 3810 of the top frame section 102 (or vice versa). The push down button 3815 may latch to the slot(s)/opening(s) 3820.

With reference to FIG. 38, a person may slide a phone through the open area 3830 of the phone holder 160. The phone holder 160 may include a spring mechanism 3882 that may allow the phone holder 160 to open and close. As shown by the arrow 3811, the top portion 3881 of the phone holder may open up (and/or down) to place a phone in the phone holder 160. As shown by the arrow 3812, the phone holder may close after a phone is placed in or removed from the phone holder 160. The phone holder 160 may include the rubber grooves 3835 located inside of the top 3881 and bottom 3883 portions of the phone holder 160. The rubber grooves 3835 may also be located on the inside corner 3886 of the phone holder 160. The rubber grooves 3835 may provide a tight grip around the phone, in order to secure the phone when the phone is placed inside of the phone holder 160.

With further reference to FIG. 38, the phone holder 160 may include a shaft/leg 3840. A rolling ball 3841 may allow a phone placed in the phone holder 160 to be tilted to or rotated in any direction forward or backward (e.g., to rotate in 360 degrees in a vertical plane), aligning the phone to comfort of the user. For example, in some of the present embodiments, the phone holder 160 may be rotated in 360 degrees around the rolling ball 3841. The phone holder 160 may have a locking mechanism (not shown) to tighten the phone holder 160 to the shaft 3840 once the phone holder is rotated to a desired angle.

The push in button 3860, which is located on the bottom of the shaft 3840, may latch (as shown by the arrow 3816) into the slot/opening 3865 that is located on the right side 3805 of the top frame section 102. The slot/opening 3865, in some embodiments, may be located on the left side 3810 of the top frame section 102. The push in button 3860 and the slot/opening 3865 may allow the phone holder 160 to be attached to the top frame section 102. Some embodiments may include several slot/opening 3865 on the top frame section 102 of the exercise device to allow a person to select where to attach the phone holder 160. The push in button 3860 may include a release button 3862.

The height of the shaft/leg 3840, in some embodiments, may be adjustable (as shown by the arrows 3813 and 3814). For example, in some embodiments, the shaft/leg 3840 may have several separate sections (not shown). Some of the sections may be made hollow to make the sections to be telescopically slidable within each other. The inner diameter of a first section may be substantially similar to the outer diameter of a second, adjacent, section such that second section may telescopically be slid within the first section. The shaft/leg 3840 may include a spring loaded lock 3850 to hold or release a section that is slid into an adjacent section.

The phone holder 160, in some embodiments, may include a charger (not shown) to charge a phone once the user places the phone inside the phone holder. For example, the exercise devices disclosed herein may include a rechargeable battery, which may be used to recharge the phones. The rechargeable battery may provide an indication (e.g., a light emitting diode (LED) or similar visual indication) that the battery may need to be recharged. A user may then connect the rechargeable battery to a separately provided charger to recharge it.

Once the user places the phone inside the phone holder 160, the person may be able to watch a digital coach on the phone while working out to track the progress, including how many calories were burned, how many sits up, and legs exercises were completed. The phone holder 160, in some embodiments, may automatically recognize when a phone is placed on and taken off. In some embodiments, once a phone is placed inside the phone holder, the phone may automatically get charged.

II. Elastic Exercise Bands with Foot or Hand Straps

Some embodiments provide different designs of straps that may be connected to an elastic band. The straps may be used around a foot and/or around a hand. As indicated in Section I, above, the terms strap and brace are interchangeably used in this specification when referred to a device that may be worn on a foot and/or on a hand. All straps/braces of the present embodiments may be connected to an ab roller exercise device or may be used independently without an ab roller device. Several examples of using the straps/braces of the present embodiments without an ab roller device are provided below.

Figure 39:
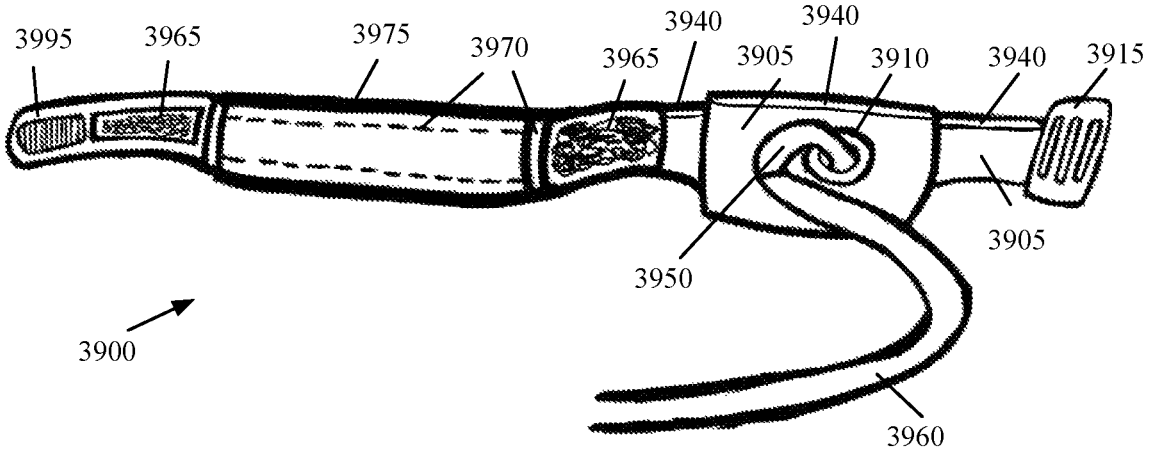
FIG. 39 is the top perspective view of a strap/brace with a fastening buckle strap that goes through a handlebar, according to various aspects of the present disclosure.
Figure 40:
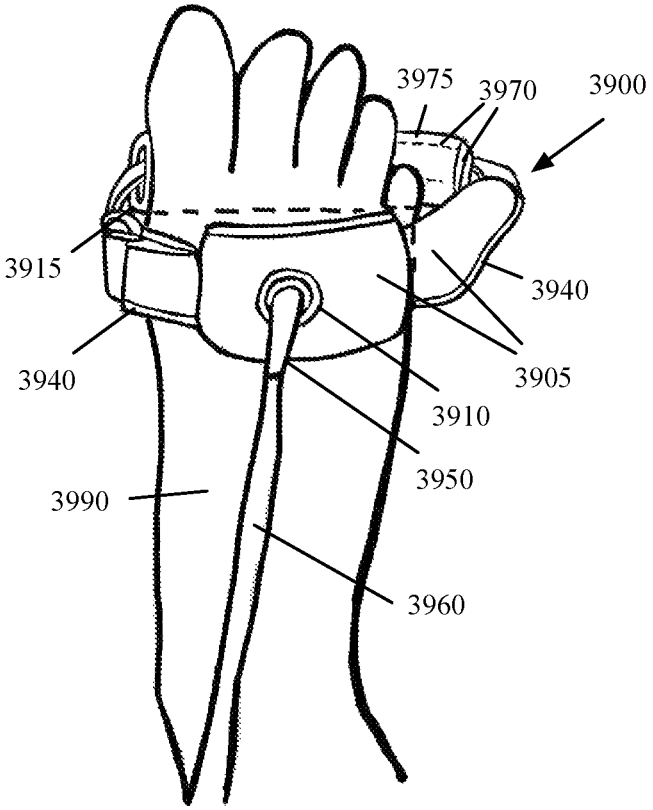
FIG. 40 is the top perspective view of the strap/brace of FIG. 39, with the handlebar wrapped around a foot, according to various aspects of the present disclosure.

FIG. 39 is the top perspective view of a strap/brace 3900 with a fastening buckle strap that goes through a handlebar, according to various aspects of the present disclosure. FIG. 40 is the top perspective view of the strap/brace of FIG. 39, with the handlebar wrapped around a foot, according to various aspects of the present disclosure.

The strap/brace 3900 may be used around a foot (as shown in FIG. 40) or around a hand (not shown). The strap/brace 3900 may be used with an elastic band 3960, with an ab roller device (e.g., and without limitations, as shown by item 120 in FIGS. 1A-1B, 1D, and 2-4). The strap/brace 3900 may also be used with the elastic band 3960 without an ab roller device.

With further reference to FIGS. 39-40, the strap/brace 3900 may include a soft cover 3905 made from wicking fabric. The wicking fabric may draw moisture away from the body and may be made, for example, and without limitations, from neoprene fabric, polyester fabric, microfiber fabric, and/or microfiber polyester fabric. The wicking fabric may absorb sweat and may provide a tight comfort support around the foot and/or the hand. The wicking fabric may protect the skin of a user from the hard edges of the elements that are incorporated within the strap/brace. Examples of such elements may include the grommet/eyelet 3910, the fastening buckle 3915, the snap hook 4120 (shown in FIG. 41A), as well the hard edges of the elastic and/or non-elastic webbing loop strap 4190 (shown in FIG. 41E).

Figure 41A:
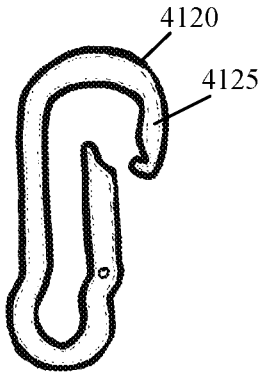
FIG. 41A is a front elevation view of a snap hook, according to various aspects of the present disclosure.
Figure 41B:
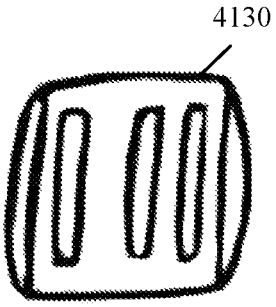
FIG. 41B is a front perspective view of a soft cover for the buckle of a strap/brace, according to various aspects of the present disclosure.

FIG. 41A is a front elevation view of a snap hook, according to various aspects of the present disclosure. As shown, the snap hook 4125 may be covered with wicking fabric (e.g., microfiber polyester fabric) and/or foam 4120 for cushioning. FIG. 41B is a front perspective view of a soft cover for the buckle of a strap/brace, according to various aspects of the present disclosure. The soft cover 4130 may be used to cover the buckle 3915 of FIGS. 39-40. The soft cover 4130 may be made, for example and without limitations, from wicking fabric and may be detachable from the buckle 3915 to allow a user to cover other buckles the user may own. Alternatively, the soft cover 4130 may be attached and/or (sewed in) permanently to the strap/brace 3900.

The hooks and the buckles of the prior art are not covered by protective fabric or foam. Covering the snap hook 4125 and the buckle 3915 by protective fabric and/or foam provides the technical advantage of protecting the user's skin. With further reference to FIGS. 39 and 40, the strap/brace 3900 may include a second fabric 3940 made from elastic and/or nonelastic webbing material. With reference to FIG. 39, at least a portion of the second fabric may have hook-and-loop fasteners 3965 on one side and may be covered by the wicking fabric 3905 on the other side. At least a portion of the second fabric 3940 may not have hook-and-loop fasteners behind it and may only be covered by the wicking fabric 3905.

As shown, one end of the strap/brace 3900 may be connected to the buckle 3915. In the example of FIG. 39, the buckle includes three loops to allow a person to not only fasten the strap/brace 3900 through the first and second loops, but also tighten the strap/brace 3900 for more security by placing the end of the strap/brace 3900 through the third loop to secure the strap/brace 3900 from untying. In other embodiments, the buckle 3915 may include any different number of one or more loops. The buckle 3915 may be made of material such as, for example and without limitations, plastic, steel, and/or other types of metal.

Examples of different type of buckles that may be used by the straps/braces of the present embodiments may include, for example, and without limitations, double 3 bar slide belt buckle, double D ring belt buckle, double O ring belt, side release belt buckle, sports belt buckle, single adjust side release buckle, double adjust side release buckle, metal/plastic hybrid side release buckle, split release buckle, single adjust whistle side release buckle, reflective side release buckle, heavy duty single adjust side release buckle, plastic 3-way side release buckle, adjust lock side release, center release buckle, plastic side release buckles, cam buckles, strap adjusters, plastic sternum strap adjuster, cast flat metal slide, rounded metal slides, metal reducing loops, metal strap adjuster, etc. Any of these types of buckles may be used in other strap/braces of the present embodiments that are described as including buckles.

In some embodiments, an elastic band 3960 may include the eyelet or grommet 3910, which may be made of, for example, and without limitations, metal and/or rubber. In the example of FIGS. 39-40, the elastic resistance band 3960 is placed directly through the eyelet or grommet 3910 without a snap hook, resulting the elastic band to permanently latch on and be attached to the strap/brace 3900. Alternatively, the eyelet or grommet 3910 may be connected to a snap hook (e.g., made of steel or plastic), such as the snap hook 4125 of FIG. 41A.

In some embodiments, the snap hook 4125 may connect to an elastic resistance band through a grommet and/or an elastic or non-elastic loop webbing strap. The end of the elastic band 3960 may include a webbing loop 4190 (shown in FIG. 41E) that may connect into the snap hook 4125 and be attached to eyelet or grommet 3910 of the strap/brace 3900. Attaching the snap hook 4125 through the eyelet or grommet may allow a person to connect different straps/braces to an elastic band. Furthermore, the person may able to connect more than one elastic band, with the ends made with webbing loops, by connecting the webbing loops into the snap hook 4125.

With further reference to FIGS. 39-40, the hook-and-loop fasteners 3965 (which may be made of elastic and/nonelastic webbing material) may cover a portion of the strap/brace 3900. The strap/brace 3900 may include a handlebar 3970, which may be covered by soft material such as, for example, and without limitations, foam and/or rubber 3975. The handlebar 3970 may be made of, for example, and without limitation, plastic or polyvinyl chloride (PVC). The handlebar 3970 and the soft cover (e.g., foam and/or rubber) 3975 provide the technical advantage of allowing a user to grab the handlebar 3970 by hand, allowing a comfortable grip, and enabling the user to perform arm, chest, and/or shoulder exercises.

As shown, a portion of the handlebar 3970 may go through the core of the cover 3975. As shown in FIG. 40, the handlebar 3970, covered with the foam and/or rubber 3975, may provide an extra exercise benefit by placing the strap/brace 3900 beneath a foot while standing up on the core handlebar 3975. The user may roll the handlebar 3970 on the floor and against the bottom of the foot 3990. For example, a handlebar 3970 made of hard plastic and covered by the foam and/or rubber padding 3975 may give the user the ability to relieve discomfort and ease pain associated with plantar fasciitis while performing the rolling motion of the handlebar 3970 on the floor against the feet.

During operation, the end 3995 of the strap/brace 3900 may be placed through the fastening buckle 3915, allowing the user to tighten and secure the strap/brace 3900 around the foot or hand. Some of the embodiments of the elastic band 3960 may include a plastic cover 3950 around the end of the elastic band 3960. The plastic cover 3950 may tighten the pressure of the elastic band 3960 and may result in tightening the pressure around a ball (not shown) that is located inside the end of the elastic band 3960. This ball may act as a block way or a barrier for the elastic band 3960 and may prevent the elastic band 3960 from slipping out through the eyelet/grommet 3910. In some embodiments, the strap/brace 3900 may not include an eyelet/grommet and may only include a nonelastic and/or elastic webbing loop.

Figure 41C:
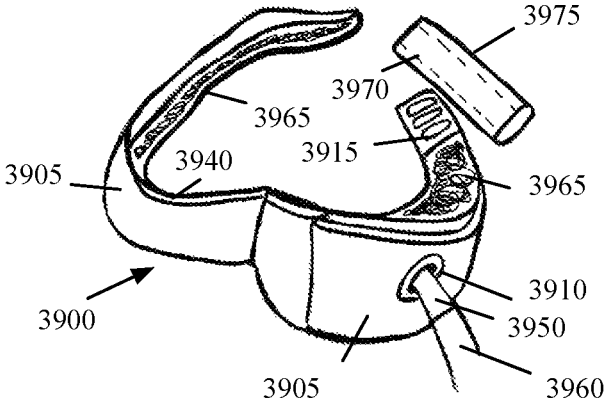
FIG. 41C is a top perspective view of the strap/brace of FIGS. 39-40 with the handlebar being detached, according to various aspects of the present disclosure.

With reference to FIGS. 39-40, the handlebar 3970 and the cover 3975 may be detached from the strap 3900, allowing the user to place the strap/brace 3900 around the foot or hand without the plastic or PVC core handlebar 3970. FIG. 41C is a top perspective view of the strap/brace of FIGS. 39-40 with the handlebar being detached, according to various aspects of the present disclosure. With reference to FIG. 41C, in order for the handlebar 3970 and the cover 3975 to be removed from the strap/brace 3900, one end of the strap/brace 3900 may be pulled out through the handlebar 3970. As an example, in one embodiment, the handlebar 3970 may have a cylindrical shape with a diameter of 1.5 inches and a hollow interior of 1.25 inches. In other embodiments, the handlebar 3970 may include different dimensions.

Figure 41D:
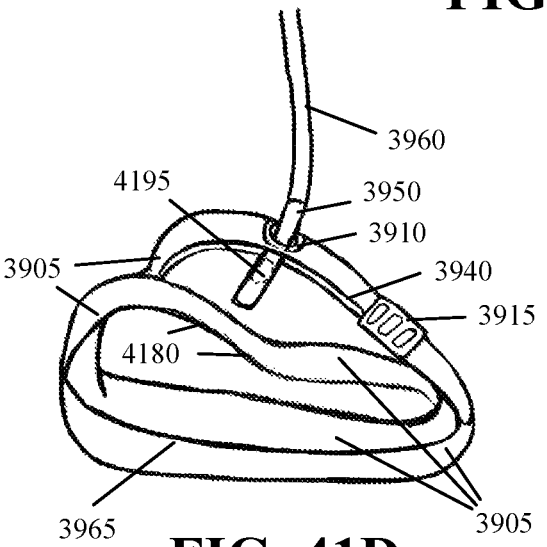
FIG. 41D is a side perspective view of the strap/brace of FIGS. 39-40 without a snap hook and without a foam/rubber handlebar, according to various aspects of the present disclosure.

FIG. 41D is a side perspective view of the strap/brace of FIGS. 39-40 without a snap hook and without a foam/rubber handlebar, according to various aspects of the present disclosure. Other components of the strap/brace of FIG. 41D may be similar to the strap/brace 3900 of FIGS. 39-40. With reference to FIG. 41D, the portion 4180 may be designed with elastic, non-elastic, and/or hook-and-loop fasteners webbing strap(s).

In some embodiments, a circular shape object 4195 (for example, made of plastic, rubber, or wood) may be placed at the end of the elastic band 3960 to prevent the elastic band 3960 to disconnect from the eyelet/grommet 3910. In the embodiment of FIG. 41D, the circular shape object is replaced with a rectangular shape object 4195 (for example, made of plastic, rubber, or wood) to obstruct the elastic band 3960 from coming out of the eyelet/grommet 3910. The technical advantage of the rectangular shape object versus the circular shape object is that the rectangular shape object 4195 may lay flat against the strap instead of the bulkiness of the circular shape (which may rub and irritate the skin during usage). As shown, the cover 3950 (e.g., made of plastic or rubber) may be placed around the elastic band 3960 to tighten the pressure of the elastic band around the circular or rectangular shape object 4195 inside of the elastic band 3960.

Figure 41E:
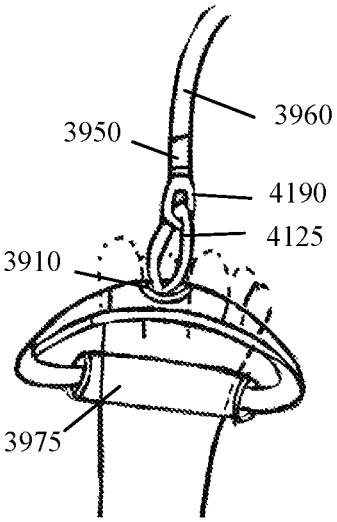
FIG. 41E is a front perceptive of a strap/brace with a handlebar connected to an elastic band by a snap hook, according to various aspects of the present disclosure.

FIG. 41E is a front perceptive view of a strap/brace with a handlebar connected to an elastic band by a snap hook 4125, according to various aspects of the present disclosure. The snap hook (or carabiner) 4125 may be, for example, similar to the snap hook 4125 of FIG. 41A. The snap hook 4125 may be made of, for example, and without limitation, steel or plastic. The snap hook 4125 may be connected through the eyelet/grommet 3910. The snap hook 4125 may also be connected to the webbing loop 4190 that is at the end of the elastic resistance band 3960. This snap hook 4125 may allow a person to connect the strap/brace 3900 to the elastic band 3960. The webbing loop 4190 may be made of elastic and/or nonelastic webbing and may also be covered with a soft wicking fabric to protect the skin from being irritated from the hard-sharp edge of the webbing loop 4190.

Figure 42A:
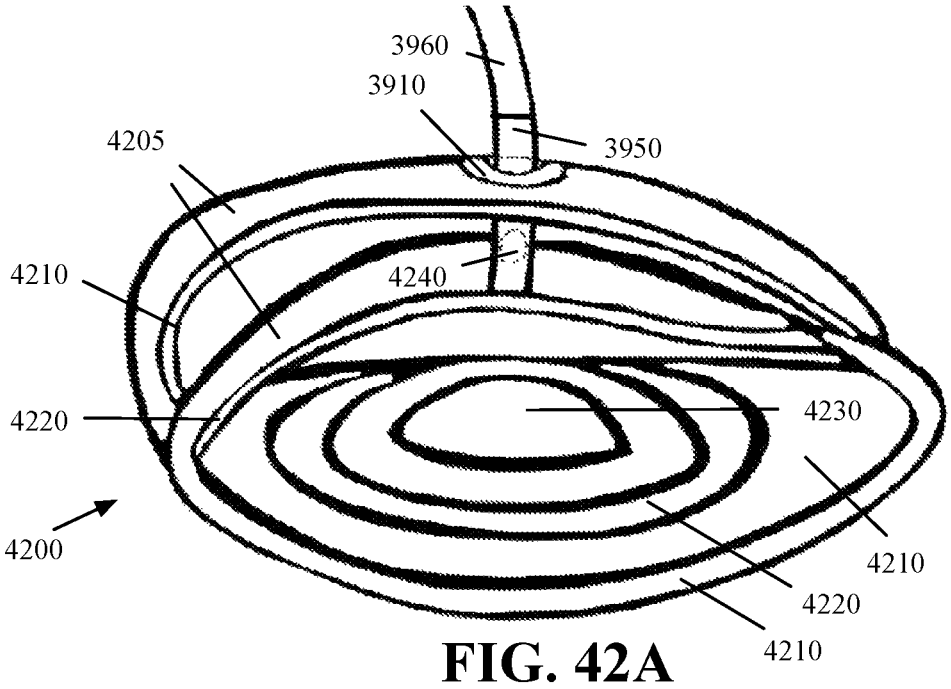
FIG. 42A is a side perceptive view of a slip-on strap/brace with extra cushioning, according to various aspects of the present disclosure.
Figure 42B:
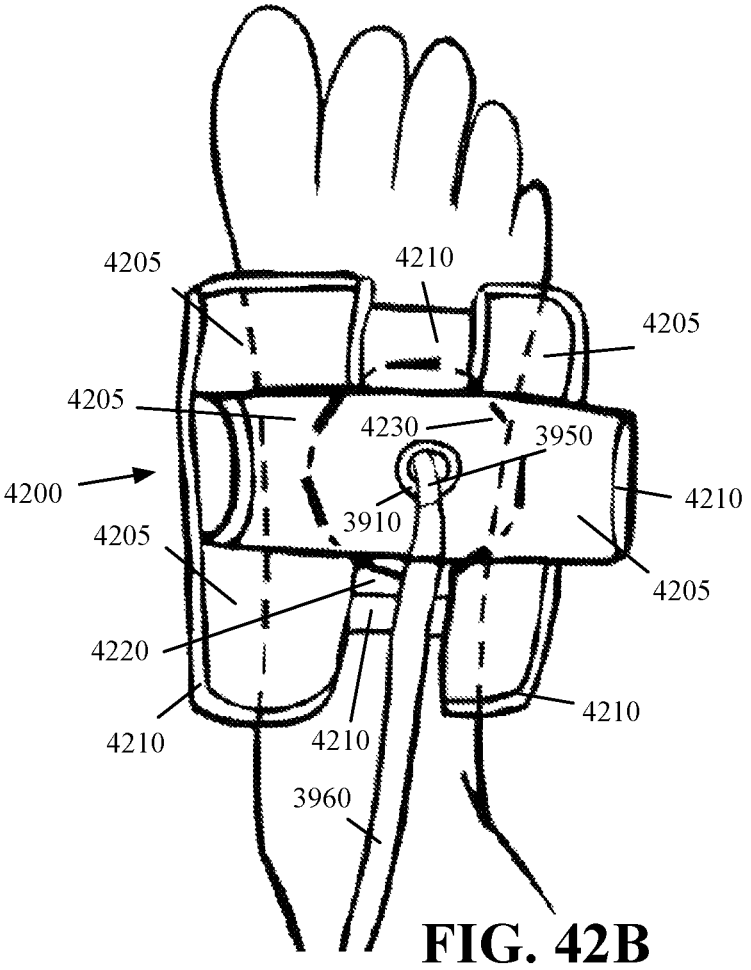
FIG. 42B is a top view of the slip-on strap/brace with extra cushioning of FIG. 42A connected around a foot, according to various aspects of the present disclosure.

FIG. 42A is a side perceptive view of a slip-on strap/brace with extra cushioning, according to various aspects of the present disclosure. FIG. 42B is a top view of the slip-on strap/brace with extra cushioning of FIG. 42A connected around a foot, according to various aspects of the present disclosure.

With reference to FIGS. 42A-42B, the strap/brace 4200 may include a soft protection cover 4205 made from breathable wicking fabric, such as, for example, and without limitations, neoprene fabric. The wicking fabric may protect the user's skin from the hard edges around the eyelet/grommet 3910 and may give the user comfortability while putting on the strap/brace 4200.

The strap/brace 4200 may include a second layer of fabric 4210 made, for example, and without limitations, from elastic and/or nonelastic webbing which may also be covered with the soft protection cover 4205 made from breathable wicking fabric. The elastic webbing fabric 4210 may allow the user to stretch the strap/brace 4200 out to fit the person's foot. Different sizes of strap/brace may be designed to fit the width of different users' feet. There are multiple layers of fabric, which may include, for example, and without limitations, a double or triple layer of elastic and/or non elastic webbing fabric that may be covered with one and/or more layers of wicking fabric.

With further reference to FIGS. 42A-42B, the strap/brace 4200 may include the cushion padding 4220 that may be made, for example, and without limitation, from foam or memory foam. In some embodiments, the padding 4220 may be made of gel pads for cushioning. The padding 4220 provides the technical advantage of giving the user's foot support for relieving any foot pain. In some embodiments, the padding 4220 may be covered with wicking fabric 4205.

The strap/brace 4200 may include the extra padding 4230 for cushioning to provide additional foot support. The extra padding 4230 may be made, for example, and without limitations, from foam, memory foam, gel pads, etc. The extra padding 4230 may support the user's heel, in case the user suffers from different types of foot pain, such as plantar fasciitis, flat feet, high or low arches. The extra padding 4230 may also help relieving foot pain. The extra foam padding 4230 may have an extra shock absorbing core, that may give support to help the user develop correct body postures by reducing force on the heels, the arch of the user's foot, as well as help aligning the user's hips and back.

The strap/brace 4200 may include a circular or rectangular shape object 4240 that may be placed inside the elastic band 3960. The circular or rectangular shape object 4240 may obstruct the path between the grommet 3910. The obstruction that is created by the circular or rectangular shape object 4240, may not allow the elastic band 3960 to slip out or slide off the elastic webbing 4210 and/or the soft protection cover 4205. The strap/brace 4200 may include the additional rubber 3950 that may cover, hold, and tighten the pressure of the elastic band 3960 around the circular or rectangular shape object 4240.

Figure 43:
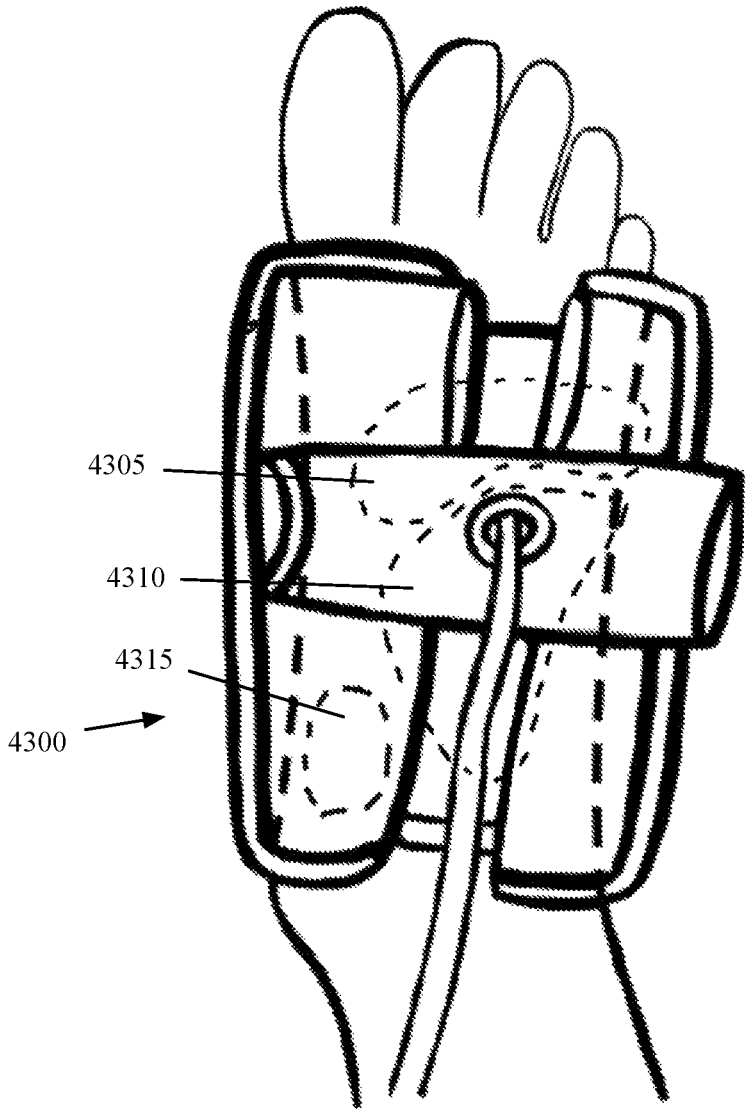
FIG. 43 is a top view of the slip-on strap/brace of FIGS. 42A-42B with additional cushioning, according to various aspects of the present disclosure.

FIG. 43 is a top view of the slip-on strap/brace of FIGS. 42A-42B with additional cushioning, according to various aspects of the present disclosure. With reference to FIG. 43, the strap/brace 4300 may include with additional cushioning for the bottom of the user's foot. The extra foam, memory foam, and/or gel cushioning 4305 may give support to the front, bottom section of the user's foot. The extra memory 4310 may give the user's foot arch support. The additional memory foam cushioning 4315 may give the user support in the heel area of the bottom of the foot. The strap/brace 4300 may be covered with soft breathable wicking fabric. The additional cushion paddings 4305-4315 may distribute the pressure across the front, middle, and lower part of the user's foot and may help with posture. The additional cushion paddings 4305-4315 may relieve foot pain, such as heel pain, Achilles tendinitis, arch pain, forefoot pain, etc.

Figure 44A:
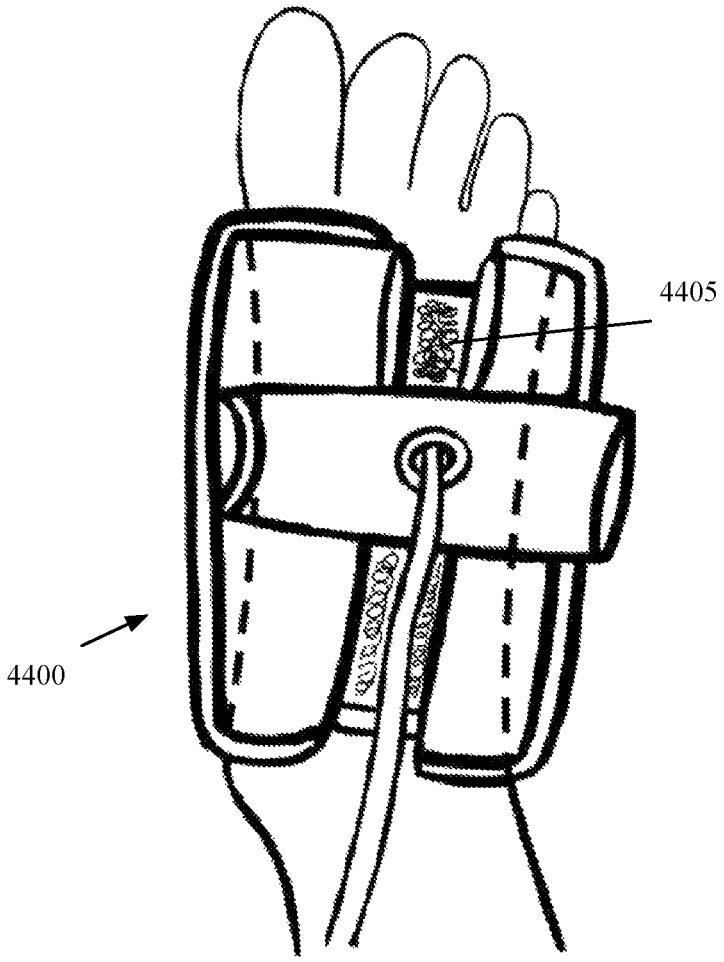
FIG. 44A is a top view of a slip-on strap/brace with a detachable and changeable cushioning that includes hook-and-loop fasteners, according to various aspects of the present disclosure.

FIGS. 44A-44D illustrate a detachable changeable cushioning that includes hook-and-loop fasteners, according to various aspects of the present disclosure. FIG. 44A is a top view of a slip-on strap/brace 4400 with a detachable and changeable cushioning that includes hook-and-loop fasteners, according to various aspects of the present disclosure. With reference to FIG. 44A, the hook-and-loop fasteners may allow changing the inner cushioning of the strap/brace 4400. The hook-and-loop fasteners may include the soft (or the loop) portion 4405 of the hook-and-loop fastener. The loop portion 4405 may be located inside the strap/brace 4400. In some embodiments, the strap/brace 4400 may also be placed around the hand or wrist areas.

Figure 44B:
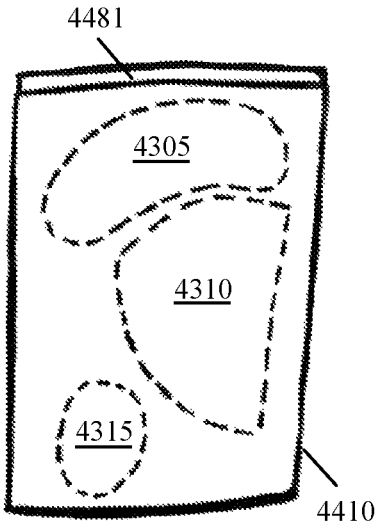
FIG. 44B is a top view of an extra memory foam and/or gel cushioning pad that covers the arch of the foot, the front of the foot, and the heel of the foot, according to various aspects of the present disclosure.
Figure 44C:
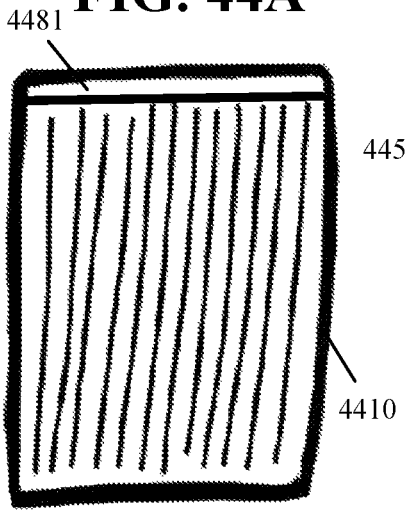
FIG. 44C is a bottom view of the extra memory foam and/or gel cushioning pad of FIG. 44B, showing the hooking portion of the hook-and-loop fastener, according to various aspects of the present disclosure.

FIG. 44B is a top view of an extra memory foam and/or gel cushioning pad that covers the arch of the foot, the front of the foot, and the heel of the foot, according to various aspects of the present disclosure. FIG. 44C is a bottom view of the extra memory foam and/or gel cushioning pad of FIG. 44B, showing the hooking portion of the hook-and-loop fastener, according to various aspects of the present disclosure. With reference to FIG. 44C, the memory foam/gel cushioning pad 4410 may be made of the hooking portion of the hook-and-loop fastener at the bottom, which may connect to the loop portion 4405 of the hook-and-loop fastener located inside the foot brace 4400.

In different embodiments, the memory foam and/or gel cushioning pad 4410 may include different configuration of padding. For example, in some embodiments, the memory foam cushioning pad 4410 may include only a padding similar to the padding 4230, which was described above with reference to FIGS. 42A-42B. In other embodiments, the memory foam and/or gel cushioning pad 4410 may include a combination of the paddings 4305, 4310, and 4315 (as shown in FIG. 44B), a combination of the paddings 4305 and 4310 (not shown), a combination of the paddings 4305 and 4315 (not shown), and/or a combination of the paddings 4310 and 4315 (not shown). The memory foam and/or gel cushioning pad 4410 may be attached to the loop portion 4405 of the hook-and-loop fastener inside the strap/brace 4400 to provide the extra cushioning.

The strap/brace 4400, in some embodiments, may include two or more sliding buckle straps (not shown) cross over the in the front of the foot brace, allowing the person to fasten the brace around the foot. The examples of different types of buckles that may be used in the present embodiments was given above with reference to FIG. 39.

Figure 44D:
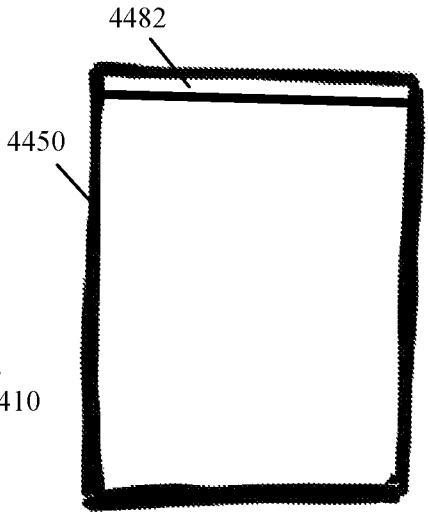
FIG. 44D is a top view of an extra memory foam and/or gel padding without additional cushioning, according to various aspects of the present disclosure.

FIG. 44D is a top view of an extra memory foam and/or gel padding without additional cushioning, according to various aspects of the present disclosure. With reference to FIG. 44D, if a person chooses to wear the strap/brace 4400 without the extra additional cushioning 4305-4315, the person may separate the memory foam and/or gel cushioning pad 4410 from the loop portion 4405 of the hook-and-loop fastener located inside the strap/brace 4400 and may attach the memory foam and/or gel cushioning pad 4450, which does not include the extra layers of additional cushioning. The memory foam and/or gel cushioning pad 4450 is a flat cushion pad with no bumps. Similar to the memory foam and/or gel cushioning pad 4410 of FIG. 44B, the bottom of the memory foam and/or gel cushioning pad 4450 of FIG. 44D may have the hook portion of the hook-and-loop fastener shown in FIG. 44C.

In some of the present embodiments, the memory foam and/or gel cushioning pad 4410 of FIGS. 44B-44C and/or the memory foam and/or gel cushioning pad 4450 of FIG. 44D may include an opening 4481-4482, respectively. The openings 4481-4482 may be used to insert a hot or cold pack into a corresponding slot (not shown), for example, to reduce inflammation and/or to reduce any pain to the foot.

One of the technical advantages of the changeable sole cushioning is allowing the person to have flat level bottom sole when wearing the foot strap/brace around the foot with shoes. Another benefit of the changeable sole cushioning is that if the person is suffering from foot pain, the person may change the padding in the inside of the foot brace with extra cushioning of the person's choice.

The strap/brace 4200 of FIGS. 42A-42B, the strap/brace 4300 of FIG. 43, and the strap/brace 4400 of FIG. 44A may be worn without shoes, to feel the extra memory foam and/or gel cushioning touching the sections of the person's foot that may need support. The outside layer of the straps/braces may include breathable wicking fabric that may facilitate wearing the straps/braces without the shoes. The detachable changeable cushioning of FIGS. 44B-44D may apply to all straps/braces described herein, except the strap/brace 3900 of FIGS. 39-40, which includes a handlebar 3970.

Figure 45A:
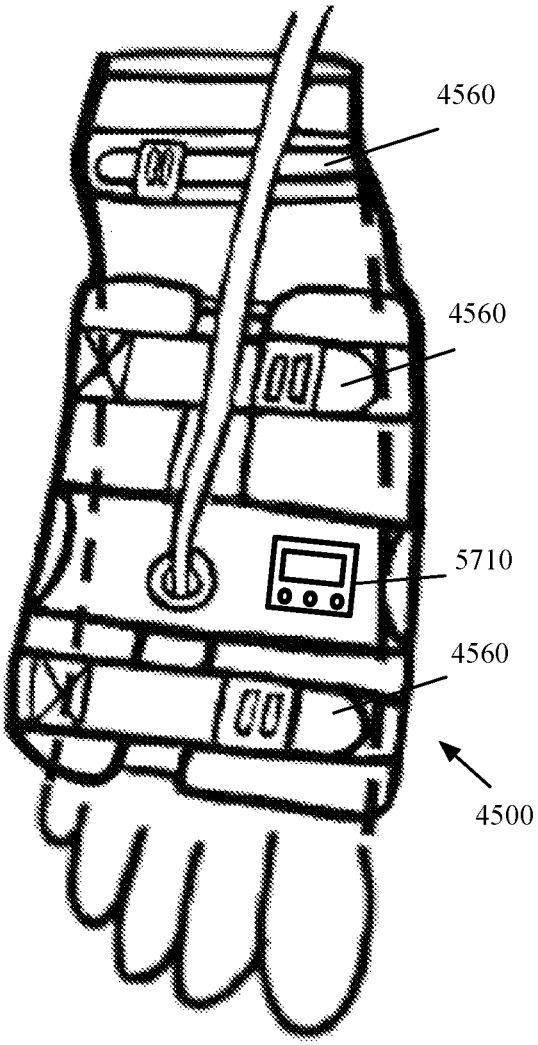
FIG. 45A is a top view and FIG. 45B is a bottom view of a slip-on strap/brace with hook-and-loop fasteners buckle straps around the middle top area of the strap/brace and the top area of the strap/brace, according to various aspects of the present disclosure.
Figure 45B:
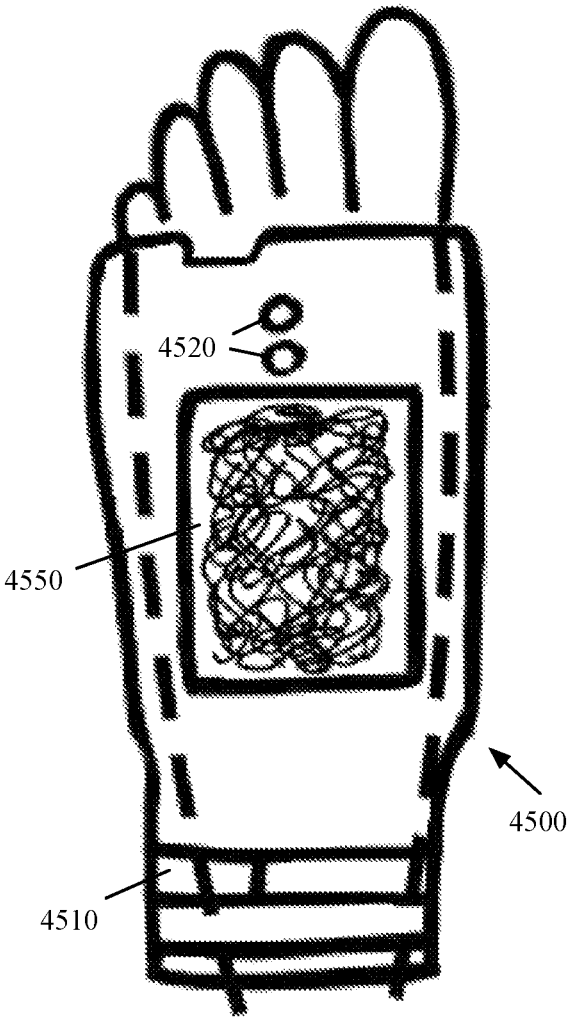

FIG. 45A is a top view and FIG. 45B is a bottom view of a slip-on strap/brace 4500 with hook-and-loop fasteners buckle straps around the middle top area of the strap/brace and the top area of the strap/brace, according to various aspects of the present disclosure. With reference to FIGS. 45A-45B, the strap/brace 4500 may have a similar components as the straps/braces 4200, 4300, and 4400, described above, with the additional hook-and-loop fasteners buckle straps 4560, for example, around the front, the middle top area, the ankle area, and the top area of the strap/brace 4500. The strap/brace 4500, in some embodiments, may be designed with an open sleeve hook-and-loop fastener strap design similar to strap/brace of FIG. 46A, described below.

Figure 45C:
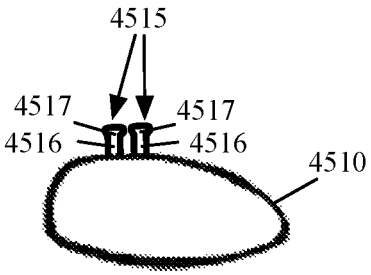
FIG. 45C is a side elevation view of a rubber arch platform for attaching to a strap/brace, according to various aspects of the present disclosure.

The strap/brace 4500 may be used with the hook-and-loop fasteners cushion padding 4410 of FIGS. 44B-44C or the padding 4450 of FIG. 44D. FIG. 45C is a side elevation view of a rubber arch platform for attaching to a strap/brace, according to various aspects of the present disclosure.

With reference to FIG. 45C, the rubber arch platform 4510, in some embodiments, may include one or more pin and/or push in button elements 4515 that are located on top of the rubber arch platform 4510. The pin and/or push in button element(s) 4515 may be hooked into the corresponding hole(s) or opening(s) 4520 (FIG. 45B) located at the bottom of the strap/brace 4500.

For example, in some embodiments, each pin or push in button element 4515 may include a shaft 4516 and a head 4517. Each hole/opening 4520 may include a tube (not shown) with substantially the same diameter as the shaft 4515. Each hole/opening 4520 may also include a cavity (not shown) at the end of the corresponding tube with substantially the same size as the head 4515. The shaft 4516 and the head 4517 of each pin/push in button element 4515 may snugly fit into the tube and cavity of a corresponding hole/opening 4520.

In other embodiments, the rubber arch platform 4510 may include a screw like element (not shown), which includes a helical ridge or thread. In these embodiments, the strap/brace 4500 may have one hole/opening 4520 with a tube. The tube may have a matching hollow thread that may allow the screw like element to screw into the hole or opening 4520.

Figure 58C:
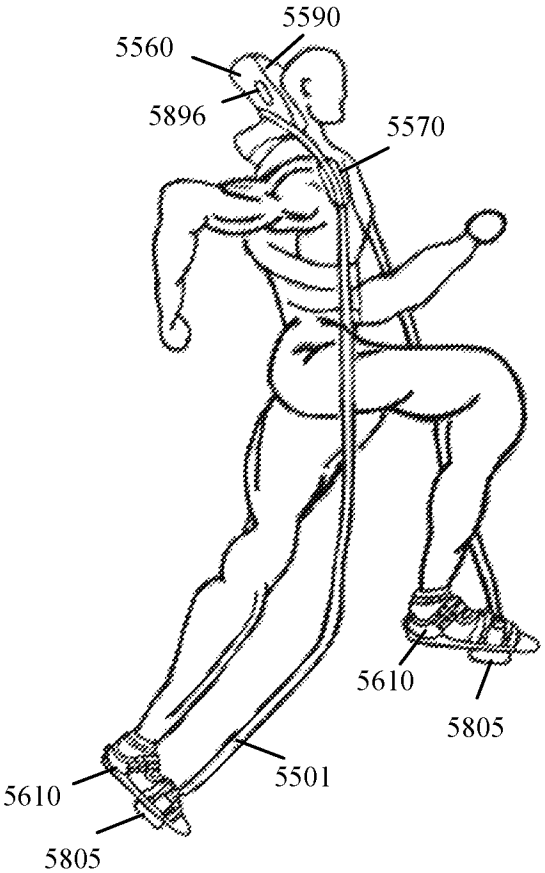
FIGS. 58A-58C are functional diagrams illustrating example uses of a resistant band attached to a memory foam pillow and a pair of straps/braces for performing lunges, according to various aspects of the present disclosure.
Figure 58B:
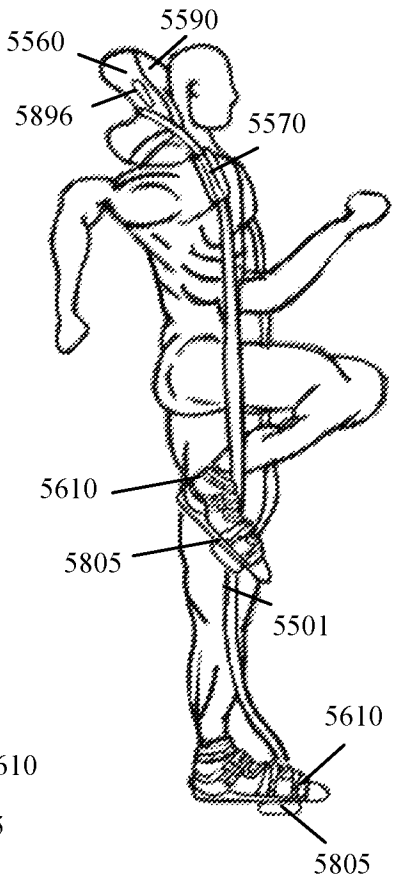
Figure 58A:
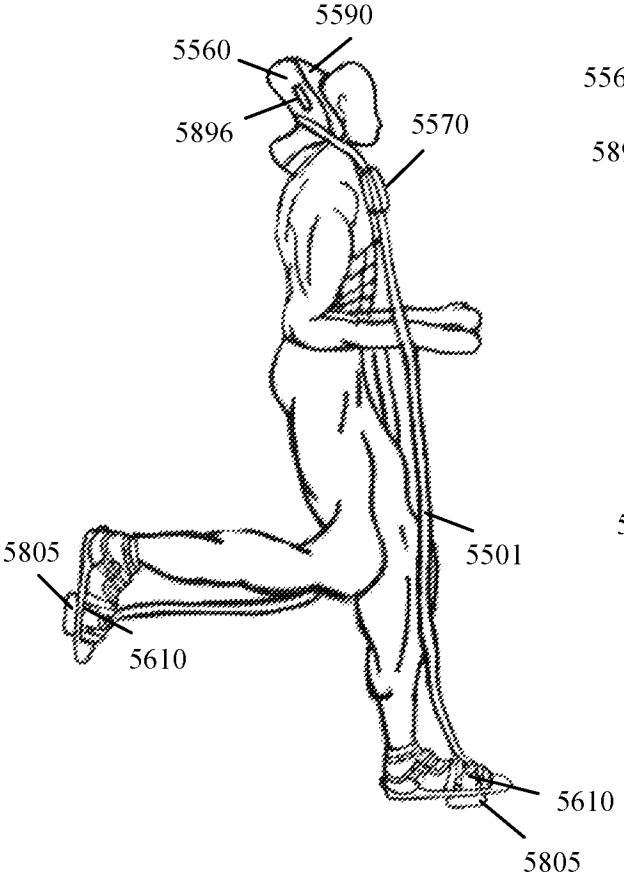

The attachment of the rubber arch platform 4510 to a strap/brace may allow a person to strengthen the calf muscles, to strengthen the Achilles tendon, and/or give the person a leg strength conditioning device. When the rubber arch platform 4510 is connected to the strap/brace 4500, the rubber arch platform 4510 is located at the bottom front portion of foot and may have the person to always apply pressure to the front of the foot while training (as if the person was standing on the tiptoes). By incorporating the rubber arch platform 4510, the person may enhance the level of training through plyometrics exercise, (e.g., as shown in FIGS. 58A-58C, described below).

Figure 45D:
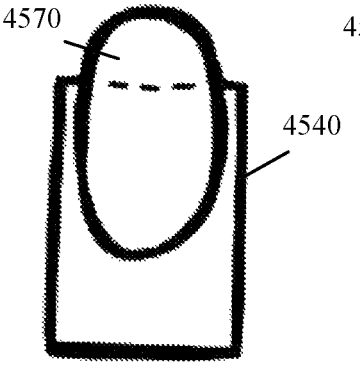
FIG. 45D is a top view and FIG. 45E is a bottom view of a rubber arch platform with a hook-and-loop fastener pad, according to various aspects of the present disclosure.
Figure 45E:
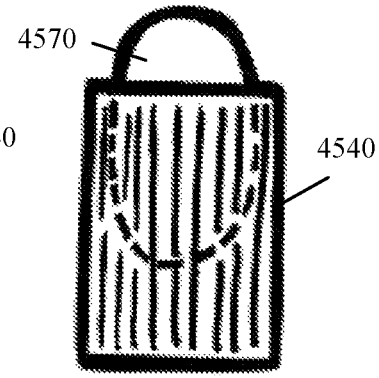

An alternative method of attaching a rubber arch platform to the strap/brace is by using a hook-and-loop fastener pad. FIG. 45D is a top view and FIG. 45E is a bottom view of a rubber arch platform with a hook and loop fastener pad, according to various aspects of the present disclosure. With reference to FIGS. 45D and 45E, the rubber arch platform with a hook and loop fastener pad 4540 may be attached to the bottom of the strap/brace 4500 where the loop part 4550 of the hook-and-loop fastener is located. The rubber arch platform 4570 may, for example, be glued and/or sewn to the hook-and-loop fastener pad.

Figure 46A:
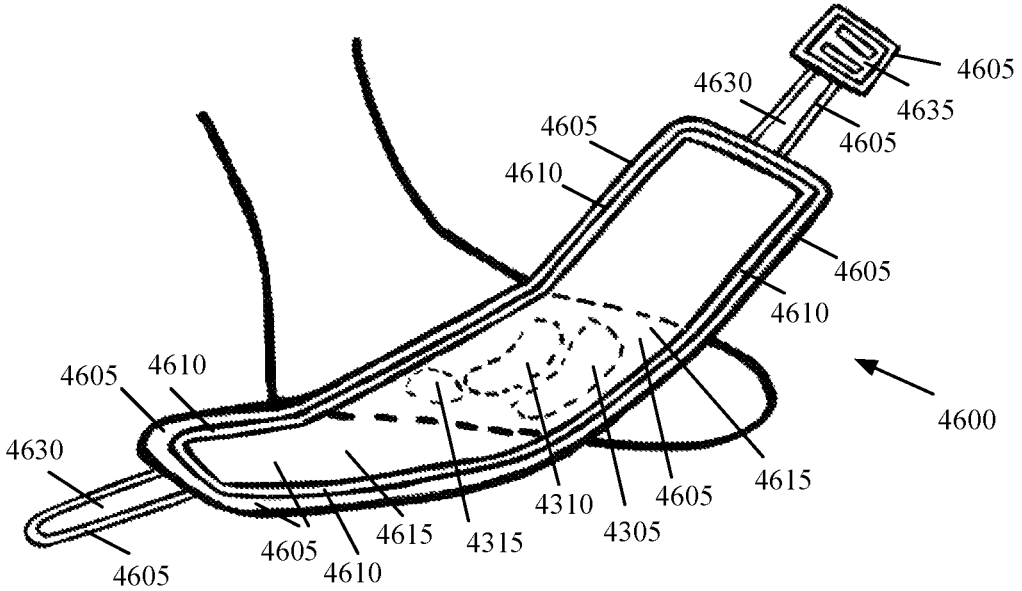
FIGS. 46A-46B are side perspective views showing a person putting a foot inside a strap/brace, according to various aspects of the present disclosure.
Figure 46B:
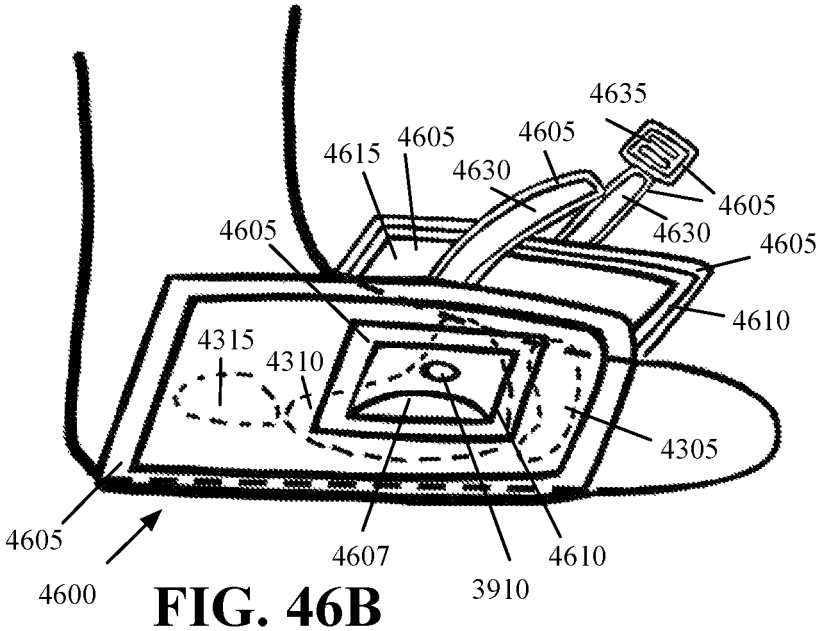
Figure 46C:
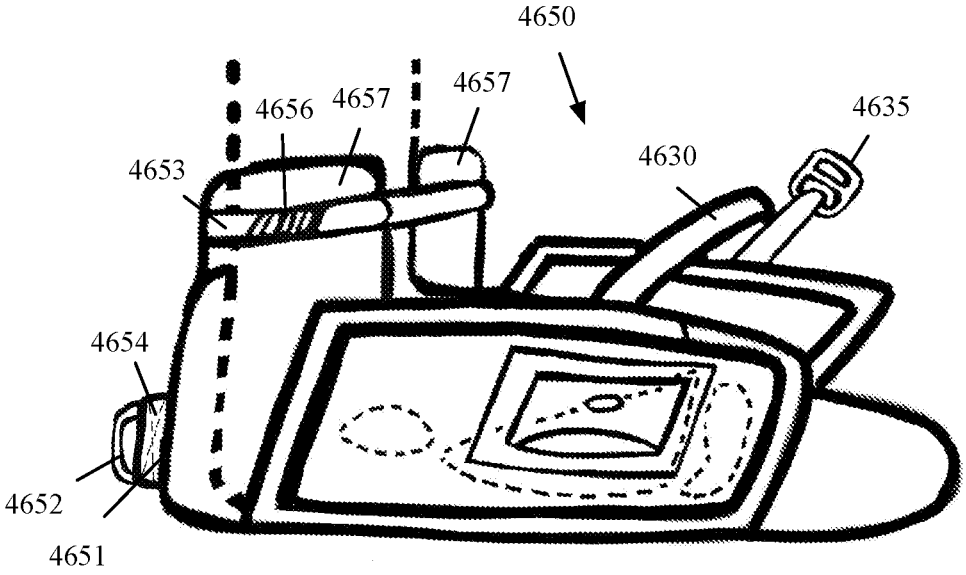
FIG. 46C is a side perspective view showing a person putting a foot inside a strap/brace with an extended fabric that covers the heal and ankle areas, according to various aspects of the present disclosure.

The strap/brace 4500, in some of the present embodiments, may include an extended fabric (not shown) that may cover the heal area with an elastic and/or non-elastic webbing strap with a loop attached to it (e.g., as shown in FIG. 46C, described below). The strap/brace 4500, in some of the present embodiments, may include an elastic and/or non-elastic ring loop strap (not shown) in the bottom of the strap/brace 4500. The ring loop strap may allow attaching the elastic bands with a snap hook to the bottom of the strap/brace 4500. The strap/brace 4500 may also be placed around the hand or wrist areas. The person may slide the hand through the strap/brace 4500 and tighten the hook-and-loop fasteners buckle straps 4560 around the wrist and hand areas.

The strap/brace 4500, in some embodiments, may include extra fabric to the back of the heal area with an elastic and/or non-elastic webbing buckle strap 4560 that is located on the ankle area of the strap/brace 4500. The elastic and/or non-elastic webbing buckle strap 4560 may tighten and secure the strap/brace 4500 around the ankle area and/or above the wrist area. This design may allow the extended portion to cover the back heal area of the foot. With this extension to the strap/brace, the person may be able to connect the resistance band(s) towards the back of the heal area (e.g., as shown in FIG. 46C, described below). The elastic and/or non-elastic webbing may also have a buckle/ring mechanism that is attached to the back area of the strap/brace (e.g., as shown in FIG. 46C, described below).

The strap/brace 4500 (and other straps/braces of present embodiments) may include a waterproof/weatherproof digital monitor 5710 that may count and/or store statistics, such as, reps, time, calories burnt, etc. The details of the digital monitors of the present embodiments are described further below.

Different embodiments may include just the webbing loop, just a buckle/ring loop mechanism, or both the webbing and the buckle/loop. Different configurations may allow the person to perform different exercises such as forward leg raises, where the person stands on one leg and lifts the other leg off the ground in a forward motion. By repeating this motion back and forth, the person may strengthen the muscles in the legs, the glutes, and the abdominal areas.

FIGS. 46A-46B are side perspective views showing a person putting a foot inside a foot strap/brace, according to various aspects of the present disclosure. With reference to FIGS. 46A-46B, the strap/brace 4600 may include a soft protection cover 4605 that may be made from breathable wicking fabric, such as, for example, and without limitations, neoprene fabric, to protect the user's skin from the hard edges around the grommet and give the user comfortability while the foot brace is worn. The soft breathable wicking fabric 4605 may also be sweat and water resistant.

The strap/brace 4600 may include a layer of webbing fabric 4610 that may be made of elastic and/or non-elastic webbing fabric. The layer of webbing fabric 4610 may, at least partially, be covered by the wicking fabric 4605. The strap/brace 4600 may include memory foam 4615 which may provide support and relief from pain to the bottom of the user's foot. The memory foam 4615 may, at least partially, be covered by the layer of webbing fabric 4610 and/or the wicking fabric 4605.

With further reference to FIGS. 46A-46B, the strap/brace 4600 may include a webbing strap 4630, which may be covered with the soft protection cover 4605 made from breathable wicking fabric. Examples of the webbing strap 4630 may include, but not limited to, a lightweight, non-elastic polypropylene or an elastic or non-elastic webbing fabric that is covered with wicking fabric. As shown, on one end of the webbing strap 4630 a tri bar slider (also known as tri-glide buckle) or a slide buckle-strap adjuster 4635 may be attached. The tri bar slider or the slide buckle-strap adjuster 4635 may be made of metal and/or plastic with a wicking fabric cover.

To fit the strap/brace 4600 tightly around the user's foot, the user may take the side of the strap/brace 4600 that has the webbing strap 4630, and may cross the strap/brace over the foot to connect to the tri bar slider/the slide buckle adjuster 4635 as shown in FIG. 46B. The two sides of the strap/brace 4600 may be connected by putting the webbing strap 4630 on the left (in the pictured orientation) through the tri bar slider/the slide buckle adjuster 4635. The tri bar slider/the slide buckle adjuster 4635 may allow the user to adjust the fit of the strap/brace 4600 to the user's liking.

The strap/brace 4600 may include the extra memory foam cushioning 4305-4315, which may be similar to the cushioning 4305-4315 described above with reference to FIG. 43. The strap/brace 4600 may include the eyelet/grommet 3910 located on top of the strap/brace 4600 that may allow an elastic band to be permanently attached through the eyelet/grommet 3910 or to allow the connection an elastic band by a snap hook or a similar snap hook device (not shown).

In some embodiments, the strap/brace 4600 may not have the grommet 3910 and may have an elastic band that has an elastic or non-elastic webbing loop to attach a snap hook. The snap hook may then be attached and connected to the elastic or non-elastic webbing loop that is located at the end of the elastic band(s). The elastic or non-elastic webbing loop 4607 may be located on the top of the strap/brace 4600. For example, and without limitations, a snap hook may latch on to the webbing loop 4607 (FIG. 46B) on the layer of webbing fabric 4610.

In some embodiments, the strap/brace 4600 may include a double O ring strap or a double D ring strap instead of the tri bar slider/the slide buckle adjuster 4635. In addition to the double O or double D ring straps, other type of connectors described above may be used. The different kinds of straps/buckles described in the present specification may be used for the strap/brace 4600 or any other straps/braces described in this specification. The straps, buckles, sliders, and loops may be in plastic and/or metal (e.g., steel, brass, etc.).

FIG. 46C is a side perspective view showing a person putting a foot inside a strap/brace with an extended fabric that covers the heal and ankle areas, according to various aspects of the present disclosure. With reference to FIG. 46C, the strap/brace 4650 may include similar components as the strap/brace 4600 of FIGS. 46A-46B, with the additional extended webbing fabric 4651 that covers the heal area. The strap/brace 4650 may include a webbing loop 4654 attached to a D ring or metal (e.g., steel) loop 4652. In some embodiments, the D ring or metal loop 4652 may be permanently sewn into the webbing loop 4654.

The strap/brace 4650 may only open in the front area at the top. The back portion of the strap/brace 4650 may be closed. The strap/brace 4650 may also include a ring loop strap (not shown) in the bottom of the strap/brace 4650 to allow a person to attach elastic bands on the bottom of the foot.

With further reference to FIG. 46C, the person may insert the foot from the top of the strap/brace 4650 where the ankle strap 4653 is located. The person may grab one side of the webbing strap 4630, and may cross the webbing strap 4630 over the foot. Then the person may slide the ends of the webbing strap 4630 through the tri bar slider/the slide buckle adjuster strap 4635, and tighten the strap/brace 4650 around the foot. The person may then proceed to fasten the rest of the strap/brace 4650 around the ankle area by sliding the webbing strap 4653 through the tri bar slider/slide buckle adjuster 4656 that is attached to the top webbing fabric 4657 around the ankle area.

As described above, the extra webbing fabric 4651 at the back of the heal area may be connected to the D ring or metal (e.g., steel) loop 4652 that allows attaching an elastic band. With this extension to the strap/brace 4650, the strap/brace 4650 may be designed to have the webbing loop (4654) with the D ring or metal loop 4652 behind the heal area. The D ring or metal loop 4652 may allow connecting one or more resistance bands behind the back of the heal area. In some embodiments, the webbing loop (4654) may not have a D ring/buckle/ring mechanism attached to the webbing loop (4654).

The strap/brace 4600 and 4650, in different embodiments, may be made with just the webbing loop, just a buckle/ring loop mechanism, or with both the webbing and the buckle/loop, allowing a person to perform different exercises such as, an exercise called a forward leg raises, where the person stands on one leg and lifts the other leg off the ground in a forward motion. By repeating this motion back and forth, the person may exercise the muscles in the glutes and the abdominal areas.

Figure 47A:
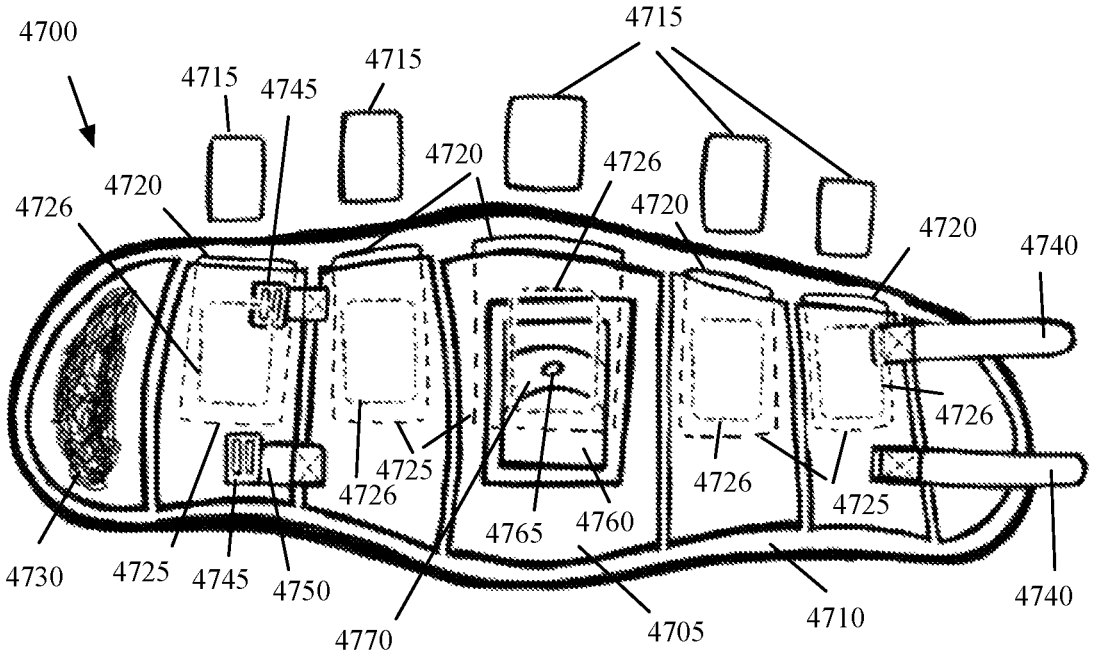
FIG. 47A is a top view showing a changeable weight strap/brace, according to various aspects of the present disclosure.
Figure 47B:
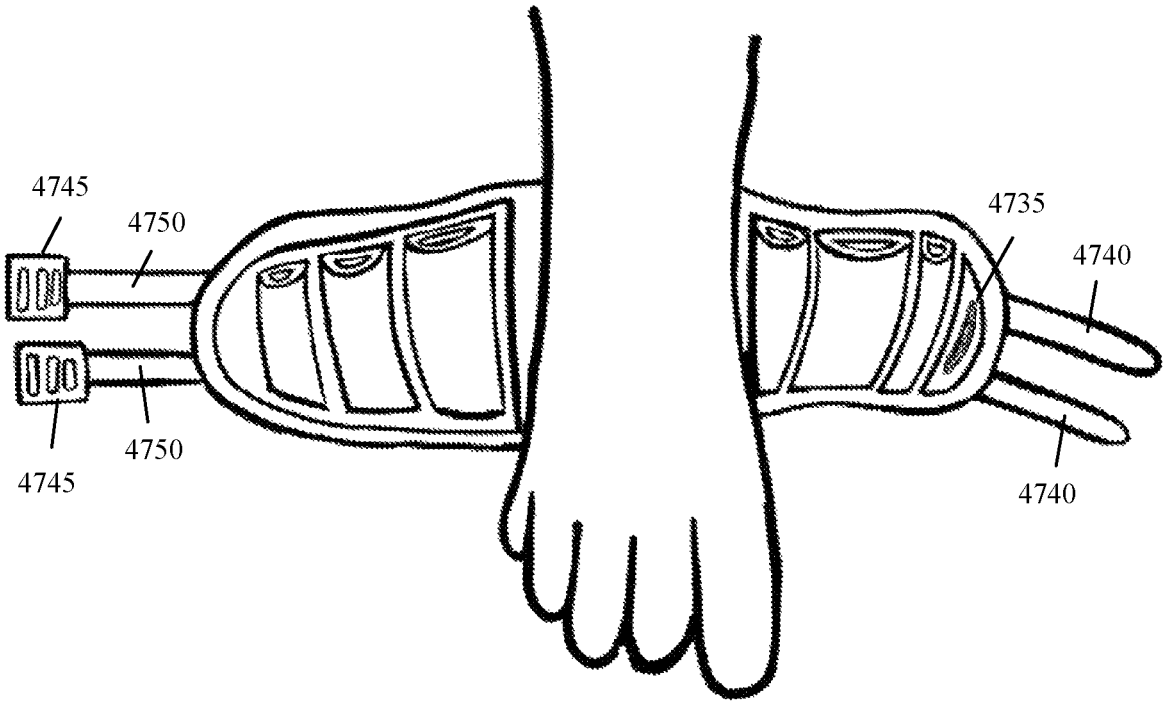
FIG. 47B is a perspective view of the changeable weight strap/brace of FIG. 47A being set up to be connected around a foot, according to various aspects of the present disclosure.

FIG. 47A is a top view showing a changeable weight strap/brace, according to various aspects of the present disclosure. FIG. 47B is a perspective view of the changeable weight strap/brace of FIG. 47A being set up to be connected around a foot, according to various aspects of the present disclosure. The strap/brace 4700 may include a soft protection cover 4705 made of breathable wicking fabric that may also be sweat resistant and waterproof. The strap/brace 4700 may include multiple layers of fabric 4710 made from webbing fabric which the soft protection cover 4705 goes over.

The strap/brace 4700 may include individual weights (e.g., sandbags, icing gel packs, heat packs, etc.) 4715 that may be placed in the slots 4725 that are incorporated within the strap/brace 4700. Each slot 4725 may include an opening 4720 to allow the sandbags, etc., 4715 to be placed in the slots 4725 and not fall out. The openings 4720 may be opened and closed by, for example, and without limitations, hook-and-loop fasteners, zipper, snap buttons, etc. The openings 4720 may be surrounded by webbing fabric 4710 and covered with soft protection cover 4705. The contents of the slots 4725 may be changed based on the type of exercise or activity. For example, a sandbag may be placed into a slot 4725 to add weight for a particular exercise. As another example, an ice pack (e.g., icing gel packs) or a heat pack (e.g., heating gel packs) may be placed into a slot 4725 to reduce inflammation and/or to reduce any pain to the foot. The approximate position of the weights 4715 after the weights 4715 are inserted into the slots 4725 are shown with the dashed squares 4726.

The strap/brace 4700 may include hook-and-loop fasteners. The loop part 4730 of the hook-and-loop fasteners is shown in FIG. 47A. The hook part 4735 of the hook-and-loop fasteners may be located inside of the strap/brace 4700, which is shown in FIG. 47B. The strap/brace 4700 may include two straps 4740 that may be elastic and/or nonelastic webbing straps that allow the user to connect foot brace around the foot by sliding the end of each strap 4740 through the corresponding slide buckle 4745. The slide buckles 4745 may be located on the elastic and/or nonelastic webbing straps 4750. The two straps 4740 may allow the strap/brace 4700 to be secured and useable in water without coming off the foot. Although FIG. 47A shows each strap 4740 and the corresponding buckles 4745 as separate pieces with an opening between them, in some embodiments each strap 4740 and the corresponding buckles 4745 are connected together as one continues piece of webbing strap. In addition, the webbing straps 4750 in FIG. 47A may be longer, in some embodiments (e.g., as shown in FIG. 47B).

The strap/brace 4700 may include an additional layer of webbing fabric 4760 located on top of the other layer of webbing fabric 4710. The webbing fabric 4760 may have an elastic and/or nonelastic webbing loop strap 4770 with a grommet 4765 located on top. The grommet 4765 may allow the user to connect a snap hook to the grommet 4765 and connect one or more elastic bands to the strap/brace 4700.

In some embodiments, the strap/brace 4700 may include just the webbing loop by itself. The snap hook may connect the elastic band to the foot strap/brace together (not shown). The grommet 4765 and/or the elastic or non-elastic webbing loop strap 4770 may be used to connect elastic band(s) to the foot/hand brace. The strap/brace 4700, in some embodiments, may be designed for the person to connect a snap hook mechanism directly to the elastic or non-elastic webbing loop strap 4770. In some embodiments, the grommet 4765 and the elastic or non-elastic webbing loop strap 4770 may be replaced with a steel ring and/or other hook mechanism described herein. The strap/brace 4700 and any other strap/brace described herein, may be designed with one or more elastic bands permanently attached to them.

Figure 48B:
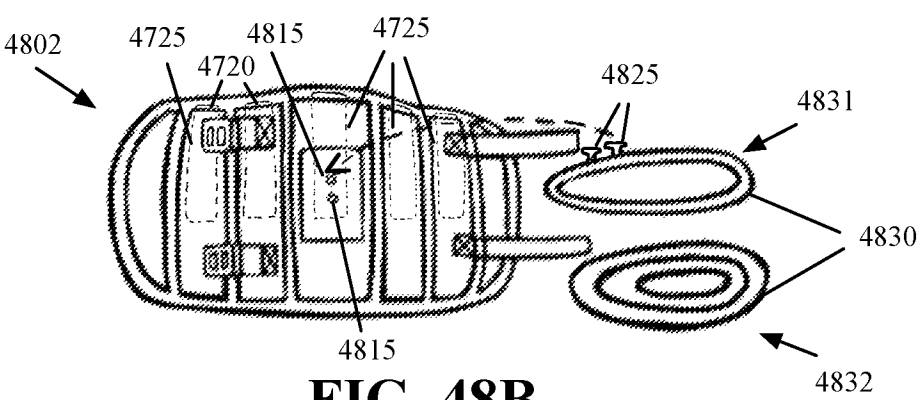
FIGS. 48A-48C are bottom views showing changeable weight straps/braces similar to the strap/brace of FIG. 47A with additional attachments incorporated, according to various aspects of the present disclosure.
Figure 48A:
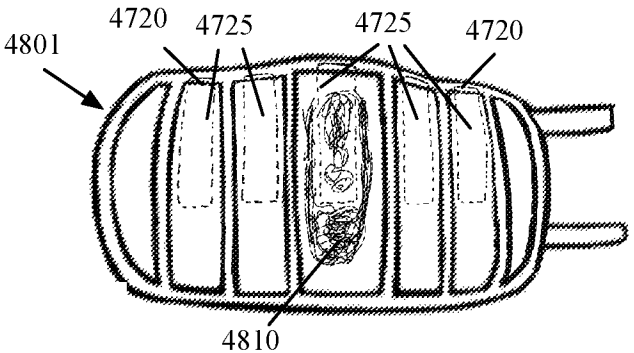
Figure 48C:
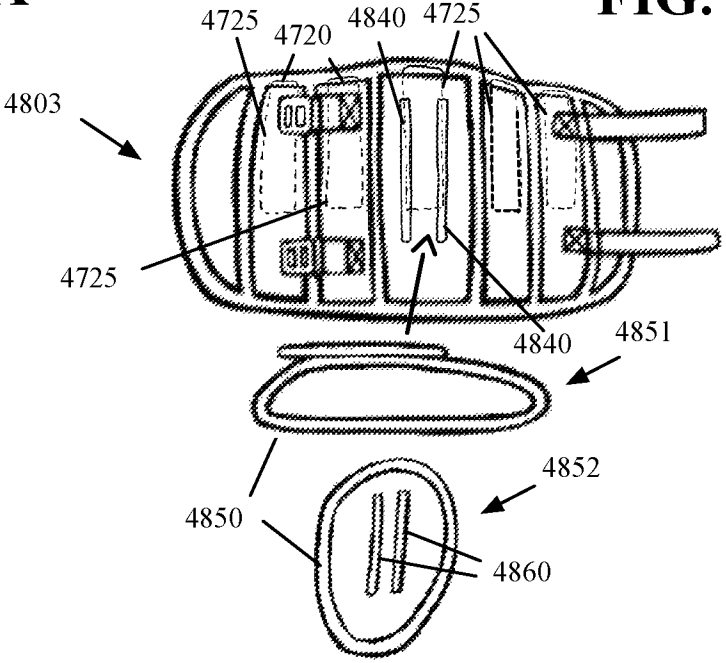

FIGS. 48A-48C are bottom views showing changeable weight straps/braces similar to the foot strap/brace of FIG. 47A with additional attachments incorporated, according to various aspects of the present disclosure. Similar to the changeable weight strap/brace 4700 of FIG. 47A, the changeable weight straps/braces 4801-4803 may include the openings 4720 to allow weights (such as, for example, and without limitations, sandbags, etc.) to be placed in the slots 4725 and not fall out. With reference to FIG. 48A, the strap/brace 4801 may include hook-and-loop fasteners. As shown, the loop part 4810 of the hook-and-loop fasteners may be located in the back side and inside the strap/brace 4801 in the middle. The hook part of the hook-and-loop fasteners may be similar to the hook part 4410 of FIG. 44C. The loop part of the hook-and-loop fasteners being inside the strap/brace provides the technical advantage of allowing a person to change the comfort and support level of the strap/brace. In some embodiments, the wicking fabric may also act as the loop part of the strap/brace 4801. The loop part of the hook-and-loop fasteners on the back side of the strap/brace 4801 allows the user to attach the rubber arch platform with the hook and loop fastener pad of FIGS. 45D-45E.

The strap/brace 4801 may also be used with the memory foam and/or gel cushioning pad 4410 of FIG. 44B or the memory foam and/or gel cushioning pad 4450 of FIG. 44D to provide different levels of comfort and support. As described above with reference to FIGS. 44B and 44C, the memory foam and/or gel cushioning pad 4410 is a pad that includes extra memory foam and/or gel foam to give aid in relieving pain at the bottom of the foot. The memory foam and/or gel cushioning pad 4450 may include extra memory foam and/or gel but has a flat surface.

With reference to FIG. 48B, there are two openings 4815 on the bottom the strap/brace 4802 that allows a person to connect the attachment 4830. The figure shows the side view 4831 and the bottom view 4832 of the rubber arch platform attachment 4830. The rubber arch platform attachment 4830 may include two pins or push in button elements 4825, which may hook into the holes or openings 4815. The pin or push in button elements 4825 and the holes/opening 4815 may be similar to the pin or push in button elements 4515 and the holes/opening 4520 of FIGS. 45C and 45B. Alternatively, the rubber arch platform attachment 4830 may include a screw-like element similar to the screw-like element and the hole/opening described above with reference to FIGS. 45C and 45B. The rubber arch platform attachment 4830 may allow the person to strengthen the calf muscles and the Achilles tendon, and may be used by the person as a leg strength conditioning device.

The rubber arch platform attachment 4830 may be connected to the bottom front of the strap/brace 4802 and may have the person wearing the strap/brace to always be applying pressure to the front of the foot while training, as if the person was standing on the tiptoes. By incorporating the rubber arch platform attachment 4830, the person may enhance the level of training through plyometrics exercise.

With reference to FIG. 48C, the strap/brace 4803 may include two linear, substantially parallel openings 4840 on the bottom of the strap/brace 4803 that may allow the rubber arch platform 4850 to fit into the openings 4840. The figure shows the side view 4851 and the top view 4852 of the rubber arch platform 4850. The two railings 4860 on the top of the rubber arch platform 4850 may slide into the openings 4840 that are located on the bottom of the strap/brace 4803, allowing the arch rubber platform 4850 to be attached and secured to the strap/brace 4803. The straps/braces 4801-4803 may be covered by wicking fabric such as, for example, and without limitations, neoprene fabric, which may be sweatproof as well as waterproof. The rubber arch platform attachments 4830 and the rubber arch platform 4850 may be incorporated in other straps/braces disclosed herein, for example by adding the opening 4815 or 4840 to the bottom of the straps/braces.

Figure 49A:
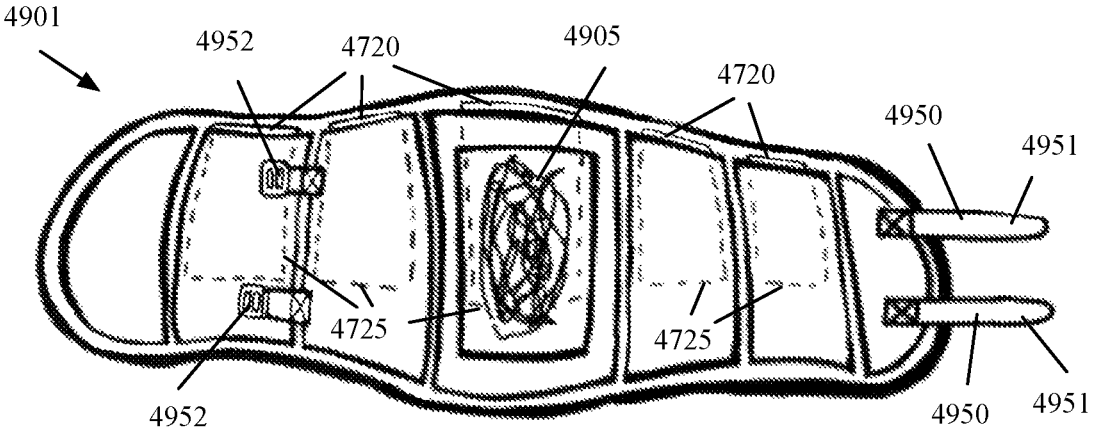
FIG. 49A is a bottom view showing a changeable weight strap/brace with hook-and-loop fasteners at the bottom to attach a rubber arch platform with a hook and loop fastener pad, according to various aspects of the present disclosure.
Figure 49B:
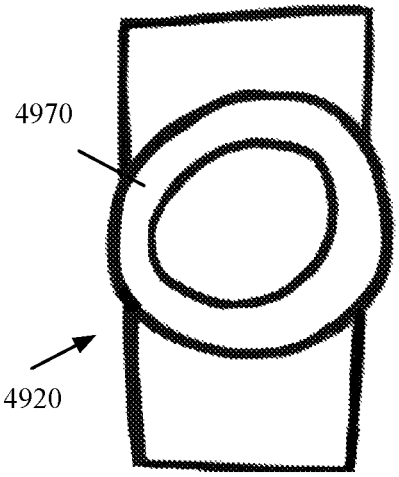
FIG. 49B is a bottom view and FIG. 49C is a top view of a rubber arch platform with a hook and loop fastener that may be attached to the bottom of the strap/brace of FIG. 49A, according to various aspects of the present disclosure.
Figure 49C:
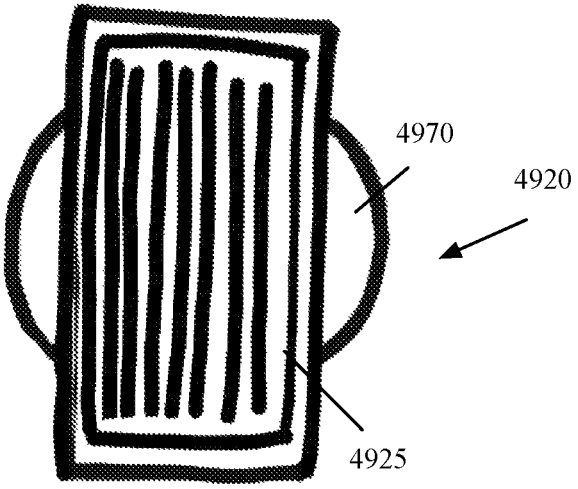

FIG. 49A is a bottom view showing a changeable weight strap/brace with hook-and-loop fasteners at the bottom to attach a rubber arch platform with a hook and loop fastener pad, according to various aspects of the present disclosure. FIG. 49B is a bottom view and FIG. 49C is a top view of a rubber arch platform with a hook and loop fastener that may be attached to the bottom of the strap/brace of FIG. 49A, according to various aspects of the present disclosure.

Similar to the changeable weight strap/brace 4700 of FIG. 47A, the changeable weight strap/brace 4901 may include the openings 4720 to allow weights (such as sandbags, etc.) to be placed in the slots 4725 and not fall out. The bottom of the strap/brace 4901 may include hook-and-loop fasteners. As shown, the bottom portion of the strap/brace 4901 may include the loop portion 4905 of the hook-and-loop fasteners. In some embodiments, the wicking fabric may also act as the loop portion of the strap/brace 4905.

With reference to FIG. 49B, the bottom of the rubber arch platform with a hook and loop fastener pad 4920 may include a platform 4970 made from material(s) such as, for example, and without limitations, rubber, foam, gel, plastic etc. FIG. 49C is the top portion of the rubber arch platform with a hook and loop fastener pad 4920. The hook part 4925 of the rubber arch platform with a hook and loop fastener pad 4920 attaches to the loop part 4905 on the bottom of the strap/brace 4901.

The strap/brace 4901 may include elastic and/or non-elastic webbing loop fabric (not shown) that may be located in the bottom of the strap/brace 4901 to connect a D ring loop (not shown). The D ring loop may allow a person to connect a resistance band under the foot when the strap/brace 4901 is worn on a foot. The D ring loop may allow a person to connect a resistance band to the palm or under the wrist area when the strap/brace 4901 is worn on a hand/wrist.

The strap/brace 4901 may include a pair of elastic and/or non-elastic webbing straps 4950 that tightens and secures the brace around the foot/ankle area and/or above the wrist area when connected to the sliding buckle strap(s) 4952. In order to wear the strap/brace 4901 around the ankles, a person may hold the strap/brace 4901 in a vertical position and grab and wrap the ends 4951 of the webbing straps 4950.

The person may then wrap the buckle straps 4950 around the ankle area by sliding the end of the webbing strap 4950 through the corresponding sliding buckle strap(s) 4952. The person may then fasten the webbing strap 4950 around the ankle area. The elastic and/or non-elastic webbing loop strap, which may have a grommet on it, (e.g., as described above with reference to FIG. 47A) may now be facing outwards behind the ankle area.

By placing the strap/brace 4901 in vertical position around the ankles, a person may perform different exercises such as forward leg raises where the person may stand on one leg and lift the other leg off the ground in a forward motion. By repeating this motion, the person may strengthen the glutes and leg muscles.

Figure 50B:
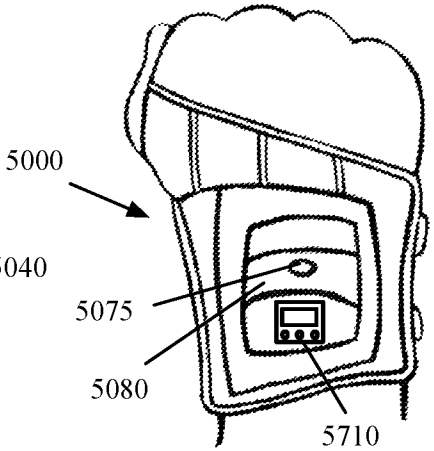
FIG. 50B is functional diagram illustrating an example use of the strap/brace of FIG. 50A as a wrist strap/brace, according to various aspects of the present disclosure.
Figure 50A:
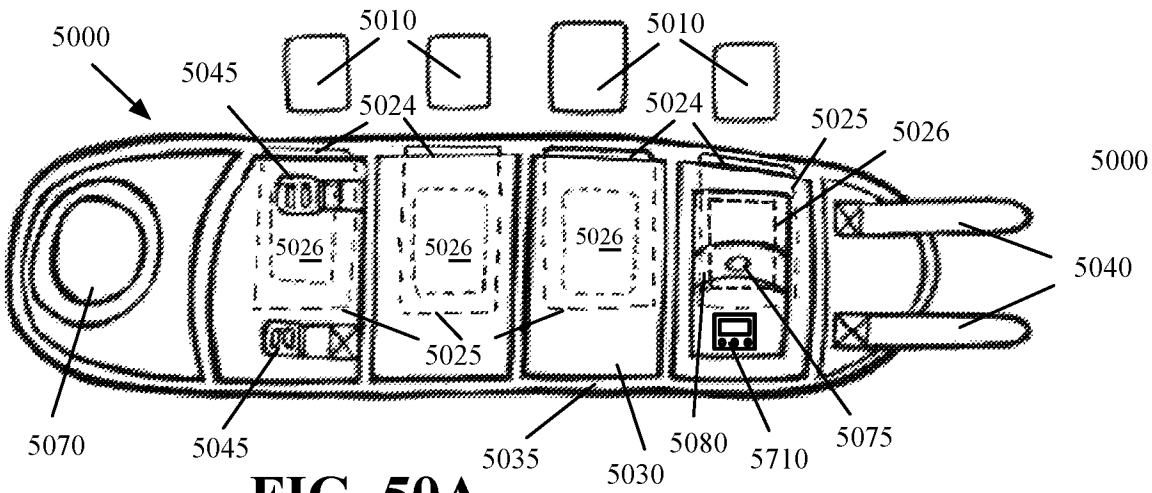
FIG. 50A is a top view showing a changeable weight strap/brace that may be worn on foot or wrist, according to various aspects of the present disclosure.
Figure 50C:
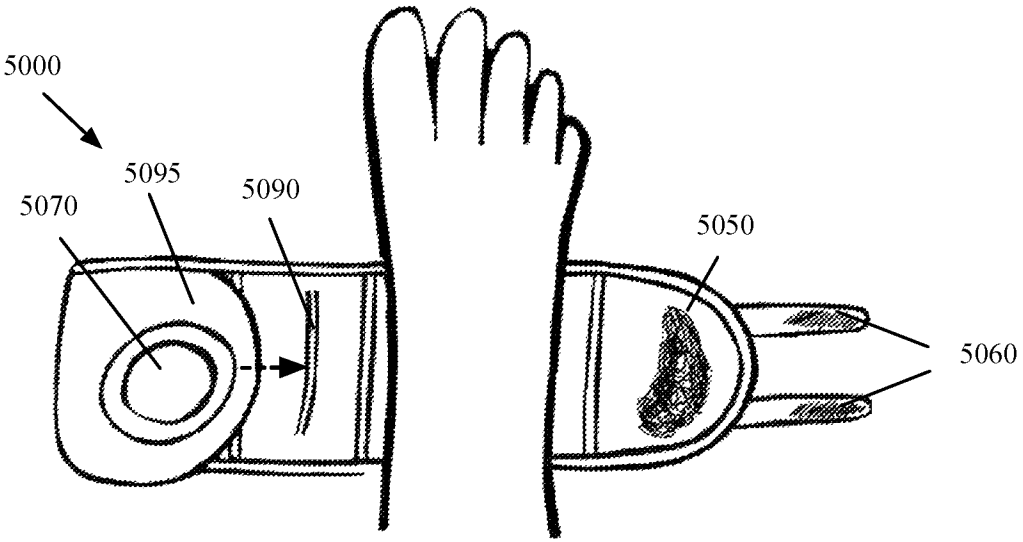
FIG. 50C is functional diagram illustrating an example use of the strap/brace of FIG. 50A as a foot strap/brace, according to various aspects of the present disclosure.

FIG. 50A is a top view showing a changeable weight strap/brace that may be worn on foot or wrist, according to various aspects of the present disclosure. FIG. 50B is functional diagram illustrating an example use of the strap/brace of FIG. 50A as a wrist strap/brace, according to various aspects of the present disclosure. FIG. 50C is functional diagram illustrating an example use of the strap/brace of FIG. 50A as a foot strap/brace, according to various aspects of the present disclosure.

Similar to the strap/brace 4700 of FIG. 47A, the strap/brace 5000 of FIGS. 50A-50C may include openings 5024 to insert weights/ice packs/hot packs 5010 into the slots 5025 to increase level of strength conditioning and/or for therapeutic treatment. The approximate position of the weights/ice packs/hot packs 5010 after the weights/ice packs/hot packs 5010 are inserted into the slots 5025 are shown with the dashed squares 5026. Also similar to the straps/braces described above, the strap/brace 5000 may include a breathable wicking fabric 5030 and an additional layer of webbing fabric 5035 made from webbing material. The soft protection cover provided by the wicking fabric 5030 may go over the additional layer of webbing fabric 5035. The wicking fabric 5030 may allow a person to attach the hook part 5050 of the hook-and-loop fasteners onto the strap/brace 5000. Similar to the straps/braces described above, the strap/brace 5000 may include sweatproof and waterproof/water resistant material.

The strap/brace 5000 may include the elastic and/or non-elastic webbing straps 5040. The webbing straps 5040 may cross over around the hand or foot and the ends of webbing straps 5040 may slide through and be pulled through the fastening buckle straps 5045, allowing the strap/brace 5000 to be tightened around the hand or foot. The back end(s) 5060 of the webbing straps 5040 may include the hook part of the hook-and-loop fasteners.

The strap/brace 5000 may include an opening 5070 where a person may place the thumb through. The strap/brace 5000 may include a grommet 5075 and an elastic and/or non-elastic loop strap 5080. With reference to FIG. 50C, the strap/brace 5000 may include a substantially circular foldable portion 5095 around the opening 5070. The strap/brace 5000 may include an opening elastic slit 5090, which may be located inside the strap/brace 5000. The person may then place the circular portion 5095 inside the elastic opening slit 5090 to convert the strap/brace 5000 into a foot brace. The opening elastic slit 5090 provides the technical advantage of allowing the person to quickly convert the brace/strap 5000 from a hand brace/strap into a foot brace/strap. With reference to FIGS. 50A and 50B, the strap/brace 5000 may include a waterproof/weatherproof digital monitor 5710 that may count and/or store statistics, such as, reps, time, calories burnt, etc. The details of the digital monitors of the present embodiments are described further below.

The strap/brace 5000 may include an elastic and/or non-elastic webbing loop fabric (not shown) located at the bottom of the strap/brace 5000 to connect a ring loop/hooking mechanism. The ring loop may allow connecting resistant bands under the foot or to the palm/under wrist area. The ring loop may be, for example, and without limitations, a D ring. The D ring may be made, for example, and without limitations, from plastic, metal (e.g., steel), etc.

Figure 51C:
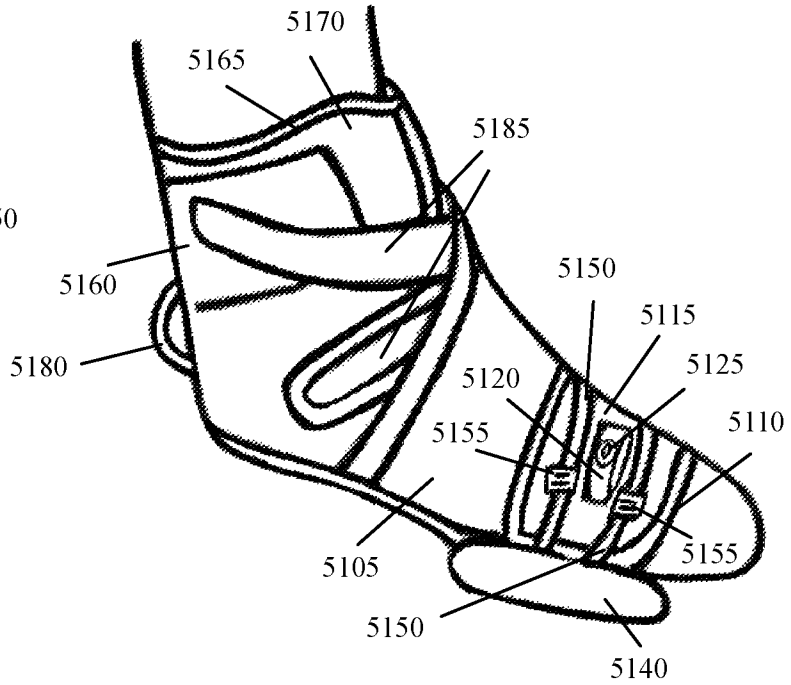
FIG. 51C is a side perspective view showing a person wearing the strap/brace of FIG. 51A, according to various aspects of the present disclosure.
Figure 51A:
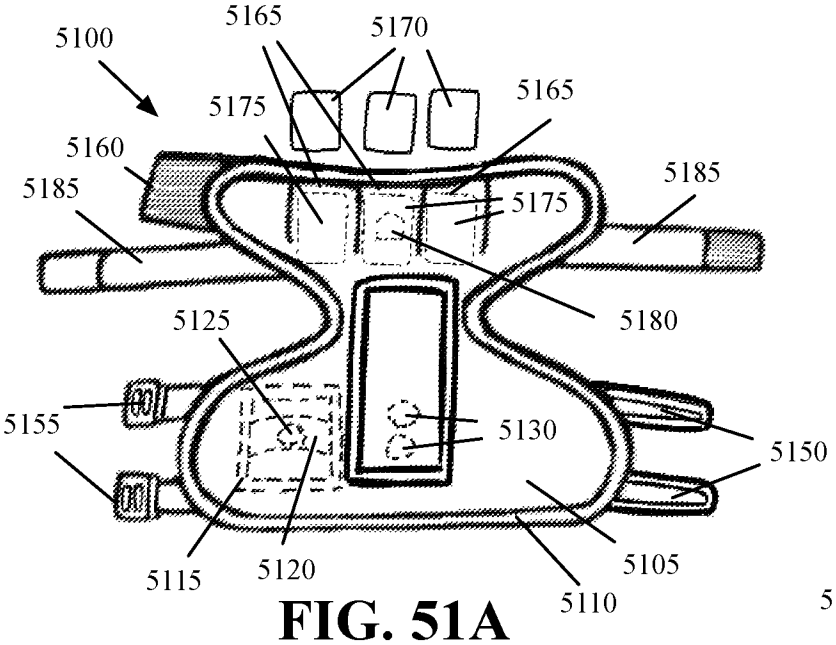
FIG. 51A is a top view showing a changeable weight strap/brace with an ankle support, according to various aspects of the present disclosure.
Figure 51B:
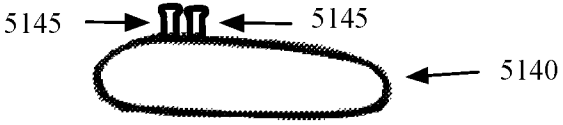
FIG. 51B is a side elevation view of a rubber arch platform for attaching to a strap/brace such as the strap/brace of FIG. 51A, according to various aspects of the present disclosure.

FIG. 51A is a top view showing a changeable weight strap/brace with an ankle support, according to various aspects of the present disclosure. FIG. 51B is a side elevation view of a rubber arch platform for attaching to a strap/brace such as the strap/brace of FIG. 51A, according to various aspects of the present disclosure. FIG. 51C is a functional diagram showing a person wearing the strap/brace of FIG. 51A, according to various aspects of the present disclosure.

With reference to FIGS. 51A-51C, the strap/brace 5100 may include multiple layers of fabric. One of the fabrics on the strap/brace 5100, may be breathable wicking fabric 5105, which may act as a soft protection cover. The strap/brace 5100 may include an additional layer of webbing fabric 5110, made from elastic and/or non-elastic webbing fabric which the wicking fabric 5105 may go over. The strap/brace 5100 may include an additional layer of webbing fabric 5115 that may be connected to an elastic and/or nonelastic webbing loop strap 5120. Some embodiments may include a grommet 5125 located on top of the elastic and/or nonelastic webbing loop strap 5120. The grommet 5125 may allow connecting a snap hook to connect an elastic bands to the strap/brace 5100.

The elastic and/or nonelastic webbing loop strap 5120, in some embodiments, may be attached to the webbing fabric 5115 without a grommet on the top of the elastic and/or nonelastic webbing loop strap 5120. Instead, a snap hook may be latched directly around the elastic and/or nonelastic webbing loop strap 5120 without a grommet. The strap/brace 5100 may include the opening slots/holes 5130 located in the middle (towards the front) of the strap/brace 5100. In some embodiments, the opening slots/holes 5130 may have a slit (not shown). When the strap/brace 5100 is worn on a foot, the opening slots/holes 5130 may be located under the foot. The opening slots/holes 5130 may enable attaching the arch rubber platform attachment 5140 to the strap/brace 5100.

As shown in FIG. 51B, the arch rubber platform 5140 may include the pin or push in button elements 5145 that may latch the into the opening/holes 5130 located on the strap/brace 5100. The pin or push in button elements 5145 and the holes/opening 5130 may be similar to the pin or push in button elements 4515 and the holes/opening 4520 of FIGS. 45C and 45B. Alternatively, the arch rubber platform 5140 may include a screw-like element similar to the screw-like element and the hole/opening described above with reference to FIGS. 45C and 45B. The arch rubber platform 5140 may allow the person to strengthen the calf muscles and the Achilles tendon, and may be used by the person as a leg strength conditioning device.

The strap/brace 5100 may include the elastic and/or non-elastic webbing straps 5150 that may slide through the buckles 5155 on the opposite side of the strap/brace 5100. The webbing straps 5150 may allow securing the front portion of the strap/brace 5100 when the strap/brace 5100 is worn.

FIGS. 51A and 51C show the hook portion 5160 of a hook-and-loop fastener strap that is located at the top of the strap/brace 5100. The hook portion 5160 of the hook-and-loop fasteners may wrap around the top area of the ankle as shown in FIG. 51C. The wicking fabric 5105 may play as the loop part of the hook-and-loop fasteners. The wicking fabric material may allow the hook part of the hook-and-loop fasteners to attach to the wicking fabric. The wicking fabric 5105 may be incorporated throughout the strap/brace 5100 to allow the strap/brace to be sweatproof and waterproof, as well as providing comfort around the foot and ankle areas.

The elastic and/or hook-and-loop fasteners slot openings 5165 may allow a person to insert the weight sandbags 5170 inside the slots 5175. The openings 5165 may also allow placing hot packs and/or cold packs into the slots 5175 to reduce inflammation to the muscles and/or add weights to enhance the workout. Applying the weights may allow strengthening of the leg muscles. The ice or hot packs may be used to reduce inflammation in the ankle area and help with the healing process.

The strap/brace 5100 may include the elastic and/or non-elastic webbing loop 5180, which may allow attaching one or more resistance bands with a snap hook. The strap/brace 5100 may include a D ring (not shown) attached to the webbing loop 5180. The strap/brace 5100 may include the hook-and-loop fasteners and/or elastic and/or non-elastic straps 5185 that may wrap around the middle and top portion of the ankle area. In some embodiments, the strap/brace 5100 may include shoelaces (not shown) around the ankle area to give a tighter support around the ankle and foot. The strap/brace 5100 may include a ring loop strap (not shown) in the bottom of the strap/brace 5100 to allow a person to attach a snap hook to connect resistance bands under the foot (e.g., when used as a foot strap/brace).

Figure 52:
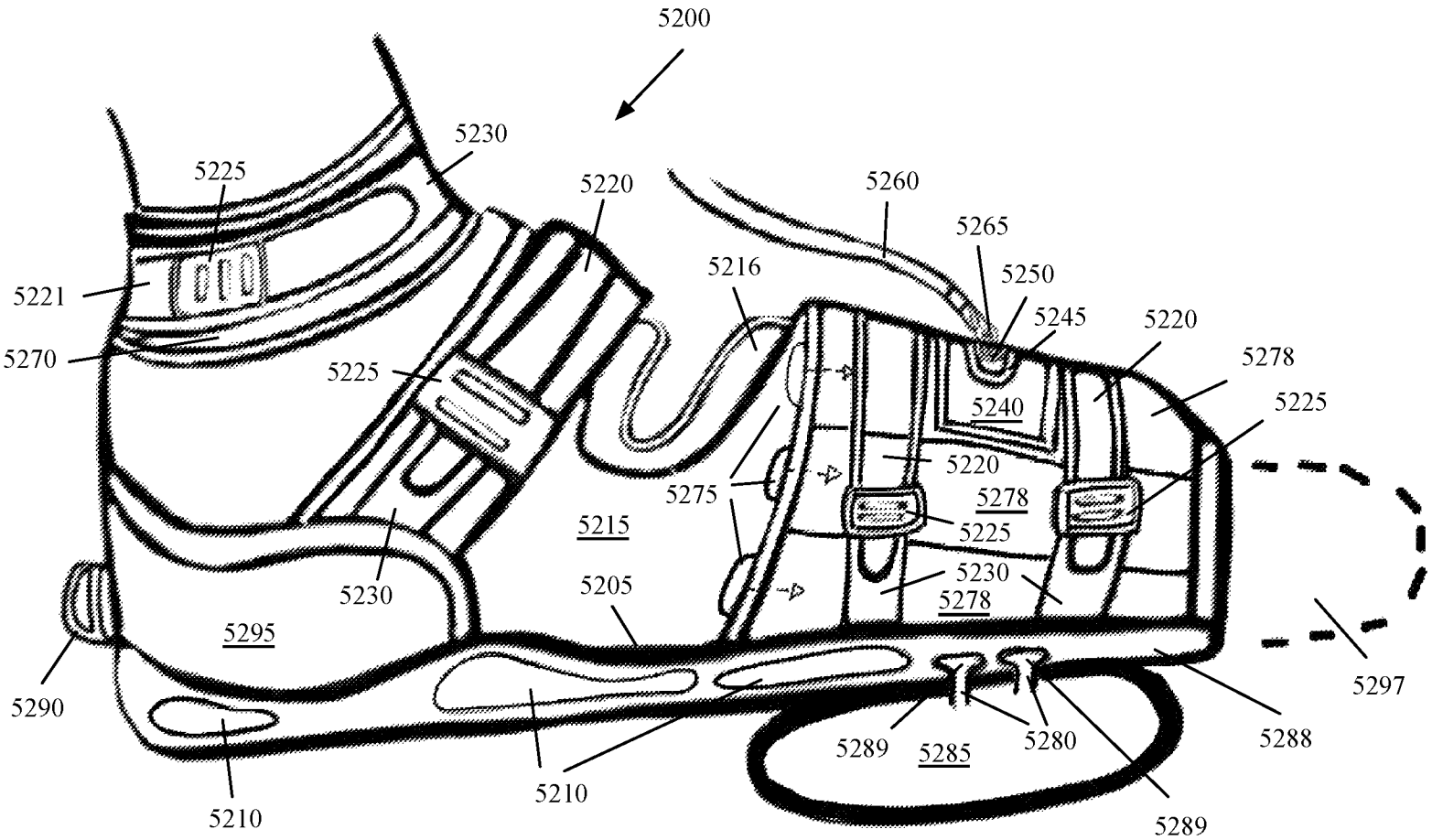
FIG. 52 is a side elevation view showing a changeable weight band strap/brace with a rubber arch platform attached to the strap/brace, according to various aspects of the present disclosure.

FIG. 52 is a side elevation view showing a changeable weight band strap/brace with a rubber arch platform attached to the strap/brace, according to various aspects of the present disclosure. With reference to FIG. 52, the strap/brace 5200 may include breathable wicking fabric and memory form, and/or extra gel padding. The strap/brace 5200 may include mesh, synthetic fabric arch and heel support, covered by wicking fabric that is waterproof and sweatproof. The strap/brace 5200 may include layers of stretchable fabric, for example, and without limitations, Spandex, Lycra, rubber, and/or other types of wicking fabric.

The strap/brace 5200, in some embodiments, may include (not shown) high top and shoelaces. The high top may include wicking fabric that may cover above the upper portion of the ankle area, with shoelaces, hook-and-loop fastener, and/or buckle strap. The strap/brace 5200, may include an insole 5205. The insole 5205 may be made, for example, and without limitations, from one or more layers of rubber and/or memory foam material. The strap/brace 5200 may include the extra gel/memory foam cushioning 5210, which may give additional support to the bottom of the foot. Once a person is wearing the strap/brace 5200, the cushioning 5210 may reduce the amount of pressure applied from the ground towards the bottom of the foot, and may reduce pain from plantar fasciitis. While the person is standing and wearing the strap/brace 5200, the cushions 5210 may also give aid in the balance of the person by giving arch support to the bottom of the foot.

In addition to, or in lieu of the cushions 5210, the strap/brace 5200, in some embodiments, may include attachable and detachable cushions similar to the attachable and detachable cushioning pad 4410 of FIGS. 44B-44C or the attachable and detachable cushioning pad 4450 of FIG. 44D. For example, the inner bottom of the strap/brace 5200 may include loop portion of a hook-and-loop fastener that may be connected to the hooking portion of the hook-and-loop fastener at the bottom of the attachable and detachable cushioning pad 4410 and 4450.

With further reference to FIG. 52, the middle portion 5215 and the top middle portion 5216 of the strap/brace 5200 may be made from multiple layers of webbing fabric. The ends 5220-5221 of the straps 5230 may be made of elastic and/or non-elastic webbing fabric and may go into the webbing strap buckles 5225. In some embodiments, the end 5221, may also be made with hook-and-loop fasteners webbing strap, and/or elastic or non-elastic hook-and-loop fasteners webbing strap with a buckle. The webbing strap 5230 may also include hook-and-loop fasteners in addition to, or in lieu of, the buckles 5225. As illustrated, the buckles and straps together may allow wrapping of the foot brace around the foot and ankle areas. The straps 5230, in some embodiments, may crisscross over the foot instead of crossing horizontally as illustrated in FIG. 52.

The strap/brace 5200 may include another layer of wicking fabric 5240 that may have an elastic and/or non-elastic webbing loop strap 5245 on it. The strap/brace 5200, in some embodiments, may include an eyelet or grommet 5250 on top of the webbing loop strap 5245. As shown, a resistant band 5260 may be connected to the eyelet or grommet 5250 by a snap hook 5265. In some embodiments, the strap/brace 5200 may not include an eyelet or grommet and the snap hook 5265 may be directly connected to the elastic and/or non-elastic webbing loop strap 5245. The strap/brace 5200, in other embodiments, may include other types of hooking/latching mechanism described herein. In some embodiments, the resistant band 5260 may be directly connected to the strap/brace 5200 without the snap hook 5265. For example, the resistant band 5260 may be attached to the eyelet or grommet 5250 as described above with reference to FIG. 39, resulting the elastic band 5260 to permanently latch on and be attached to the strap/brace 5200.

The strap/brace 5200 may include a multiple layer of thick stretchable wicking fabric 5270 for ankle support, which may wrap tightly around the ankle. The strap/brace 5200 may include the attachable weights sandbags 5275 that may slide into elastic and/or hook-and-loop fasteners slits located inside the sleeves 5278 of the strap/brace 5200.

The strap/brace 5200 may include the openings or slits 5280 where the arch rubber platform 5285 may be attached to the outsole 5288 part of the strap/brace 5200. As shown, the opening/holes 5280 may be located on the bottom front part of the strap/brace 5200 and may allow the arch rubber platform 5285 to latch into the bottom of the strap/brace 5200.

The arch rubber platform 5285 may include the pin or push in button elements 5289 that may latch into the opening/holes 5280 located on the strap/brace 5200. The pin or push in button elements 5289 and the holes/opening 5280 may be similar to the pin or push in button elements 4515 and the holes/opening 4520 of FIGS. 45C and 45B. Alternatively, the arch rubber platform 5285 may include a screw-like element similar to the screw-like element and the hole/opening described above with reference to FIGS. 45C and 45B. The arch rubber platform 5285 may allow the person to strengthen the calf muscles and the Achilles tendon, and may be used by the person as a leg strength conditioning device.

When the arch rubber platform 5285 is not attached, the outsole 5288 may touch the ground. When the arch rubber platform 5285 is attached to the strap/brace 5200, the arch rubber platform may touch the ground during exercise and may act as the outsole of the strap/brace 5200. For example, as described above with reference to FIG. 45, the person using the strap/brace 5200 may always apply pressure to the front of the foot as if the person was standing on the tiptoes.

With continued reference to FIG. 52, the strap/brace 5200 may include webbing loop strap or buckle strap 5290 that may be attached to the back of the strap/brace 5200 to allow the person to attach resistant band(s) to the webbing loop or buckle 5290 with a snap hook. The strap/brace 5200 may include a D ring (not shown) attached to the webbing loop strap or buckle strap 5290. The webbing loop strap or buckle strap 5290 may, in some embodiments, include a snap lock/shock cord mechanism to allow the direct attachment of elastic band(s) to the strap/brace 5200 without a snap hook. The back part 5295 of the foot brace may include a stiff piece of rubber material that may be layered with memory foam and covered with wicking fabric to provide support to the back heal area of the foot and to strengthen the rear of the strap/brace 5200.

In order to wear the strap/brace 5200 on a foot or a shoe, the person may slide the foot into the top ankle portion 5270 of the strap/brace 5200 and into the middle part of the strap/brace 5200. The person may then grab the two sleeve webbing straps 5278 and wrap one side of the sleeve over the other around the foot and/or the shoe. The person may then connect the straps 5230 together, securing the strap/brace 5200 around the foot and/or the shoe. By pulling on the straps 5230 through the buckles 5225, the person may be able to adjust the fit and tighten the fit of the strap/brace 5200 to the person's liking. The strap/brace 5200, in some embodiments, may include an open toe area to allow the person to place the foot brace around the shoe. The strap/brace 5200, in some embodiments, may include a closed front 5297 to cover the toes of the person. The strap/brace 5200, in some embodiments, may be sweatproof and waterproof.

Figures 53A, 53B, 53C:
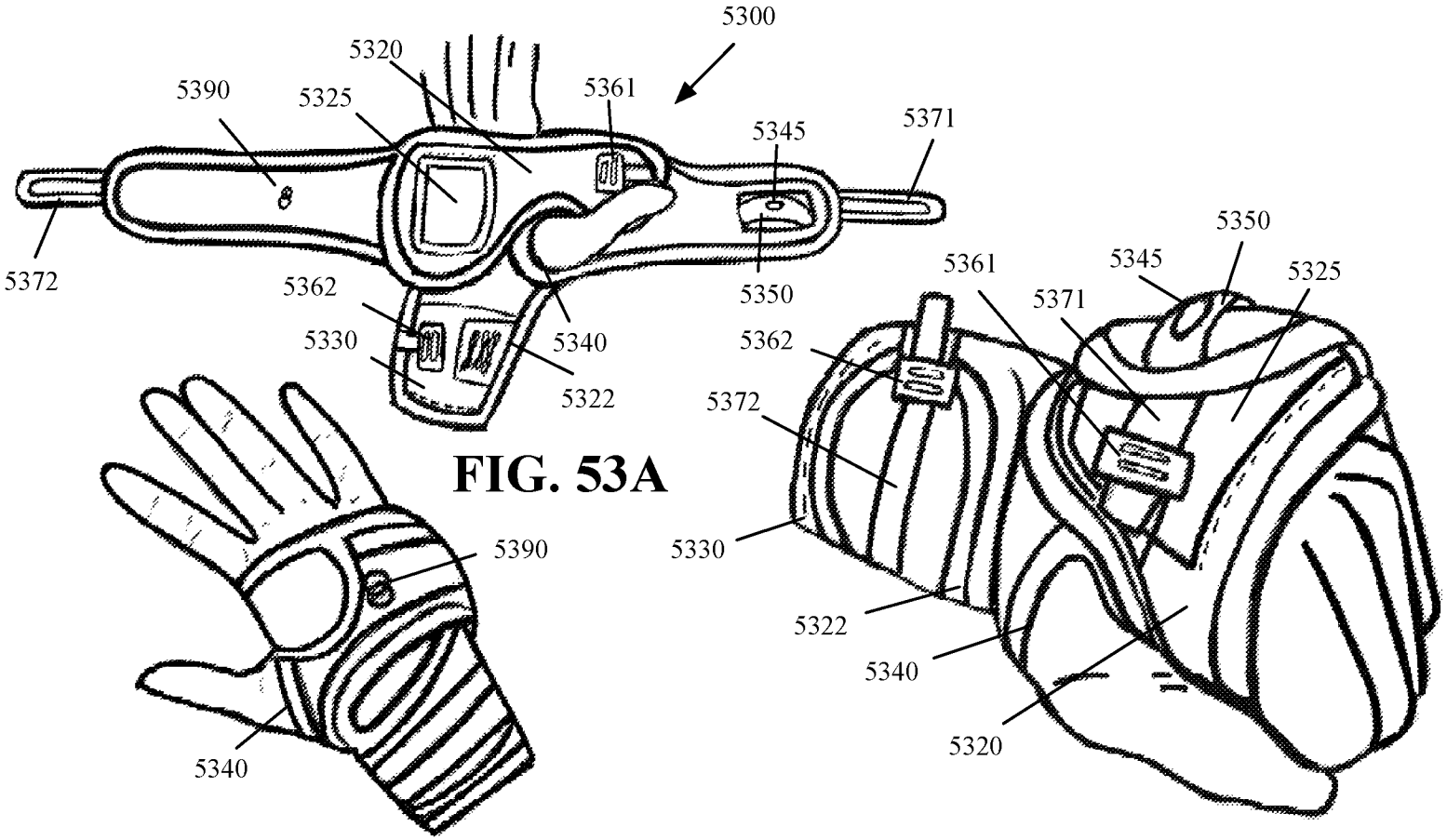
FIG. 53A is a bottom view showing a changeable weight band strap/brace used as a glove, according to various aspects of the present disclosure.
FIG. 53B is a bottom view and FIG. 53C is a perspective view illustrating how the strap/brace of FIG. 53A may be worn.

FIG. 53A is a bottom view showing a changeable weight strap/brace used as a glove, according to various aspects of the present disclosure. FIG. 53B is a bottom view and FIG. 53C is a perspective view illustrating how the strap/brace of FIG. 53A may be worn.

The strap/brace 5300 may include the adjustable buckle straps 5361-5362 and webbing straps 5371-5372. The buckle straps 5361-5362 and the webbing straps 5371-5372 may be similar to any of the buckles and straps described above. In the embodiments illustrated in FIGS. 53A-53C, the strap/brace 5300 may include elastic and/or non-elastic webbing buckles straps and/or hook and loop fasteners. The end of the webbing strap 5371 may slide into the adjustable buckle strap 5361, which may fasten the strap/brace 5300 around the top area of a person's hands. The webbing strap 5372 may connect to the buckle strap 5362 to secure the strap/brace 5300 around the wrist area.

In some embodiments, the straps may be crisscrossed, and/or the strap/brace 5300 may have two or more webbing strap buckles. The strap/brace 5300 may also include laces (not shown) to secure the glove around the wrist area.

The strap/brace 5300 may include the breathable wicking fabric 5320 and the pocket area 5325 for placing a sandbag weight and/or a hot or a cold pack. The strap/brace 5300 may include another pocket 5330 located towards the wrist area, which may be used to insert sandbag weights, and/or a hot or a cold pack.

The strap/brace 5300 may include an opening 5340 where the person may place the thumb through. The person may wrap the strap/brace 5300 around the hand by connecting the buckles 5361-5362 and straps 5371-5372, as described above. The strap/brace 5300 may include an eyelet or grommet 5345 that may be placed on the elastic and/non elastic webbing loop strap 5350. The eyelet or grommet 5345 may allow latching on a snap hook (not shown) to attach to an elastic band (not shown).

The strap/brace 5300, in some embodiments, may not include an eyelet or grommet. Instead, a snap hook may be connected directly around the elastic and/or non-elastic loop webbing strap 5350. The strap/brace 5300 may include a ring loop strap (not shown), or two loops 5390 (which may be made of metal, plastic, and/or webbing fabric), for attaching resistance bands. The strap/brace 5300 may include the wicking fabric 5322 that may include the hook part of a hook-and-loop fastener on top of in order to allows the left side of the strap/brace 5300 where the strap 5372 is located to be connected. The wicking fabric 5322 may act as the loop part of the hook-and-loop fastener.

Figure 54B:
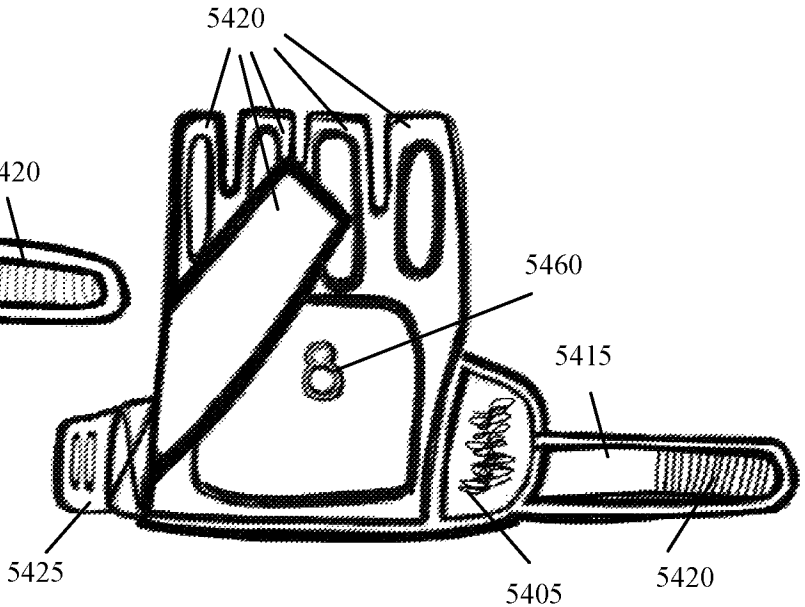
FIG. 54A is a top view and FIG. 54B is a bottom view showing a changeable weight band strap/brace glove that covers part of all of the fingers, according to various aspects of the present disclosure.
Figure 54A:
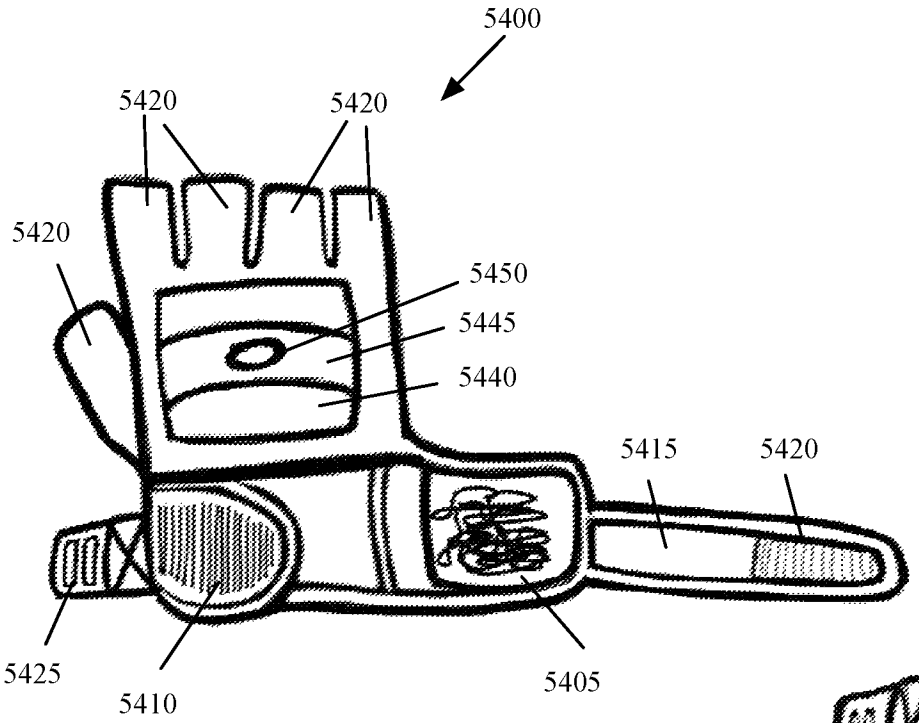

FIG. 54A is a top view and FIG. 54B is a bottom view showing a changeable weight band strap/brace glove that covers part of all of the fingers, according to various aspects of the present disclosure. As shown in FIG. 54A, the strap/brace glove 5400 may allow the person to place all fingers through the strap/brace glove 5400, resulting in the strap/brace glove to wrap around the fingers.

With reference to FIG. 54A, a person may first slide the hand/fingers into the strap/brace glove 5400. The person may then wrap the loop part 5405 of the hook-and-loop fasteners over onto the hook part 5410 of the hook-and-loop fasteners. The hook-and-loop fasteners may be elastic and/or non-elastic hook-and-loop fasteners. The person may grab the loop part 5405 of the hook-and-loop fasteners and cross the webbing strap 5415 over the loop part 5405 and to the hook part 5410 of the hook-and-loop fasteners. The person may then slide the tip 5420 of the webbing strap 5415 into the webbing buckle strap 5425. By connecting the tip 5420 of the strap 5415 into the webbing buckle strap 5425, strap/brace glove 5400 may be tightened around the wrist area. The strap/brace glove 5400 may include wicking fabric. The hook part of the strap may be able to attach onto the wicking fabric of the strap/brace glove.

The strap/brace glove 5400 may include an additional layer of webbing fabric 5440 that may be located on top of the strap/brace glove 5400. A webbing loop strap 5445 may be located on top of the additional layer of fabric 5440. The strap/brace glove 5400, in some embodiments, may include an eyelet or grommet 5450 over the webbing loop strap 5445 for attaching elastic bands. The strap/brace glove 5400, in some embodiments, may not include an eyelet or grommet and may include a non-elastic webbing loop strap 5445 to directly connect an elastic band to it with a snap hook.

Some embodiments of the strap/brace 5400, may include layer(s) of extra rubber fabric, silicone, and/or vinyl material 5420 which may be located on the inside fingers and tips of the strap/brace glove 5400. The strap/brace glove 5400 may include a metal grommet and/or metal/steel ring 5460 and/or a webbing loop strap (not shown) that may be used for attaching an elastic band with a snap hook on the inside of the strap/brace glove 5400.

Attaching a resistant band on bottom of the glove provides several advantages for strengthening the wrist area. For example, by not closing the fist, and being able to perform an exercise called front raise with an open palm may allow the person to not only strengthen the arms, shoulders, and chest areas, but the person may also be able to strengthen the wrist muscles. This exercise may be performed by bending the elbows slightly and raising the arms straight in front of the body. The elasticity of the band may then contract the wrist muscles.

The strap/brace glove 5400 may be used for the wrist and shoulder rehabilitation. For example, if a person needs to strengthen the wrist, the person may perform the wrist extension and flexion exercise. The person may start with the elbow bent at the side and the palm facing downwards. The person may then move the palm upwards until feeling a stretch. The person may then return to the original position. Holding the wrist in the upward position for approximately five seconds and back down and repeating this movement for about ten times may result in building strength in the wrist. This exercise may be used for tennis, football, baseball, basketball, hockey, boxing, mixed martial arts (MMA), swimming, etc. Adding the resistant bands to this exercise enhances the level of exercise, making the exercise more difficult because of the resistant. At the same time, adding the resistant band may make this work out to be more effective in building the strength in the wrist area.

III. Elastic Exercise Bands with Cushion

Figure 55B:
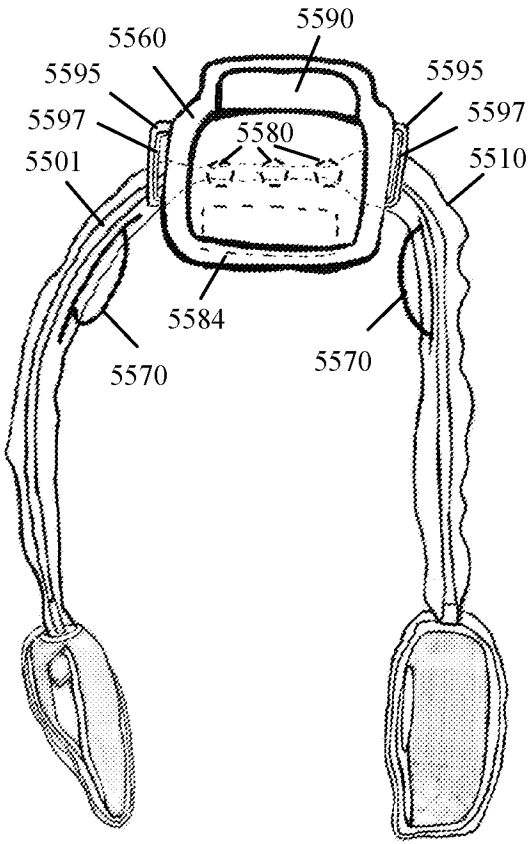
FIG. 55B is a front perspective view illustrating the elastic band of FIG. 55A with an ergonomic foam pillow attached, according to various aspects of the present disclosure.
Figure 55A:
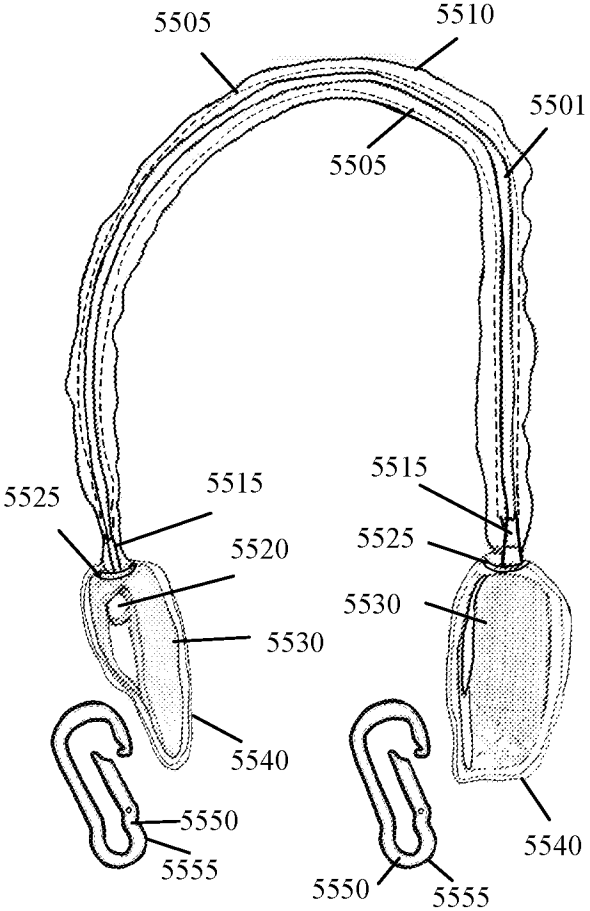
FIG. 55A is a perspective view illustrating an elastic band with wicking fabric on the outside and foam in the inside, according to various aspects of the present disclosure.

FIG. 55A is a perspective view illustrating an elastic band with wicking fabric on the outside and foam in the inside, according to various aspects of the present disclosure. With reference to FIG. 55A, the elastic band 5501 may be tubular or non-tubular. The elastic band 5501 may include the inner lining 5505 (shown with dotted lines) that may include foam, memory foam, and/or gel padding. In the embodiments discussed herein, unless explicitly excluded, the term foam also applies to memory foam and vice versa. The foam 5505 may be sewn to the inside of the soft wicking fabric 5510 that may cover the elastic band 5501. The wicking fabric may be sweatproof and/or waterproof.

The foam 5505 may provide the technical advantage of giving the person comfortability and support during a workout, for example, and without limitations, when the band is placed around the neck, chest and shoulder areas. The foam 5505 may create support and comfort from the tension and pressure that is applied when the elastic band is placed around the neck, chest, and shoulder areas. The wicking fabric 5510 may provide the technical advantage of preventing the user's skin from being agitated when the elastic band rubs against the skin. For example, without the wicking fabric 5510 and/or the foam 5505, the elastic band 5501 may pull the hairs of the person's skin, creating pain and discomfort.

With reference to FIG. 55A, the rubber covers 5515 may hold and tighten the pressure of the elastic band 5501 around the circular and/or rectangular shape objects 5520 that is placed inside and at the end of the elastic band 5501. The purpose of the object 5520 is to prevent the elastic band 5501 from slipping through the eyelet/grommet 5525 that may be located on the elastic or non-elastic webbing loop 5530.

The soft wicking fabric 5540 (e.g., and without limitations, made of wicking neoprene fabric) may protect the user's skin from the hard edges around the grommet 5525 and the sharp edges around the corners of the webbing loop 5530. The soft wicking fabric 5540 and/or 5510 provides the technical advantage of preventing the person's skin from being irritated by the rubbing of elastic band 5501 against the skin, and/or having the hard/sharp edges of the grommet/webbing/buckle/snap to hurt the bones and skin of the person while working out.

The snap hooks 5550 (e.g., and without limitations, metal spring links and/or carabiners) may be attached to the webbing loop 5530 to a connect foot/hand strap(s)/band(s) (not shown). The foot/hand strap(s) may be similar to any strap/band of the present embodiments described above. The snap hooks 5550 may be covered with soft wicking fabric 5555 (e.g., and without limitations, made of neoprene fabric) to protect the user's skin from the hard edges around the hooks 5550.

FIG. 55B is a front perspective view illustrating the elastic band 5501 of FIG. 55A with an ergonomic foam pillow attached, according to various aspects of the present disclosure. FIG. 55C is a back perspective view of FIG. 55B, where there is a webbing strap with loops attached, according to various aspects of the present disclosure. With reference to FIGS. 55B-55C, a foam/memory foam pillow 5560 may be attached to the elastic band 5501. In the embodiments discussed herein, unless explicitly excluded, the term foam pillow also applies to memory foam pillow and vice versa.

Although several examples of the ergonomic pillows of the present embodiments are referred to as memory foam pillows, the ergonomic pillows in all these examples may include material other than foam or memory foam. For example, in addition to, or in lieu of the shapeable materials foam or memory foam, some embodiments may include shapeable materials such as gel, rubber, sandbag, etc. The shapeable material(s) may be covered with wicking fabric. The elastic band(s) may then be placed inside the shapeable material. In some embodiments, foam or memory foam may be added to the other shapeable material (e.g., gel, rubber, sandbag, etc.) to further reduce the pressure of the elastic band and prevent the elastic band from irritating the skin when the elastic band is being pulled against the skin. The shapeable material, in some embodiments, may be squeezable (e.g., the shapeable material may be gel that surrounds an elastic band) to enable a person to squeeze the material and tighten the pressure of the hold in securing the elastic band.

With further reference to FIGS. 55B-55C, the ergonomic pillow 5560 may include a back cushion portion 5590 for providing upper head area support as well as lower neck support. An example showing how the shape of the ergonomic pillow 5560 and the back cushion portion 5590 may provide support for the back of the head and neck during work out is described below with reference to FIG. 56C. An example showing how the shape of the ergonomic pillow 5560 and the back cushion portion 5590 may provide support for the front of the head during work out is described below with reference to FIG. 57D.

With continued reference to FIGS. 55B-55C, the ergonomic pillow 5560 may include the side handles 5595. The side handles 5595 may be made of rubber, silicone, vinyl, plastic, etc. The side handles 5595 may include inner grip padding 5597 and may be covered with wicking fabric (not shown). The inner grip padding 5597 may be made of, for example, and without limitations, silicone, vinyl, and/or foam. The side handles 5595 and the wicking fabric of the ergonomic pillow 5560 may allow a person to have a firm grip with the hands when the person holds the pillow during workout.

On each side of the ergonomic pillow 5560 where a side handle 5595 is located, there may be an indenture section (not shown), which may be covered by a material such as, for example, and without limitations, rubber and/or plastic. The indenture section is shown as item 5896 in FIGS. 58A-58C. With reference to FIGS. 55B-55C, each side handle 5595 may be pushed into the corresponding indenture section when not used. Each indenture section may have adequate depth for a corresponding side handle 5595 to be pushed in. When the person decides to use the side handles 5595 to work out, the person may grab the side handles 5595 and may pull them out of the side rubber indentures. A side handle 5595 and the corresponding indenture section may be compared to a luggage handle that may be pushed in and pulled out. It should be noted that some or all of the pillows of the present embodiments may include side handles and/or indentures similar to the side handles 5595 of FIGS. 55B-55D and/or indenture section 5896 of FIGS. 58A-58C.

With reference to FIG. 55C, the ergonomic pillow 5560 may include one or more (e.g., three, as shown in FIG. 55C) connection loops 5580 that may be attached to a webbing strap 5582 that may be sewn into the wicking fabric that covers the ergonomic pillow 5560. For example, the webbing strap 5582 may be sewn over a portion of the connection loops 5580 to hold the connection loops 5580 in place. The connection loops 5580 may be made of metal (e.g., steel, iron), plastic, etc., and may be covered with wicking fabric. The loops 5580 may be, for example, and without limitations, D rings, loop rings, or similar connectors. The connection loops 5580, in some embodiments, may be detachable from the webbing strap 5582. Some embodiments may include one or more webbing loops (not shown) instead of the connection loops 5580. For example, the webbing loop may be sewn over the webbing strap 5582 5582 and/or onto the pillow 5560, and may function similar to the connection loops 5580.

The connection loops 5580 may allow connecting the elastic band 5501 to the ergonomic pillow 5560. For example, the elastic band 5501 may be slid through the loops 5580. The ergonomic pillow 5560 may be placed behind the head (e.g., as described below with reference to in FIGS. 56A-56C). The loops 5580 may also be used to connect additional elastic bands (not shown) for arm and abdominal exercises.

As another example, the person may use a snap hook to attach one side of the elastic band(s) that has a snap hook to one of the loops 5580 and other end of the elastic band that may have another snap hook may be connected to an anchor wall mount to perform hand/arm exercise. The person may stand sideways with the legs wide apart and slightly bent (similar to a baseball stance).

The person may then grab the side handles 5595 of the ergonomic pillow 5560 with the hands and may step away from the anchor wall mount to about to 2-4 feet, while the person is holding the ergonomic pillow 5560 in front of the person's body. The arms may be extended out, straight in front of the chest area. The person may pull on the elastic band as the person holds the ergonomic pillow 5560, swinging the arms sideways and rotating the hips (as if the person is hitting a baseball). As the person repeats the swinging motion back and forth, the elastic band may create contraction to the muscles in the arms, chest, abdominal areas.

The ergonomic pillow 5560, in some embodiments, may include a pouch/pocket 5584 that may be located in the back of the pillow. The pocket 5584 may be used to insert weights 5586 which may enhance the level of the strengthen conditioning. The pocket 5584 may include an opening 5588 that may be secure by, for example, and without limitations, a zipper, a loop-and-hook fastener, snap buttons, etc.

The pocket 5584 may further be used for placing personal items such as keys, ID cards, wallet, etc. The ergonomic pillow 5560, in some embodiments, may include more than one pocket 5584 on the back. In addition to, or in lieu of the pockets in the back, the ergonomic pillow 5560 may include one or more pockets in front (not shown), for example, to allow insert hot or cold packs. As the person places the head and neck on the ergonomic pillow 5560, the hot/cold pack(s) may reduce inflammation or swelling. In addition to, or in lieu of the pockets mentioned above, the ergonomic pillow 5560, in some embodiments, may include one or more pockets on the side of the pillow (not shown).

The ergonomic pillow 5560, in some embodiments, may include several (e.g., four) nonelastic webbing loops 5589 located on the back the of the ergonomic pillow 5560. At the end of each nonelastic webbing loop 5589, a fastening buckle strap (not shown) may be connected. A fastening buckle strap (not shown) may be connected to a webbing loop 5589 on the top and a webbing loop 5589 at the bottom of the ergonomic pillow 5560 to secure the ergonomic pillow 5560 in a folded position (e.g., as described below with reference to FIG. 57A).

Figure 55D:
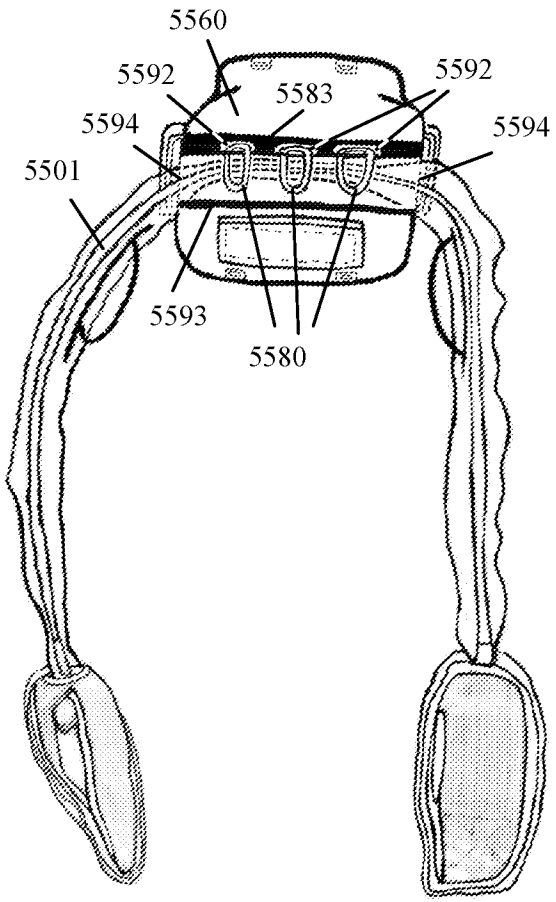
FIG. 55D is a back perspective view of FIG. 55B in an embodiment where two webbing straps are used to attach the loops, according to various aspects of the present disclosure.
Figure 55C:
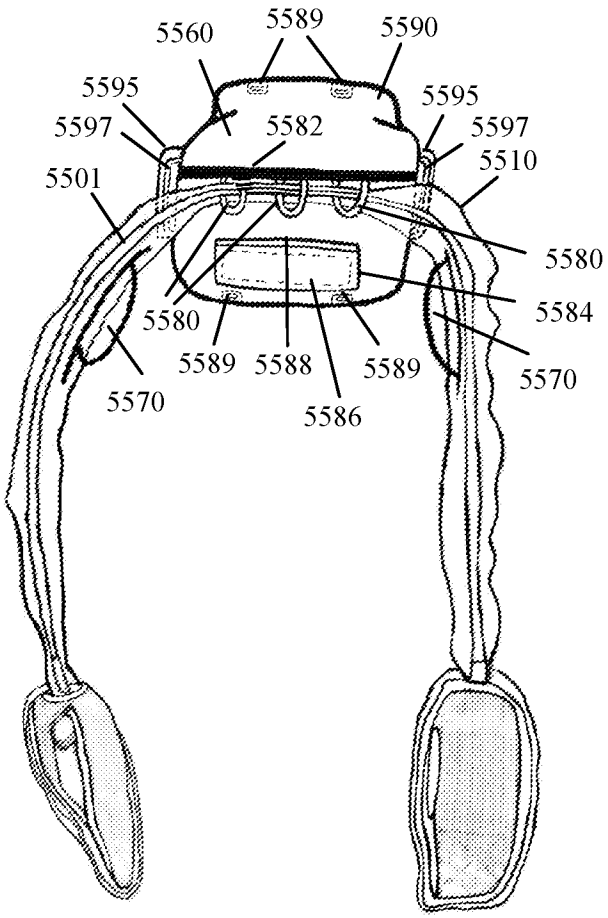
FIG. 55C is a back perspective view of FIG. 55B, where there is a webbing strap with loops attached, according to various aspects of the present disclosure.

FIG. 55D is a back perspective view of FIG. 55B in an embodiment where two webbing straps are used to attach the loops, according to various aspects of the present disclosure. With reference to FIG. 55D, the ergonomic pillow 5560 may include the same components as the pillow 5560 of FIG. 55C, except that the ergonomic pillow 5560 of FIG. 55D may include two webbing straps 5583 and 5593. The webbing straps 5583 and 5593 may be sewn on the ergonomic pillow 5560. There may be the openings 5594 on the two sides of the ergonomic pillow 5560 to allow the elastic band 5501 to be slid in the area between the webbing straps 5583 and 5593.

The webbing strap 5583 may include several (e.g., three, as shown in FIG. 55D) openings or holes 5592 to attach the connection loops 5580 to the webbing strap 5583. For example, the connection loops 5580 may go through the openings/holes 5592. The connection loops 5580, in some embodiments, may be, for example, and without limitations, attachable and detachable rings/loops (e.g., D rings, O rings, snap hooks, carabiners, etc.). As described above with reference to FIG. 55C, the connection loops 5580 may be used to attach additional elastic bands to the ergonomic pillow 5560 of FIG. 55D.

In the depicted example of FIGS. 55B-55C, the elastic band 5501 includes wicking fabric 5510 on the outside, but no foam padding in the inside. In some embodiments, the elastic band of FIGS. 55B-55C may include the wicking fabric 5510 and the foam padding 5505 (e.g., as shown in FIG. 55A). The memory foam pillow 5560 may provide support for the neck and head area of a person. The memory foam pillow 5560 may reduce the tension and pressure from a tubular and/or non-tubular elastic band that is being pulled against the neck and shoulder areas. The elastic band 5501 may also include the memory foam and/or gel cushion pads 5570, which may also include wicking fabric around them The memory foam and/or gel cushion pads 5570 may give support to and may reduce the pressure from elastic band being pulled against the chest and shoulder areas. The pads 5570 may be attached to the elastic band 5501, for example, and without limitations, by a hook-and-loop fastener webbing strap and/or fastener buckle webbing strap that may be located in the back of the pad (not shown). The length and the overall size of the pads 5570 may vary in different embodiments. For example, some pads may be longer to cover more areas of the upper body. The pads 5570 may include shoulder straps and/or sternum strap with sliding buckles (not shown). The person may adjust the memory foam/gel cushion pad 5570 by moving the pad up or down the elastic band to allow the person to fit the padding to the person's height. The memory foam pillow 5560 and the pads 5570 may, in some embodiments, be attached to the elastic band 5501 without any outside wicking fabric. The memory foam pillow 5560 may have multiple layers of fabric, not limited to the wicking fabric, for the cover.

Instead of the webbing straps 5582, 5583, and 5593 of FIGS. 55C and 55D, the ergonomic pillow 5560, in some embodiments may include several straps (not shown) in the back. The strap(s) may be sewn to the back of the ergonomic pillow 5560. In these embodiment, the elastic band 5501 may be attached to the ergonomic pillow 5560 by sliding the elastic band 5501 through the back straps of the pillow. The strap(s), in some of these embodiments, may be positioned in a vertical direction. The strap(s), in other embodiments, may be in a crisscross position. The strap(s) may include a cover that conceals the strap from showing. The straps, in some embodiments, may be located on the top and bottom back of the pillow. The strap(s) may be elastic and/or nonelastic webbing straps.

In some of the present embodiments, the back straps (not shown) may have sliding buckles to tighten pressure of the straps. In these embodiments, the back straps may be fastened by sliding the hanging end of the strap through the buckle end of the strap. The person may pull the hanging end of the strap through the buckle side of the strap to fasten the strap of the pillow.

The ergonomic pillow 5560, in some embodiments, may have zipper and/or hook-and-loop fasteners (not shown) to remove the pillow's cover (e.g., the wicking fabric cover). The wicking fabric around the pillow may be sweatproof and waterproof. The cover of the pillow may be taken off and washed, if needed. As described below with reference to FIGS. 56A-56C, the memory foam pillow with the elastic band may be placed around the person's neck and head area and the pillow may be used as a workout mechanism. The shape of the memory foam pillow 5560 may vary in different embodiments. Several examples of different shapes of the memory foam pillow 5560 are described below.

It should be noted that the ends of all elastic bands of the present embodiments may be connected to a foot/hand strap/brace and/or a memory foam pillow. In some of the present embodiments, the elastic band may be permanently connected to the foot/hand strap/brace and/or a memory foam pillow. Furthermore, the webbing loop may be connected to the elastic band by a grommet/eyelet and/or snap hook. The webbing loop may also be connected to the elastic band by wrapping the webbing loop with tape and/or rubber. The webbing loop may also be sewn onto the elastic band. In some embodiments, the loops may be made of metal, plastic snap hooks, D rings, and/or bungee snap cord like mechanism, or other type of loops disclosed in the present embodiments. In some embodiments, the loops may be made from the elastic band itself. The loops may be made, for example, by making a loop at the ends of the elastic band and securing the loops by wrapping tape around the loops that was/were created.

As described below, some embodiments may include one or more horizontal elastic bands that is/are attached to the vertical elastic band. The horizontal band(s) may be elastic or non-elastic and may act as a stabilizer strap. The additional horizontal tubular and/or non-tubular, elastic and/or non-elastic band may give support to the waist line/lower back area of the person. Furthermore, the tubular and/or non-tubular elastic bands, in some embodiments (e.g., as described below with reference to FIG. 67A-57F), may include adjusters, which may allow the person to adjust the length of the elastic band.

Figures 56A, 56B, 56C:
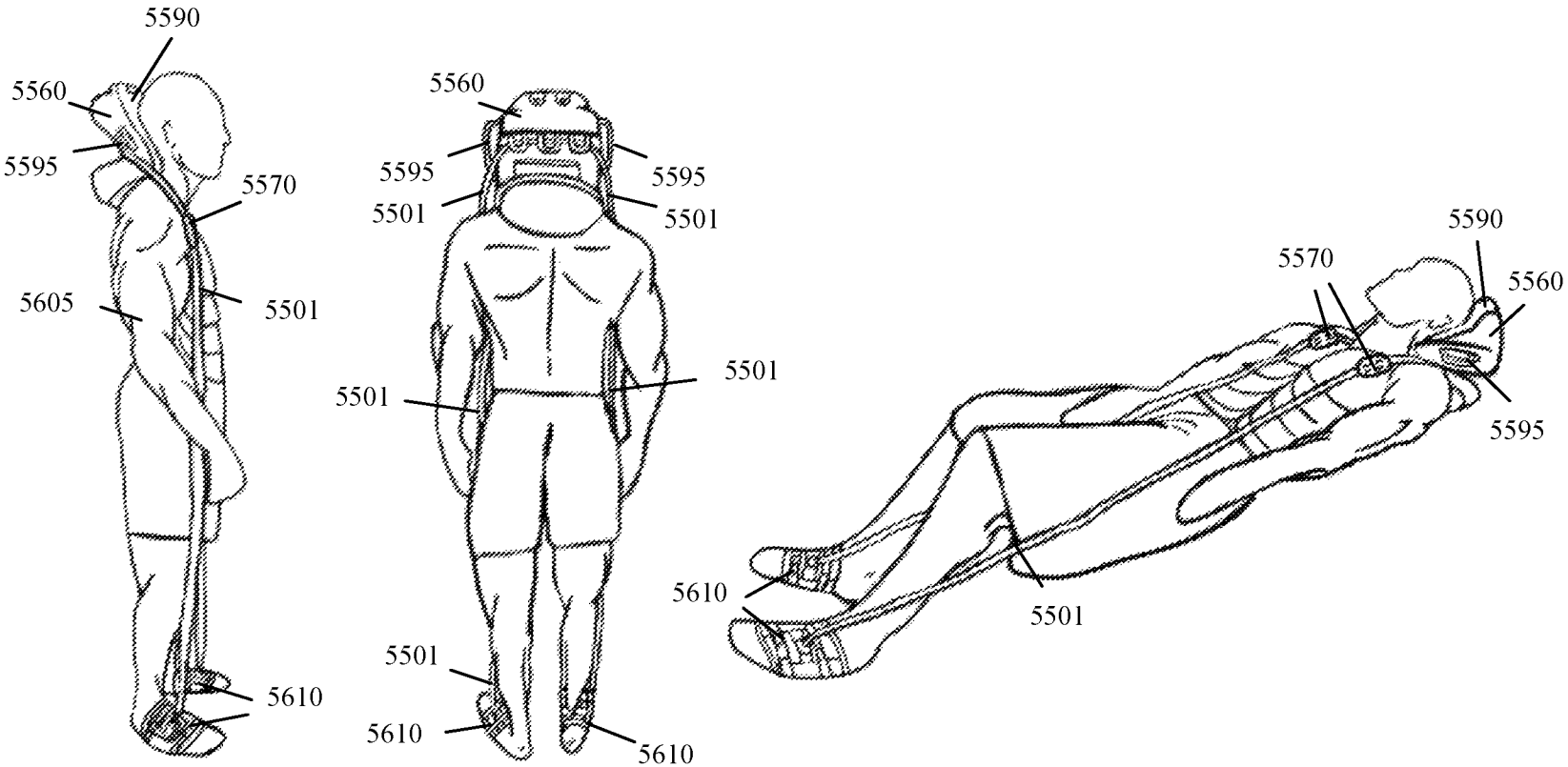
FIG. 56A is a functional diagram illustrating an example memory foam pillow with the elastic band being placed around a person's neck and head areas for a workout, according to various aspects of the present disclosure.
FIG. 56B is the back view perceptive of FIG. 56A, according to various aspects of the present disclosure.
FIG. 56C is a functional diagram illustrating a person lying down on the back with the memory foam pillow contouring the shape the person's neck, according to various aspects of the present disclosure.

FIG. 56A is a functional diagram illustrating an example memory foam pillow with the elastic band being placed around a person's neck and head areas for a workout, according to various aspects of the present disclosure. FIG. 56B is the back view perceptive of FIG. 56A, according to various aspects of the present disclosure. As shown in FIGS. 56A-56B, the person 5605 may be standing up with the memory foam pillow 5560 behind the neck and head areas. The elastic band 5501 may be attached to the pillow 5560 and to the foot straps/braces 5610.

FIGS. 56A-56B illustrate how the ergonomic pillow 5560 may contour around the neck and head areas. The back cushion portion 5590 may provide upper head area support as well as lower neck support. The figures also show the memory foam and/or gel cushion pads 5570 that may give support to and may reduce the tension and pressure of the elastic band 5501 against the chest and shoulder areas. As described above with reference to FIGS. 55B-55C, when the person decides to use the side handles 5595 to work out, the person may grab the side handles 5595 and may pull them out of the side rubber indentures (not shown). The person may also push the side handles 5595 into the side rubber indentures (not shown) when the side handles 5595 are not used for an exercise.

By having the memory foam pillow 5560 attached to the elastic band 5501, which is also connected to the person's foot by the straps/braces 5610, the elastic band 5501 may cover the distance between the person's head and foot areas. The elastic band 5501 may extend the frame of the body, giving the person a core and back stretch because of the resistance of the band.

The resistance of the band 5501 may also allow the person to correct the person's posture by arching the back and bringing out the chest. The person may walk and perform exercises comfortability without feeling the pressure of the elastic band around the neck area due to the support of the memory foam pillow and the padding.

FIG. 56C is a functional diagram illustrating a person lying down on the back with the ergonomic memory foam pillow contouring the shape of the person's neck, according to various aspects of the present disclosure. With reference to FIG. 56C, the memory foam pillow 5560 may support the person's head against the hard surface of the ground. The back cushion portion 5590 of the ergonomic pillow 5560 may provide additional cushioning for the head, allowing the person to lean back in a resting position.

Having the ergonomic memory foam pillow 5560 placed around the head area, and having the distance of the elastic band extend from the person head to feet, may result in gaining a stretch to the back, core, and leg areas. By extending outward with the feet, the band 5501 may contract and give assistance to the person in performing different leg and core exercises, such as the leg lift exercise. The leg lift exercise involves the person lifting the legs in the air while the person is lying down on the back. The elastic band 5501 may assist the person in doing legs exercises because of the resistance of the elastic band 5501. The elasticity of the elastic band 5501 contracting may assist the person in raising up the legs. By using the elastic band 5501, lying flat down and raising the legs up and down may be a lot easier to achieve, resulting the person to perform more leg lifts. Lifting the legs up and down may work out the abdominal muscles and may strengthen the core and legs at the same time.

Figure 57C:
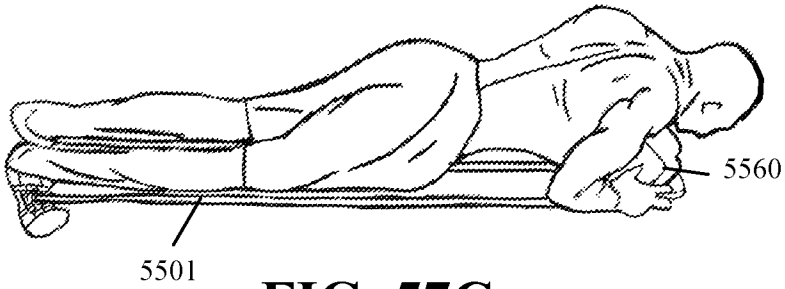
FIGS. 57A-57D are functional diagrams illustrating an example of how the memory foam pillow may be used during workout, according to various aspects of the present disclosure.
Figure 57D:
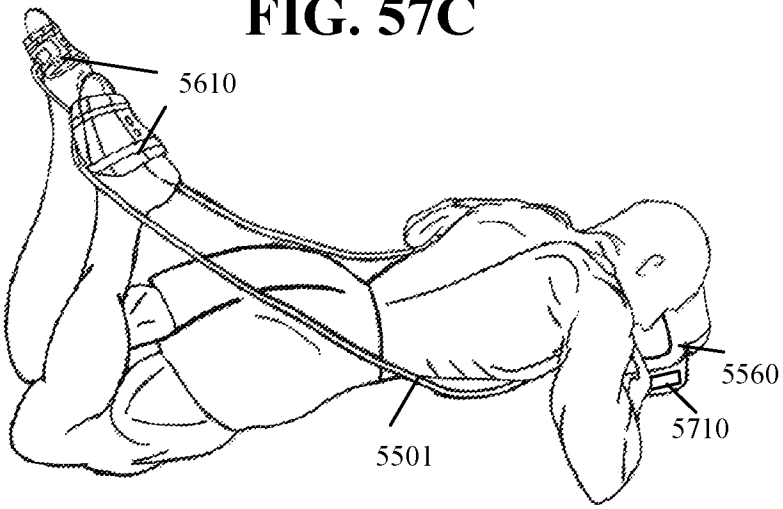
Figure 57A:
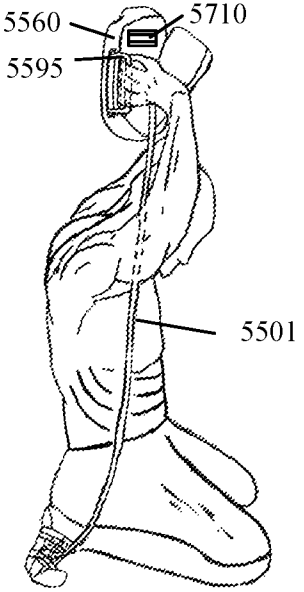

FIGS. 57A-57D are functional diagrams illustrating an example of how the memory foam pillow may be used during workout, according to various aspects of the present disclosure. In FIG. 57A, a person is shown on the floor with the knees bent. The person may be reaching behind the head and grabbing the side handles 5595 (only one side handle is shown in the side view of FIG. 56A). As described above with reference to 55B-55D, the person may also push the side handles 5595 into the corresponding indenture sections (not shown) and grab the sides of (or the top and the bottom of) the pillow 5560 by the hand.

As shown in FIGS. 57A-57D, the pillow 5560 may be folded. For example, in the embodiments that have the webbing loops 5589 (shown in FIGS. 55C-55D), each end of a fastening buckle strap (not shown) may be connected to a webbing loop (not shown) on the top and a webbing loop (not shown) on the bottom of the pillow 5560 to secure the pillow 5560 in the folded position.

In the embodiments that do not include the side handles, the pillow may be held by itself. The person may have to concentrate on gripping the pillow with the hands and not letting go. As shown in FIG. 57A, the person may grab the side handlebar 5595 on the side edges of the ergonomic pillow and lift the pillow off the neck. This is done by gripping the pillow with the hands, while having the elbows bent. The person may then straighten the elbows having the arm vertically positioned behind the head. By repeating this motion up and down, the person may work out the triceps, shoulder, and abs simultaneously.

Figure 57B:
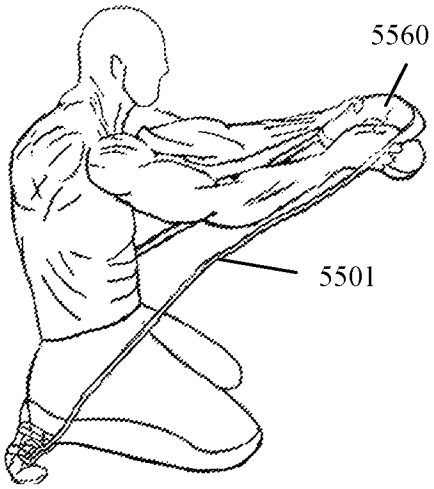

As shown in FIG. 57B, by extending the motion of FIG. 57A and pulling the pillow over the head, the person may perform another exercise similar to an arm pullover and/or arm pulldown. The person may reach back behind the head, lift the pillow over the head, and extend the arms straight out. By repeating the up and down and forward and backwards motion with the ergonomic pillow 5560, the resistance of the band 5501 may contract the muscles and build strength. This exercise may strengthen the person's arm, shoulders, chest, and abdominal muscles.

With reference to FIG. 57B, the person may perform another exercise, by just keeping the pillow 5560 lifted off the neck for a duration of time (e.g., from 10 to 60 seconds). By keeping the pillow upwards, lifted behind the neck, the resistance of the elastic band may contract the muscles building strength in the shoulders, arms, and abdominal areas. Another exercise may be done in the same position shown in FIG. 57B. By holding the pillow up forward, in a straight position in front of the face for a duration of time, the person may contract the arm muscles. This workout may strengthen and tone the person's arm, shoulder, chest, and abdominal areas. The position of this workout may also stretch out the muscles in the abdominal area. Both workouts may also be done standing up.

Another exercise may be performed by extending the motion shown in FIG. 57C. The person may move the upper body forward, towards the ground, while extending the legs outwards. The person may now be in a horizontal position, holding the pillow with the hands in front and the face towards the ground. This exercise is referred to as planking. Planking is an isometric core strength exercise that a person must keep a position for a duration of time. This position is similar to a push up position, and the person may not allow the core, legs, or face to touch the ground. Only the feet, elbows, or hands may touch the ground during planking. Adding the resistance band to this exercise may give the person an intense workout, resulting in an effective workout by contracting the muscles because of the resistant band.

Some embodiments may include wicking fabric with rubber around the memory foam handles to give the person a better grip around the handles (not shown). In addition, the vertical straps (not shown) on the back of the pillow may be elastic and/or non-elastic webbing buckle adjustment straps which may allow securing the elastic band when the pillow is folded.

All pillows of the present embodiments may include one or more elastic or non-elastic webbing straps located on the back and/or on the side edges of the pillow. All pillows of the present embodiments may include a snap button mechanism (e.g., four snap buttons 510 as described above with reference to FIG. 5) that may allow snapping the pillow onto the headrest of an ab roller device.

Another workout that the person may perform is knee crunches and planks at the same time. The person may keep the hands in the same position, as shown in FIG. 57C, and then bend each knee in one at a time towards the chest. Another workout that the person may be able to perform while still being in the same position as shown in FIG. 57C, is by extending the arms straight out in front and moving the pillow forward away from the face and back towards the chest area. This exercise may strengthen the arms, shoulders, chest, abs, and leg muscles due to the contraction of the resistance band, resulting in strengthening the muscles in upper and lower body.

Following a tense workout in the position as illustrated in FIG. 57C, the person may go into position shown in FIG. 57D. As shown in FIG. 57D, the person may lie down flat on the ground with the face placed against the ergonomic pillow 5560. The foam pillow may act as a resting tool to support the face. Holding the ergonomic pillow 5560 firmly against the upper chest area may enable the person to work out the legs and glute by curling in the legs back toward the glutes and slowly moving the legs back down towards the ground. By repeating this curling motion of the legs while the elastic band 5501 is connected to the foot brace 5601 and the ergonomic pillow 5560, the elastic band 5501 may contract the muscles in the legs and glutes and strengthen the hamstrings, glutes, and calve area.

The memory foam pillow 5560 in some embodiments may include a built-in waterproof/weatherproof digital monitor (or digital tracker) that may count and/or store statistics, such as, reps, time, calories burnt, etc. The digital monitor may be configured to be located on the side edges of the memory foam pillow 5560. FIG. 57A shows an embodiment of the memory foam pillow that includes a digital monitor 5710. FIG. 57D shows an embodiment of the memory foam pillow where the digital monitor 5710 is on the side of the memory foam pillow. In the example of FIGS. 57A-57D, while the person is performing different exercises with the pillow, the digital monitor 5710 may allow the person to track exercise statistics such as, for example, and without limitations, the person's heart rate, the number of reps, calories burnt, the number of steps traveled, the time and distance the person traveled, etc.

The digital monitor, in some embodiments may include a display, such as, for example, and without limitations, a liquid-crystal (LCD) display. The digital monitor may include a communication port, such as, for example, and without limitations, a universal serial bus (USB) that may be used to connect the digital monitor, by a USB cable, to an external electronic device, such as a desktop computer and/or a mobile device (e.g., a smartphone, a digital watch, a tablet, etc.) in order to upload the exercise results. The digital monitor may also be connected to an external device by the cable to update the software and/or the firmware of the digital monitor. The digital monitor, in some embodiments, may have a wireless transceiver. In these embodiments, the digital monitor may wirelessly communicate with external electronic devices. For example, the exercise statistics may be wirelessly uploaded to an external electronic device and the software and/or the firmware of the digital monitor may be wireless updated. The digital monitor, in some embodiments, may include rechargeable batteries that may be recharged through a cable or wirelessly. The digital monitor, in some embodiments, may include one or more replaceable batteries.

In some embodiment, the memory foam pillow may include a rubber and/or a clip (e.g., a plastic clip) to allow attaching and detaching of a digital monitor to the memory foam pillow. In some embodiments, the digital monitor may not have a wired or wireless transceiver to communicate with external devices. The digital monitor and/or the display, in some embodiments, may be battery operated and detachable from the memory pillow.

FIGS. 58A-58C are functional diagrams illustrating example uses of an elastic band attached to a memory foam pillow and a pair of straps/braces for performing lunges, according to various aspects of the present disclosure. With reference to FIGS. 58A-58C, the person may connect the elastic band 5501 to a strap/brace such as, for example, and without limitations, the changeable weight straps/braces 5610 that are connected to the feet. The person may place the memory foam pillow 5560 behind the neck and head areas. By having the back cushion portion 5590 of the ergonomic memory foam pillow 5560 supporting the neck and head area, the person may be able to perform an exercise called lunges with a correct posture.

With further reference to FIGS. 58A-58C, the side handles (not shown) are pushed into the indenture sections 5896 (in the side view of FIGS. 58A-58C, only one indenture section is shown). The person may place the memory foam pillow 5560 behind the head, which may allow the person to rest the head on the cushioning of the pillow, and at the same time, have the elastic band 5501 connected to the strap/brace 5610 which may be connected around the feet. The person may then lift the right knee up to the hip level, and then come back down on the ground. The person may switch one leg to another, bring up the knees forward to the chest, and jump at the same time, resulting in a skipping motion. By repeating the skipping motion with each leg, the person may perform the lunges exercise. During this work out with the strap/brace 5610 and the elastic band 5501, which may be attached to the memory foam pillow 5560, may be similar to doing a plyometric exercise. The extension of the elastic band may also align the back in a straight posture while the person is performing the exercise in FIGS. 58A-58C.

The memory foam and/or gel cushion pads 5570 may give support to and may reduce the tension and pressure from the chest and shoulder areas during exercise. The length and the overall size of the pads 5570 may vary in different embodiments. The person may adjust the memory foam/gel cushion pad 5570 by moving the pad up or down the elastic band to allow the person to fit the padding to the person's height.

As shown in FIGS. 58A-58C, the person may attach the rubber arch platforms 5805 to the bottom of the foot straps/braces 5610. The rubber arch platforms 5805 may be similar to any rubber arch platform described above with reference to, for example, FIGS. 45A-45E, 48A-48C, 49A-49C, 51A-51C, and 52. With reference to FIGS. 58A-58C, when the feet come down, the rubber platform may touch the ground while the back of the person's foot may not touch ground. Attaching the optional rubber arch platforms 5805 may enhance the workout by placing more pressure to the front of the feet, resulting in having the calf muscles to contract more. The person may then bend the left knee and lift the left leg off the ground towards the chest area followed by the same movements for the right knee and right leg. By repeating this skipping motion, the person may strengthen the muscles in the calves, ankles, feet, abs, upper legs, thighs, hamstrings, glutes, and the lower back. The resistance of the band 5501 may contract the abdominal and leg muscles as the person continues the work out.

Figures 59A, 59B, 59C:
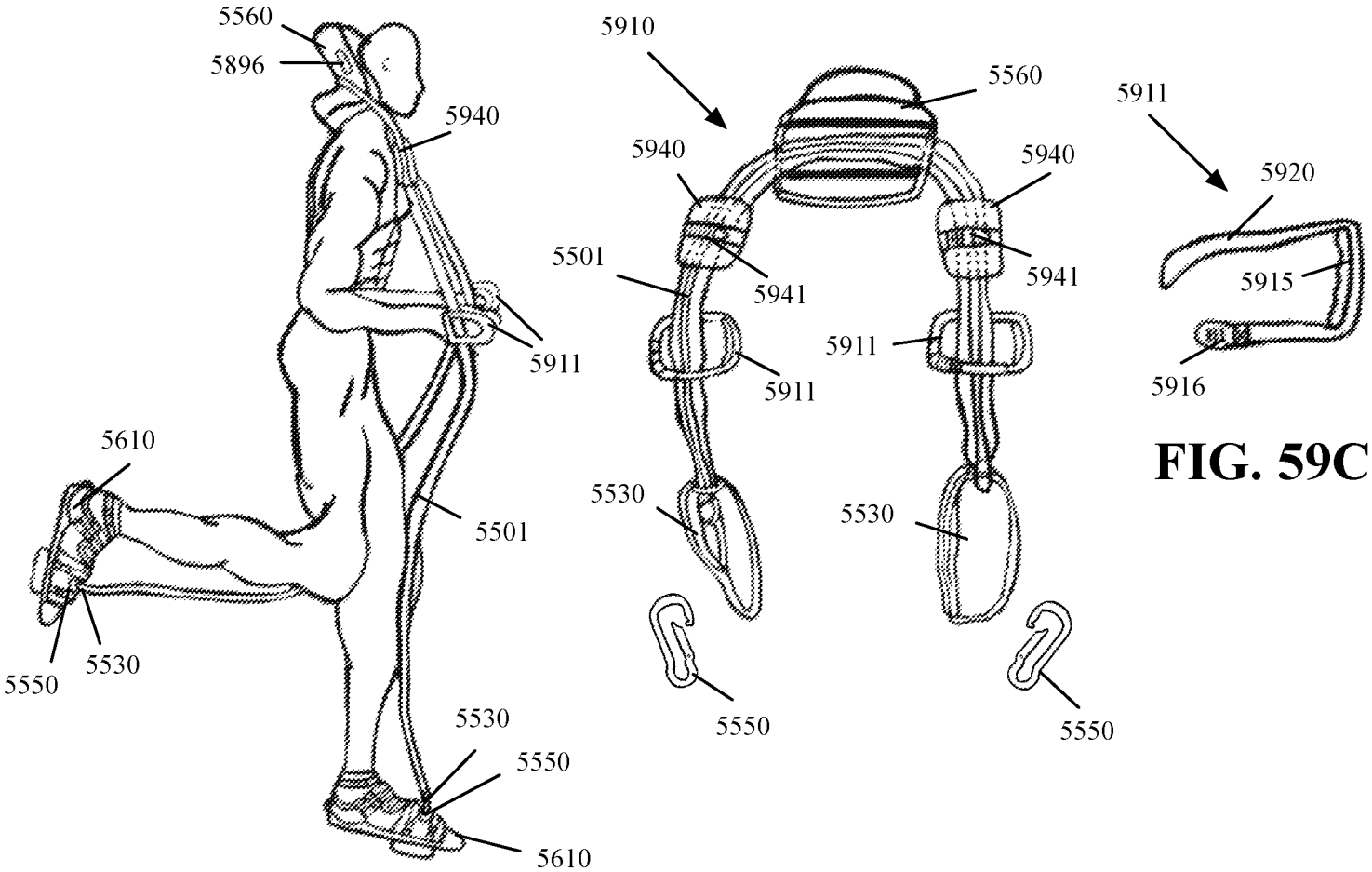
FIG. 59A is functional diagram illustrating an example workout for the arms and latissimus dorsi in addition to the workout shown in FIGS. 58A-58C, according to various aspects of the present disclosure.
FIG. 59B is a perspective view of the elastic band of FIG. 59A with a pair of grip handles attached to the elastic band, according to various aspects of the present disclosure.
FIG. 59C is a perspective view of the grip handle of FIG. 59B, according to various aspects of the present disclosure.

FIG. 59A is functional diagram illustrating an example workout for the arms and latissimus dorsi (lats) in addition to the workout shown in FIGS. 58A-58C, according to various aspects of the present disclosure. FIG. 59B is a perspective view of a memory foam pillow elastic band exercise device 5910 with an elastic band that may be similar to the elastic band of FIG. 59A, with a pair of grip handles attached to the elastic band, according to various aspects of the present disclosure. FIG. 59C is a perspective view of the grip handle of FIG. 59B, according to various aspects of the present disclosure.

With reference to FIGS. 59A-59C, the grip handles 5911 may be attachable and detachable. For example, and without limitations, the grip handles 5911 may include the fasteners 5916. The fasteners 5916 may be, for example, and without limitations, buckles (e.g., any type of buckle described above, with reference to FIG. 39), hook-and-loop fasteners, etc. The grip handles 5911 may be made of elastic or non-elastic webbing material. The grip handles 5911 may include foam or memory foam cushioning 5915 inside the grip handles 5911. The grip handles 5911 may be covered with sweatproof and/or waterproof wicking fabric 5920.

The snap hooks 5550 may be attached to the webbing loops 5530 to connect the straps/braces 5610 to the elastic band 5501. In the depicted embodiments, the grip handles 5911 are not permanently attached to the elastic band 5501 and may move up and down on the elastic band 5501. In other embodiments, the grip handles 5911 may be permanently attached to the elastic band 5501.

The elastic band 5501 may also include the memory foam padding 5940 that may give support around the shoulder and chest areas from the pressure of the memory foam elastic band 5501 being pulled around the neck. The memory foam padding 5940 may be attachable and detachable. For example, and without limitations, the memory foam padding 5940 may include the fastener straps 5941. The fastener straps 5941 may be, for example, and without limitations, hook and loop fastener straps, and/or buckles straps (e.g., any type of buckle described above, with reference to FIG. 39).

With reference to FIG. 59A, the side handles (not shown) are pushed into the indenture sections 5896 (in the side view of FIG. 59A, only one indenture section is shown). The person may be performing lunges and at the same time may work out the arms and lats. The person may have the elbows bent in a running position while the person is running, jogging, walking, and/or performing the lunges. The person may grab the grip handles 5911 and may push forward on the elastic band 5501 and continuously push forward in diagonal motion and release the contraction of the elastic band 5501, resulting in having the person contracting the muscles in the arms and abdominal areas. It should be noted that the grip handles 5911 and the memory foam padding 5940 of FIG. 59B may be used with any elastic band of the present embodiments.

Figure 59F:
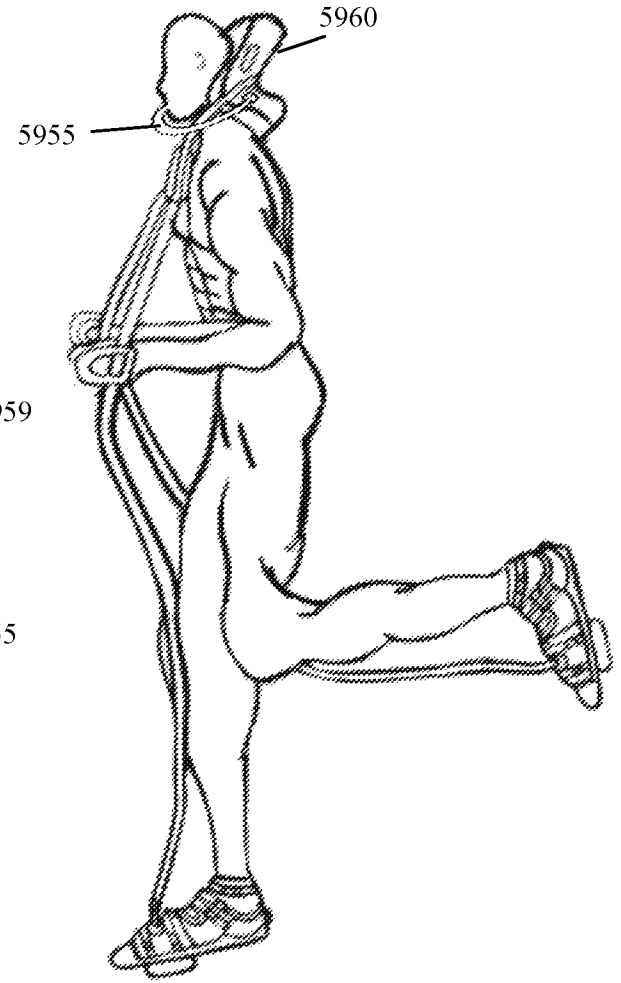
FIG. 59F is a functional diagram illustrating an example use of the liquid reservoir, according to various aspects of the present disclosure.

In some embodiments, the memory foam pillow may include an interior sleeve/pocket that may hold a liquid reservoir (e.g., a water bladder bag). FIG. 59D is a back perspective view of an elastic band that includes a memory foam pillow with a detachable liquid reservoir, according to various aspects of the present disclosure.

With reference to FIG. 59D, the elastic band 5501 may be similar to any of the elastic bands 5501 of FIGS. 55A-55D.

The memory foam pillow 5560 may be similar to any of the memory foam pillows 5560 of FIGS. 55B-55D. As shown in FIG. 59D, the memory foam pillow 5560 may include an interior sleeve/pocket 5950 that may be used to store a liquid reservoir.

The interior sleeve/pocket 5950 may have an opening 5951 that may be used to insert and remove the liquid reservoir. The opening 5951 may be secured by, for example, and without limitations, a zipper, hook-and-loop fasteners, one or more buttons, etc. The memory foam pillow 5960 may include an opening 5956 (e.g., on the side of the memory foam pillow) to allow a drinking tube 5955 of a liquid reservoir that is stored inside the sleeve/pocket 5950 to come out of the memory foam pillow. Around the opening 5956, there may be a leak proof rubber seam 5972, which may create a snug fit around the drinking tube 5955 to prevent spillage. In some embodiments, the drinking tube hole 5956 may include a rubber gasket seal (not shown) to create a waterproof seal.

Figure 59E:
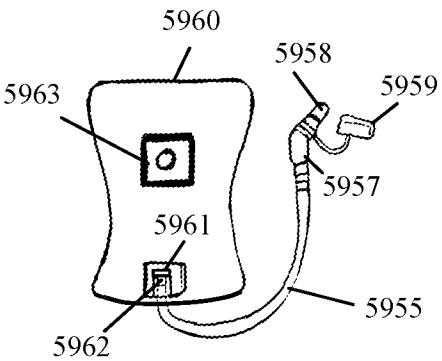
FIG. 59E is a back elevation view of the detachable liquid reservoir of FIG. 59D, according to various aspects of the present disclosure.
Figure 59D:
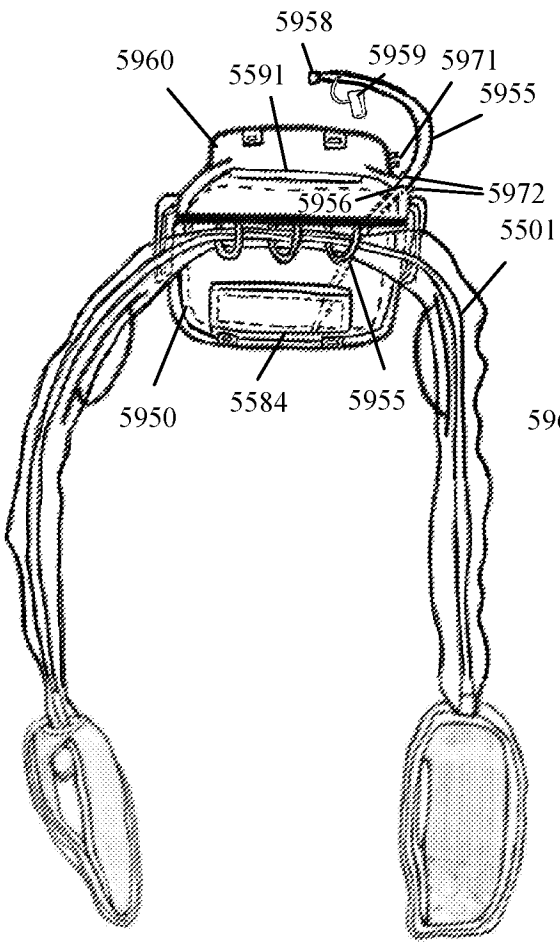
FIG. 59D is a back perspective view of an elastic band that includes a memory foam pillow with a detachable liquid reservoir, according to various aspects of the present disclosure.

FIG. 59E is a back elevation view of the detachable liquid reservoir of FIG. 59D, according to various aspects of the present disclosure. With reference to FIG. 59E, the liquid reservoir may be made of a flexible material, such as, for example, and without limitations, flexible plastic. For example, the plastic may be an ultra-durable, abrasion resistant, thermoplastic polyurethane (TPU) and may be sealed tight with high frequency weld during manufacture. The liquid reservoir, in some embodiments, may be bisphenol (BPA) free and polyvinyl chloride (PVC) free and may only include non-toxic material. The liquid reservoir may be pressure-tolerant and leak proof.

The flexible reservoir 5960 may substantially fit inside the cavity of the interior sleeve/pocket 5950. The reservoir 5960 may include a double soldering sealing design that ensures the reservoir to be leakproof. The liquid reservoir 5960 may include an automatic shutoff value 5961. The drinking tube 5955, in some embodiments, may include a leak-proof on/off switch, 5957, a soft bite mouthpiece 5958, and/or a dust cover 5955. The body of the reservoir 5960 and the drinking tube 5955, in some embodiments, may be made with antimicrobial agents to inhibit bacterial growth. In some embodiments, the drinking tube 5955 may include bite valve on/off switches and/or quick disconnecting tubing.

The drinking tube 5955, in some embodiments, may be made of, for example, and without limitations, silicone, and or rubber material. The soft bite mouthpiece 5958 may be a self-seal bite valve mouthpiece to prevent water leaks after each sip. The on/off switch 5957 may prevent leaks when the tube 5955 is not in use. The automatic shutoff valve 5961 on the reservoir 5960 prevents leaking when the tube 5955 is detached from the quick release tube connector 5962. The reservoir 5960 may include a cap 5963 that may be a wide roll top slide seal top that opens wide for quick refills with a liquid, such as water, and/or ice and seals tight with leak proof seal. Wide opening and rounded corners also make cleaning easy.

FIG. 59F is a functional diagram illustrating an example use of the liquid reservoir, according to various aspects of the present disclosure. As shown, the drinking tube 5955 may be used during exercise to keep a person hydrated. The drinking tube 5955 may be a long tube (e.g., more than 35 inches long) with a wide diameter (e.g., quarter inch diameter) to provide a flexible non-kink routing and optimum water flow. The memory form pillow, in some embodiments, may include 420D denier nylon fabric, coated with polyurethane to make the fabric highly water repellent. In some embodiments, the fabric may be made of a waterproof material, such as vinyl (e.g., 18 oz vinyl). The memory foam pillow, in some embodiments, may include a rubber clip 5971 on the side edges of the memory foam pillow to allow the drinking tube 5955 to be held sturdy in upright position, allowing the drinking tube 5955 not to hang or dangle while working out.

Several other memory foam pillow elastic band exercise devices are described below with reference to FIGS. 60A-60C, 61A-61C, 62A-62B, 63A-63B, 64A-64E, 65A-65C, 66A-66E, and 67A-67F. Some or all of the ergonomic memory foam pillows described with reference to these figures may include one or more of the following components of FIGS. 55B-55C, such as the side handles 5595, the pocket(s) 5586, the webbing loops 5589, the connections loops 5580, and/or the webbing straps 5582, 5583, 5593, and/or the memory foam/gel cushion pads 5570. Some or all of the ergonomic memory foam pillows described with reference to these figures may also include the indenture sections of FIGS. 58A-58C. Some or all of these components may not have been shown in FIGS. 60A-60C, 61A-61C, 62A-62B, 63A-63B, 64A-64E, 65A-65C, 66A-66E, and 67A-67F in order to show other details associated with the ergonomic pillows of these figures. Some or all of the ergonomic memory foam pillows described with reference to these figures may also include an interior sleeve/pocket, such as the interior sleeve/pocket 5950 of FIG. 59D, to store a liquid reservoir, such as the liquid reservoir 5960 of FIG. 59E. These memory foam pillows may include an opening, such as the opening 5956 of FIG. 59D to allow a drinking tube 5955 to come out of the memory foam pillows.

The wearable bands/straps of FIGS. 39-54B, in some embodiments, may include a built in waterproof/weatherproof digital monitor 5710 similar to the digital monitor 5710 of FIGS. 57A and 57D. An example of such digital monitor 5710 is shown in FIGS. 45A, 50A, and 50B. The digital monitor may allow tracking statistics, such as, for example, and without limitations, the amount of movement with hands and feet, the distance traveled during movement, how fast and powerful the person's hand and feet movement is during performance, etc. For example, a person may wear the band/straps of the present embodiments on the hand and/or feet, and upon impact of a punching bag, the digital monitor may track how hard and how fast the person's kick or pushes are. the digital monitor may track other statistics, such as, for example, and without limitations, the calories burnt and how long the person has been working out.

In some embodiments, the digital monitor may be configured to track the foot-landing habits of a person. For example in FIGS. 58A-58C, the digital monitor (not shown) on the strap/band may be configured to track the foot-landing habits as the person is performing plyometrics exercise. In some embodiments, the wearable foot band/straps may include a rubber and/or plastic clip (not shown) that may allow attaching and detaching of a digital monitor from the band/straps. All built digital monitors of the present embodiments may be configured to communicate wirelessly and/or through a wired connection with external electronic devices to upload exercise statistics and/or to receive update to the software and/or the firmware of the digital monitor.

The wearable bands/straps of some embodiments may include a clip, such as a rubber or plastic clip (not shown) for attaching and detaching a digital monitor. The digital monitor or the clip may be configured to be located on a sleeve of the wearable bands/straps, on the back (e.g., the heel/ankle section) of a foot strap, and/or on the end of a hand strap (e.g., on the wrist section of the hand strap).

Figure 60A:
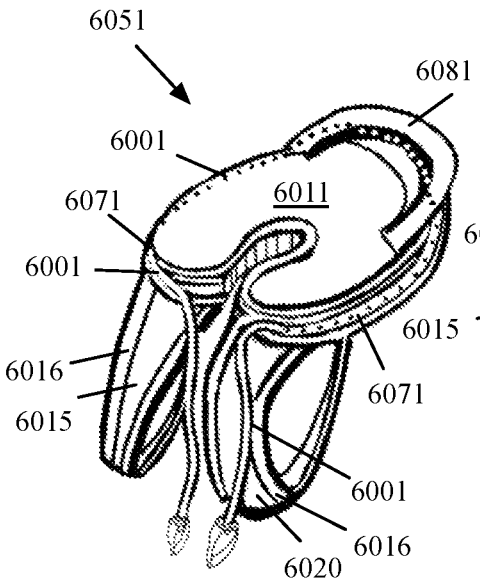
FIGS. 60A-60C are perspective views of three ergonomic memory foam pillow elastic band exercise devices, according to various aspects of the present disclosure.
Figure 60B:
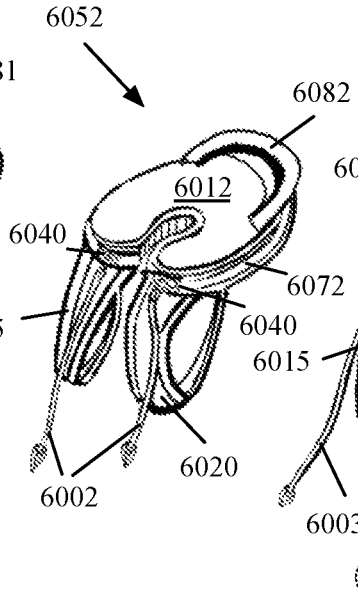
Figure 60C:
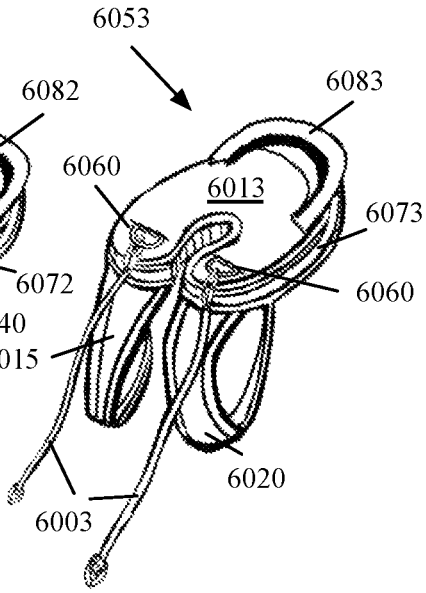

FIGS. 60A-60C are perspective views of three ergonomic memory foam pillow elastic band exercise devices, according to various aspects of the present disclosure. With reference to FIGS. 60A-60C, the memory foam pillow elastic bands exercise devices 6051-6053 may include the elastic bands 6001-6003 and the corresponding ergonomic memory foam pillows 6011-6013. The memory foam pillow elastic bands exercise devices 6051-6053 may be covered with wicking fabric that may be sweatproof and/or waterproof. The memory foam pillows 6011-6013 may be ergonomically U-shaped memory foam pillows and each may have two ergonomic elastic and/or non-elastic webbing sleeve extensions 6015 and 6020 that may allow a person to place the arms into the sleeves 6015 and 6020. The back portion 6081-6083 may provide additional cushioning for the head, allowing the person to lean back the head in a resting position.

The sleeves 6015 and 6020, in some embodiments, may be ergonomic and may include shapeable material such as, for example, and without limitation, memory foam. The sleeves 6015 and 6020 may be covered with wicking fabric 6016. The ergonomic sleeves 6015 and 6020 may contour around the person's armpit area and may provide protection for the chest, shoulders, and the armpit areas from the pressure of the elastic band contracting during workout. The distance between the head to the feet, may create pressure against the neck, chest, shoulders, and the armpit area due to the pulling of the corresponding elastic bands 6001, 6002, 6003. The memory foam and sleeves 6015 and 6020 may give support and comfort while working out by reducing the amount pressure that is applied by the pulling of the corresponding elastic bands 6001, 6002, 6003.

It should be noted that by placing an elastic band directly around a person's neck and attaching the end of the elastic band to the feet, the pressure of the elastic band around neck may be uncomfortable and may hurt the person's neck. A person, who is exercising with an elastic band that is attached to the feet and placed around the neck, may feel a tight pressure around the shoulder, chest, and armpit. The memory foam pillow resistant bands of the present embodiments resolve the issue of the elastic band(s) being discomforting as well as providing the person a workout device to enhance the person's workout.

With further reference to FIGS. 60A-60C, the memory foam pillows 6011-6013 may have a similar U shape with sleeves, however, each memory foam pillow 6011-6013 may have different connectors for connecting to the elastic bands 6001-6003. The memory foam pillows 6011-6013, in some embodiments, may include a corresponding slit (or opening) 6071-6073 around the sides of the memory foam pillow 6011. The slits/openings 6071-6073 may have depth, allowing the corresponding elastic bands 6001-6003 to be inserted into the slits/openings 6071-6073 in the memory foam pillow 6011.

As shown in FIG. 60A, the elastic band 6001 may go around (as shown by the dotted line) the memory foam pillow 6011 and the ends of the elastic band 6001 may come out from the front part of the memory foam pillow 6011. The slit/opening 6071 in the memory foam pillow 6011 may allow a person to tuck/slide/push in, the elastic band 6001 inside the memory foam pillow 6011.

Tucking in the elastic band 6001 into the slits/openings 6071-6073 of the memory foam pillow 6011 may allow the elastic band 6001 to be secured. The pillow's wicking fabric, in some embodiments, may include (not shown) snap buttons (e.g., four snap buttons), hook-and-loop fasteners, and/or zipper sleeves. Once the elastic band 6001 is tucked into the slits/openings 6071-6073, for additional security to prevent the elastic band 6001 from slipping out from the pillow 6011, the snap buttons, hook-and-loop fasteners, and/or zipper sleeves may allow the person to cover the elastic band 6001.

As shown in FIG. 60B, the memory foam pillow 6012 may include two holes 6040. The edges of the of holes 6040 may be protected and sealed with rubber, silicone, and/or vinyl to allow the holes to hold their shape while the elastic bands are being pulled on around the edges of the openings of the holes 6040. Each one of the two elastic bands 6002 may be connected to one of the holes 6040.

The person may place the memory foam pillow 6012 around the neck and put the arms through each sleeve 6015-6020, and then connect the ends of each elastic band 6002 through the corresponding hole 6040. The person may then have the ends of the elastic band 6002 come down to allow the person to grab the ends of the elastic band and connect the ends of the elastic band to the feet. Memory foam pillow elastic band 6052 may also include (not shown) other types of connectors such as steel D rings or other types of connectors described above.

The memory foam pillows of the present embodiments play important roles by not only securing the neck while working out and being used as a workout device, but because the elastic band extended from the person's head to the feet allows the person to keep forming a straight posture by extension of the elastic band. Keeping the back straight may pull on the elastic band(s), resulting in having the elastic band that is attached to the pillow and the feet in aligning the posture of the person standing or laying down.

The person may know when the posture is correct by contracting the elastic band as far as possible. The straighter the back is, the tighter the elastic band may contract, resulting in preventing the person from hunching back and allowing a correct posture to be maintained (e.g., as shown in FIGS. 56A-56B). Furthermore, to secure and tighten the pressure of the sleeves 6015-6020, the sleeve may include (not shown) a hook-and-loop fastener buckle strap and/or a sliding buckle strap to tighten and/or loosen the pressure of the sleeve, allowing the person to adjust the sleeves 6015-6020 to fit the person's size.

Some embodiments may include (not shown) additional elastic and/or non-elastic webbing strap(s) behind the sleeves 6015-6020. The webbing strap(s) may include hook-and-loop fasteners buckle(s) and/or sliding buckle(s), covered with wicking fabric to allow the person to adjust the tightness of the sleeves 6015-6020. Additional horizontal webbing strap(s) (not shown) may also be included on the back of the sleeves 6015-6020, which may play an important role in having the person keep a correct posture and may act as stabilizer strap(s) to the back of the person, pulling back the shoulders and further aligning the posture. The additional horizontal webbing strap (not shown) may be attached to the back of left side sleeve 6015 and connected to the horizontal webbing buckle strap (not shown) on the back of the right side sleeve 6020.

As shown in FIG. 60C, the memory foam pillow elastic band 6053 may include the hooking elements 6060 located on the top front (lower) end of the U-shaped pillow 6013. The hooking elements 6060 may be similar to any of the hooking elements described above such as, for example, and without limitations, steel D rings, shock (or bungee) cord hook, etc. Each hooking elements 6060 may be connected to one of the two elastic bands 6003. Some embodiments of the pillows 6011-6013 may include a pouch compartment (not shown) for placing to personal items such as, for example, and without limitations, identifications, weights, money, keys, phone, etc. The pouch compartment (not shown) may be located behind the pillows 6011-6013 and/or on the side corner edges of the pillows 6011-6013. In some embodiments, (not shown) the pillows 6011-6013 may have the pouch compartment located in front of the top middle of the pillow, where the person may rest the head. In other embodiments, (not shown) the pillows 6011-6013 may have the pouch compartment located in the middle U-shaped section of the pillow where the person places the neck.

Figure 61A:
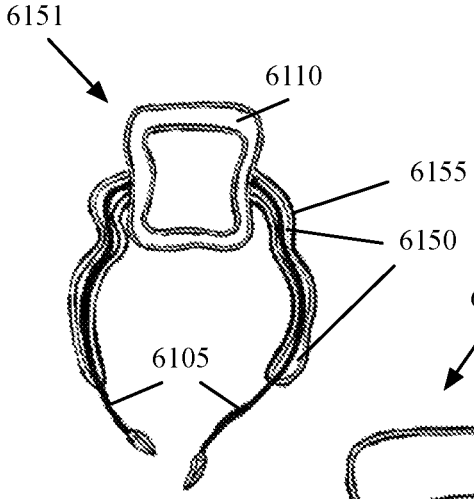
FIG. 61A is a front perspective view of an ergonomic memory foam pillow elastic band exercise device, according to various aspects of the present disclosure.
Figure 61B:
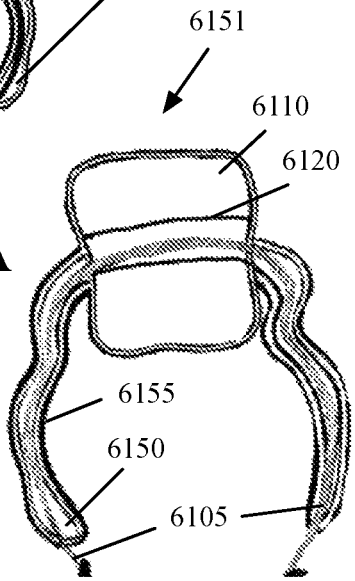
FIG. 61B is a back perspective view of the ergonomic memory foam pillow elastic band exercise device of FIG. 61A, according to various aspects of the present disclosure.
Figure 61C:
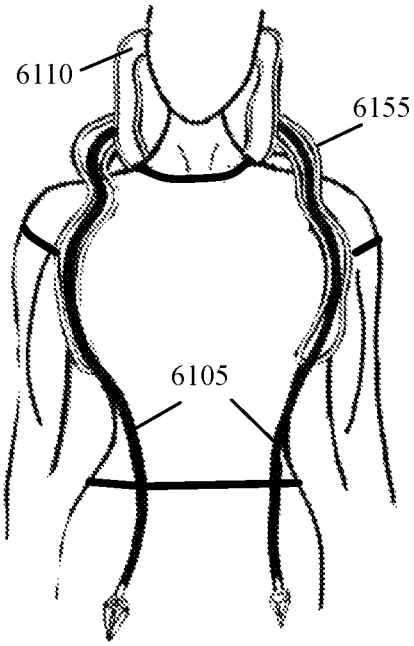
FIG. 61C is a functional perspective showing an example of wearing the ergonomic memory foam pillow elastic band exercise device of FIGS. 61A-61B, according to various aspects of the present disclosure.

FIG. 61A is a front perspective view of an ergonomic memory foam pillow elastic band exercise device, according to various aspects of the present disclosure. FIG. 61B is a back perspective view of the ergonomic memory foam pillow elastic band exercise device of FIG. 61A, according to various aspects of the present disclosure. FIG. 61C is a functional perspective showing an example of wearing the ergonomic memory foam pillow elastic band exercise device of FIGS. 61A-61B, according to various aspects of the present disclosure. FIGS. 61A-61C show a different way of connecting an elastic band 6105 to a memory foam pillow 6110 by some of the present embodiments. The elastic band may be tubular and/or non-tubular.

As shown in FIG. 61B, the memory foam pillow elastic band 6151 may include an elastic or non-elastic webbing straps 6120 behind the pillow 6110. The strap 6120 may be sewn to the pillow 6110, with a space between the strap, allowing the elastic band 6105 to pass through the space. A person may slide the elastic band 6105 through the strap 6120. The strap 6120, in some embodiments, may have cover (not shown), concealing the strap 6120 behind the cover. In some embodiments, the elastic band 6105 may be connected to two webbing loop straps with D rings (not shown) that are connected to the back of the pillow 6110. The elastic band 6105 may be slid through each D ring located in the back of the pillow 6110. In other embodiments, the memory foam pillow elastic band 6151 may include side indentures with handles, similar to the memory foam pillow elastic band of FIG. 59A. It should be noted that all memory foam pillows of the present embodiments may be connected to one or more webbing loop straps with D rings that are connected to the back of the pillows.

Some embodiments may include snap buttons (not shown) behind the pillow 6110. For example, some embodiments may include four snap buttons located on each corner of the pillow 6110 to allow snapping on the pillow 6110 to the bottom of the headrest of an ab roller device such as the ab rollers of the present embodiments described above. The memory foam pillow elastic band 6151 may be covered with sweatproof and/or waterproof wicking fabric. The elastic band 6105 may be tubular or non-tubular.

Some embodiments may include the shapeable material (e.g., gel, rubber, foam, memory foam, sandbag, etc.) 6150 that may be covered with a protection cover made from wicking fabric 6155. The elastic band 6105 may be placed inside the shapeable material 6150. The shapeable material, in some embodiments, may be squeezable (e.g., the shapeable material may be gel) to enable a person to squeeze the material and tighten the pressure of the hold in securing the elastic band. The shapeable material may be able to change its shape, allowing a person to bend and stretch the shape, contouring the protection cover to the shape of the person's body. The wicking fabric 6155 may also include another layer of material (not shown), such as, for example, and without limitations, memory foam and rubber to give more support, which may result in reducing the pressure of the elastic band from irritating the skin.

Some embodiments may include several (e.g., three) horizontal hook-and-loop fasteners/buckle webbing straps (not shown) on each side of the elastic band 6105. The hook-and-loop fasteners buckle webbing straps (not shown) may be located on the outside of the wicking fabric. These webbing straps (not shown) may further secure the elastic band once the elastic band is placed in the cover. Some embodiments may include a pouch compartment (not shown) for placing, for example, and without limitations, personal items such as identifications, money, keys, phone, etc. The pouch compartment (not shown) may be located behind the pillow 6110 and/or on the side corner edges of the pillow 6110.

Figure 62B:
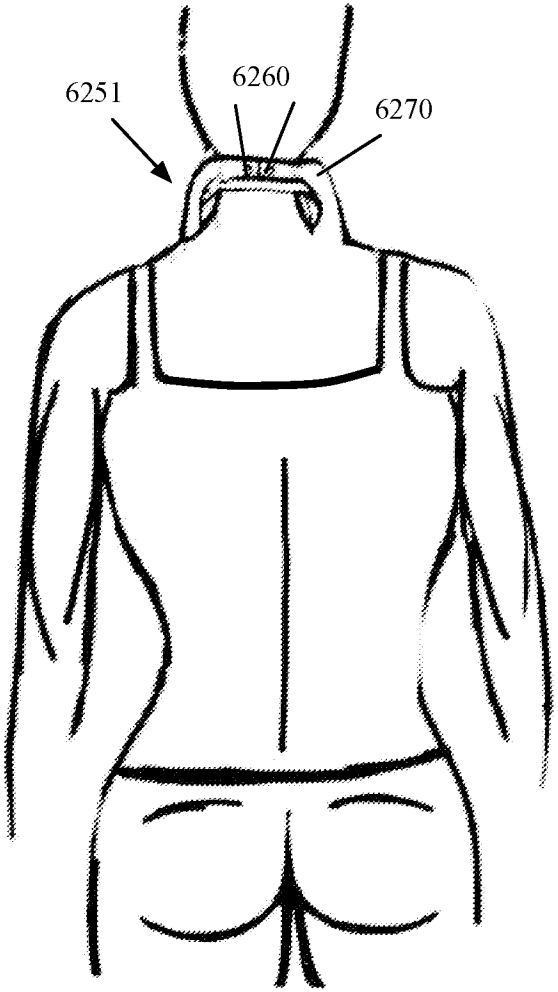
FIG. 62A is a functional front perspective and FIG. 62B is a functional back perspective showing an example of wearing an ergonomic memory foam pillow elastic band exercise device, according to various aspects of the present disclosure.
Figure 62A:
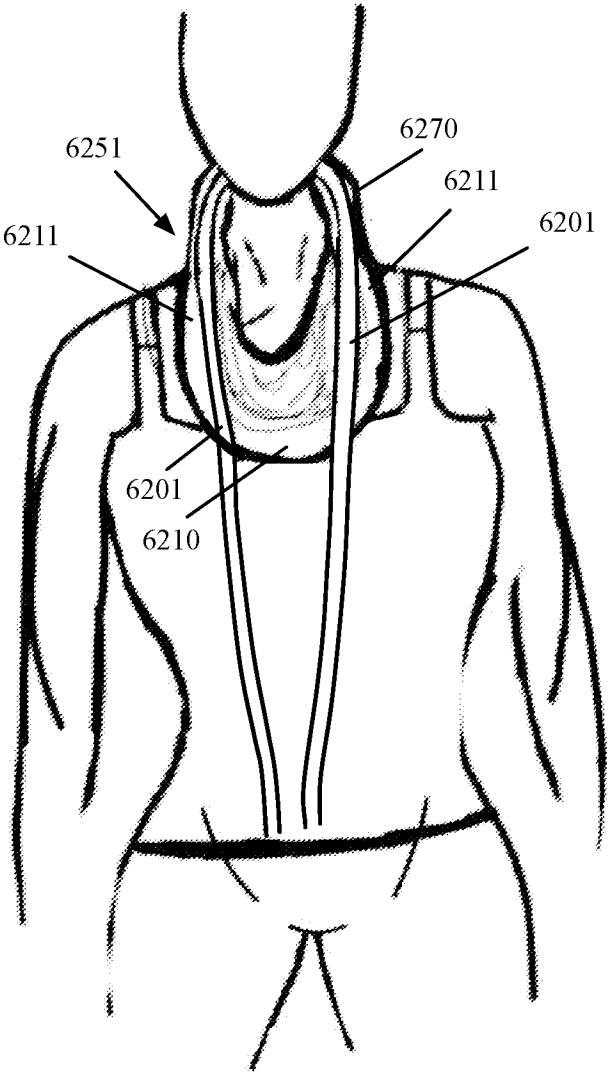

FIG. 62A is a functional front perspective and FIG. 62B is a functional back perspective showing an example of wearing an ergonomic memory foam pillow elastic band exercise device, according to various aspects of the present disclosure. With reference to FIGS. 62A-62B, the memory foam pillow elastic band exercise device 6251 may be covered with sweatproof/waterproof wicking fabric 6210.

The memory foam pillow elastic band 6251 may include a memory foam pillow 6211 and an elastic band 6201. As described above with reference to FIGS. 55B-55C, the ergonomic pillows of the present embodiments may include material other than foam or memory foam. With reference to FIG. 62A, in addition to, or in lieu of foam or memory foam, the memory foam pillow 6211 may include shapeable material such as, for example, and without limitations, gel, rubber, foam, memory foam, sandbag, etc., that may be covered with wicking fabric 6210. The elastic band 6201 may then be placed inside the shapeable material. In some embodiments, foam or memory foam may be added to the other shapeable material(s) (e.g., gel, rubber, etc.) to further reduce the pressure of the elastic band 6201 and prevent the elastic band from irritating the skin when the elastic band is being pulled against the skin.

As shown in FIGS. 62B, the ergonomically designed pillow 6211 may have a narrow back 6270, preventing a person from having a bulky pillow around the neck. As shown, the pillow 6211 may fit as a narrow loop behind the neck. Some embodiments may include one or more (e.g., two, four, etc.) snap on buttons 6260 at the ends of each side of the cover. The snap on buttons 6260 may be used to fasten and secure the pillow 6211 around the neck. It should be noted that all pillows of the present embodiments may include snap on buttons similar to the snap on buttons 6260 to fasten and secure the pillows around the neck.

Some embodiments of the ergonomically designed pillow 6211, in order to fasten and secure the pillow 6211 around the neck, may include (not shown) buckle webbing straps, such as elastic and/or non-elastic hook-and-loop fastener buckle straps, sliding belt buckle straps, or other type of buckles that may be attached to the webbing straps described above with reference to FIG. 39. The pillow 6211, in some embodiments, may be squeezed and the shapeable material (for example, and without limitations, gel/rubber/foam/memory foam, etc.) may hold its form. By squeezing and compacting the shapeable material together, the person may be able to form the material into a substantially circular shape.

In order to have more cushioning behind the head, the person may just turn the front side of the pillow 6251 (that has more shapeable material) backwards and may compact the shapeable material into a substantially circular shape, and lay the head on top of it. Alternatively, the person may just squeeze additional shapeable material towards the back of the neck. The ergonomic pillow with shapeable material provides the advantage of contouring to the shape of the neck and head, giving the person support and comfort by fitting exactly to the shape of the person's neck and head.

Figure 63B:
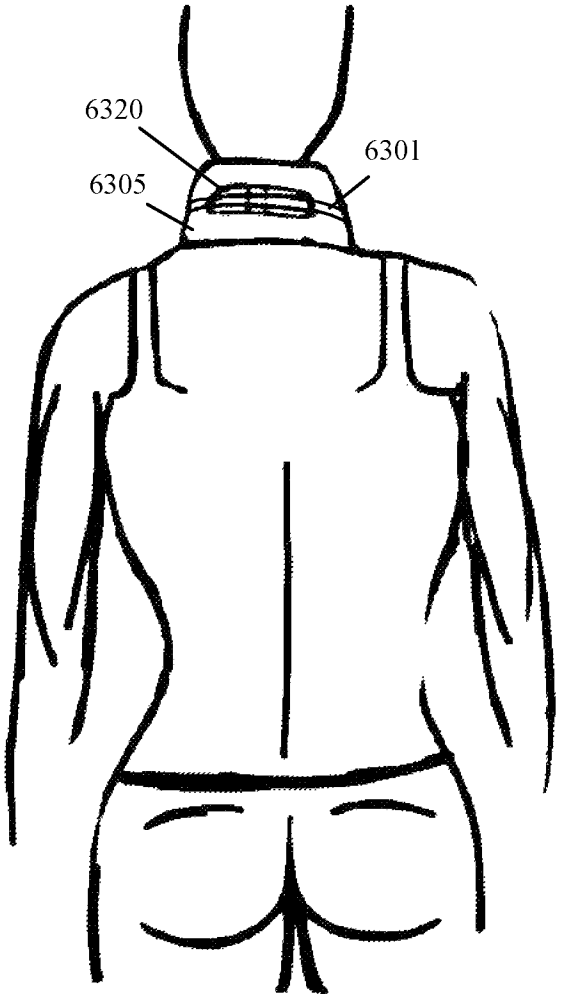
FIG. 63A is a functional front perspective and FIG. 63B is a functional back perspective showing an example of wearing a U-shaped ergonomic memory foam pillow elastic band exercise device, according to various aspects of the present disclosure.
Figure 63C:
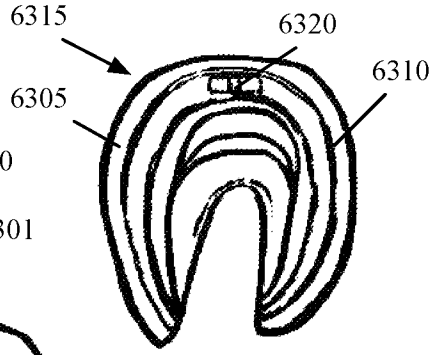
FIG. 63C is a top view of the ergonomic memory foam pillow elastic band exercise device of FIGS. 63A-63B.
Figure 63A:
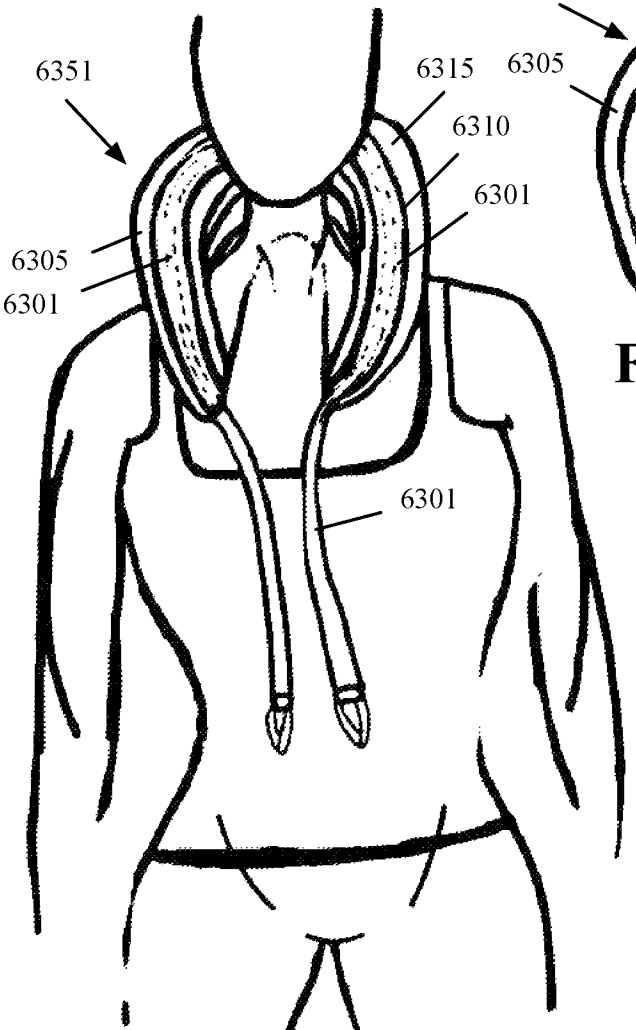

FIG. 63A is a functional front perspective and FIG. 63B is a functional back perspective showing an example of wearing a U-shaped ergonomic memory foam pillow elastic band exercise device, according to various aspects of the present disclosure. FIG. 63C is a top view of the ergonomic memory foam pillow elastic band exercise device of FIGS. 63A-63B. With reference to FIGS. 63A-63C, the U-shaped ergonomic memory foam pillow elastic band exercise device 6351 may include an ergonomic memory foam pillow 6315 and an elastic band 6301. The memory foam pillow 6315 and the elastic band 6301 may be covered with wicking fabric 6305. In FIG. 63A, a portion of the tubular and/or non-tubular elastic band 6301 that is covered is shown by dotted lines.

The memory foam pillow 6315, in some embodiments, may include a slit (or opening) 6310 in the memory foam (or other shapeable material described above). The slit/opening 6310 may create depth by allowing the person to tuck in the elastic band 6301 into the slit/opening 6310 of the memory foam pillow 6315. The memory foam pillow elastic band device 6351, in some embodiments, may include (not shown) elastic and/or non-elastic hook-and-loop fasteners buckle and/or zipper strip on the outside and/or inside to secure the elastic band from coming out of the slit/opening.

The memory foam pillow 6315 may include an opening 6320 with two holes on the back of the memory foam pillow 6315. The opening 6320 may be sealed with rubber to hold its shape and may be covered with wicking fabric. The opening 6320 may allow weaving the elastic band 6301 from the one hole through the other hole, securing the elastic band 6301 around the pillow.

FIGS. 64A-64E are front perspectives showing five examples of the ergonomic memory foam pillow elastic bands exercise devices, according to various aspects of the present disclosure. With reference to FIGS. 64A-64E, the memory foam pillow elastic band exercise devices 6451-6454 may include the ergonomic memory foam pillows 6411-6415 and the elastic bands 6401-6405, respectively.

The ergonomic memory foam pillows 6411-6415 may include shapeable material (for example, and without limitations, foam, memory foam, gel, rubber, sandbag, or a combination of two or more of these material). The ergonomic pillows 6411-6415 may be covered with wicking fabric 6470. The elastic bands 6401-6405 may be tubular and/or non-tubular. The elastic bands 6401-6405, in some embodiments, may be covered with sweat resistant, and/or waterproof, breathable wicking fabric. In other embodiments, the elastic bands 6401-6405 may not be covered with wicking fabric.

The pillows 6411-6415 may include two elastic and/or non-elastic webbing straps (not shown) on the outside of the wicking fabric. The webbing straps (not shown) may also be covered with wicking fabric and rubber. In some embodiments, these straps may have buckles at each end of the webbing strap(s) that may allow attaching additional elastic band(s) to work out the hands. The pillows 6411-6415, in some embodiments, may include grip handle(s) (not shown) that may be used to hold the pillow with hands during workout. The grip handle(s) (not shown) may be similar to the side handles 5595 of FIGS. 55B-55D. The grip handles may be made, for example, and without limitations, from plastic, rubber, silicone, and/or vinyl.

The back of the pillows 6411-6415 may include (not shown) an elastic and/or non-elastic webbing strap with snap buttons (e.g., four snap), which may allow the pillow to be attached to an ab roller headrest for extra cushioning. The pillows 6411-6415 may be also be placed on the lower back, under the feet, glute area, and/or behind the knee area while working out.

Figures 64A, 64B, 64C, 64D, 64E:
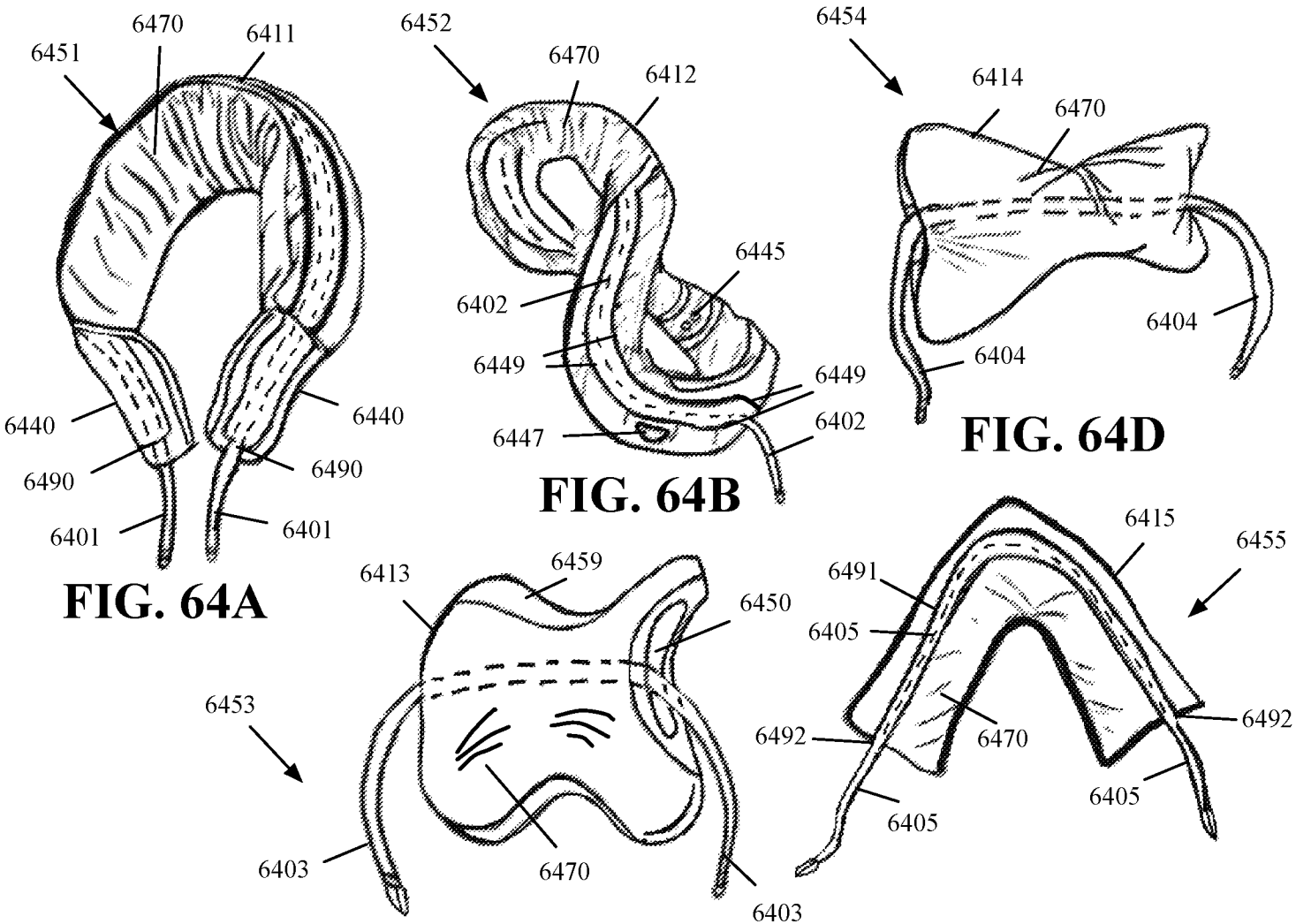
FIGS. 64A-64E are front perspectives showing five examples of the ergonomic memory foam pillow elastic bands exercise devices, according to various aspects of the present disclosure.

As shown in FIG. 64A, the pillow 6411 may have slits/openings 6490 that may allow the elastic band 6401 to be tucked into the pillow 6411. In some embodiments, at the two ends of the pillow 6411, there may be two elastic or non-elastic webbing sleeves 6440. The sleeves 6440 may include memory foam and may be covered with wicking fabric. The sleeves 6440 may protect the person's shoulder and chest areas from the elastic band 6401 pulling on the skin of the person while working out. In the embodiments that the pillow 6411 is made of shapeable material, the elastic band 6401 may be tucked into the shapeable material.

The pillow 6412 in FIG. 64B may be made of shapeable material such as, for example, and without limitations, foam, memory foam, sandbag, and/or gel and may be covered with wicking fabric 6470. The pillow 6412 may be squeezed. After squeezing, the shapeable material of the pillow 6412 may hold its form. By squeezing the shapeable material may compact the together to form a FIG. 8 shape.

The pillow 6412 may include several (e.g., two, four, etc.) snap in buttons 6445, a hook-and-loop fastener, and/or a webbing strap buckle to secure the pillow around the person's neck. The pillow 6412, in some embodiments, may include a loop ring or a D ring (e.g., and without limitations made of metal such as steel, plastic, etc.) 6447 that may be used to attach additional elastic bands to work out the hands. The pillow 6412 may include a sleeve or lining 6449, which is an opening that allows sliding the elastic band 6402 through.

With reference to FIG. 64C, the pillow 6413 may be made of memory foam and may be covered with wicking fabric 6470. The elastic band 6403 may be placed through two side openings/holes 6450 (in the perspective view of FIG. 64C, the side opening/hole located on the left side of the perspective view is not shown). Around the edges of the two opening/holes 6450 may be sealed with rubber (not shown), allowing the two openings/holes 6450 to maintain their shape. The elastic band 6403 may be slid from one opening/hole to the other. Some embodiments may include rubber 6459 around the pillow 6413 for the pillow to hold its shape.

With reference to FIG. 64D, the pillow 6414 may include shapeable material (e.g., foam, memory foam, gel, rubber, sandbag, or a combination of two or more of these materials) and may be covered with the wicking fabric 6470. The elastic band 6404 may be placed through an elastic and/or non-elastic webbing strap. The webbing strap (not shown) may be sewn to the back of the pillow 6414. In the pictured orientation, the webbing strap may be located from the left edge to the right edge of the pillow 6414 and may be located on the back middle section of the pillow. There may be a space between the webbing strap and the pillow 6414 to pass the elastic band 6494 through. The webbing strap, in some embodiments, may also include a cover to conceal the elastic band in the back of the pillow 6414. The pillow 6414, in some embodiments, may include two or more loop rings or D rings (not shown) for the elastic band 6404 to pass through.

With reference to FIG. 64E, the pillow 6415 may include shapeable material (e.g., foam, memory foam, gel, rubber, sandbag, or a combination of two or more of these materials) and may be covered with the wicking fabric 6470. The pillow 6415 may have elastic or non-elastic webbing sleeve 6491 on the pillow 6415 The webbing sleeve 6491 may have an opening 6492 at each of the two ends of the pillow 6415 that allows the elastic band 6405 to be inserted into the webbing sleeve 6491. The webbing sleeve 6491 may be covered with wicking fabric, and may protect the person's shoulder and chest areas from the elastic band pulling on the skin of the person while working out. The webbing sleeve 6491 may also secure the elastic band 6405 from slipping out of the pillow 6415.

In some embodiments that the pillow 6411 is made of shapeable material, the elastic band 6401 may be tucked into the shapeable material. In the embodiments that the shapeable material in the pillow is squeezable (for example, and without limitations, gel), the elastic band 6405 may be tucked into the squeezable material.

It should be noted that all pillows of the present embodiments may be made of squeezable material (e.g., gel) and the elastic band may be tucked into the squeezable material. Furthermore, all pillows of the present embodiments may be made of foam, memory foam, rubber, and/or sandbag, and the elastic band may be placed through an elastic and/or non-elastic webbing strap, one or more loop rings, and/or one or more D rings attached to the pillow.

Figure 65B:
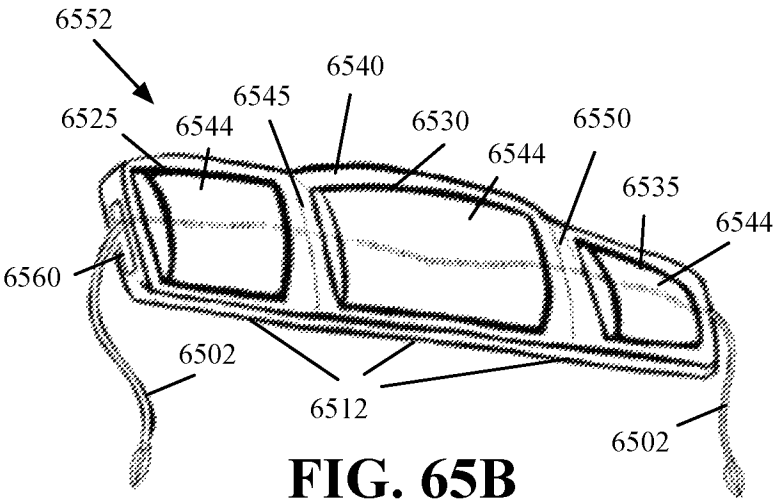
FIG. 65B is a front perspective showing a memory foam pillow elastic band exercise device with three pieces of memory foam padding, according to various aspects of the present disclosure.
Figure 65C:
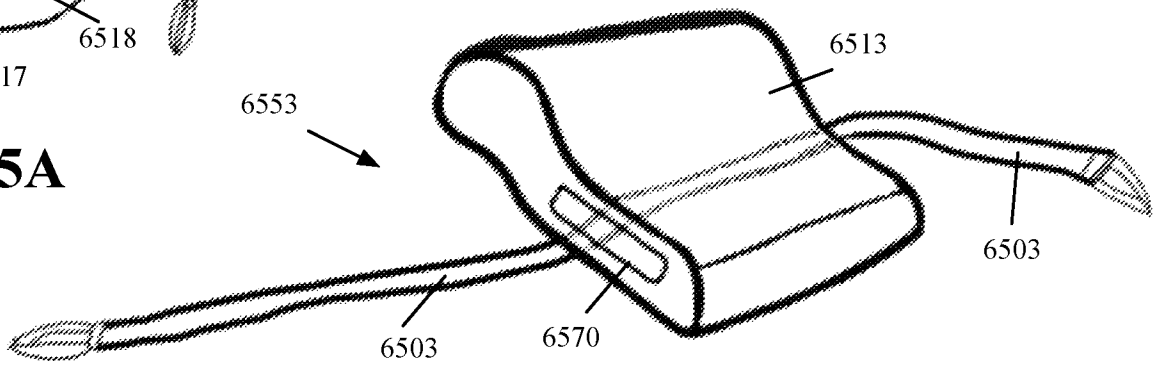
FIG. 65C is a front perspective showing a memory foam pillow elastic band exercise device, according to various aspects of the present disclosure.
Figure 65A:
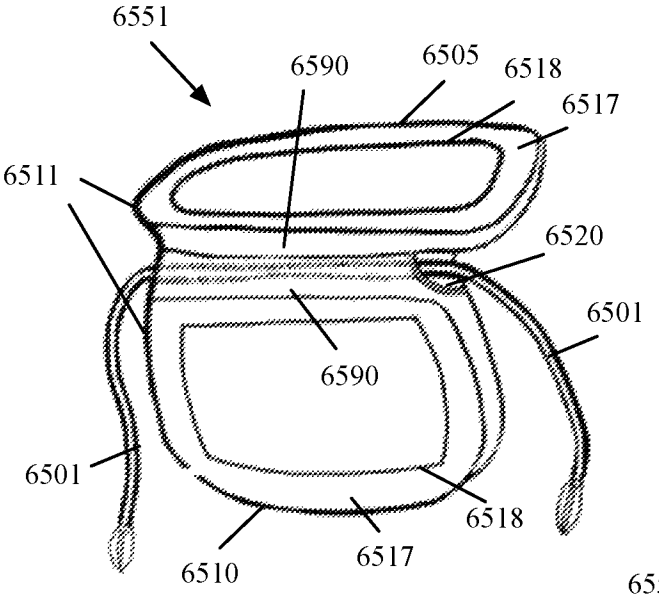
FIG. 65A is a front perspective showing a memory foam pillow elastic band exercise device with two pieces of memory foam padding, according to various aspects of the present disclosure.

FIG. 65A is a front perspective showing a memory foam pillow elastic band exercise device with two pieces of memory foam padding, according to various aspects of the present disclosure. With reference to FIG. 65A, the ergonomic memory foam pillow elastic band exercise device 6551 may include an ergonomic memory foam pillow 6511 and an elastic band 6501. The ergonomic memory foam pillow 6511 may include two rubber boards 6505 and 6510 made with memory foam padding and may be covered with wicking fabric 6517. The ergonomic memory foam pillow 6511 may include an additional layer 6518 of memory foam covered by wicking fabric.

The pillow 6511 may be folded by the middle rubber frame 6590 that connects the two boards 6505 and 6510 made with memory foam padding. The two boards 6505-6510 may create a sturdy backing. The boards 6505-6510 may be made of, for example, and without limitations, plastic, rubber, PVC, silicone, and/or vinyl padding. The middle rubber frame 6590, in some embodiments, is bendable. For example, a person may place the pillow memory foam elastic band 6551 on the edge of a jacuzzi or pool. The person may receive support from the pillow 6511 when placing the neck on corner edges of the jacuzzi, on corner edges of the pool, or on the back of a chair.

The pillow 6511 may also support the lower neck/upper back area of the person. The pillow 6511 may contour to the back of the neck. The tubular and/or non-tubular elastic band 6501 may be connected to the pillow 6511 by sliding the elastic band 6501 through the two side openings/holes 6520 (only one opening/hole is shown). The two openings/holes 6520 may be located in the middle of the pillow 6511 where the pillow 6511 may fold. Some embodiments of pillow 6551, may include an elastic webbing loop strap (not shown) that may connect the two boards 6505 and 6510, and at the same time allow the elastic band 6501 to slide through the webbing loop strap.

FIG. 65B is a front perspective showing a memory foam pillow elastic band exercise device with three pieces of memory foam padding, according to various aspects of the present disclosure. With reference to FIG. 65B, the ergonomic memory foam pillow elastic band exercise device 6552 may include an elastic band 6502 and three memory foam padding pieces 6525-6535 that may be covered with wicking fabric 6544.

The two pieces of memory foam 6525 and 6535 may cover the side of the neck area and the middle piece 6530 may support the head and lower neck area of the person. The three pieces 6525-6535 may be placed on the padding board 6540 that may be made of PVC, rubber, silicone, and/or vinyl.

There may be a fold or a webbing strap 6545 and 6550 in between the middle memory foam 6530 and each adjacent memory foam 6525 and 6535, respectively. The folds or webbing straps 6545-6550 may allow the two side pieces 6525 and 6535 to fold in. The tubular and/or no-tubular elastic band 6502 may connect to the pillow 6512 by sliding the elastic band 6502 through the two-side openings/holes 6560 (only one opening/hole is shown). The openings/holes 6560 may be located on the side edges of the of the pillow 6512. The edges of the of the two openings/holes 6560 may be covered with PVC, rubber, silicone, and/or vinyl, which may allow the openings/holes 6560 to keep their shape. All pillows of the present embodiments may give orthopedic support to the neck, and/or lower back area of the person.

FIG. 65C is a front perspective showing a memory foam pillow elastic band exercise device, according to various aspects of the present disclosure. With reference to FIG. 65C, the memory foam pillow elastic band exercise device 6553 include an ergonomic memory foam pillow 6513 and an elastic band 6503. The memory foam pillow elastic band exercise device 6553 may be covered with wicking fabric (not shown).

The elastic band 6503 may be placed through the two openings/holes 6570 (only one opening/hole is shown). The edges of the openings/holes 6570 may be covered with PVC, rubber, silicone, and/or vinyl, which may allow the holes to keep their shape. The ergonomic memory foam pillow elastic band exercise device 6553, in some embodiments, may include one or more elastic and/or non-elastic webbing straps (not shown), which may be located in the back of pillow 6513 to allow the elastic band to slide through. The webbing strap(s) on the back of the pillow 6513 may also conceal the elastic band 6503. The elastic band 6503, in some embodiments, may be connected to two metal (e.g., steel) rings (not shown) that may be located in the back or on the side of the pillow 6513. The two rings may be attached to the webbing strap(s) and attach to the back and or side of the pillow 6513.

Figures 66A, 66B, 66C, 66D, 66E, 66F:
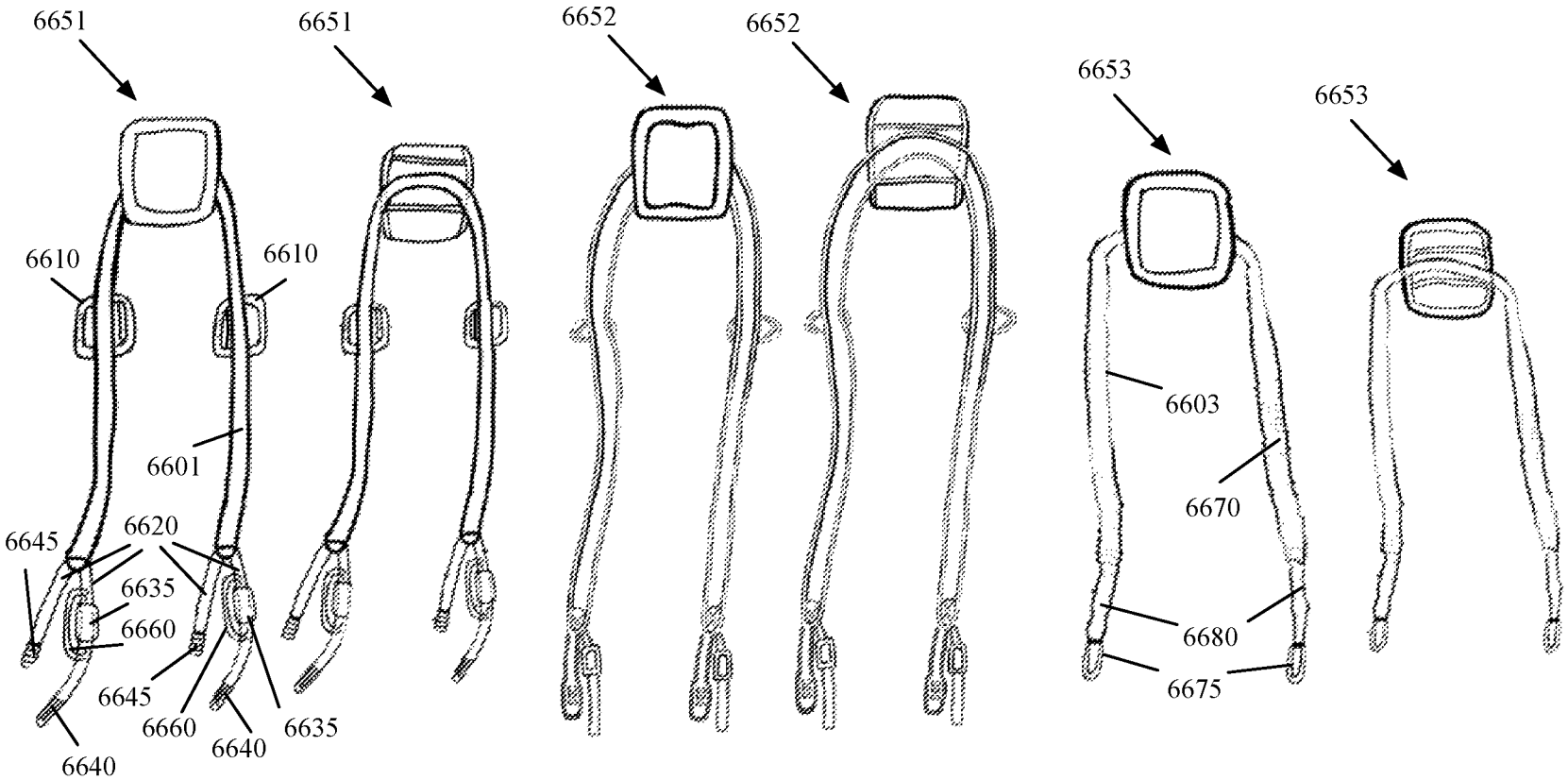
FIG. 66A is a front elevation view and FIG. 66B is a back elevation view showing a memory foam pillow elastic band exercise device with grip handles and inner loop straps, according to various aspects of the present disclosure.
FIG. 66C is a front elevation view and FIG. 66D is a back elevation view showing another memory foam pillow elastic band exercise device without inner loops, according to various aspects of the present disclosure.
FIG. 66E is a front elevation view and FIG. 66F is a back elevation view showing another memory foam pillow elastic band exercise device with a snap hook, according to various aspects of the present disclosure.

FIG. 66A is a front elevation view and FIG. 66B is a back elevation view showing a memory foam pillow elastic band exercise device with grip handles and inner loop straps, according to various aspects of the present disclosure. With reference to FIGS. 66A-66B, the memory foam pillow elastic band exercise device 6651 may be covered with wicking fabric. The memory foam pillow elastic band exercise device 6651 may include the grip handles 6610. The grip handles 6610 may be similar to the grip handles 5911 of FIGS. 59A-59C).

The memory foam pillow elastic band exercise device 6651 may be similar to the memory foam pillow elastic band exercise device 5910 of FIG. 59B, except that the ends of the memory foam pillow elastic band 6651 are not made with a hook/loop strap. Instead, the ends of the memory foam pillow elastic band 6651 are made with an elastic and/or non-elastic hook-and-loop fasteners/buckle webbing strap 6620 that may be placed around the foot and/or hand. The elastic and/or non-elastic webbing strap 6620 may be covered with wicking fabric (not shown).

The webbing strap 6620 may include a buckle side and a side opposite to the buckle side. The two sides of the webbing strap 6620 may be independently sewn onto the wicking fabric (not shown) of the elastic band 6601. The two sides of webbing strap 6620 may be connected together by sliding the end of the hook-and-loop fasteners webbing strap 6640 into the strap buckle 6645. The person may adjust the size of the webbing strap 6620 to fit secure around a person's feet and/or hands.

The memory foam pillow elastic band exercise device 6651 may include the inner memory foam padding 6635. The padding 6635 may give the person support and comfort when the person places the foot inside a foot/hand strap. The memory foam pillow elastic band 6651 may include the inner elastic and/or non-elastic loop webbing strap 6660 that may include a hook-and-loop fastener buckle/sliding buckle straps (not shown), allowing the person to adjust the inner loop 6660 to fit around the person's foot. The purpose of the inner loops are to prevent the outside strap from hitting the top of the foot and/or ankle as the hard edges of the elastic and/or non-elastic webbing loop may scrape the top of the foot and ankle.

FIG. 66C is a front elevation view and FIG. 66D is a back elevation view showing another memory foam pillow elastic band exercise device without inner loops, according to various aspects of the present disclosure. With further reference to FIGS. 66C-66D, the memory foam pillow elastic band exercise device 6652 may be similar to the memory foam pillow elastic band exercise device 6651 of FIGS. 66A-66B, except that the memory foam pillow elastic band 6652 may not include the inner loops (e.g., the inner loops 6660 of FIGS. 66A-66B). The memory foam pillow elastic band exercise device 6652, in some embodiments, may be covered with wicking fabric (not shown).

FIG. 66E is a front elevation view and FIG. 66F is a back elevation view showing another memory foam pillow elastic band exercise device with a snap hook, according to various aspects of the present disclosure. The memory foam pillow elastic band exercise device 6653 may be covered by the wicking fabric 6670. The ends of the memory foam pillow elastic band 6653 may include a snap hook and/or a shock (bungee) cord hook 6675, that may be attached and secured by tape and/or rubber 6680. In some embodiments, the snap hook and/or a shock (bungee) cord hook 6675 may be sewn onto the wicking fabric 6670.

In some embodiments, the ends of the elastic band 6603 may also include elastic and/or non-elastic loops 6675 that may be made of the elastic and/or non-elastic band itself. In some embodiments, the loops 6675 may be made by making a loop at the ends and securing the loop by wrapping a tape around the loop that was created. As shown, the tape 6680 may be wrapped around the end of the elastic band 6603 to secure the snap hook/bungee shock cord like hook/elastic loop 6675. It should be noted that all elastic bands of the present embodiments may also be designed with foot/hand strap/brace directly connected onto the elastic band, making the foot/hand brace permanent.

Figures 67A, 67B, 67C, 67D, 67E, 67F:
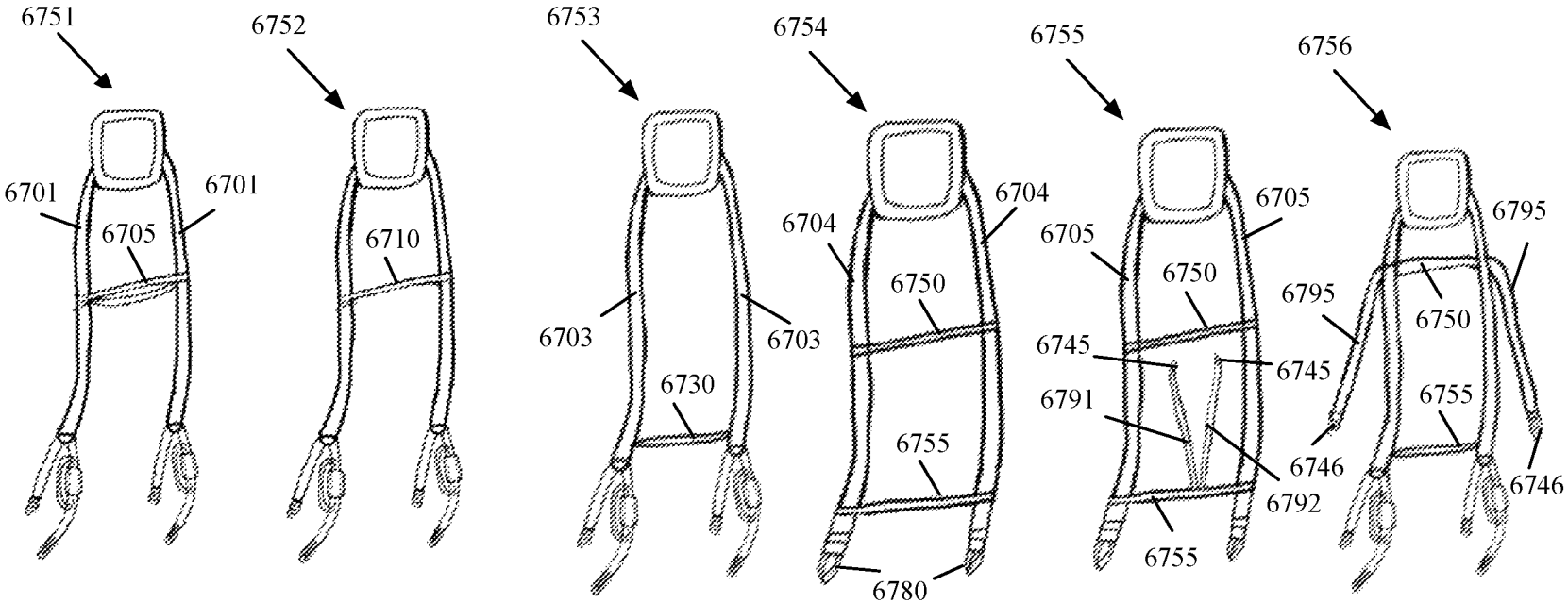
FIG. 67A is a front elevation view showing a memory foam pillow elastic band exercise device with a middle horizontal elastic loop band attached to the middle of a vertical elastic band, according to various aspects of the present disclosure.
FIG. 67B is a front elevation view showing a memory foam pillow elastic band exercise device with a middle horizontal elastic band attached to the middle of a vertical elastic band, according to various aspects of the present disclosure.
FIG. 67C is a front elevation view showing a memory foam pillow elastic band exercise device with a middle horizontal elastic band attached to the lower part of a vertical elastic band, according to various aspects of the present disclosure.
FIG. 67D is a front elevation view showing a memory foam pillow elastic band exercise device with two middle horizontal elastic bands attached to a vertical elastic band, according to various aspects of the present disclosure.
FIG. 67E is a front elevation view showing a memory foam pillow elastic band exercise device with two vertical elastic bands that are attached to a lower middle horizontal elastic band, according to various aspects of the present disclosure.
FIG. 67F is a front elevation view showing a memory foam pillow elastic band exercise device with two horizontal elastic band where one of the horizontal bands includes two hanging ends, according to various aspects of the present disclosure.

FIG. 67A is a front elevation view showing a memory foam pillow elastic band exercise device with a middle horizontal elastic loop band attached to the middle of a vertical elastic band, according to various aspects of the present disclosure. As shown, the memory foam pillow elastic band exercise device 6751 may include a vertical elastic band 6701 and a middle horizontal elastic loop band 6705. The middle horizontal elastic loop band 6705 may be attached to approximately the middle of the vertical elastic band 6701. The elastic band 6701 may or may not be covered with wicking fabric in different embodiments.

When a person's knees are placed inside the middle horizontal elastic loop band 6705 (e.g., when the person performs an exercise called side to side squats), the middle horizontal elastic loop band 6705 may allow the person to enhance the stretch and exercise. The middle horizontal elastic loop band 6705 may contract the leg muscles more, when the person moves side to side since the elastic band is positioned horizontally. The person may be getting two bands into one elastic band by adding the horizontal elastic loop band 6705 to the vertical elastic band 6701.

Other exercises that may be enhanced because of the middle horizontal elastic loop band are knee crunches and a butterfly stretch. While having the vertical elastic band 6701 attached to the foot, the person may do legs raises. The person may then transition into knee crunches by bending in the knees and moving the knees in and out away from the chest. Because of the middle elastic loop band 6705, the person may be able to enhance the knee crunches by placing the knees inside the middle elastic loop band 6705, which may create more security around the legs in performing this exercise.

Repeating this back and forth motion of the knees, going in and out away from the chest, may result in contracting the muscles in the abdominal area. The person may then be able to transition into a butterfly stretch. This stretch may be done by bending the knees and placing the knees sideways inside the middle elastic loop band 6705. Once the knees are secured, the placement of the foot may be positioned and the bottom of the two feet may be touching each other. The person may apply downward pressure with the knees on the elastic loop band 6705. This movement may contract the bands, which may result in stretching out the hips, glutes, and abdominal areas.

In should be noted that all horizontal bands of the present embodiments may be attached to a vertical elastic band that may or may not have a foot/hand strap/brace on it. In some embodiments, the horizontal bands may be directly attached to the vertical elastic band by wrapping tape. In some embodiments, the horizontal bands may be attached to the vertical elastic band by melting the bands together. In some embodiments the horizontal band may be covered by wicking fabric and may be sewn onto the wicking fabric of the vertical elastic band.

In some embodiments, the horizontal bands may be attached to the vertical elastic band by a hook/loop element that may hook onto each side of the vertical elastic band and side of the horizontal elastic. In these embodiments, the wicking fabric may have a ring looping mechanism located on both sides. The hook/loop elements may be sewn into the layer of webbing loop that is attached to the wicking fabric. In some embodiments the hook/loop elements may be directly sewn onto the wicking fabric. The ring looping mechanism may include, for example, and without limitations, a plastic and/or steel D ring loop and both ends of the horizontal elastic band may include a shock (or bungee) cord hook, snap hook, and/or an elastic or non-elastic webbing loop. The ring looping mechanism may be located on the middle section of the wicking fabric of the vertical elastic band, and may be used to connect the ends of an elastic horizontal band that has a snap hook.

In the embodiments that the ends of the horizontal band include webbing loops, the person may be able to connect the end of the webbing loops of the horizontal band to a D ring located on the vertical elastic band with a snap hook. The horizontal elastic band may also be attached to the inner sides of the vertical elastic band by having both ends of the horizontal elastic band to include elastic or non-elastic hook-and-loop fasteners buckle straps/sliding buckles, in which the person may strap the ends of the horizontal elastic band to the vertical elastic band. This may allow the horizontal elastic band to be slidable, moving up and down the vertical elastic band. Another embodiment (not shown) may include a railing mechanism on the wicking fabric with hook/loop mechanism to allow moving the hook/loop mechanism up and down the on the wicking fabric. A person may choose where to attach the horizontal band to the vertical elastic band. It should be noted that all wicking fabric around the elastic bands of the present embodiments may be made with the railing mechanism.

FIG. 67B is a front elevation view showing a memory foam pillow elastic band exercise device with a middle horizontal elastic band attached to the middle of a vertical elastic band, according to various aspects of the present disclosure. The memory foam pillow elastic band exercise device 6752 may be similar to the memory foam pillow elastic band 6751 of FIG. 67A, except the middle horizontal elastic band 6710 is a tubular and/or non-tubular elastic band instead of an elastic loop band. The middle horizontal elastic band 6710 may also be covered with wicking fabric.

The middle horizontal elastic band 6710 may allow the person to grab, fit, and secure the hands and/or feet, ankles, and thighs. The middle elastic band 6710 may allow the person to perform another exercise referred to as the V sit up. The V sit up may be performed by the person lying on the back and lifting the legs up in the air, and at the same time pulling on the middle band with the hands over the head and then back down as the legs move back down.

FIG. 67C is a front elevation view showing a memory foam pillow elastic band exercise device with a middle horizontal elastic band attached to the lower part of a vertical elastic band, according to various aspects of the present disclosure. The memory foam pillow elastic band exercise device 6753 may be similar to the memory foam pillow elastic band exercise device 6751 of FIG. 67A, except that the middle tubular and/or non-tubular elastic band 6730 is placed on the lower part (instead of the middle) of the vertical elastic band 6703, which is located close by the ankles. The middle elastic band 6730 may be a loop or non-loop elastic band.

The placement of the middle horizontal elastic band 6730 at the lower part makes a difference in the work out. The middle horizontal elastic band 6730 being close to the ankle area, may allow the person to feel a wider stretch, by having the horizontal band contract further horizontally allowing the person to enhance the leg spilt. As the person performs leg spilt, the horizontal elastic band that is located on the lower part of the vertical elastic band, may contract the leg and glute muscles. This exercise may allow the person to improve the lateral movement.

FIG. 67D is a front elevation view showing a memory foam pillow elastic band exercise device with two middle horizontal elastic bands attached to a vertical elastic band, according to various aspects of the present disclosure. The memory foam pillow elastic band exercise device 6754 may be similar to the memory foam pillow elastic band exercise device 6753 of FIG. 67C, except that the memory foam pillow elastic band exercise device 6754 includes two horizontal middle elastic bands 6750-6755 that are attached to the vertical elastic band 6704.

Either one, or both of, the two middle horizontal elastic bands 6750-6755 may be a loop elastic band or a non-loop elastic band. The ends of the vertical elastic band 6704 may include an elastic or non-elastic webbing loop straps 6780 that may be covered with wicking fabric (not shown). It should be noted that the end of the elastic bands of the present embodiments may vary and may be similar to any of the endings described herein. It should also be noted that the elastic bands of the present embodiments may be tubular or non-tubular.

FIG. 67E is a front elevation view showing a memory foam pillow elastic band exercise device with two vertical elastic bands that are attached to a lower middle horizontal elastic band, according to various aspects of the present disclosure. The memory foam pillow elastic band exercise device 6755 may be similar to the memory foam pillow elastic band exercise device 6754 of FIG. 67D, except that the memory foam pillow elastic band exercise device 6755 includes two additional vertical tubular and/or non-tubular elastic bands 6791-6792 that may be attached to the lower middle horizontal elastic band 6755.

In FIG. 67E, the two hanging vertical elastic bands 6791-6792 may be attached to the lower horizontal elastic band 6755 the same way as the lower horizontal elastic band 6755 is connected to the vertical elastic band 6705. The ends of the two-hanging elastic bands 6791-6792 may include elastic and/or non-elastic webbing loop straps 6745, which may allow connecting different foot/hand straps/braces.

In some embodiments, the vertical bands 6791-6792, which are attached to the lower horizontal elastic band 6755, may also be permanently attached to foot/hand straps/braces. The ends of the two hanging vertical elastic bands 6791-6792 may be similar to different ends that were described above. The advantage of the two hanging elastic bands 6791-6792 is that the person may be able to grab the two hanging elastic bands 6791-6792 and create more contraction to the legs, arms, and abdominal areas by pulling and holding the two elastic bands with the hands and at the same time pushing out with the knees performing knee crunches.

FIG. 67F is a front elevation view showing a memory foam pillow elastic band exercise device with horizontal elastic band that includes two hanging ends, according to various aspects of the present disclosure. The memory foam pillow elastic band exercise device 6756 may be similar to the memory foam pillow elastic band exercise device 6754 of FIG. 67D, except that in the memory foam pillow elastic band exercise device 6756, the horizontal elastic band 6750 may include hanging ends 6795 that may include the webbing loop straps 6746. The person may then be able to attach foot/hand strap/brace of the person's choice. In some embodiments, the hanging ends 6795 may include a non-detachable handle strap. The horizontal band 6750 of FIG. 67F may be placed behind the person's back during working out. The person may grab the two ends 6795 of the elastic band 6750 that are around the back and the person and may move the arms slowly out in front of them, resulting in the band to contract the chest and shoulder muscles. This exercise may be done laying down and/or standing. With further reference to FIG. 67F, the memory foam pillow elastic band exercise device 6756 may include two hanging vertical elastic bands (not shown) similar to the two hanging vertical elastic bands 6791-6792 of FIG. 67E.

In a first aspect, an abdominal exercise device is provided. The abdominal device comprises: a frame comprising a top frame section, a middle frame section connected to the top frame section, and a bottom frame section connected to the middle frame section, the middle frame section having a curved shape for creating a teeter-totter movement during exercise; a headrest connected to the bottom frame section; a plurality of connectors for connecting elastic bands to the frame; an elastic band connected to at least two connectors in the plurality of connectors, the elastic band comprising a first end configured to connect to a first strap and a second end configured to connect to a second strap; the exercise device configured to create the teeter-totter movement to exercise the abdominal muscles in response to: a person lying down in supine position with the back of the person's head on the headrest and the person's feet in the two straps; the person applying a downward pressure with the feet to the straps to move the headrest from a resting position; and the person removing the downward pressure with the feet to allow the headrest to go back to the resting position.

In an embodiment of the first aspect, the headrest comprises a head cushion comprising shapeable material comprising at least one of memory foam and gel; an adjustable spring lock comprising a top section connected to the head cushion, and a bottom section connected to the bottom frame section of the exercise device, the top and bottom sections of the adjustable spring lock configured to move up and down with pressure applied by the neck and head of the person during exercise.

In another embodiment of the first aspect, the adjustable spring lock further comprises: a slider fitted over the top section of the adjustable spring lock for adjusting a position of the head cushion over the top section of the adjustable spring lock; and a knob to tighten the head cushion to the top section of the adjustable spring lock.

An embodiments of the first aspect further comprises one or more railings across the frame, each railing for adjusting a location of one or more connectors in the plurality of connectors, each railing comprising: a plurality of slots; a bracket for sliding across the corresponding railing, wherein a connector in the plurality of connectors is connected to each railing's bracket; and a locking element comprising one of a pin and a push in button configured to lock the bracket in a slot in the plurality of slots.

Another embodiments of the first aspect further comprises: two armrests, each armrest comprising a top surface for placing one of an arm, an elbow, and a hand, wherein the top surface of each armrest comprises a curvature configured to create a teeter-totter movement on the exercise device when the person applies downward pressure to the armrest and releases the downward pressure on the armrest.

In another embodiment of the first aspect, said two connectors are located on one of the top frame section and the middle frame section.

In another embodiment of the first aspect, the plurality of connectors comprises at least one of a loop connector, a hook connector, and a latch connector.

In another embodiment of the first aspect, the plurality of connectors comprises a plurality of holes made in the frame of the exercise device for connecting an elastic band.

Another embodiments of the first aspect further comprises a memory foam pillow attached to an elastic band, the elastic band comprising a first end connected to a first connector located on the middle frame section and a second end connected to a second connector located on the middle frame section, the memory foam pillow configured to: support the person's chest during a pushup exercise when the abdominal exercise device is turned upside down; and support the person's glute area during a dip exercise when the abdominal exercise device is turned upside down.

In another embodiment of the first aspect, the top frame section comprises first and second segments configured to change a width of the exercise device, wherein the first segment is hollow and comprises a larger interior diameter than an exterior diameter of the second segment, wherein the first segment comprises a plurality of slots and the second segment a push in button to allow the second segment to fit into a portion of the first segment.

In another embodiment of the first aspect, the bottom frame section comprises first and second segments configured to change a width of the exercise device, wherein the first segment of the bottom frame section is hollow and comprises a larger interior diameter than an exterior diameter of the second segment of the bottom frame section, wherein the first segment of the bottom frame section comprises a plurality of slots and the second segment of the bottom frame section comprises a push in button to allow the second segment of the bottom frame section to fit into a portion of the first segment of the bottom frame section.

Another embodiments of the first aspect further comprises: a telephone holder comprising: a spring loaded C-shaped frame for holding a cellular phone; a shaft comprising a plurality of segments, wherein an inner diameter of a first section of the shaft is substantially the same as an outer diameter of a second, adjacent, section such that second section telescopically slides within the first section; and a rolling ball connecting the C-shaped frame to the shaft, the rolling ball configured to rotate the C-shaped frame in a vertical plane.

In a second aspect, an abdominal exercise device is provided. The abdominal exercise device comprises: a frame comprising: a curved shaped section for creating a teeter-totter movement to exercise the abdominal muscles; and a plurality of slots, wherein at least a portion of an interior of the frame is hollow; a set of one or more band retractors; a plurality of bands, at least a portion of each band going through the hollow interior of the frame, each band comprising first and second ends, the first end of each band connected to a band retractor in the set of band retractors, and the second end of each elastic band coming out of a slot in the plurality of slots; wherein each band retractor is configured to retract one or more bands that are connected to the band retractor into the hollow interior of the frame.

An embodiments of the second aspect further comprises: a plurality of webbing loops, each webbing loop connected to the second end of a band, wherein each webbing loop is configured to connect to a strap by a snap hook.

Another embodiments of the second aspect further comprises a plurality of connectors comprising one of a snap hook and a shock cord hook, each connector connected to the second end of a band and configured to connect to a strap.

Another embodiments of the second aspect further comprises a set of push in buttons, each push in button configured to activate a band retractor in the set of band retractors to retract one or more bands connected to the band retractor.

Another embodiments of the second aspect further comprises: a plurality of spools, each spool for winding a corresponding band in the plurality of bands; wherein each band retractor is configured to wind one or more bands around the corresponding spools.

In an embodiment of the second aspect, the plurality of bands comprises a plurality of elastic bands.

In another embodiment of the second aspect, the band retractors are spring loaded, wherein the plurality of bands comprises a plurality of non-elastic bands, wherein the spring loaded band retractors are configured to create a teeter-totter movement when a person pulls on the non-elastic bands.

In another embodiment of the second aspect, the plurality of bands comprise a plurality of pairs of bands, each pair of bands providing a different level of resistance.

The above description presents the best mode contemplated for carrying out the present embodiments, and of the manner and process of practicing them, in such full, clear, concise, and exact terms as to enable any person skilled in the art to which they pertain to practice these embodiments. The present embodiments are, however, susceptible to modifications and alternate constructions from those discussed above that are fully equivalent. Consequently, the present invention is not limited to the particular embodiments disclosed. On the contrary, the present invention covers all modifications and alternate constructions coming within the spirit and scope of the present disclosure. For example, the steps in the processes described herein need not be performed in the same order as they have been presented, and may be performed in any order(s). Further, steps that have been presented as being performed separately may in alternative embodiments be performed concurrently. Likewise, steps that have been presented as being performed concurrently may in alternative embodiments be performed separately.

What is claimed is:

1. An abdominal exercise device, comprising:

a frame comprising:

a curved shaped section for creating a teeter-totter movement to exercise the abdominal muscles; and a plurality of slots, wherein at least a portion of an interior of the frame is hollow;

a set of one or more band retractors;

a plurality of bands, at least a portion of each band going through the hollow interior of the frame, each band comprising first and second ends, the first end of each band connected to a band retractor in the set of band retractors, and the second end of each elastic band coming out of a slot in the plurality of slots;

wherein each band retractor is configured to retract one or more bands that are connected to the band retractor into the hollow interior of the frame.

2. The abdominal exercise device of claim 1 further comprising a plurality of webbing loops, each webbing loop connected to the second end of a band of the plurality of bands, wherein each webbing loop is configured to connect to a strap by a snap hook.

3. The abdominal exercise device of claim 1 further comprising a plurality of connectors comprising one of a snap hook and a shock cord hook, each connector connected to the second end of a band of the plurality of bands and configured to connect to a strap.

4. The abdominal exercise device of claim 1 further comprising a set of push in buttons, each push in button configured to activate a band retractor in the set of band retractors to retract one or more bands connected to the band retractor.

5. The abdominal exercise device of claim 1, wherein the plurality of bands comprises a plurality of elastic bands.

6. The abdominal exercise device of claim 1, wherein the band retractors are spring loaded, wherein the plurality of bands comprises a plurality of non-elastic bands, wherein the spring loaded band retractors are configured to create a teeter-totter movement when a person pulls on the non-elastic bands.

7. The abdominal exercise device of claim 1, wherein the plurality of bands comprises a plurality of pairs of bands, each pair of bands providing a different level of resistance.

* * * * *